US010930292B2

(12) United States Patent
Disch et al.

(10) Patent No.: US 10,930,292 B2
(45) **Date of Patent: *Feb. 23, 2021**

(54) AUDIO PROCESSOR AND METHOD FOR PROCESSING AN AUDIO SIGNAL USING HORIZONTAL PHASE CORRECTION

(71) Applicant: Fraunhofer-Gesellschaft zur Foerderung der angewandten Forschung e.V., Munich (DE)

(72) Inventors: Sascha Disch, Fuerth (DE); Mikko-Ville Laitinen, Helsinki (FI); Ville Pulkki, Espoo (FI)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/258,604

(22) Filed: Jan. 27, 2019

(65) Prior Publication Data

US 2019/0156842 A1 May 23, 2019

Related U.S. Application Data

(63) Continuation of application No. 15/392,776, filed on Dec. 28, 2016, now Pat. No. 10,192,561, which is a (Continued)

(30) Foreign Application Priority Data

Jul. 1, 2014 (EP) ..... 14175202
Jan. 16, 2015 (EP) ..... 15151478

(51) Int. Cl.
*G10L 19/00* (2013.01)
*G10L 19/02* (2013.01)
(Continued)

(52) U.S. Cl.
CPC ..... *G10L 19/0204* (2013.01); *G10L 19/02* (2013.01); *G10L 19/025* (2013.01); (Continued)

(58) Field of Classification Search
CPC ..... G10L 19/008; G10L 19/26; G10L 21/013
See application file for complete search history.

(56) References Cited

U.S. PATENT DOCUMENTS 4,802,225 A 1/1989 Patterson
5,001,758 A 3/1991 Galand et al.
(Continued)

FOREIGN PATENT DOCUMENTS

CN 1217111 A 5/1999
CN 1527995 A 9/2004
(Continued)

OTHER PUBLICATIONS

Daudet, Laurent et al., "MDCT Analysis of Sinusoids: Exact Results and Applications to Coding Artifacts Reduction", IEEE Transactions on Speech and Audio Processing, vol. 12, No. 3, May 2004, 302-312.
(Continued)

*Primary Examiner* — Daniel Abebe
(74) *Attorney, Agent, or Firm* — Michael A. Glenn; Perkins Coie LLP

(57) ABSTRACT

An audio processor for processing an audio signal includes an audio signal phase measure calculator configured for calculating a phase measure of an audio signal for a time frame, a target phase measure determiner for determining a target phase measure for the time frame, and a phase corrector configured for correcting phases of the audio signal for the time frame using the calculated phase measure and the target phase measure to obtain a processed audio signal.

10 Claims, 67 Drawing Sheets

Related U.S. Application Data continuation of application No. PCT/EP2015/064443, filed on Jun. 25, 2015.

(51) Int. Cl.

| | |
|---|---|
| ***G10L 19/22*** | (2013.01) |
| ***G10L 19/18*** | (2013.01) |
| ***G10L 21/038*** | (2013.01) |
| ***G10L 21/007*** | (2013.01) |
| ***G10L 19/26*** | (2013.01) |
| ***G10L 19/025*** | (2013.01) |
| *G10L 21/01* | (2013.01) |

(52) U.S. Cl.

CPC ..... *G10L 19/0208* (2013.01); *G10L 19/18* (2013.01); *G10L 19/22* (2013.01); *G10L 19/26* (2013.01); *G10L 21/007* (2013.01); *G10L 21/038* (2013.01); *G10L 21/01* (2013.01)

(56) References Cited

U.S. PATENT DOCUMENTS

| | | | |
|---|---|---|---|
| 5,142,584 | A | 8/1992 | Ozawa |
| 5,794,186 | A | 8/1998 | Bergstrom et al. |
| 5,809,459 | A | 9/1998 | Bergstrom et al. |
| 6,226,661 | B1 | 5/2001 | Savell |
| 6,292,775 | B1 | 9/2001 | Holmes |
| 6,701,297 | B2 | 3/2004 | Main |
| 6,745,155 | B1 | 6/2004 | Andringa et al. |
| 6,980,933 | B2 | 12/2005 | Cheng et al. |
| 7,146,503 | B1 | 12/2006 | Johnston et al. |
| 7,676,336 | B2 | 3/2010 | Herre et al. |
| 8,036,891 | B2 | 10/2011 | Fulop |
| 8,255,228 | B2 | 8/2012 | Hilpert et al. |
| 8,886,499 | B2 | 11/2014 | Matsumoto |
| 9,240,196 | B2 | 1/2016 | Disch et al. |
| 9,424,847 | B2 | 8/2016 | Ishikawa et al. |
| 9,881,624 | B2 | 1/2018 | Choo et al. |
| 10,140,997 | B2 | 11/2018 | Disch et al. |
| 10,192,561 | B2 | 1/2019 | Disch et al. |
| 10,529,346 | B2 | 1/2020 | Disch et al. |
| 2003/0004697 | A1 | 1/2003 | Ferris |
| 2004/0225505 | A1 | 11/2004 | Andersen et al. |
| 2005/0165587 | A1 | 7/2005 | Cheng et al. |
| 2005/0171785 | A1 | 8/2005 | Nomura et al. |
| 2005/0177360 | A1 | 8/2005 | Schuijers et al. |
| 2006/0014299 | A1 | 1/2006 | Troup |
| 2006/0143000 | A1 | 6/2006 | Setoguchi |
| 2006/0147056 | A1 | 7/2006 | Klayman |
| 2007/0019746 | A1 | 1/2007 | Lin et al. |
| 2007/0027678 | A1 | 2/2007 | Hotho et al. |
| 2007/0067162 | A1 | 3/2007 | Villemoes et al. |
| 2007/0094009 | A1 | 4/2007 | Ryu et al. |
| 2007/0100610 | A1 | 5/2007 | Disch et al. |
| 2007/0233466 | A1 | 10/2007 | Tammi |
| 2007/0238415 | A1 | 10/2007 | Sinha et al. |
| 2008/0052068 | A1 | 2/2008 | Aguilar et al. |
| 2008/0154615 | A1* | 6/2008 | Oomen ..... G10L 19/24 704/500 |
| 2008/0170711 | A1 | 7/2008 | Breebaart et al. |
| 2008/0235034 | A1 | 9/2008 | Lee et al. |
| 2008/0243493 | A1 | 10/2008 | Rault et al. |
| 2008/0255828 | A1 | 10/2008 | Chesnutt et al. |
| 2009/0006103 | A1 | 1/2009 | Koishida et al. |
| 2009/0012782 | A1 | 1/2009 | Geiser et al. |
| 2009/0299756 | A1 | 12/2009 | Davis et al. |
| 2009/0304198 | A1 | 12/2009 | Herre et al. |
| 2009/0326942 | A1 | 12/2009 | Fulop |
| 2010/0010808 | A1 | 1/2010 | Sugiyama et al. |
| 2010/0063811 | A1 | 3/2010 | Gao |
| 2010/0198588 | A1 | 8/2010 | Sudo et al. |
| 2010/0286805 | A1 | 11/2010 | Gao et al. |
| 2011/0004478 | A1 | 1/2011 | Jax et al. |
| 2011/0046964 | A1 | 2/2011 | Moon et al. |
| 2011/0132179 | A1 | 6/2011 | Saino |
| 2011/0173005 | A1 | 7/2011 | Hilpert et al. |
| 2011/0173006 | A1 | 7/2011 | Nagel et al. |
| 2011/0206209 | A1 | 8/2011 | Ojala |
| 2011/0206223 | A1 | 8/2011 | Ojala |
| 2011/0216918 | A1 | 9/2011 | Nagel et al. |
| 2011/0246205 | A1 | 10/2011 | Lin et al. |
| 2011/0280421 | A1 | 11/2011 | Macours |
| 2011/0288873 | A1 | 11/2011 | Nagel et al. |
| 2011/0305352 | A1 | 12/2011 | Villemoes et al. |
| 2012/0010880 | A1 | 1/2012 | Nagel et al. |
| 2012/0020499 | A1 | 1/2012 | Neusinger et al. |
| 2012/0239388 | A1* | 9/2012 | Sverrisson ..... G10L 19/12 704/205 |
| 2012/0278088 | A1 | 11/2012 | Villemoes |
| 2012/0303362 | A1 | 11/2012 | Duni et al. |
| 2013/0010985 | A1 | 1/2013 | Disch et al. |
| 2013/0058498 | A1 | 3/2013 | Disch et al. |
| 2013/0089215 | A1 | 4/2013 | Kon |
| 2013/0114817 | A1 | 5/2013 | Wu et al. |
| 2013/0117029 | A1 | 5/2013 | Liu et al. |
| 2013/0166286 | A1 | 6/2013 | Matsumoto |
| 2013/0173273 | A1 | 7/2013 | Kuntz et al. |
| 2013/0262096 | A1 | 10/2013 | Wilhelms-tricarico et al. |
| 2013/0304480 | A1 | 11/2013 | Kuntz et al. |
| 2014/0088978 | A1 | 3/2014 | Mundt et al. |
| 2014/0214413 | A1 | 7/2014 | Atti et al. |
| 2014/0297295 | A1 | 10/2014 | Villemoes et al. |
| 2014/0372131 | A1 | 12/2014 | Disch et al. |
| 2015/0078571 | A1 | 3/2015 | Kurylo et al. |
| 2015/0149156 | A1 | 5/2015 | Atti et al. |
| 2015/0230041 | A1 | 8/2015 | Fejzo et al. |
| 2015/0340045 | A1 | 11/2015 | Hardwick et al. |
| 2016/0006453 | A1 | 1/2016 | Jalali et al. |
| 2016/0118056 | A1 | 4/2016 | Choo et al. |
| 2016/0134985 | A1 | 5/2016 | Hashimoto et al. |
| 2016/0291056 | A1 | 10/2016 | Pickerd et al. |
| 2017/0110133 | A1 | 4/2017 | Disch et al. |
| 2017/0110134 | A1 | 4/2017 | Disch et al. |
| 2017/0110135 | A1 | 4/2017 | Disch et al. |
| 2017/0270937 | A1 | 9/2017 | Nagel et al. |

FOREIGN PATENT DOCUMENTS

| | | | |
|---|---|---|---|
| CN | 1647155 | A | 7/2005 |
| CN | 1669073 | A | 9/2005 |
| CN | 1754205 | A | 3/2006 |
| CN | 1781141 | A | 5/2006 |
| CN | 1875402 | A | 12/2006 |
| CN | 1917495 | A | 2/2007 |
| CN | 1934618 | A | 3/2007 |
| CN | 1950815 | A | 4/2007 |
| CN | 1969487 | A | 5/2007 |
| CN | 101046964 | A | 10/2007 |
| CN | 101051456 | A | 10/2007 |
| CN | 101086845 | A | 12/2007 |
| CN | 101091209 | A | 12/2007 |
| CN | 101373594 | A | 2/2009 |
| CN | 101443843 | A | 5/2009 |
| CN | 101641734 | A | 2/2010 |
| CN | 101960515 | A | 1/2011 |
| CN | 102089807 | A | 6/2011 |
| CN | 102194457 | A | 9/2011 |
| CN | 102334158 | A | 1/2012 |
| CN | 102483921 | A | 5/2012 |
| CN | 102027537 | B | 10/2012 |
| CN | 102741921 | A | 10/2012 |
| CN | 102985970 | A | 3/2013 |
| CN | 103037290 | A | 4/2013 |
| CN | 103258539 | A | 8/2013 |
| CN | 103490678 | A | 1/2014 |
| CN | 103548077 | A | 1/2014 |
| CN | 103621110 | A | 3/2014 |
| CN | 103632678 | A | 3/2014 |
| EP | 1259955 | B1 | 1/2006 |
| EP | 1903560 | A1 | 3/2008 |
| EP | 1081684 | B1 | 4/2010 |
| EP | 2019391 | B1 | 1/2013 |
| EP | 2631906 | A1 | 8/2013 |
| EP | 2720222 | A1 | 4/2014 |

(56) References Cited

FOREIGN PATENT DOCUMENTS

| | | | |
|---|---|---|---|
| EP | 2411976 | B1 | 5/2014 |
| EP | 2545553 | B1 | 7/2014 |
| JP | 2004-53895 | | 2/2004 |
| JP | 2012515362 | A | 7/2012 |
| JP | 2013521536 | A | 6/2013 |
| JP | 2013135433 | A | 7/2013 |
| JP | 2015-508911 | A | 3/2015 |
| RU | 2325046 | C2 | 5/2008 |
| RU | 2407072 | C1 | 12/2010 |
| RU | 2418324 | C2 | 5/2011 |
| RU | 2452044 | C1 | 5/2012 |
| TW | 201248619 | A | 12/2012 |
| WO | 9732413 | A1 | 9/1997 |
| WO | 1998057436 | A2 | 12/1998 |
| WO | 03042979 | A2 | 5/2003 |
| WO | 2005073960 | A1 | 8/2005 |
| WO | 2007068861 | A2 | 6/2007 |
| WO | 2009008068 | A1 | 1/2009 |
| WO | 2010108895 | A1 | 9/2010 |
| WO | 2012025283 | A1 | 3/2012 |
| WO | 2012131438 | A1 | 10/2012 |
| WO | 2013124445 | A2 | 8/2013 |
| WO | 2013127801 | A1 | 9/2013 |

OTHER PUBLICATIONS

Dietz, Martin et al., "Spectral Band Replication, a Novel Approach in Audio Coding", Audio Engineering Society Convention Paper 5553 Presented at the 112th Convention. XP009020921, May 2002, 1-8.

Dorran, David et al., "Time-Scale Modification of Music Using a Synchronized Subband/Time-Domain Approach", IEEE International Conference on Acoustics, Speech, and Signal Processing, May 2004, IV225-IV228.

Ekstrand, Per , "Bandwidth Extension of Audio Signals by Spectral Band Replication", Proc 1st IEEE Benelux Workshop on Model Based Processing and Coding of Audio (MPCA-2002) XP-000962047, Nov. 15, 2002, 53-58.

Fitz, Kelly R. et al., "A Unified Theory of Time-Frequency Reassignment", arXiv preprint arXiv:0903.3080, Mar. 2009, 1-38.

Fulop, Sean A. et al., "Algorithms for computing the time-corrected instantaneous frequency (reassigned) spectrogram, with applications", The Journal of the Acoustical Society of America 119.1, 01.06, pp. 360-371.

Gerzon, Michael A. , "The Presentation of Statistical Information on a Circle", Journal of the Audio Engineering Society 22.7, 1974, p. 536.

Griesinger, David , "The Relationship Between Audience Engagement and the Ability to Perceive Pitch, Timbre, Azimuth and Envelopment of Multiple Sources", 26th Tonmeistertagung-VDT International Convention, Nov. 2010, 456-480.

Jaillet, F. et al., "On the structure of the phase around the zeros of the short-time Fourier transform", Proceedings of NAG/DAGA International Conference on Acoustics, Rotterdam, Netherlands., Mar. 2009, pp. 1584-1587.

Kim, Junghoe et al., "Enhanced Stereo Coding with Phase Parameters for MPEG Unified Speech and Audio Coding", Audio Engineering Society Convention 127. Oct. 12, 2009 http://www.aes.org/e-lib/browse.cfm?elib=15070, Oct. 1, 2009.

Kim, Kijun et al., "Improvement in Parametric High-Band Audio Coding by Controlling Temporal Envelope With Phase Parameter", Audio Engineering Society Convention Paper 8982 Presented at the 135th Convention, New York, Oct. 2013, 1-7.

Klapuri, Anssi P. , "Multiple Fundamental Frequency Estimation Based on Harmonicity and Spectral Smoothness", IEEE Transactions on Speech and Audio Processing, vol. 11, No. 6, Nov. 2003, 804-816.

Laitinen, Mikko-Ville et al., "Sensitivity of Human Hearing to Changes in Phase Spectrum", J. Audio Eng. Soc., vol. 61, No. 11 XP40633294A, Nov. 2013, 860-877.

Laroche, Jean , "Frequency-Domain Techniques for High-Quality Voice Modification", Proc. of the 6th Int. Conference on Digital Audio Effects (DAFx-03), London, UK, Sep. 2003, 322-328.

Laroche, Jean et al., "Phase-Vocoder: About This Phasiness Business", Applications of Signal Processing to Audio and Acoustics. IEEE ASSP Workshop, 1997, 19-22.

Larsen, Erik et al., "Audio Bandwidth Extension Application of Psychoacoustics, Signal Processing and Loudspeaker Design", John Wiley and Sons, Ltd. Chapters 5 and 6, 2004, C1-91.

Moore, Brian C. et al., "Suggested Formulae for Calculating Audiotry-Filter Bandwidths and Excitation Patterns", The Journal of the Acoustical Society of America 74, 750 (1983); doi: 10.1121/1.389861, Sep. 1983, 750-753.

Nagel, Frederik et al., "A Phase Vocoder Driven Bandwidth Extension Method With Novel Transient Handling for Audio Codecs", Audio Engineering Society Convention Paper Presented at the 126th Convention, Munich, Germany, May 2008, 1-8.

Nelson, Douglas J. , "Cross-spectral Methods for Processing Speech", The Journal of the Acoustical Society of America 110.5, Nov. 2001, 2575-2592.

Painter, Ted et al., "Perceptual Coding of Digital Audio", Proceedings of the IEEE, vol. 88, No. 4, Apr. 2000, 451-513.

Robel, Axel , "A New Approach to Transient Processing in the Phase Vocoder", 6th International Conference on Digital Audio Effects (DAFx), Sep. 2003, 344-349.

Shackleton, Trevor M. et al., "The Role of Resolved and Unresolved Harmonics in Pitch Perception and Frequency Modulation Dicrimination", J. Acoust. Soc. Am. 95, Jun. 1994, 3529-3540.

Stylianou, Yannis, "Applying the Harmonic Plus Noise Model in Concatenative Speech Synthesis", IEEE Transactions on Speech and Audio Processing, vol. 9, No. 1, Jan. 2001, pp. 21-29, Jan. 2001, pp. 21-29.

Sean Fulop, "The Reassigned Spectrogram", Speech Spectrum Analysis, Signals and Communication Technology, DOI:10,1007/978-3-642-17478-0_6, May 2011, pp. 127-163.

Philippe Guillemain, et al. "Characterization of Acoustic Signals Through Continuous Linear Time-Frequency Representations." Proceedings of the IEEE vol. 84, No. 4, Apr. 1996, pp. 561-585.

Cheng Liu, et al., "Instantaneous frequency estimation by the reassigned Stockwell spectrogram", 11th International Conference on Information Science, Signal Processing and their Applications (ISSPA). IEEE, Jul. 2012, pp. 1235-1240.

Axel Roebel, "Transient detection and preservation in the phase vocoder", International Computer Music Conference (ICMG), Oct. 2003, Singapore, pp. 247-250.

"Group delay and phase delay", Wikipedia, 6 pages, downloaded May 4, 2020. (Year: 2020), 6 pp.

Enderlein, J. , et al., "Two channel SAW spread spectrum transmission system for audio signals", IEEE Ultrasonics Symposium, 1996, 1996.

* cited by examiner

AUDIO PROCESSOR AND METHOD FOR PROCESSING AN AUDIO SIGNAL USING HORIZONTAL PHASE CORRECTION

CROSS-REFERENCE TO RELATED APPLICATIONS

This application is a continuation of copending U.S. patent application Ser. No. 15/392,776, filed Dec. 28, 2016, which is a continuation of copending International Application No. PCT/EP2015/064443, filed Jun. 25, 2015, which is incorporated herein in its entirety by this reference thereto, which claims priority from European Applications Nos. EP 14 175 202.2, filed Jul. 1, 2014, and EP 15 151 478.3, filed Jan. 16, 2015, which are each incorporated herein in its entirety by this reference thereto.

The present invention relates to an audio processor and a method for processing an audio signal, a decoder and a method for decoding an audio signal, and an encoder and a method for encoding an audio signal. Furthermore, a calculator and a method for determining phase correction data, an audio signal, and a computer program for performing one of the previously mentioned methods are described. In other words, the present invention shows a phase derivative correction and bandwidth extension (BWE) for perceptual audio codecs or correcting the phase spectrum of bandwidth-extended signals in QMF domain based on perceptual importance.

BACKGROUND

Perceptual Audio Coding

The perceptual audio coding seen to date follows several common themes, including the use of time/frequency-domain processing, redundancy reduction (entropy coding), and irrelevancy removal through the pronounced exploitation of perceptual effects [1]. Typically, the input signal is analyzed by an analysis filter bank that converts the time domain signal into a spectral (time/frequency) representation. The conversion into spectral coefficients allows for selectively processing signal components depending on their frequency content (e.g. different instruments with their individual overtone structures).

In parallel, the input signal is analyzed with respect to its perceptual properties, i.e. specifically the time- and frequency-dependent masking threshold is computed. The time/frequency dependent masking threshold is delivered to the quantization unit through a target coding threshold in the form of an absolute energy value or a Mask-to-Signal-Ratio (MSR) for each frequency band and coding time frame.

The spectral coefficients delivered by the analysis filter bank are quantized to reduce the data rate needed for representing the signal. This step implies a loss of information and introduces a coding distortion (error, noise) into the signal. In order to minimize the audible impact of this coding noise, the quantizer step sizes are controlled according to the target coding thresholds for each frequency band and frame. Ideally, the coding noise injected into each frequency band is lower than the coding (masking) threshold and thus no degradation in subjective audio is perceptible (removal of irrelevancy). This control of the quantization noise over frequency and time according to psychoacoustic requirements leads to a sophisticated noise shaping effect and is what makes a the coder a perceptual audio coder.

Subsequently, modern audio coders perform entropy coding (e.g. Huffman coding, arithmetic coding) on the quantized spectral data. Entropy coding is a lossless coding step, which further saves on bit rate.

Finally, all coded spectral data and relevant additional parameters (side information, like e.g. the quantizer settings for each frequency band) are packed together into a bitstream, which is the final coded representation intended for file storage or transmission.

Bandwidth Extension

In perceptual audio coding based on filter banks, the main part of the consumed bit rate is usually spent on the quantized spectral coefficients. Thus, at very low bit rates, not enough bits may be available to represent all coefficients in the precision that may be used for achieving perceptually unimpaired reproduction. Thereby, low bit rate requirements effectively set a limit to the audio bandwidth that can be obtained by perceptual audio coding. Bandwidth extension [2] removes this longstanding fundamental limitation. The central idea of bandwidth extension is to complement a band-limited perceptual codec by an additional high-frequency processor that transmits and restores the missing high-frequency content in a compact parametric form. The high frequency content can be generated based on single sideband modulation of the baseband signal, on copy-up techniques like used in Spectral Band Replication (SBR) [3] or on the application of pitch shifting techniques like e.g. the vocoder [4].

Digital Audio Effects

Time-stretching or pitch shifting effects are usually obtained by applying time domain techniques like synchronized overlap-add (SOLA) or frequency domain techniques (vocoder). Also, hybrid systems have been proposed which apply a SOLA processing in subbands. Vocoders and hybrid systems usually suffer from an artifact called phasiness [8] which can be attributed to the loss of vertical phase coherence. Some publications relate improvements on the sound quality of time stretching algorithms by preserving vertical phase coherence where it is important [6][7].

State-of-the-art audio coders [1] usually compromise the perceptual quality of audio signals by neglecting important phase properties of the signal to be coded. A general proposal of correcting phase coherence in perceptual audio coders is addressed in [9].

However, not all kinds of phase coherence errors can be corrected at the same time and not all phase coherence errors are perceptually important. For example, in audio bandwidth extension it is not clear from the state-of-the-art, which phase coherence related errors should be corrected with highest priority and which errors can remain only partly corrected or, with respect to their insignificant perceptual impact, be totally neglected.

Especially due to the application of audio bandwidth extension [2][3][4], the phase coherence over frequency and over time is often impaired. The result is a dull sound that exhibits auditory roughness and may contain additionally perceived tones that disintegrate from auditory objects in the original signal and hence being perceived as an auditory object on its own additionally to the original signal. Moreover, the sound may also appear to come from a far distance, being less "buzzy", and thus evoking little listener engagement [5]

Therefore, there is a need for an improved approach.

SUMMARY

According to an embodiment, an audio processor for processing an audio signal may have: an audio signal phase measure calculator configured for calculating a phase measure of an audio signal for a time frame; a target phase measure determiner for determining a target phase measure for said time frame; a phase corrector configured for correcting phases of the audio signal for the time frame using the calculated phase measure and the target phase measure to achieve a processed audio signal.

According to another embodiment, a decoder for decoding an audio signal may have: an audio processor according to claim 1; a core decoder configured for core decoding an audio signal in a time frame with a reduced number of subbands with respect to the audio signal; a patcher configured for patching a set of subbands of the core decoded audio signal with the reduced number of subbands, wherein the set of subbands forms a first patch, to further subbands in the time frame, adjacent to the reduced number of subbands, to achieve an audio signal with a regular number of subbands; wherein the audio processor is configured for correcting the phases within the subbands of the first patch according to a target function.

According to another embodiment, an encoder for encoding an audio signal may have: a core encoder configured for core encoding the audio signal to achieve a core encoded audio signal having a reduced number of subbands with respect to the audio signal; a fundamental frequency analyzer for analyzing the audio signal or a low-pass filtered version of the audio signal for achieving a fundamental frequency estimate of the audio signal; a parameter extractor configured for extracting parameters of subbands of the audio signal not included in the core encoded audio signal; an output signal former configured for forming an output signal having the core encoded audio signal, the parameters, and the fundamental frequency estimate.

According to another embodiment, a method for processing an audio signal may have the steps of: calculating a phase measure of an audio signal for a time frame with an audio signal phase measure calculator; determining a target phase measure for said time frame with a target phase measure determiner; correcting phases of the audio signal for the time frame with a phase corrector using the calculated phase measure and the target phase measure to achieve a processed audio signal.

According to another embodiment, a method for decoding an audio signal may have the steps of: decoding an audio signal in a time frame with a reduced number of subbands with respect to the audio signal; patching a set of subbands of the decoded audio signal with the reduced number of subbands, wherein the set of subbands forms a first patch, to further subbands in the time frame, adjacent to the reduced number of subbands, to achieve an audio signal with a regular number of subbands; correcting the phases within the subbands of the first patch according to a target function with the audio processor.

According to another embodiment, a method for encoding an audio signal may have the steps of: core encoding the audio signal with a core encoder to achieve a core encoded audio signal having a reduced number of subbands with respect to the audio signal; analyzing the audio signal or a low-pass filtered version of the audio signal with a fundamental frequency analyzer for achieving a fundamental frequency estimate of the audio signal; extracting parameters of subbands of the audio signal not included in the core encoded audio signal with a parameter extractor; forming an output signal having the core encoded audio signal, the parameters, and the fundamental frequency estimate with an output signal former.

According to another embodiment, a non-transitory digital storage medium may have a computer program stored thereon to perform any of the inventive methods.

According to another embodiment, an audio signal may have: a core encoded audio signal having a reduced number of subbands with respect to an original audio signal; a parameter representing subbands of the audio signal not included in the core encoded audio signal; a fundamental frequency estimate of the audio signal or the original audio signal.

The present invention is based on the finding that the phase of an audio signal can be corrected according to a target phase calculated by an audio processor or a decoder. The target phase can be seen as a representation of a phase of an unprocessed audio signal. Therefore, the phase of the processed audio signal is adjusted to better fit the phase of the unprocessed audio signal. Having a, e.g. time frequency representation of the audio signal, the phase of the audio signal may be adjusted for subsequent time frames in a subband, or the phase can be adjusted in a time frame for subsequent frequency subbands. Therefore, a calculator was found to automatically detect and choose the most suitable correction method. The described findings may be implemented in different embodiments or jointly implemented in a decoder and/or encoder.

Embodiments show an audio processor for processing an audio signal comprising an audio signal phase measure calculator configured for calculating a phase measure of an audio signal for a time frame. Furthermore, the audio signal comprises a target phase measure determiner for determining a target phase measure for said time frame and a phase corrector configured for correcting phases of the audio signal for the time frame using the calculated phase measure and the target phase measure to obtain a processed audio signal.

According to further embodiments, the audio signal may comprise a plurality of subband signals for the time frame. The target phase measure determiner is configured for determining a first target phase measure for a first subband signal and a second target phase measure for a second subband signal. Furthermore, the audio signal phase measure calculator determines a first phase measure for the first subband signal and a second phase measure for the second subband signal. The phase corrector is configured for correcting the first phase of the first subband signal using the first phase measure of the audio signal and the first target phase measure and for correcting a second phase of the second subband signal using the second phase measure of the audio signal and the second target phase measure. Therefore, the audio processor may comprise an audio signal synthesizer for synthesizing a corrected audio signal using the corrected first subband signal and the corrected second subband signal.

In accordance with the present invention, the audio processor is configured for correcting the phase of the audio signal in horizontal direction, i.e. a correction over time. Therefore, the audio signal may be subdivided into a set of time frames, wherein the phase of each time frame can be adjusted according to the target phase. The target phase may be a representation of an original audio signal, wherein the audio processor may be part of a decoder for decoding the audio signal which is an encoded representation of the original audio signal. Optionally, the horizontal phase correction can be applied separately for a number of subbands of the audio signal, if the audio signal is available in a time-frequency representation. The correction of the phase of the audio signal may be performed by subtracting a deviation of a phase derivative over time of the target phase and the phase of the audio signal from the phase of the audio signal.

Therefore, since the phase derivative over time is a frequency $$(\frac{d\varphi}{dt} = f,$$

with φ being a phase), the described phase correction performs a frequency adjustment for each subband of the audio signal. In other words, the difference of each subband of the audio signal to a target frequency can be reduced to obtain a better quality for the audio signal.

To determine the target phase, the target phase determiner is configured for obtaining a fundamental frequency estimate for a current time frame and for calculating a frequency estimate for each subband of the plurality of subbands of the time frame using the fundamental frequency estimate for the time frame. The frequency estimate can be converted into a phase derivative over time using a total number of subbands and a sampling frequency of the audio signal. In a further embodiment, the audio processor comprises a target phase measure determiner for determining a target phase measure for the audio signal in a time frame, a phase error calculator for calculating a phase error using a phase of the audio signal and the time frame of the target phase measure, and a phase corrector configured for correcting the phase of the audio signal and the time frame using the phase error.

According to further embodiments, the audio signal is available in a time frequency representation, wherein the audio signal comprises a plurality of subbands for the time frame. The target phase measure determiner determines a first target phase measure for a first subband signal and a second target phase measure for a second subband signal. Furthermore, the phase error calculator forms a vector of phase errors, wherein a first element of the vector refers to a first deviation of the phase of the first subband signal and the first target phase measure and wherein a second element of the vector refers to a second deviation of the phase of the second subband signal and the second target phase measure. Additionally, the audio processor of this embodiment comprises an audio signal synthesizer for synthesizing a corrected audio signal using the corrected first subband signal and the corrected second subband signal. This phase correction produces corrected phase values on average.

Additionally or alternatively, the plurality of subbands is grouped into a baseband and a set of frequency patches, wherein the baseband comprises one subband of the audio signal and the set of frequency patches comprises the at least one subband of the baseband at a frequency higher than the frequency of the at least one subband in the baseband.

Further embodiments show the phase error calculator configured for calculating a mean of elements of a vector of phase errors referring to a first patch of the second number of frequency patches to obtain an average phase error. The phase corrector is configured for correcting a phase of the subband signal in the first and subsequent frequency patches of the set of frequency patches of the patch signal using a weighted average phase error, wherein the average phase error is divided according to an index of the frequency patch to obtain a modified patch signal. This phase correction provides good quality at the crossover frequencies, which are the border frequencies between two subsequent frequency patches.

According to a further embodiment, the two previously described embodiments may be combined to obtain a corrected audio signal comprising phase corrected values which are good on average and at the crossover frequencies. Therefore, the audio signal phase derivative calculator is configured for calculating a mean of phase derivatives over frequency for a baseband. The phase corrector calculates a further modified patch signal with an optimized first frequency patch by adding the mean of the phase derivatives over frequency weighted by a current subband index to the phase of the subband signal with the highest subband index in a baseband of the audio signal. Furthermore, the phase corrector may be configured for calculating a weighted mean of the modified patch signal and the further modified patch signal to obtain a combined modified patch signal and for recursively updating, based on the frequency patches, the combined modified patch signal by adding the mean of the phase derivatives over frequency, weighted by the subband index of the current subband, to the phase of the subband signal with the highest subband index in the previous frequency patch of the combined modified patch signal.

To determine the target phase, the target phase measure determiner may comprise a data stream extractor configured for extracting a peak position and a fundamental frequency of peak positions in a current time frame of the audio signal from a data stream. Alternatively, the target phase measure determiner may comprise an audio signal analyzer configured for analyzing the current time frame to calculate a peak position and a fundamental frequency of peak positions in the current time frame. Furthermore, the target phase measure determiner comprises a target spectrum generator for estimating further peak positions in the current time frame using the peak position and the fundamental frequency of peak positions. In detail, the target spectrum generator may comprise a peak detector for generating a pulse train of a time, a signal former to adjust a frequency of the pulse train according to the fundamental frequency of peak positions, a pulse positioner to adjust the phase of the pulse train according to the position, and a spectrum analyzer to generate a phase spectrum of the adjusted pulse train, wherein the phase spectrum of the time domain signal is the target phase measure. The described embodiment of the target phase measure determiner is advantageous for generating a target spectrum for an audio signal having a waveform with peaks.

The embodiments of the second audio processor describe a vertical phase correction. The vertical phase correction adjusts the phase of the audio signal in one time frame over all subbands. The adjustment of the phase of the audio signal, applied independently for each subband, results, after synthesizing the subbands of the audio signal, in a waveform of the audio signal different from the uncorrected audio signal. Therefore, it is e.g. possible to reshape a smeared peak or a transient.

According to a further embodiment, a calculator is shown for determining phase correction data for an audio signal with a variation determiner for determining a variation of the phase of the audio signal in a first and a second variation mode, a variation comparator for comparing a first variation determined using the phase variation mode and a second variation determined using the second variation mode, and a correction data calculator for calculating the phase correction in accordance with the first variation mode or the second variation mode based on a result of the comparing.

A further embodiment shows the variation determiner for determining a standard deviation measure of a phase derivative over time (PDT) for a plurality of time frames of the audio signal as the variation of the phase in the first variation mode or a standard deviation measure of a phase derivative over frequency (PDF) for a plurality of subbands as the variation of the phase in the second variation mode. The variation comparator compares the measure of the phase derivative over time as the first variation mode and the measure of the phase derivative over frequency as the second variation mode for time frames of the audio signal. According to a further embodiment, the variation determiner is configured for determining a variation of the phase of the audio signal in a third variation mode, wherein the third variation mode is a transient detection mode. Therefore, the variation comparator compares the three variation modes and the correction data calculator calculates the phase correction in accordance with the first variation mode, the second variation, or the third variation mode based on a result of the comparing.

The decision rules of the correction data calculator can be described as follows. If a transient is detected, the phase is corrected according to the phase correction for transients to restore the shape of the transient. Otherwise, if the first variation is smaller or equal than the second variation, the phase correction of the first variation mode is applied or, if the second variation is larger than the first variation, the phase correction in accordance with the second variation mode is applied. If the absence of a transient is detected and if both the first and the second variation exceed a threshold value, none of the phase correction modes are applied.

The calculator may be configured for analyzing the audio signal, e.g. in an audio encoding stage, to determine the best phase correction mode and to calculate the relevant parameters for the determined phase correction mode. In a decoding stage, the parameters can be used to obtain a decoded audio signal which has a better quality compared to audio signals decoded using state of the art codecs. It has to be noted that the calculator autonomously detects the right correction mode for each time frame of the audio signal.

Embodiments show a decoder for decoding an audio signal with a first target spectrum generator for generating a target spectrum for a first time frame of a second signal of the audio signal using first correction data and a first phase corrector for correcting a phase of the subband signal in the first time frame of the audio signal determined with a phase correction algorithm, wherein the correction is performed by reducing a difference between a measure of the subband signal in the first time frame of the audio signal and the target spectrum. Additionally, the decoder comprises an audio subband signal calculator for calculating the audio subband signal for the first time frame using a corrected phase for the time frame and for calculating audio subband signal for a second time frame different from the first time frame using the measure of the subband signal in the second time frame or using a corrected phase calculation in accordance with a further phase correction algorithm different from the phase correction algorithm.

According to further embodiments, the decoder comprises a second and a third target spectrum generator equivalent to the first target spectrum generating and a second and a third phase corrector equivalent to the first phase corrector. Therefore, the first phase corrector can perform a horizontal phase correction, the second phase corrector may perform a vertical phase correction, and the third phase corrector can perform phase correction transients. According to a further embodiment the decoder comprises a core decoder configured for decoding the audio signal in a time frame with a reduced number of subbands with respect to the audio signal. Furthermore, the decoder may comprise a patcher for patching a set of subbands of the core decoded audio signal with a reduced number of subbands, wherein the set of subbands forms a first patch, to further subbands in the time frame, adjacent to the reduced number of subbands, to obtain an audio signal with a regular number of subbands. Furthermore, the decoder can comprise a magnitude processor for processing magnitude values of the audio subband signal in the time frame and an audio signal synthesizer for synthesizing audio subband signals or a magnitude of processed audio subband signals to obtain a synthesized decoded audio signal. This embodiment can establish a decoder for bandwidth extension comprising a phase correction of the decoded audio signal.

Accordingly, an encoder for encoding an audio signal comprising a phase determiner for determining a phase of the audio signal, a calculator for determining phase correction data for an audio signal based on the determined phase of the audio signal, a core encoder configured for core encoding the audio signal to obtain a core encoded audio signal having a reduced number of subbands with respect to the audio signal, and a parameter extractor configured for extracting parameters of the audio signal for obtaining a low resolution parameter representation for a second set of subbands not included in the core encoded audio signal, and an audio signal former for forming an output signal comprising the parameters, the core encoded audio signal, and the phase correction data can form an encoder for bandwidth extension.

All of the previously described embodiments may be seen in total or in combination, for example in an encoder and/or a decoder for bandwidth extension with a phase correction of the decoded audio signal. Alternatively, it is also possible to view all of the described embodiments independently without respect to each other.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
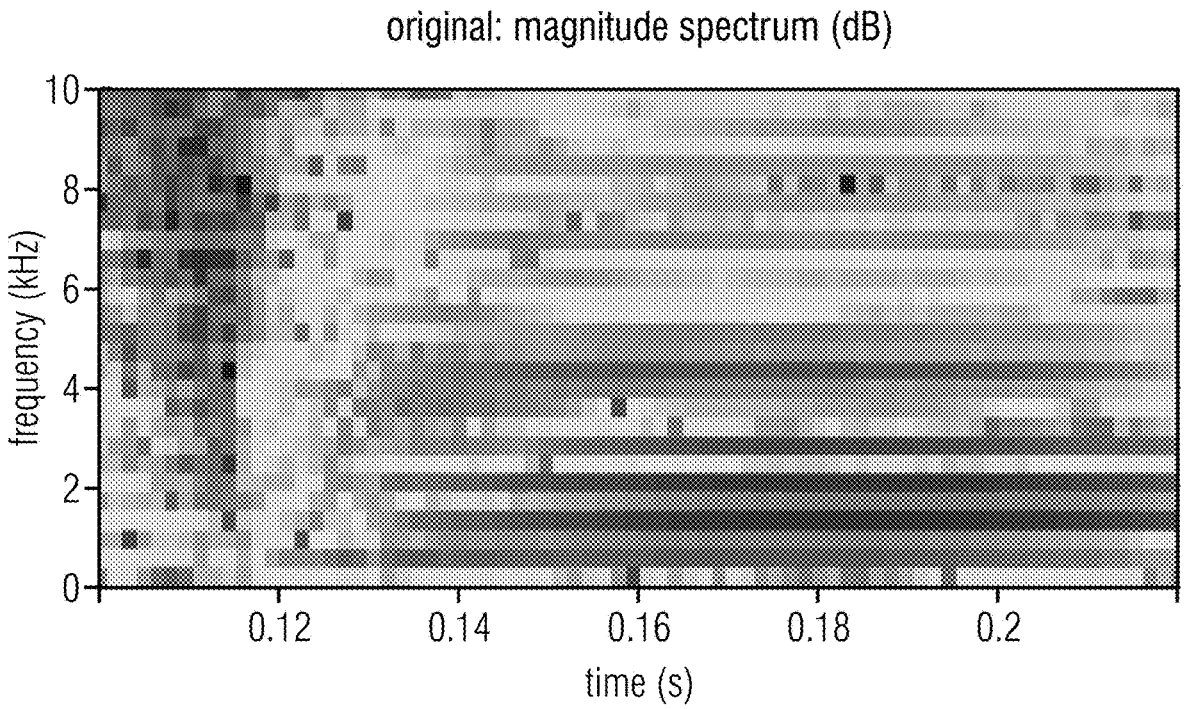
FIG. 1*a* shows the magnitude spectrum of a violin signal in a time frequency representation.

In the following, embodiments of the invention will be described in further detail. Elements shown in the respective figures having the same or a similar functionality will have associated therewith the same reference signs.

Embodiments of the present invention will be described with regard to a specific signal processing. Therefore, FIGS. 1-14 describe the signal processing applied to the audio signal. Even though the embodiments are described with respect to this special signal processing, the present invention is not limited to this processing and can be further applied to many other processing schemes as well. Furthermore, FIGS. 15-25 show embodiments of an audio processor which may be used for horizontal phase correction of the audio signal. FIGS. 26-38 show embodiments of an audio processor which may be used for vertical phase correction of the audio signal. Moreover, FIGS. 39-52 show embodiments of a calculator for determining phase correction data for an audio signal. The calculator may analyze the audio signal and determine which of the previously mentioned audio processors are applied or, if none of the audio processors is suitable for the audio signal, to apply none of the audio processors to the audio signal. FIGS. 53-59 show embodiments of a decoder and an encoder which may comprise the second processor and the calculator.

1 Introduction

Perceptual audio coding has proliferated as mainstream enabling digital technology for all types of applications that provide audio and multimedia to consumers using transmission or storage channels with limited capacity. Modern perceptual audio codecs are expected to deliver satisfactory audio quality at increasingly low bit rates. In turn, one has to put up with certain coding artifacts that are most tolerable by the majority of listeners. Audio Bandwidth Extension (BWE) is a technique to artificially extend the frequency range of an audio coder by spectral translation or transposition of transmitted lowband signal parts into the highband at the price of introducing certain artifacts.

The finding is that some of these artifacts are related to the change of the phase derivative within the artificially extended highband. One of these artifacts is the alteration of phase derivative over frequency (see also "vertical" phase coherence) [8]. Preservation of said phase derivative is perceptually important for tonal signals having a pulse-train like time domain waveform and a rather low fundamental frequency. Artifacts related to a change of the vertical phase derivative correspond to a local dispersion of energy in time and are often found in audio signals which have been processed by BWE techniques. Another artifact is the alteration of the phase derivative over time (see also "horizontal" phase coherence) which is perceptually important for overtone-rich tonal signals of any fundamental frequency. Artifacts related to an alteration of the horizontal phase derivative correspond to a local frequency offset in pitch and are often found in audio signals which have been processed by BWE techniques.

The present invention presents means for readjusting either the vertical or horizontal phase derivative of such signals when this property has been compromised by application of so-called audio bandwidth extension (BWE). Further means are provided to decide if a restoration of the phase derivative is perceptually beneficial and whether adjusting the vertical or horizontal phase derivative is perceptually advantageous.

Bandwidth-extension methods, such as spectral band replication (SBR) [9], are often used in low-bit-rate codecs. They allow transmitting only a relatively narrow low-frequency region alongside with parametric information about the higher bands. Since the bit rate of the parametric information is small, significant improvement in the coding efficiency can be obtained.

Typically the signal for the higher bands is obtained by simply copying it from the transmitted low-frequency region. The processing is usually performed in the complex-modulated quadrature-mirror-filter-bank (QMF) [10] domain, which is assumed also in the following. The copied-up signal is processed by multiplying the magnitude spectrum of it with suitable gains based on the transmitted parameters. The aim is to obtain a similar magnitude spectrum as that of the original signal. On the contrary, the phase spectrum of the copied-up signal is typically not processed at all, but, instead, the copied-up phase spectrum is directly used.

The perceptual consequences of using directly the copied-up phase spectrum is investigated in the following. Based on the observed effects, two metrics for detecting the perceptually most significant effects are suggested. Moreover, methods how to correct the phase spectrum based on them are suggested. Finally, strategies for minimizing the amount of transmitted parameter values for performing the correction are suggested.

The present invention is related to the finding that preservation or restoration of the phase derivative is able to remedy prominent artifacts induced by audio bandwidth extension (BWE) techniques. For instance, typical signals, where the preservation of the phase derivative is important, are tones with rich harmonic overtone content, such as voiced speech, brass instruments or bowed strings.

The present invention further provides means to decide if—for a given signal frame—a restoration of the phase derivative is perceptually beneficial and whether adjusting the vertical or horizontal phase derivative is perceptually advantageous.

The invention teaches an apparatus and a method for phase derivative correction in audio codecs using BWE techniques with the following aspects:

1. Quantification of the "importance" of phase derivative correction
2. Signal dependent prioritization of either vertical ("frequency") phase derivative correction or horizontal ("time") phase derivative correction
3. Signal dependent switching of correction direction ("frequency" or "time")
4. Dedicated vertical phase derivative correction mode for transients
5. Obtaining stable parameters for a smooth correction
6. Compact side information transmission format of correction parameters 2 Presentation of Signals in the QMF Domain A time-domain signal x(m), where m is discrete time, can be presented in the time-frequency domain, e.g. using a complex-modulated Quadrature Mirror Filter bank (QMF). The resulting signal is X(k,n), where k is the frequency band index and n the temporal frame index. The QMF of 64 bands and the sampling frequency $f_s$ of 48 kHz are assumed for visualizations and embodiments. Thus, the bandwidth $f_{BW}$ of each frequency band is 375 Hz and the temporal hop size $t_{hop}$ (17 in FIG. 2) is 1.33 ms. However, the processing is not limited to such a transform. Alternatively, an MDCT (Modified Discrete Cosine Transform) or a DFT (Discrete Fourier Transform) may be used instead.

The resulting signal is X(k,n), where k is the frequency band index and n the temporal frame index. X(k,n) is a complex signal. Thus, it can also be presented using the magnitude $X^{mag}(k,n)$ and the phase components $X^{pha}(k,n)$ with j being the complex number $$X(k,n)=X^{mag}(k,n)e^{j\cdot X^{pha}(k,n)}. \quad (1)$$

The audio signals are presented mostly using $X^{mag}(k,n)$ and $X^{pha}(k,n)$ (see FIGS. 1*a*-1*d* for two examples).

Figure 1B:
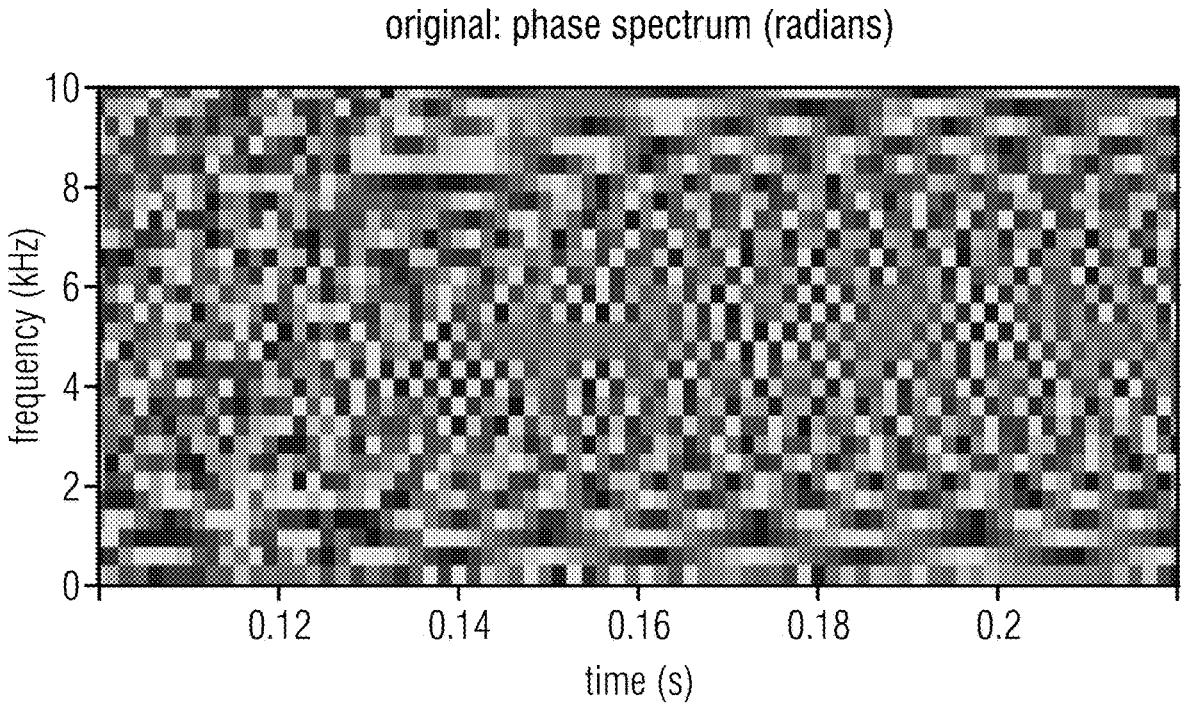
FIG. 1*b* shows the phase spectrum corresponding to the magnitude spectrum of FIG. 1*a;*
Figure 1C:
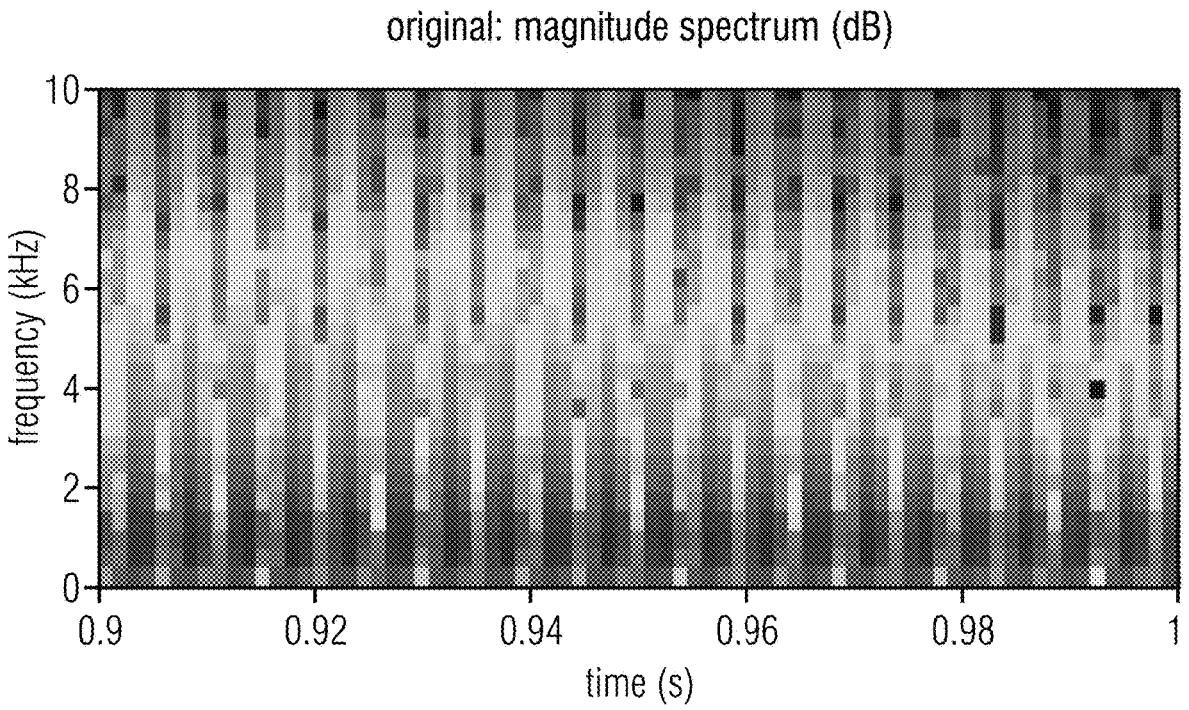
FIG. 1*c* shows the magnitude spectrum of a trombone signal in the QMF domain in a time frequency representation.
Figure 1D:
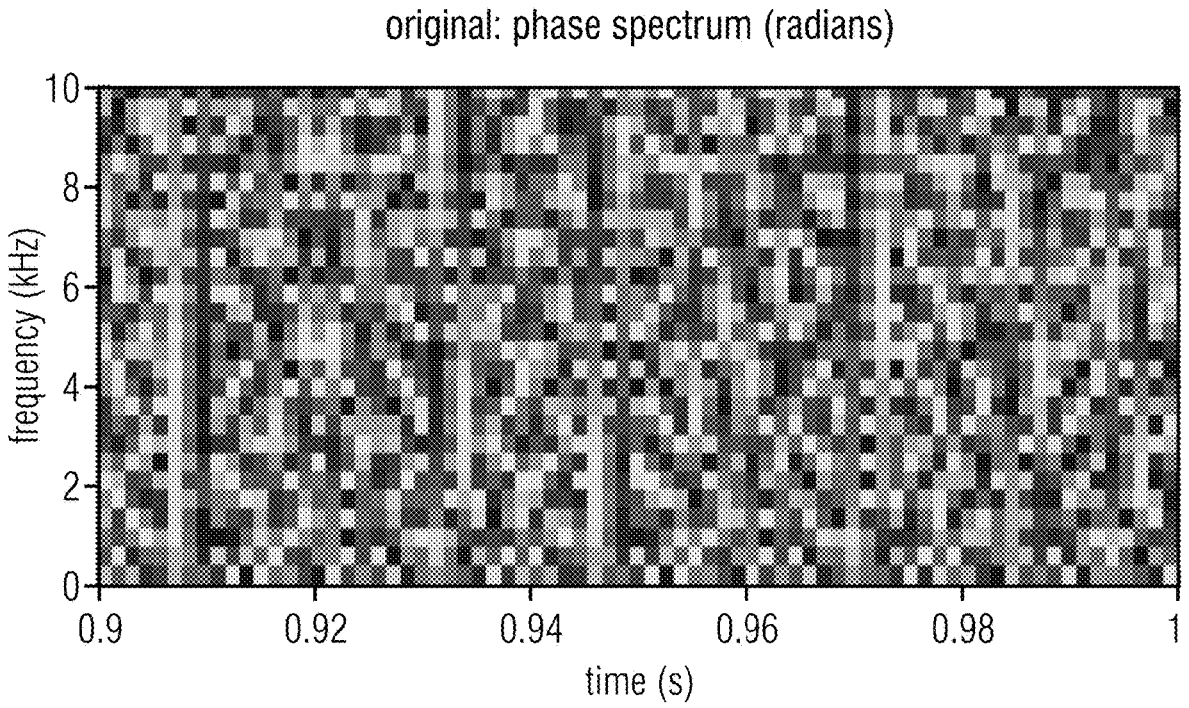
FIG. 1*d* shows the phase spectrum corresponding to the magnitude spectrum of FIG. 1*c;*

FIG. 1*a* shows a magnitude spectrum $X^{mag}$ (k,n) of a violin signal, wherein FIG. 1*b* shows the corresponding phase spectrum $X^{pha}(k,n)$, both in the QMF domain. Furthermore, FIG. 1*c* shows a magnitude spectrum $X^{mag}(k,n)$ of a trombone signal, wherein FIG. 1*d* shows the corresponding phase spectrum again in the corresponding QMF domain. With regard to the magnitude spectra in FIGS. 1*a* and 1*c*, the color gradient indicates a magnitude from red=0 dB to blue=−80 dB. Furthermore, for the phase spectra in FIGS. 1*b* and 1*d*, the color gradient indicates phases from red=π to blue=−π.

3 Audio Data

The audio data used to show an effect of a described audio processing are named 'trombone' for an audio signal of a trombone, 'violin' for an audio signal of a violin, and 'violin+clap' for the violin signal with a hand clap added in the middle.

4 Basic Operation of SBR

Figure 2:
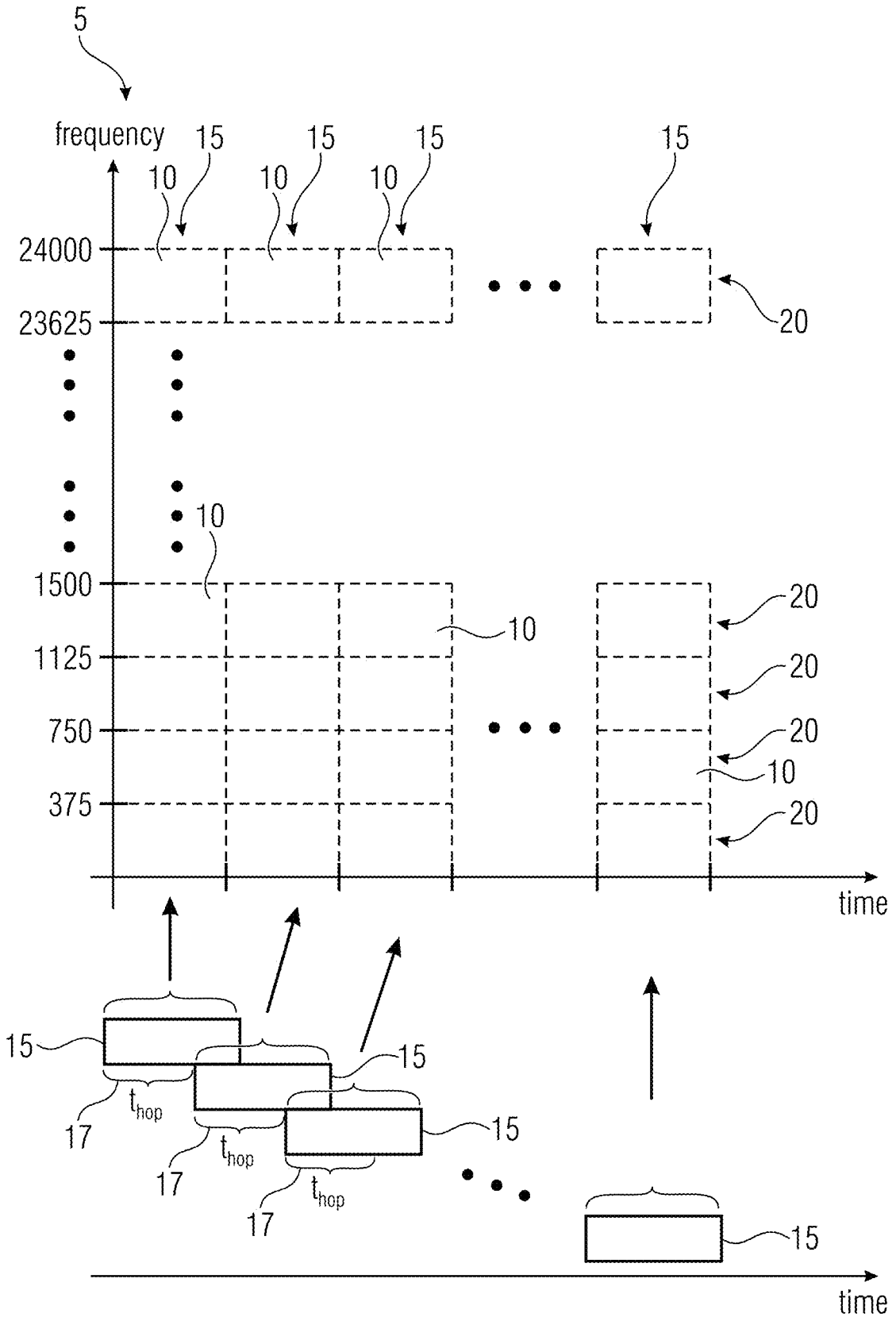
FIG. 2 shows a time frequency diagram comprising time frequency tiles (e.g. QMF bins, Quadrature Mirror Filter bank bins), defined by a time frame and a subband.

FIG. 2 shows a time frequency diagram 5 comprising time frequency tiles 10 (e.g. QMF bins, Quadrature Mirror Filter bank bins), defined by a time frame 15 and a subband 20. An audio signal may be transformed into such a time frequency representation using a QMF (Quadrature Mirror Filter bank) transform, an MDCT (Modified Discrete Cosine Transform), or a DFT (Discrete Fourier Transform). The division of the audio signal in time frames may comprise overlapping parts of the audio signal. In the lower part of FIG. 1, a single overlap of time frames 15 is shown, where at maximum two time frames overlap at the same time. Furthermore, i.e. if more redundancy is needed, the audio signal can be divided using multiple overlap as well. In a multiple overlap algorithm three or more time frames may comprise the same part of the audio signal at a certain point of time. The duration of an overlap is the hop size $t_{hop}$ 17.

Assuming a signal X(k,n), the bandwidth-extended (BWE) signal Z(k,n) is obtained from the input signal X(k,n) by copying up certain parts of the transmitted low-frequency frequency band. An SBR algorithm starts by selecting a frequency region to be transmitted. In this example, the bands from 1 to 7 are selected:

$$\forall 1\leq k\leq 7: X_{trans}(k,n)=X(k,n). \quad (2)$$

The amount of frequency bands to be transmitted depends on the desired bit rate. The figures and the equations are produced using 7 bands, and from 5 to 11 bands are used for the corresponding audio data. Thus, the cross-over frequencies between the transmitted frequency region and the higher bands are from 1875 to 4125 Hz, respectively. The frequency bands above this region are not transmitted at all, but instead, parametric metadata is created for describing them. $X_{trans}$ (k,n) is coded and transmitted. For the sake of simplicity, it is assumed that the coding does not modify the signal in any way, even though it has to be seen that the further processing is not limited to the assumed case.

In the receiving end, the transmitted frequency region is directly used for the corresponding frequencies.

For the higher bands, the signal may be created somehow using the transmitted signal. One approach is simply to copy the transmitted signal to higher frequencies. A slightly modified version is used here. First, a baseband signal is selected. It could be the whole transmitted signal, but in this embodiment the first frequency band is omitted. The reason for this is that the phase spectrum was noticed to be irregular for the first band in many cases. Thus, the baseband to be copied up is defined as $$\forall 1\leq k\leq 6: X_{base}(k,n)=X_{trans}(k+1,n). \quad (3)$$

Other bandwidths can also be used for the transmitted and the baseband signals. Using the baseband signal, raw signals for the higher frequencies are created $$Y_{raw}(k,n,i)=X_{base}(k,n), \tag{4}$$

where $Y_{raw}(k,n,i)$ is the complex QMF signal for the frequency patch i. The raw frequency-patch signals are manipulated according to the transmitted metadata by multiplying them with gains g(k,n,i)

$$Y(k,n,i)=Y_{raw}(k,n,i)g(k,n,i). \tag{5}$$

It should be noted that the gains are real valued, and thus, only the magnitude spectrum is affected and thereby adapted to a desired target value. Known approaches show how the gains are obtained. The target phase remains non-corrected in said known approaches.

The final signal to be reproduced is obtained by concatenating the transmitted and the patch signals for seamlessly extending the bandwidth to obtain a BWE signal of the desired bandwidth. In this embodiment, i=7 is assumed.

$$Z(k,n)=X_{trans}(k,n),$$

$$Z(k+6i+1,n)=Y(k,n,i). \tag{6}$$

Figure 3A:
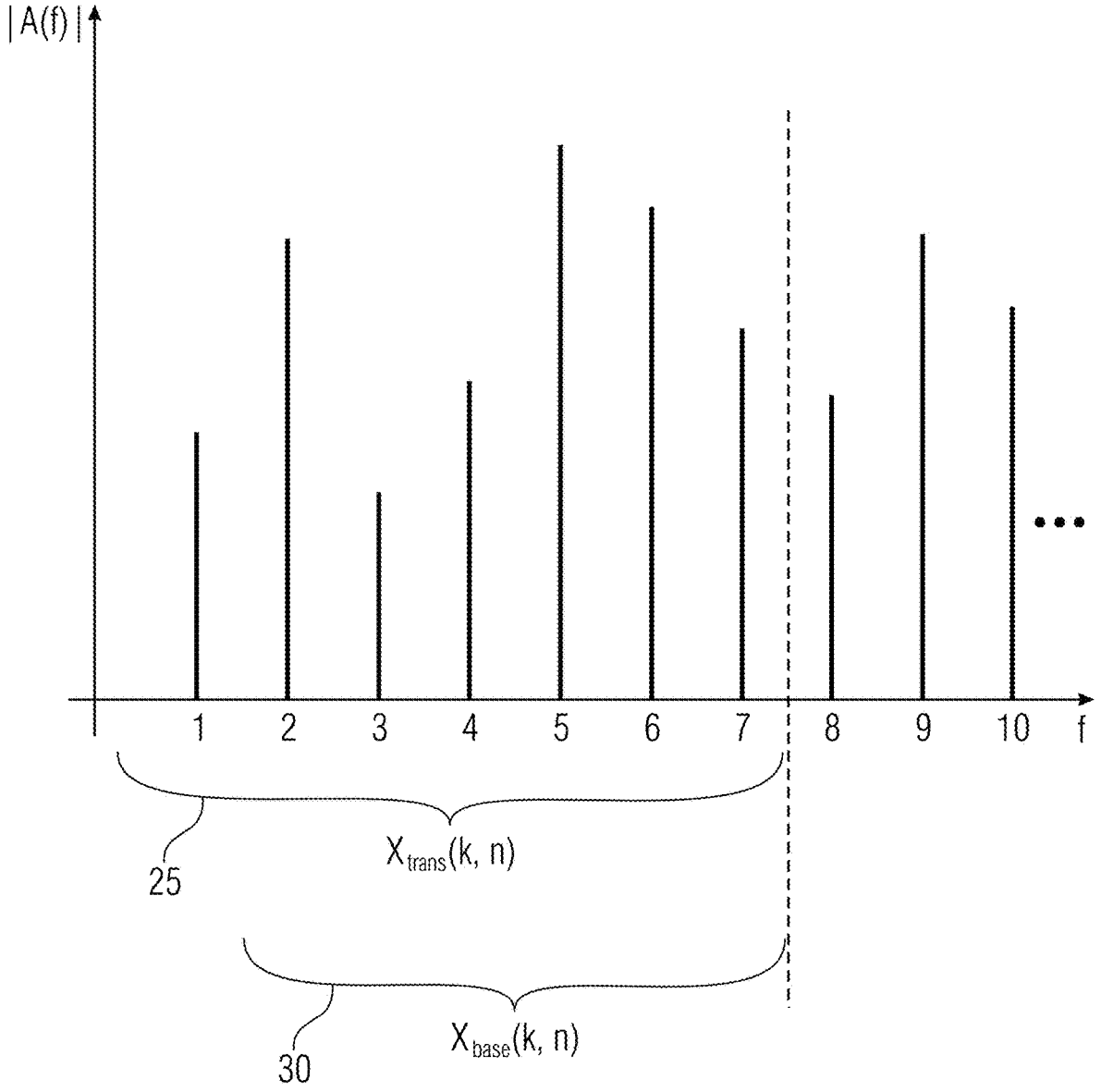
FIG. 3*a* shows an exemplary frequency diagram of an audio signal, wherein the magnitude of the frequency is depicted over ten different subbands.
Figure 3B:
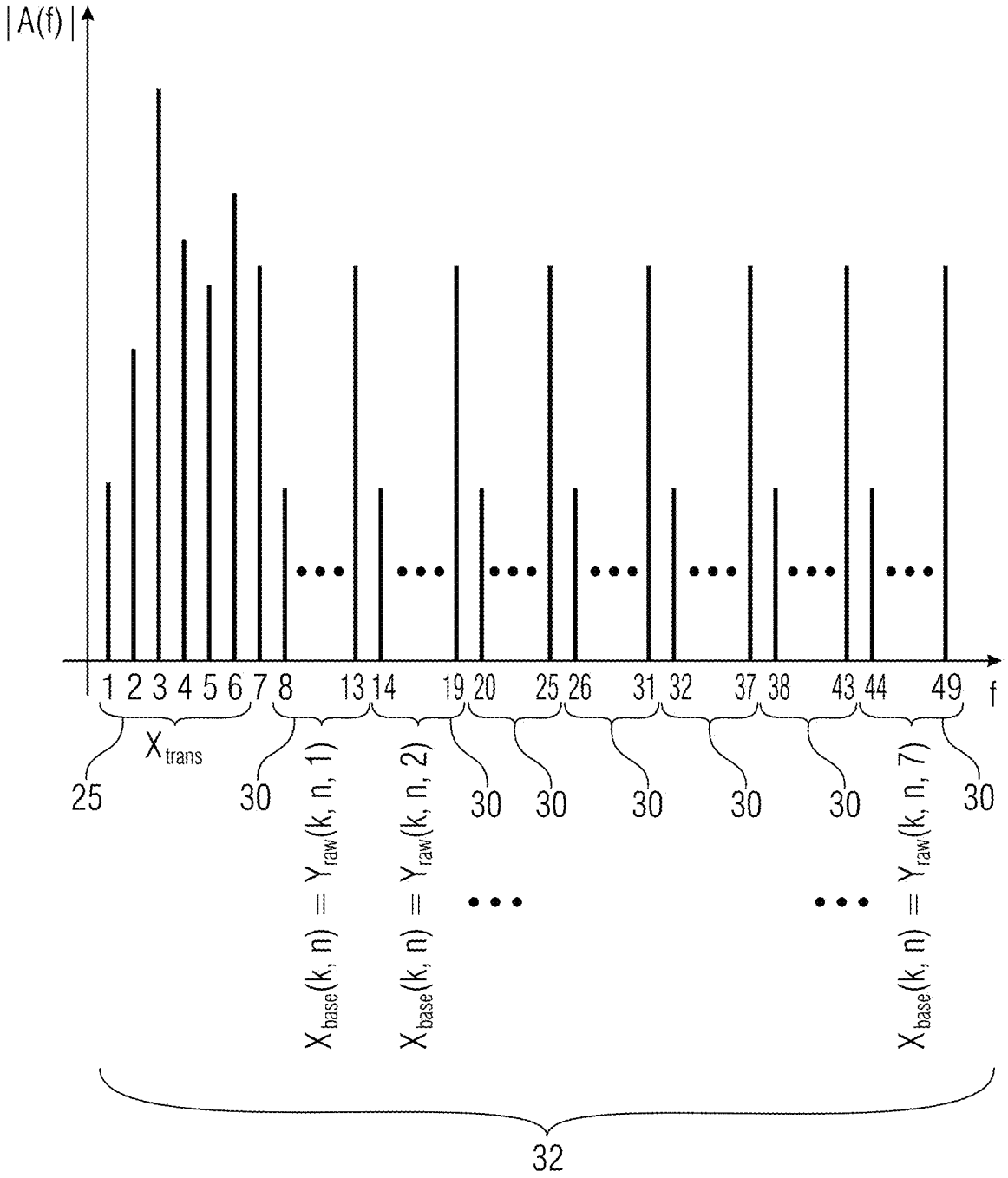
FIG. 3*b* shows an exemplary frequency representation of the audio signal after reception, e.g. during a decoding process at an intermediate step.
Figure 3C:
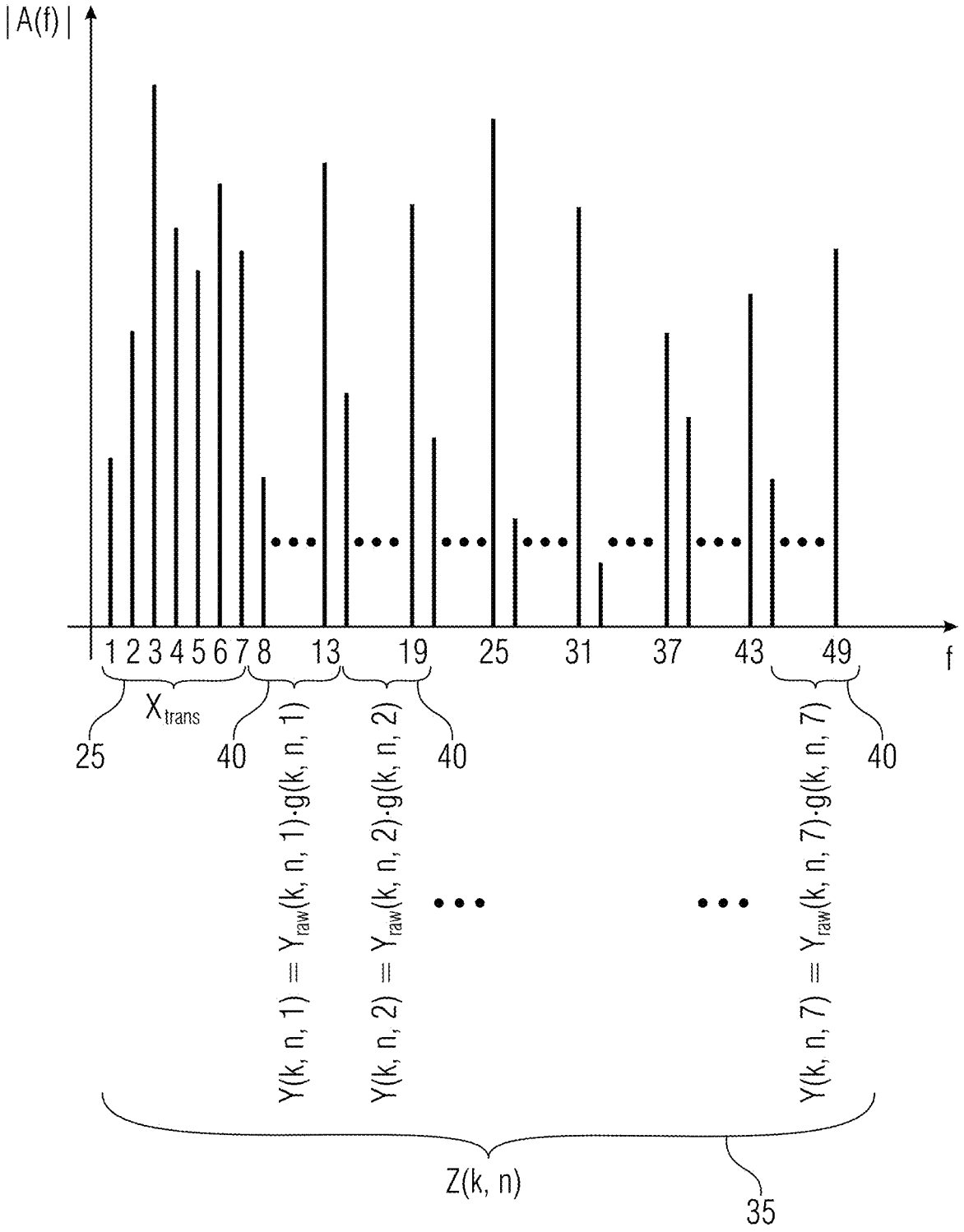
FIG. 3*c* shows an exemplary frequency representation of the reconstructed audio signal Z(k,n)
Figure 4A:
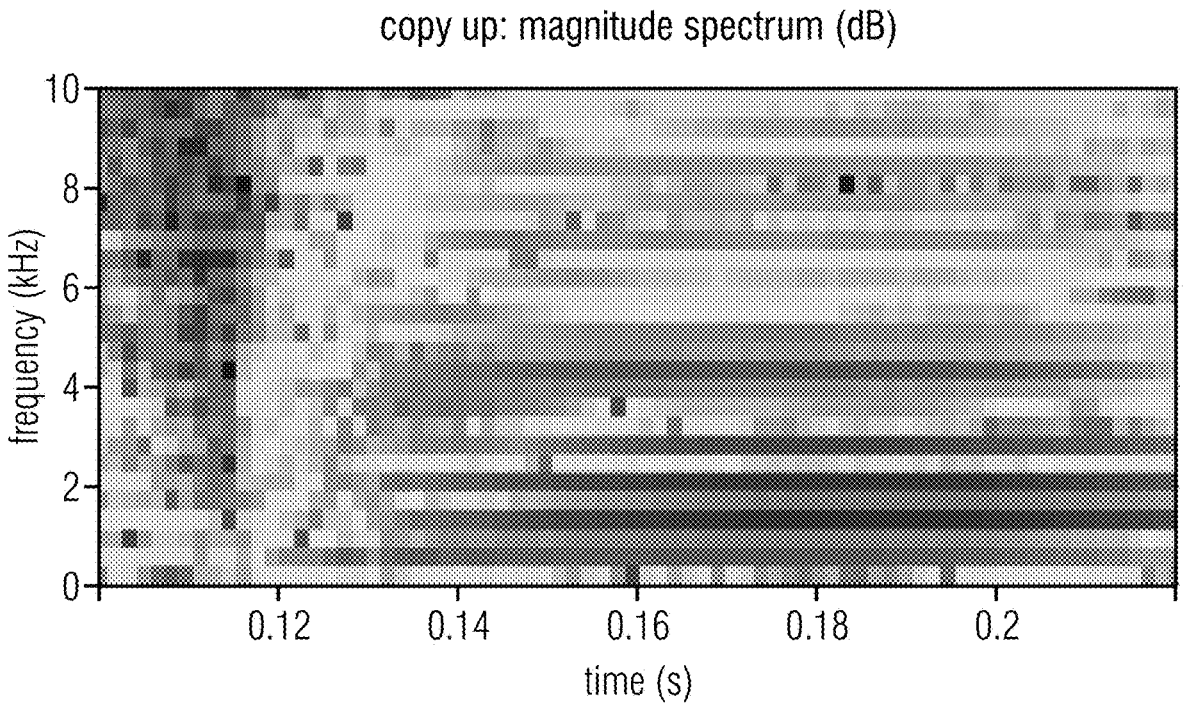
FIG. 4*a* shows a magnitude spectrum of the violin signal in the QMF domain using direct copy-up SBR in a time-frequency representation.
Figure 4B:
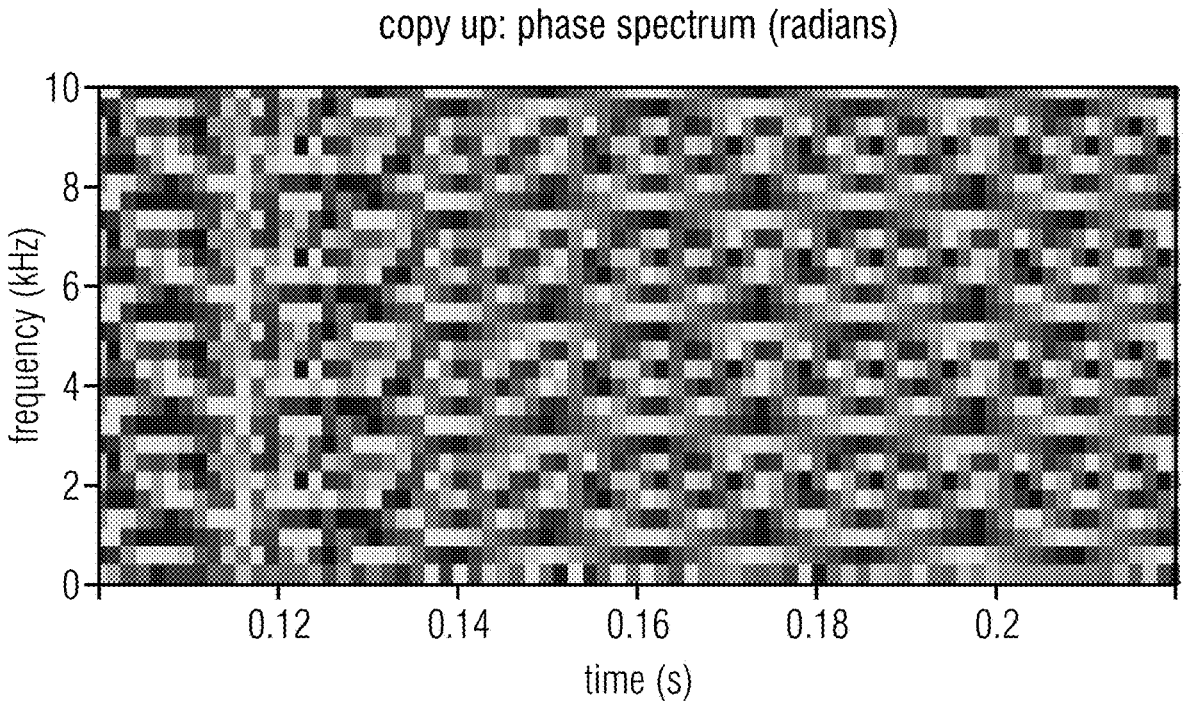
FIG. 4*b* shows a phase spectrum corresponding to the magnitude spectrum of FIG. 4*a;*
Figure 4C:
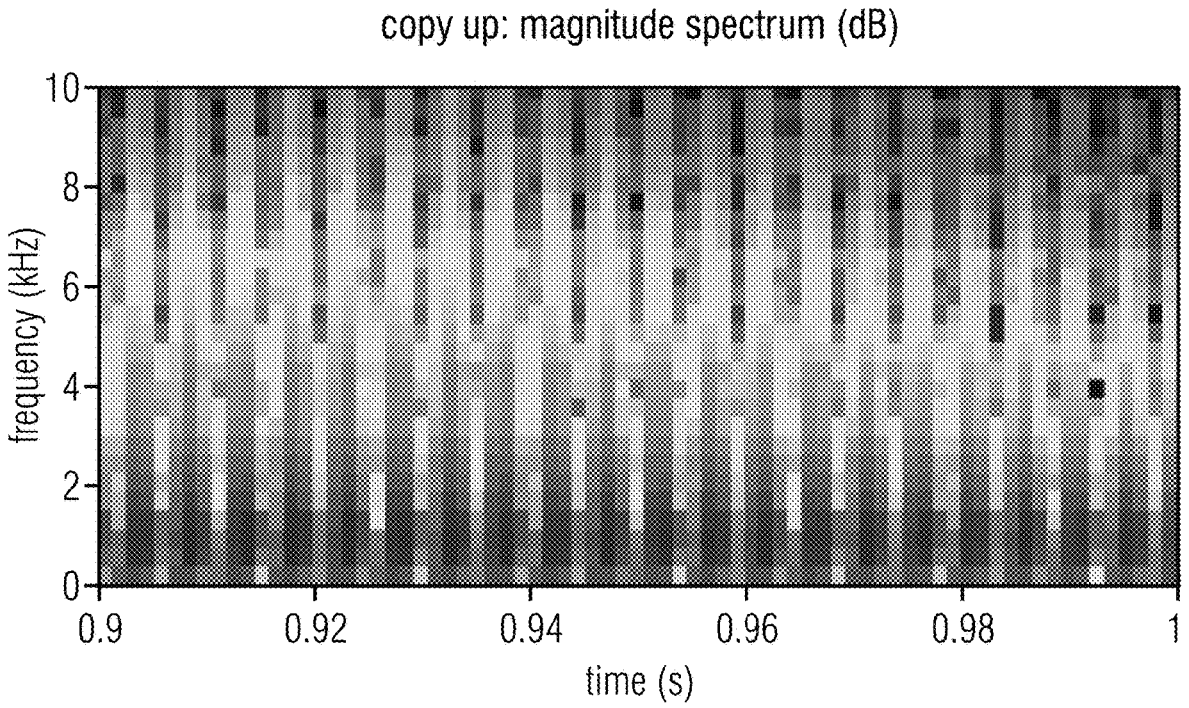
FIG. 4*c* shows a magnitude spectrum of a trombone signal in the QMF domain using direct copy-up SBR in a time-frequency representation.
Figure 4D:
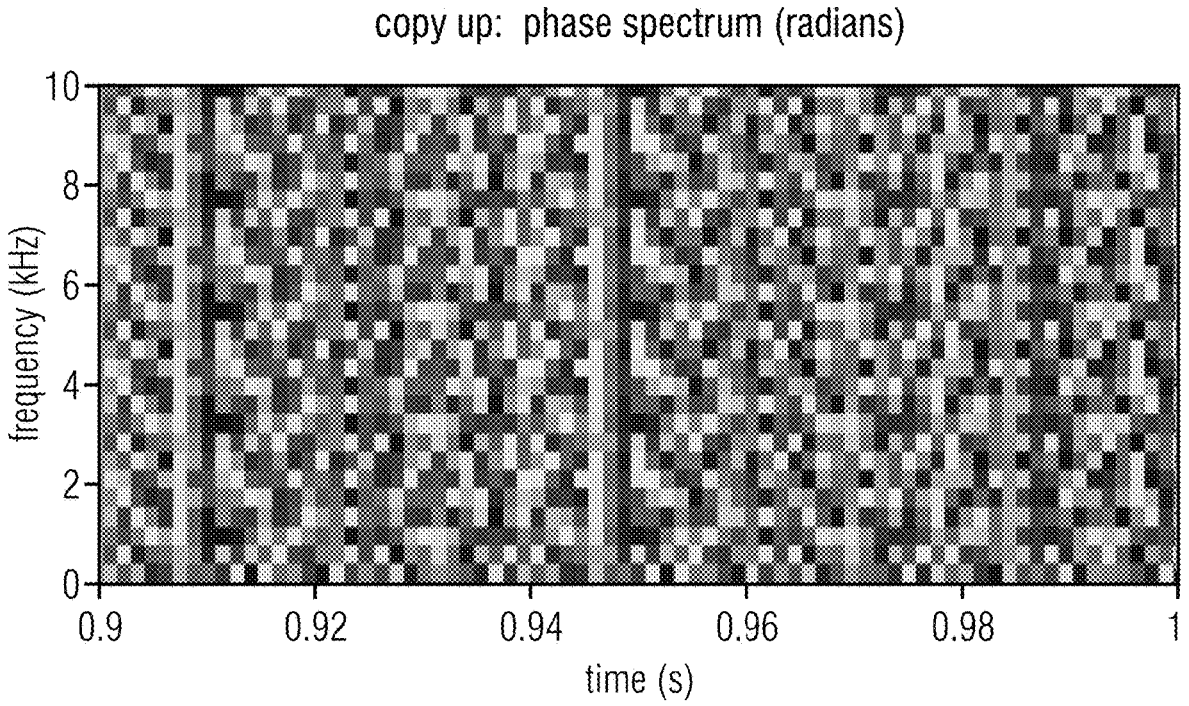
FIG. 4*d* shows the phase spectrum corresponding to the magnitude spectrum of FIG. 4*c;*

FIG. 3 shows the described signals in a graphical representation. FIG. 3*a* shows an exemplary frequency diagram of an audio signal, wherein the magnitude of the frequency is depicted over ten different subbands. The first seven subbands reflect the transmitted frequency bands $X_{trans}(k,n)$ 25. The baseband $X_{base}(k,n)$ 30 is derived therefrom by choosing the second to the seventh subbands. FIG. 3*a* shows the original audio signal, i.e. the audio signal before transmission or encoding. FIG. 3*b* shows an exemplary frequency representation of the audio signal after reception, e.g. during a decoding process at an intermediate step. The frequency spectrum of the audio signal comprises the transmitted frequency bands 25 and seven baseband signals 30 copied to higher subbands of the frequency spectrum forming an audio signal 32 comprising frequencies higher than the frequencies in the baseband. The complete baseband signal is also referred to as a frequency patch. FIG. 3*c* shows a reconstructed audio signal Z(k,n) 35. Compared to FIG. 3*b*, the patches of baseband signals are multiplied individually by a gain factor. Therefore, the frequency spectrum of the audio signal comprises the main frequency spectrum 25 and a number of magnitude corrected patches Y(k,n,1) 40. This patching method is referred to as direct copy-up patching. Direct copy-up patching is exemplarily used to describe the present invention, even though the invention is not limited to such a patching algorithm. A further patching algorithm which may be used is, e.g. a harmonic patching algorithm.

It is assumed that the parametric representation of the higher bands is perfect, i.e., the magnitude spectrum of the reconstructed signal is identical to that of the original signal $$Z^{mag}(k,n)=X^{mag}(k,n). \tag{7}$$

However, it should be noted that the phase spectrum is not corrected in any way by the algorithm, so it is not correct even if the algorithm worked perfectly. Therefore, embodiments show how to additionally adapt and correct the phase spectrum of Z(k,n) to a target value such that an improvement of the perceptual quality is obtained. In embodiments, the correction can be performed using three different processing modes, "horizontal", "vertical" and "transient". These modes are separately discussed in the following.

$Z^{mag}(k,n)$ and $Z^{pha}(k,n)$ are depicted in FIG. 4 for the violin and the trombone signals. FIG. 4 shows exemplary spectra of the reconstructed audio signal 35 using spectral bandwidth replication (SBR) with direct copy-up patching. The magnitude spectrum $Z^{mag}(k,n)$ of a violin signal is shown in FIG. 4*a*, wherein FIG. 4*b* shows the corresponding phase spectrum $Z^{pha}(k,n)$. FIGS. 4*c* and 4*d* show the corresponding spectra for a trombone signal. All of the signals are presented in the QMF domain. As already seen in FIG. 1, the color gradient indicates a magnitude from red=0 dB to blue=−80 dB, and a phase from red=π to blue=−π. It can be seen that their phase spectra are different than the spectra of the original signals (see FIG. 1). Due to SBR, the violin is perceived to contain inharmonicity and the trombone to contain modulating noises at the cross-over frequencies. However, the phase plots look quite random, and it is really difficult to say how different they are, and what the perceptual effects of the differences are. Moreover, sending correction data for this kind of random data is not feasible in coding applications that use low bit rate. Thus, understanding the perceptual effects of the phase spectrum and finding metrics for describing them are needed. These topics are discussed in the following sections.

Meaning of the Phase Spectrum in the QMF Domain

Often it is thought that the index of the frequency band defines the frequency of a single tonal component, the magnitude defines the level of it, and the phase defines the 'timing' of it. However, the bandwidth of a QMF band is relatively large, and the data is oversampled. Thus, the interaction between the time-frequency tiles (i.e., QMF bins) actually defines all of these properties.

Figure 5:
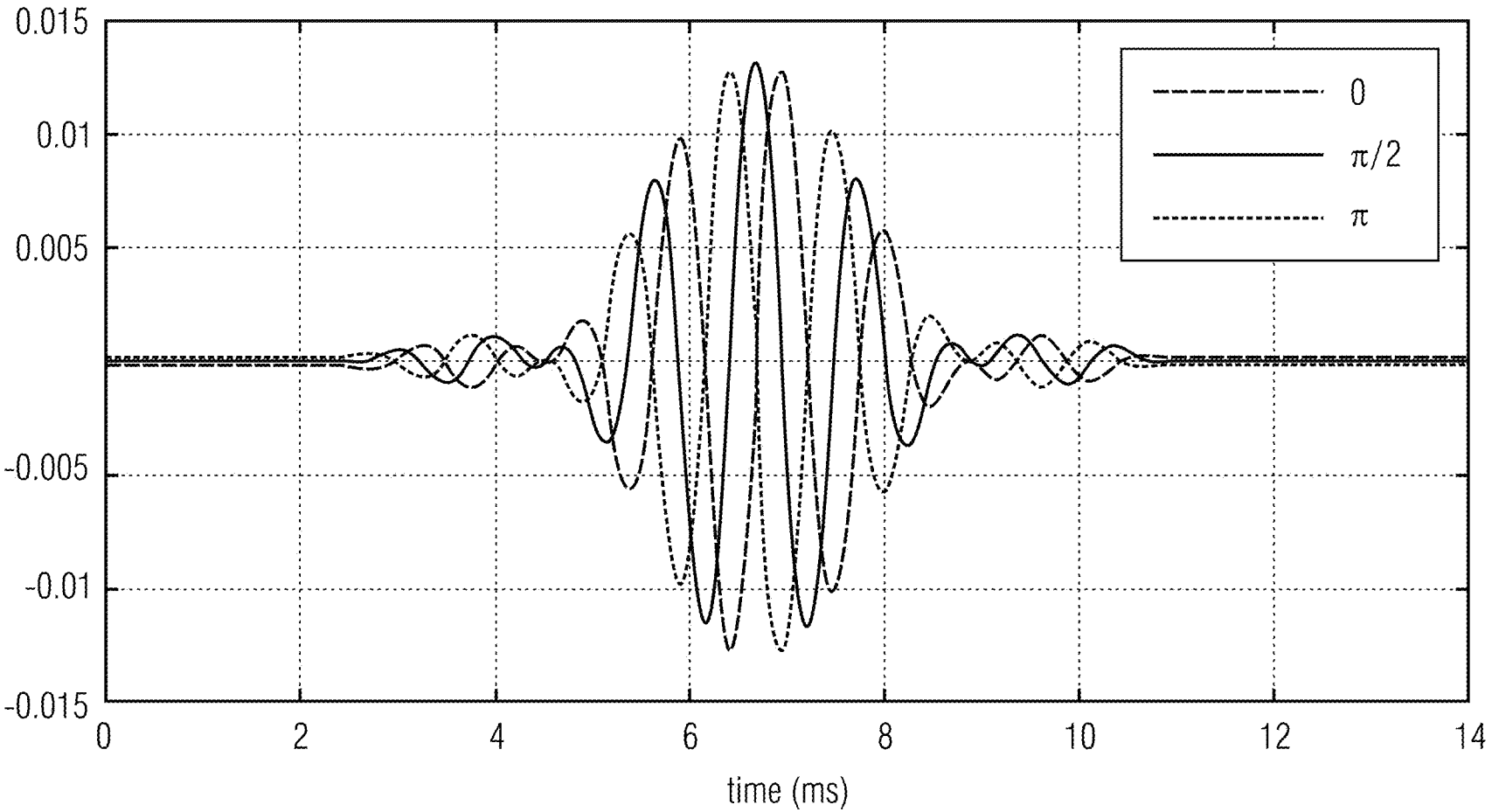
FIG. 5 shows a time-domain representation of a single QMF bin with different phase values.

A time-domain presentation of a single QMF bin with three different phase values, i.e., $X^{mag}(3,1)=1$ and $X^{pha}(3,1)=0$, π/2, or π is depicted in FIG. 5. The result is a sinc-like function with the length of 13.3 ms. The exact shape of the function is defined by the phase parameter.

Considering a case where only one frequency band is non-zero for all temporal frames, i.e., $$\forall n \exists \mathbb{N} : X^{mag}(3,n)=1. \tag{8}$$

By changing the phase between the temporal frames with a fixed value α, i.e., $$X^{pha}(k,n)=X^{pha}(k,n-1)+\alpha, \tag{9}$$

a sinusoid is created. The resulting signal (i.e., the time-domain signal after inverse QMF transform) is presented in FIG. 6 with the values of α=π/4 (top) and 3π/4 (bottom). It can be seen that the frequency of the sinusoid is affected by the phase change. The frequency domain is shown on the right, wherein the time domain of the signal is shown on the left of FIG. 6.

Figure 7:
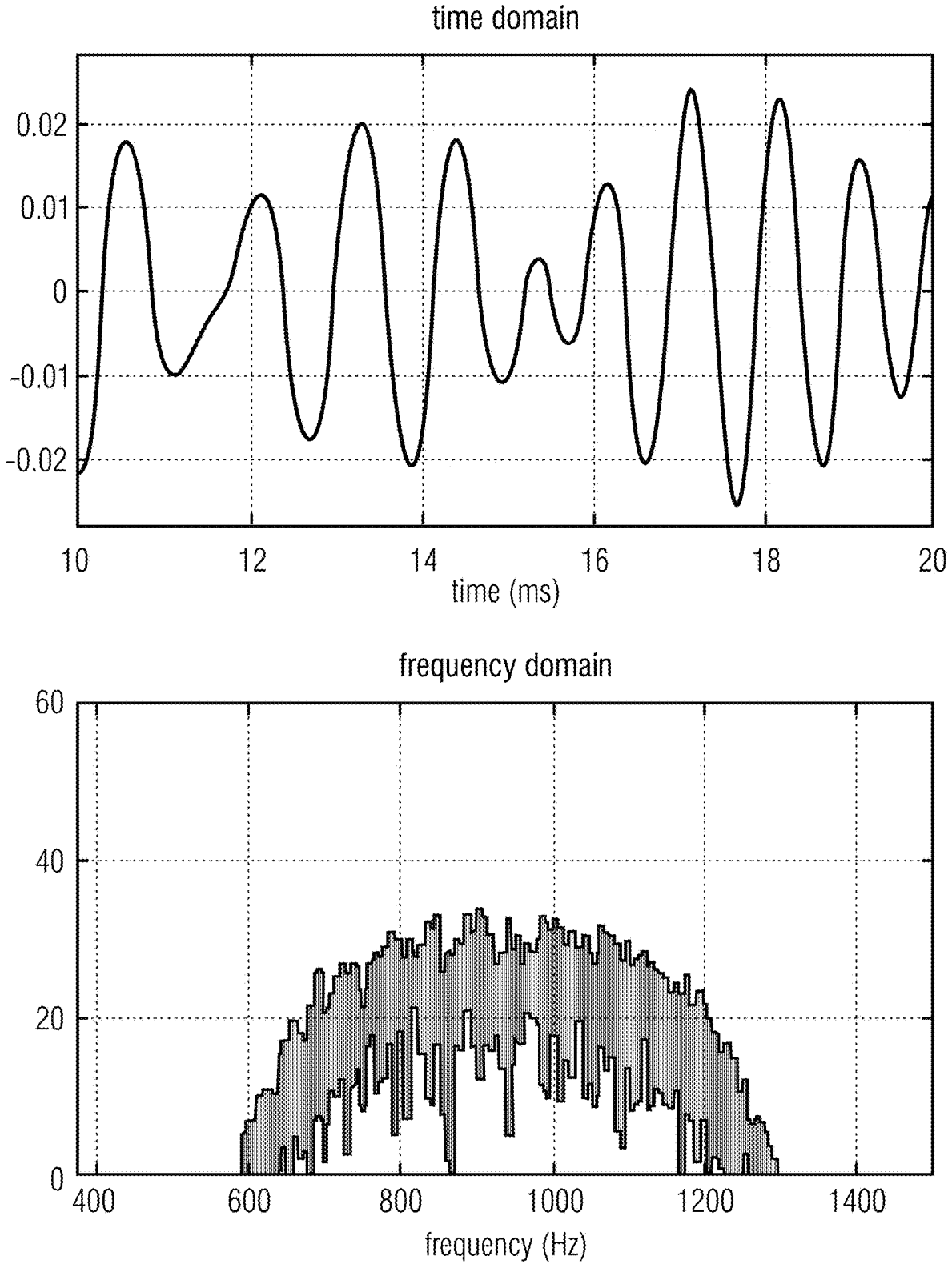
FIG. 7 shows a time-domain and a frequency-domain presentation of a signal, which has one non-zero frequency band and the phase is changing randomly.

Correspondingly, if the phase is selected randomly, the result is narrow-band noise (see FIG. 7). Thus, it can be said that the phase of a QMF bin is controlling the frequency content inside the corresponding frequency band.

Figure 6:
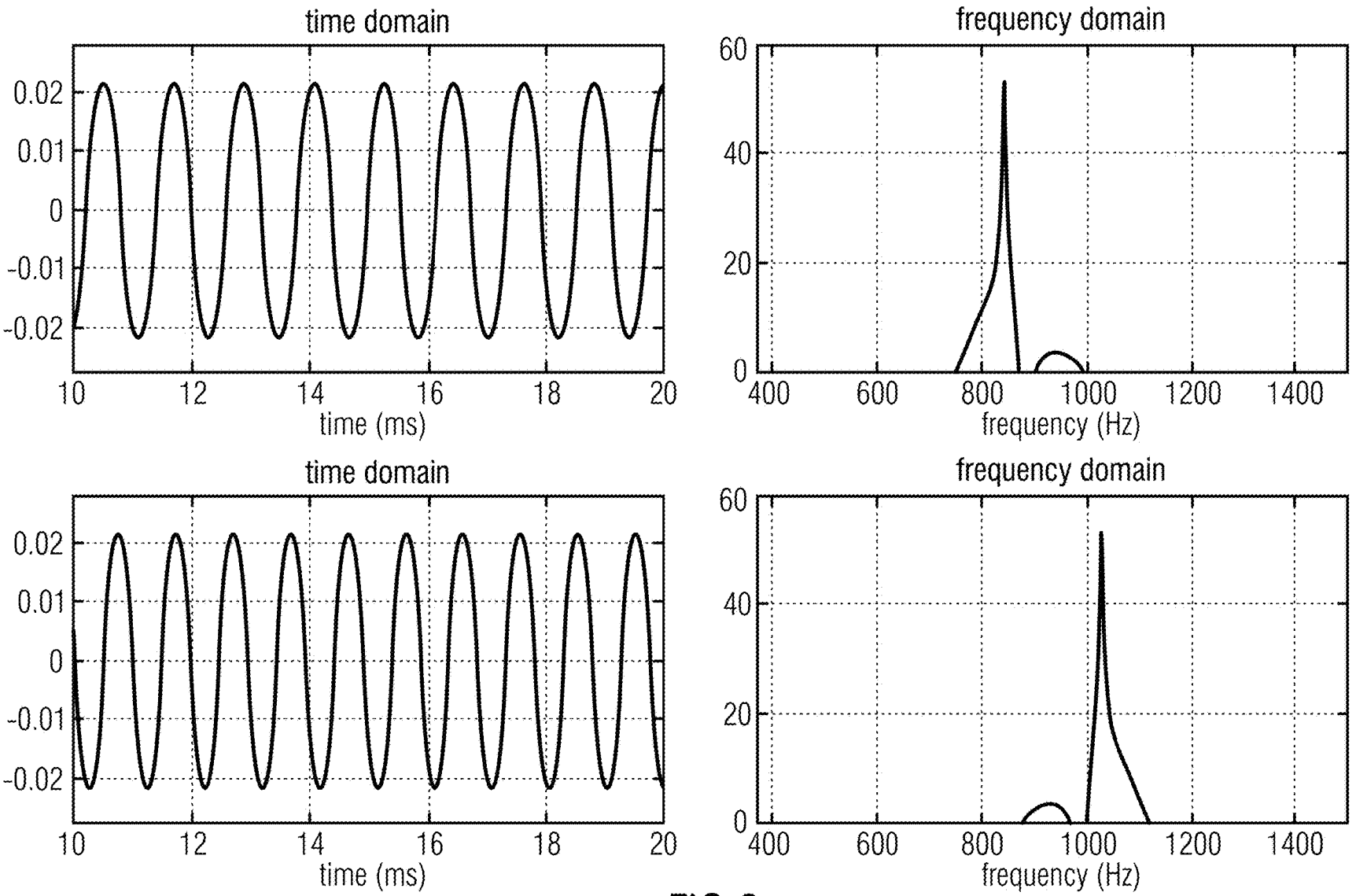
FIG. 6 shows a time-domain and frequency-domain presentation of a single, which has one non-zero frequency band and the phase changing with a fixed value, π/4 (upper) and 3π/4 (lower)
Figure 8:
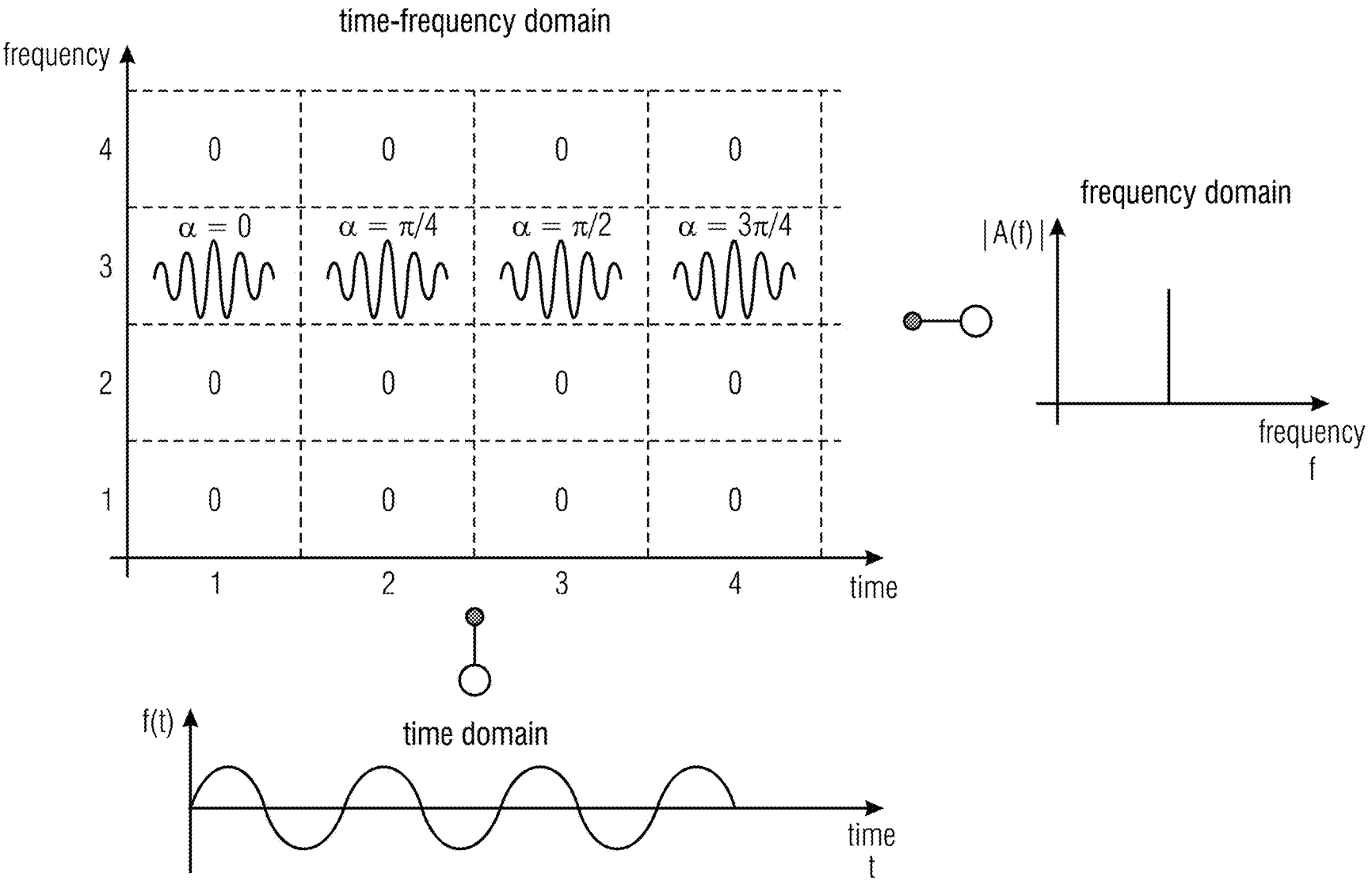
FIG. 8 shows the effect described regarding FIG. 6 in a time frequency representation of four time frames and four frequency subbands, where only the third subband comprises a frequency different from zero.

FIG. 8 shows the effect described regarding FIG. 6 in a time frequency representation of four time frames and four frequency subbands, where only the third subband comprises a frequency different from zero. This results in the frequency domain signal from FIG. 6, presented schematically on the right of FIG. 8, and in the time domain representation of FIG. 6 presented schematically at the bottom of FIG. 8.

Considering a case where only one temporal frame is non-zero for all frequency bands, i.e., $$\forall k \exists \mathbb{N} : X^{mag}(k,3)=1. \tag{10}$$

By changing the phase between the frequency bands with a fixed value α, i.e., $$X^{pha}(k,n)=X^{pha}(k-1,n)+\alpha, \tag{11}$$

a transient is created. The resulting signal (i.e., the time-domain signal after inverse QMF transform) is presented in FIG. 9 with the values of $\alpha=\pi/4$ (top) and $3\pi/4$ (bottom). It can be seen that the temporal position of the transient is affected by the phase change. The frequency domain is shown on the right of FIG. 9, wherein the time domain of the signal is shown on the left of FIG. 9.

Figure 10:
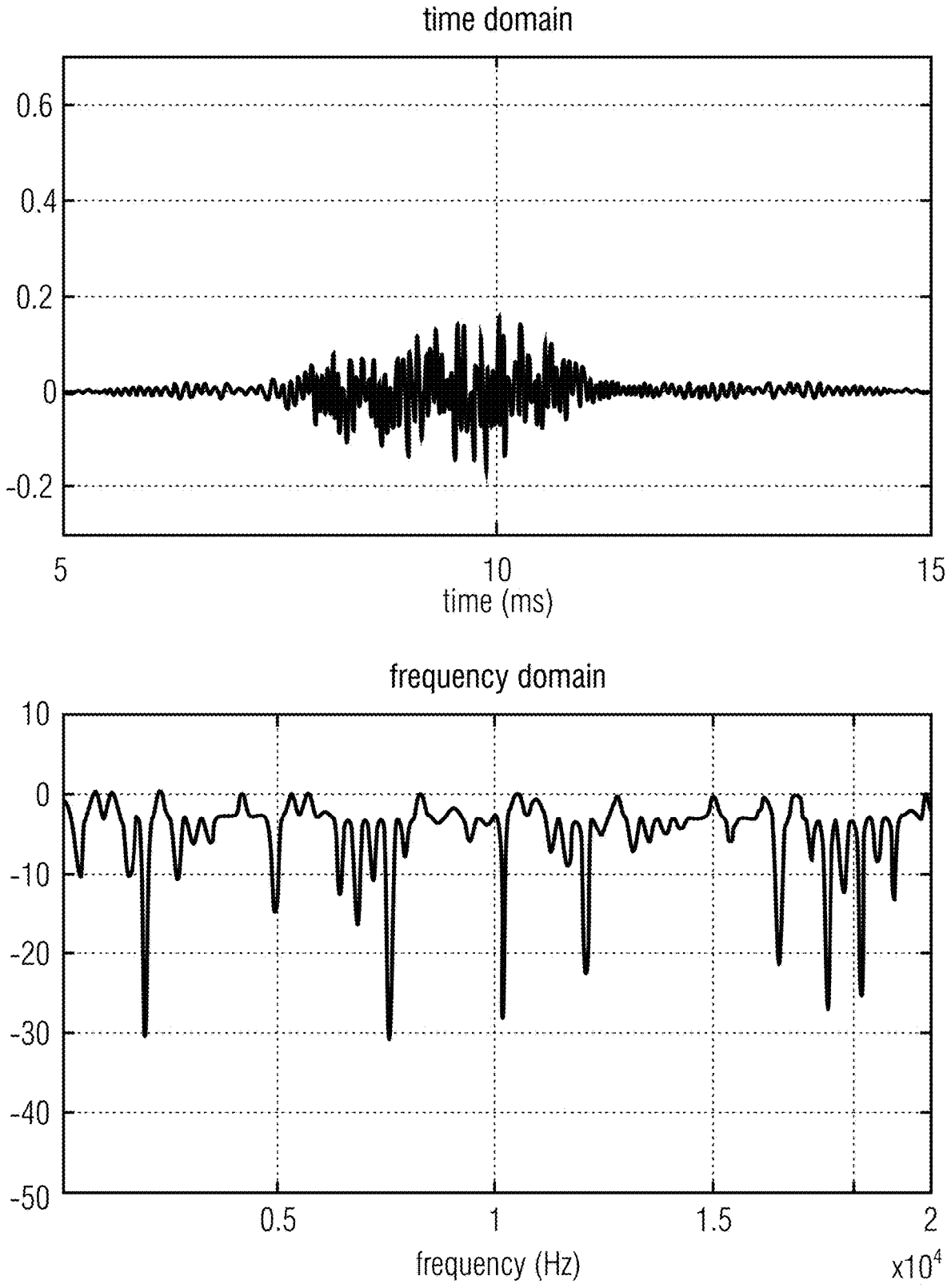
FIG. 10 shows a time-domain and a frequency-domain presentation of a signal, which has one non-zero temporal frame and the phase is changing randomly.

Correspondingly, if the phase is selected randomly, the result is a short noise burst (see FIG. 10). Thus, it can be said that the phase of a QMF bin is also controlling the temporal positions of the harmonics inside the corresponding temporal frame.

Figure 9:
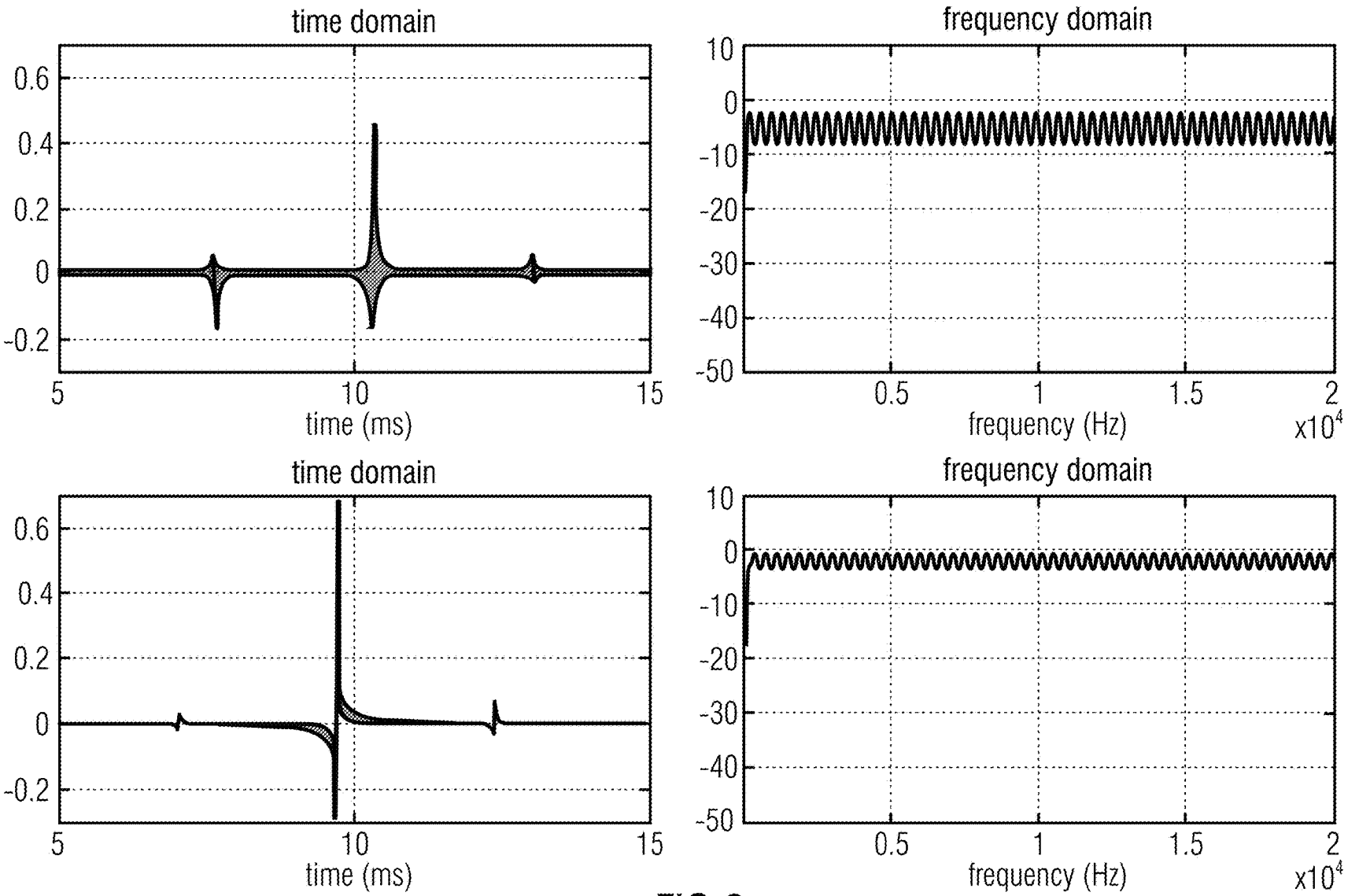
FIG. 9 shows a time-domain and a frequency-domain presentation of a signal, which has one non-zero temporal frame and the phase is changing with a fixed value, π/4 (upper) and 3π/4 (lower)
Figure 11:
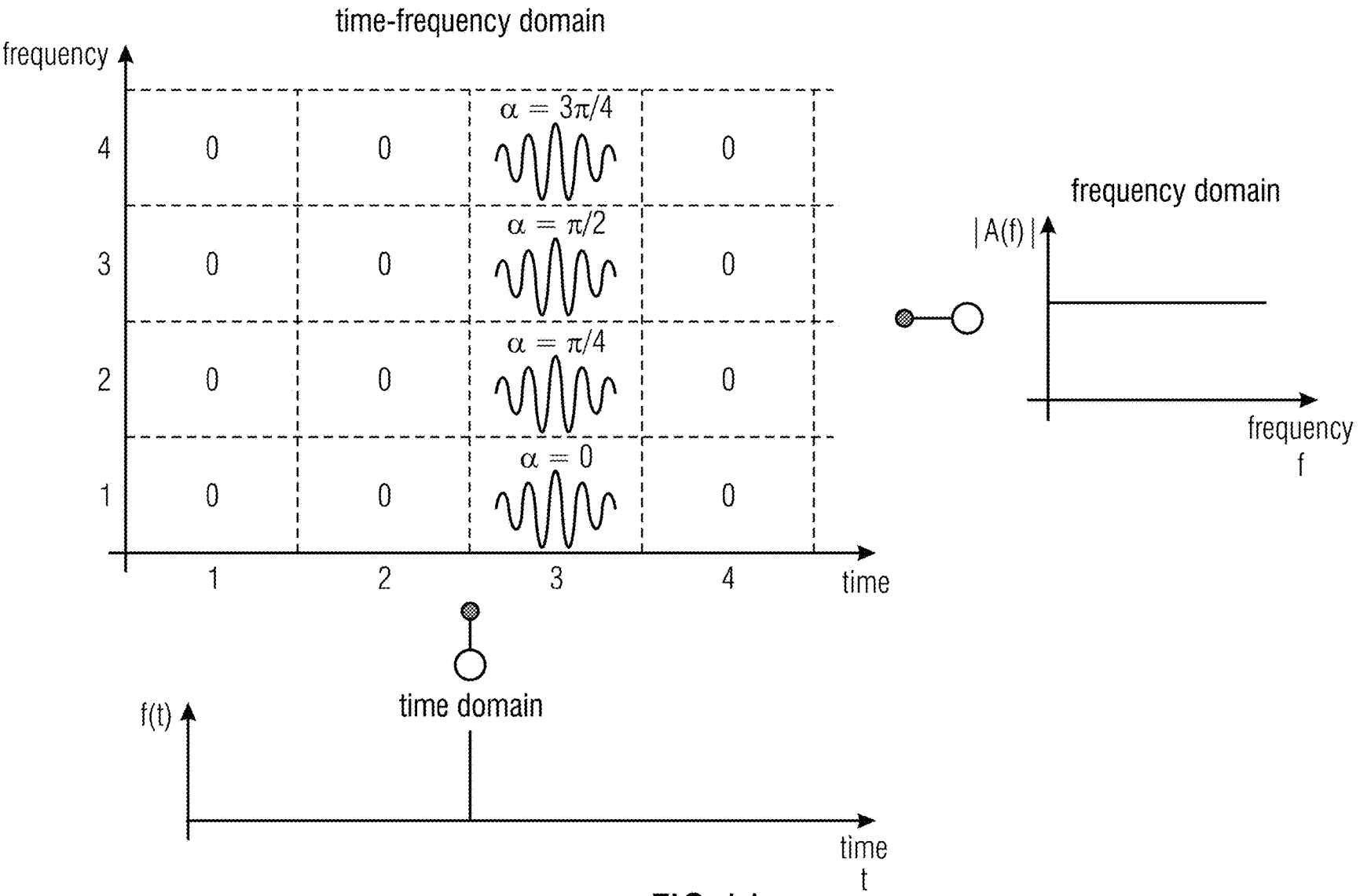
FIG. 11 shows a time frequency diagram similar to the time frequency diagram shown in FIG. 8, where only the third time frame comprises a frequency different from zero.

FIG. 11 shows a time frequency diagram similar to the time frequency diagram shown in FIG. 8. In FIG. 11, only the third time frame comprises values different from zero having a time shift of $\pi/4$ from one subband to another. Transformed into a frequency domain, the frequency domain signal from the right side of FIG. 9 is obtained, schematically presented on the right side of FIG. 11. A schematic of a time domain representation of the left part of FIG. 9 is shown at the bottom of FIG. 11. This signal results by transforming the time frequency domain into a time domain signal.

6 Measures for Describing Perceptually Relevant Properties of the Phase Spectrum As discussed in Section 4, the phase spectrum in itself looks quite messy, and it is difficult to see directly what its effect on perception is. Section 5 presented two effects that can be caused by manipulating the phase spectrum in the QMF domain: (a) constant phase change over time produces a sinusoid and the amount of phase change controls the frequency of the sinusoid, and (b) constant phase change over frequency produces a transient and the amount of phase change controls the temporal position of the transient.

The frequency and the temporal position of a partial are obviously significant to human perception, so detecting these properties is potentially useful. They can be estimated by computing the phase derivative over time (PDT)

$$X^{pdt}(k,n)=X^{pha}(k,n+1)-X^{pha}(k,n) \tag{12}$$

and by computing the phase derivative over frequency (PDF)

$$X^{pdf}(k,n)=X^{pha}(k+1,n)-X^{pha}(k,n). \tag{13}$$

$X^{pdt}(k,n)$ is related to the frequency and $X^{pdf}(k,n)$ to the temporal position of a partial. Due to the properties of the QMF analysis (how the phases of the modulators of the adjacent temporal frames match at the position of a transient), $\pi$ is added to the even temporal frames of $X^{pdf}(k,n)$ in the figures for visualization purposes in order to produce smooth curves.

Figure 12A:
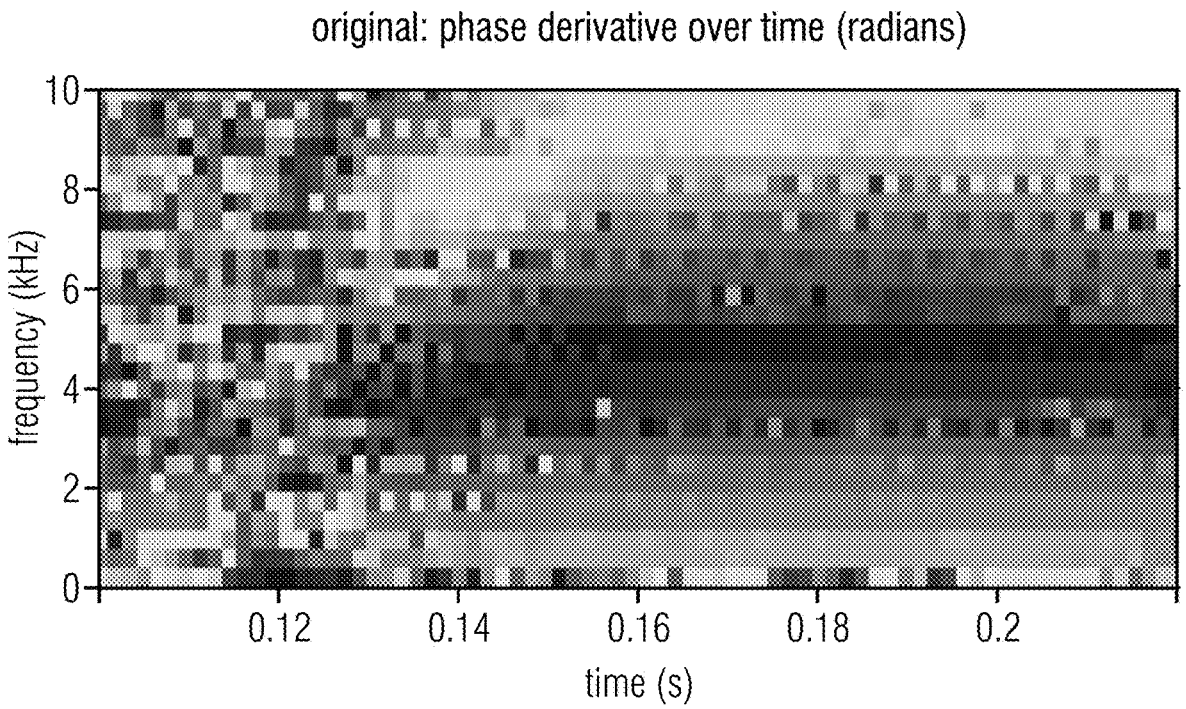
FIG. 12*a* shows a phase derivative over time of the violin signal in the QMF domain in a time-frequency representation.
Figure 12B:
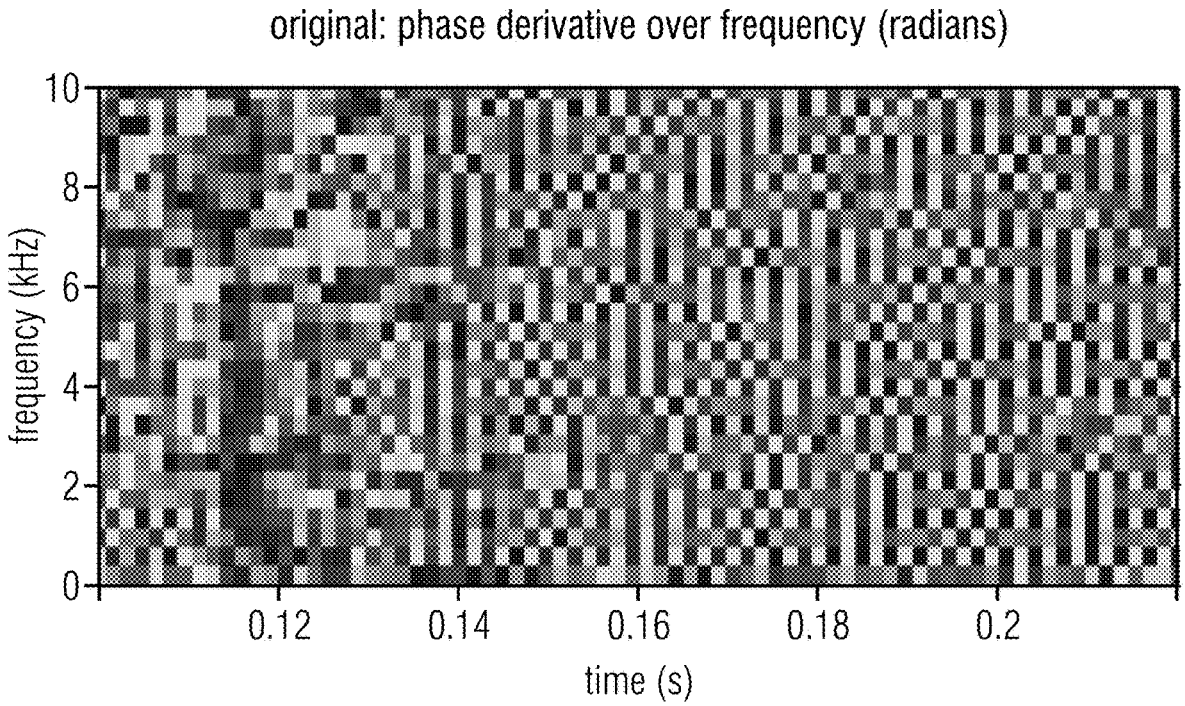
FIG. 12*b* shows the phase derivative frequency corresponding to the phase derivative over time shown in FIG. 12*a;*
Figure 12C:
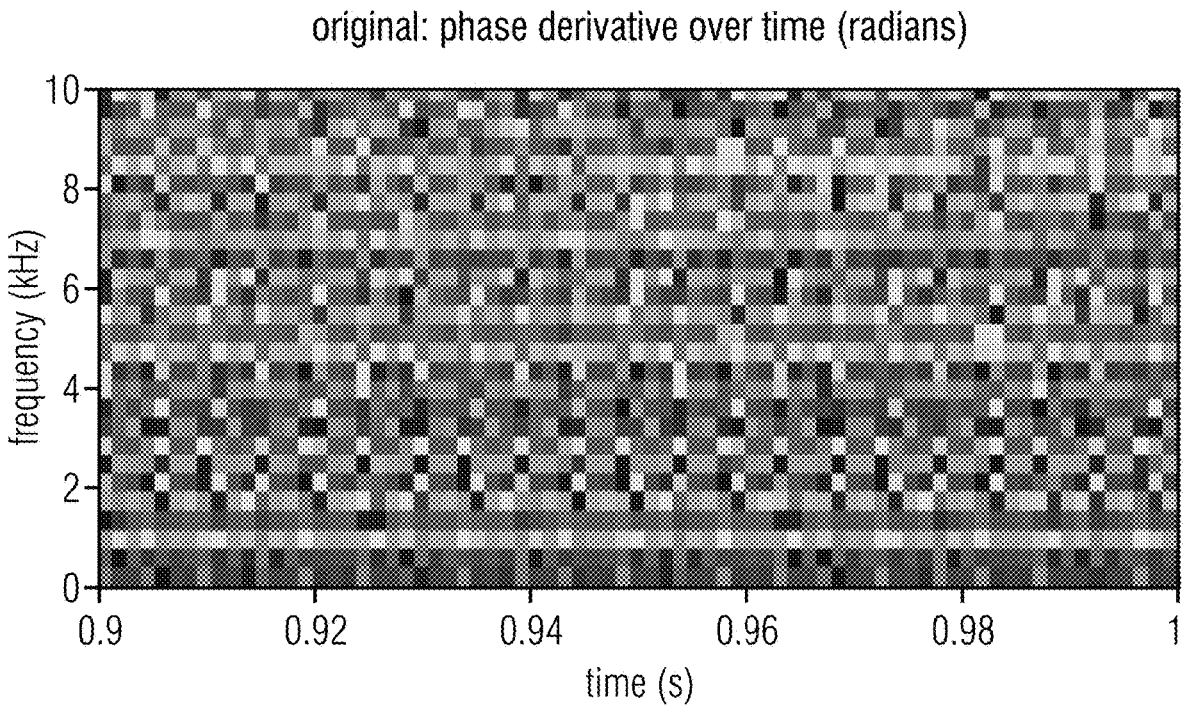
FIG. 12*c* shows the phase derivative over time of the trombone signal in the QMF domain in a time-frequency representation.
Figure 12D:
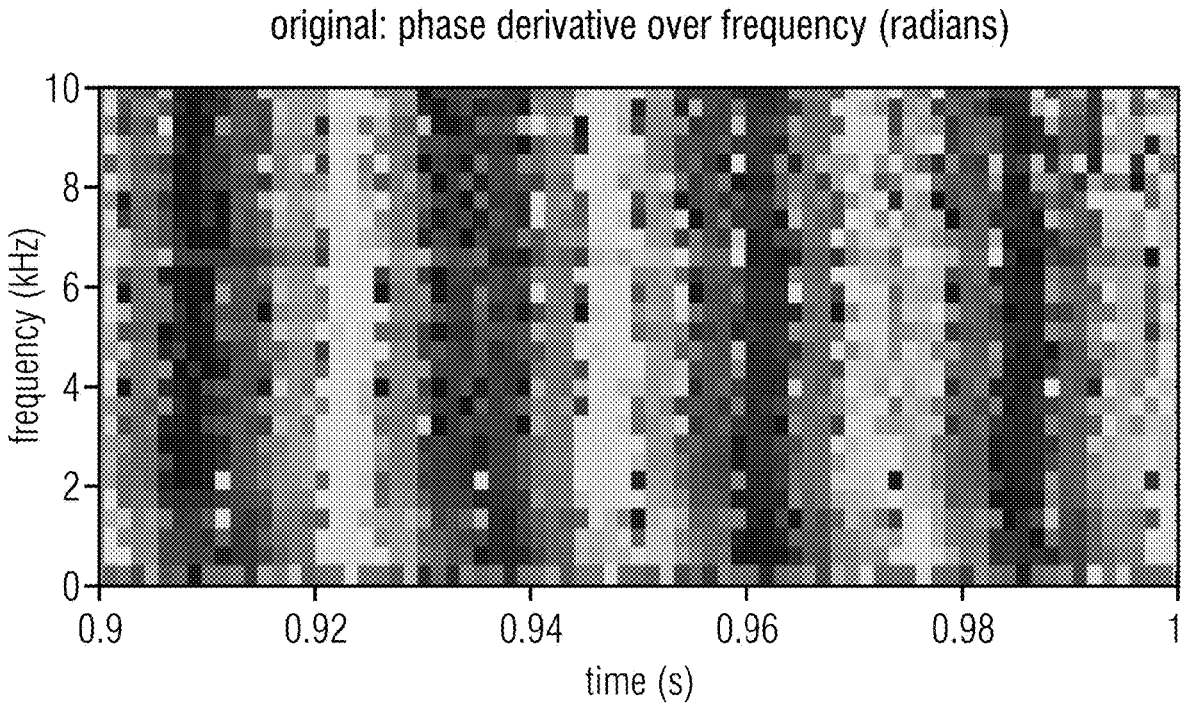
FIG. 12*d* shows the phase derivative over frequency of the corresponding phase derivative over time of FIG. 12*c;*
Figure 13A:
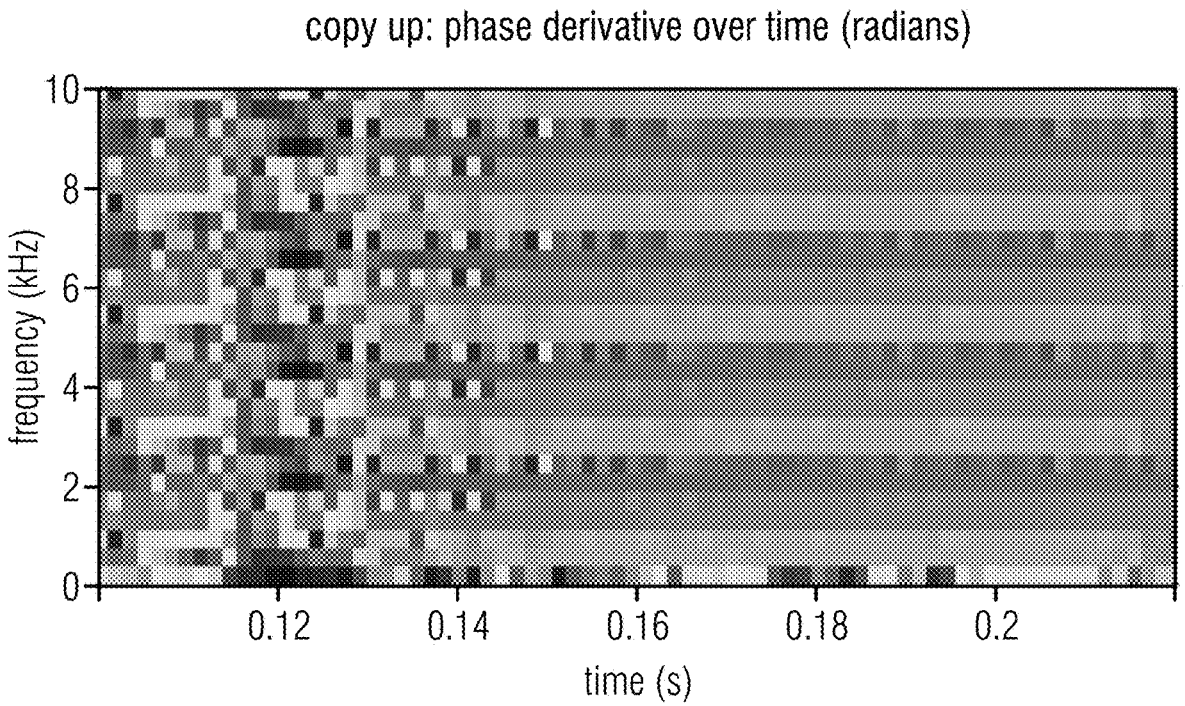
FIG. 13*a* shows the phase derivative over time of the violin signal in the QMF domain using direct copy-up SBR in a time-frequency representation.
Figure 13B:
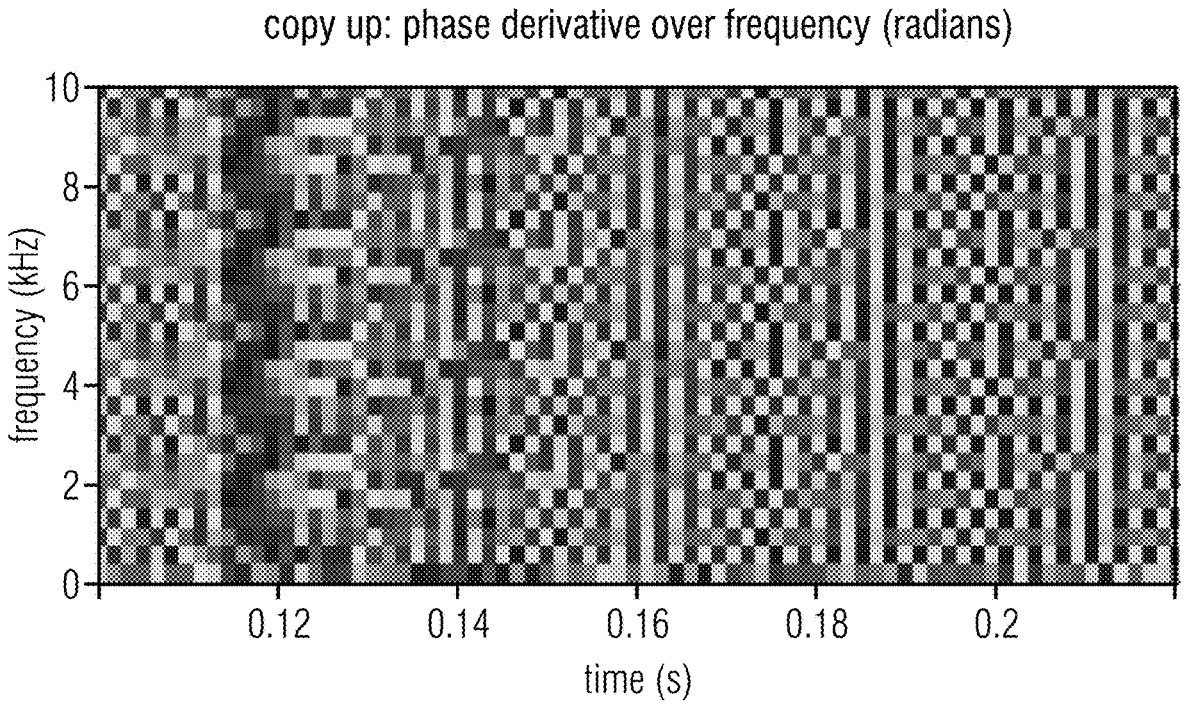
FIG. 13*b* shows the phase derivative over frequency corresponding to the phase derivative over time shown in FIG. 13*a;*
Figure 13C:
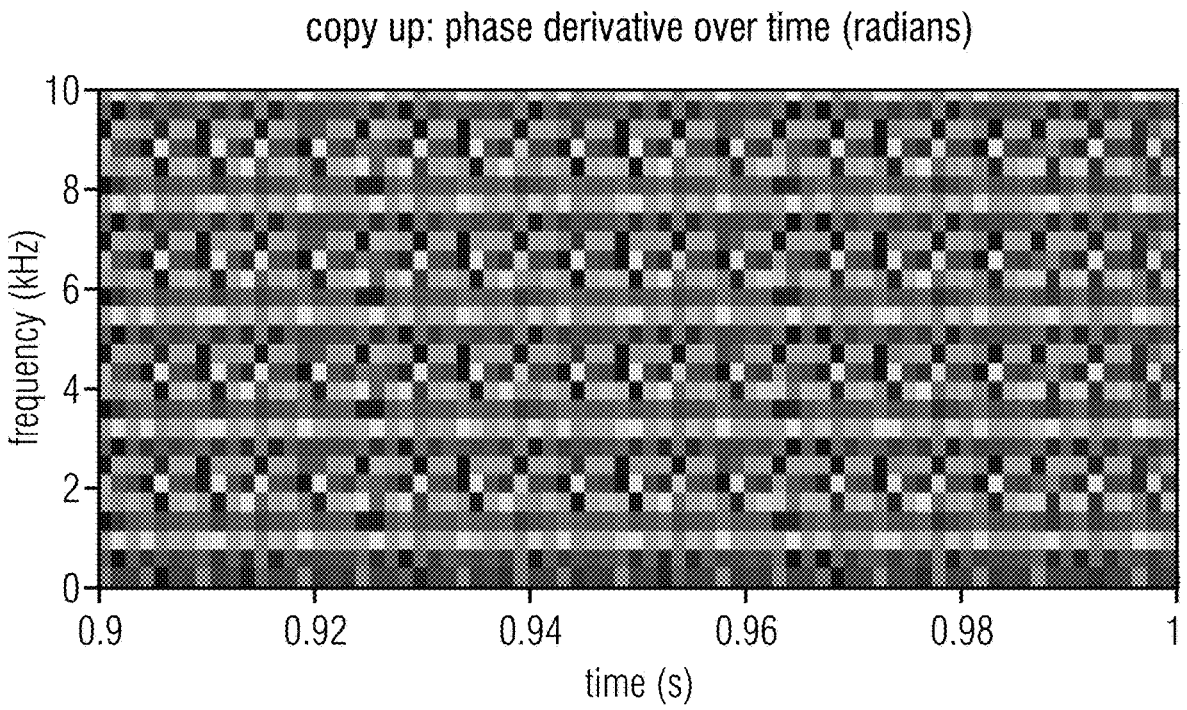
FIG. 13*c* shows the phase derivative over time of the trombone signal in the QMF domain using direct copy-up SBR in a time-frequency representation.
Figure 13D:
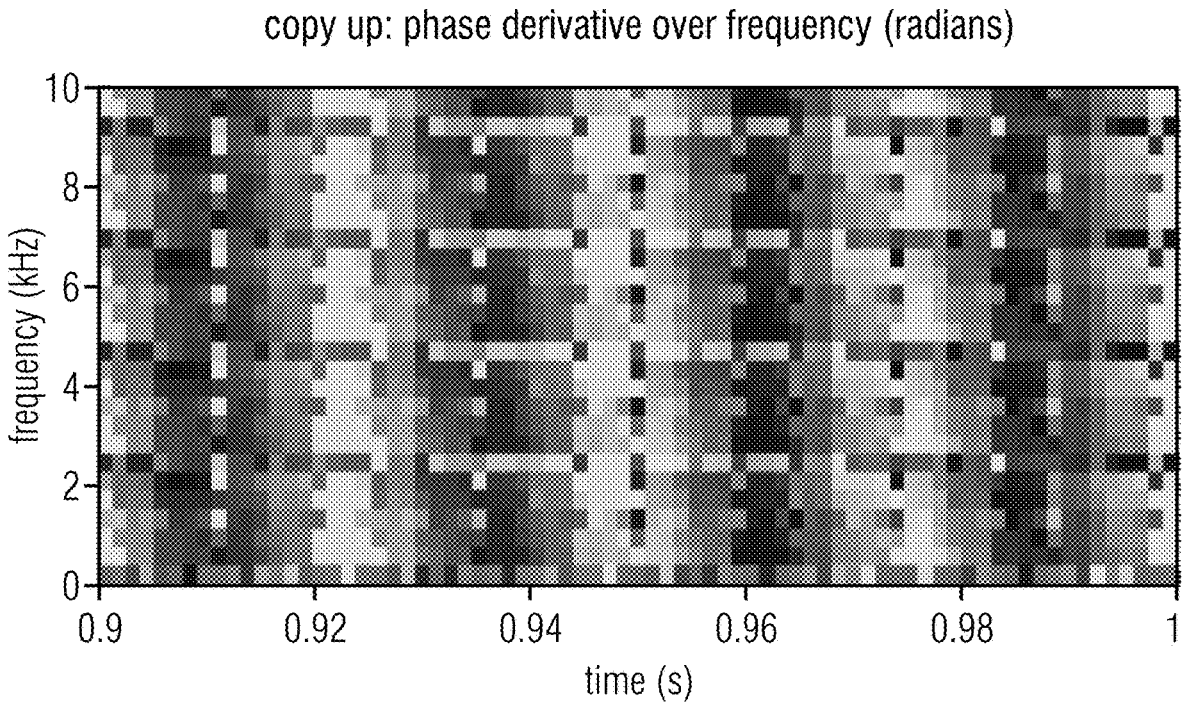
FIG. 13*d* shows the phase derivative over frequency corresponding to the phase derivative over time shown in FIG. 13*c;*

Next it is inspected how these measures look like for our example signals. FIG. 12 shows the derivatives for the violin and the trombone signals. More specifically, FIG. 12*a* shows a phase derivative over time $X^{pdt}(k,n)$ of the original, i.e. non-processed, violin audio signal in the QMF domain. FIG. 12*b* shows a corresponding phase derivative over frequency $X^{pdf}(k,n)$. FIGS. 12*c* and 12*d* show the phase derivative over time and the phase derivative over frequency for a trombone signal, respectively. The color gradient indicates phase values from red=$\pi$ to blue=$-\pi$. For the violin, the magnitude spectrum is basically noise until about 0.13 seconds (see FIG. 1) and hence the derivatives are also noisy. Starting from about 0.13 seconds $X^{pdt}$ appears to have relatively stable values over time. This would mean that the signal contains strong, relatively stable, sinusoids. The frequencies of these sinusoids are determined by the $X^{pdt}$ values. On the contrary, the $X^{pdf}$ plot appears to be relatively noisy, so no relevant data is found for the violin using it.

For the trombone, $X^{pdt}$ is relatively noisy. On the contrary, the $X^{pdf}$ appears to have about the same value at all frequencies. In practice, this means that all the harmonic components are aligned in time producing a transient-like signal. The temporal locations of the transients are determined by the $X^{pdf}$ values.

The same derivatives can also be computed for the SBR-processed signals Z(k,n) (see FIG. 13). FIGS. 13*a* to 13*d* are directly related to FIGS. 12*a* to 12*d*, derived by using the direct copy-up SBR algorithm described previously. As the phase spectrum is simply copied from the baseband to the higher patches, PDTs of the frequency patches are identical to that of the baseband. Thus, for the violin, PDT is relatively smooth over time producing stable sinusoids, as in the case of the original signal. However, the values of $Z^{pdt}$ are different than those with the original signal $X^{pdt}$, which causes that the produced sinusoids have different frequencies than in the original signal. The perceptual effect of this is discussed in Section 7.

Correspondingly, PDF of the frequency patches is otherwise identical to that of the baseband, but at the cross-over frequencies the PDF is, in practice, random. At the cross-over, the PDF is actually computed between the last and the first phase value of the frequency patch, i.e., $$Z^{pdt}(7,n)=Z^{pha}(8,n)-Z^{pha}(7,n)=Y^{pha}(1,n,i)-Y^{pha}(6,n,i) \tag{14}$$

These values depend on the actual PDF and the cross-over frequency, and they do not match with the values of the original signal.

For the trombone, the PDF values of the copied-up signal are correct apart from the cross-over frequencies. Thus, the temporal locations of the most of the harmonics are in the correct places, but the harmonics at the cross-over frequencies are practically at random locations. The perceptual effect of this is discussed in Section 7.

7 Human Perception of Phase Errors

Sounds can roughly be divided into two categories: harmonic and noise-like signals. The noise-like signals have, already by definition, noisy phase properties. Thus, the phase errors caused by SBR are assumed not to be perceptually significant with them. Instead, it is concentrated on harmonic signals. Most of the musical instruments, and also speech, produce harmonic structure to the signal, i.e., the tone contains strong sinusoidal components spaced in frequency by the fundamental frequency.

Human hearing is often assumed to behave as if it contained a bank of overlapping band-pass filters, referred to as the auditory filters. Thus, the hearing can be assumed to handle complex sounds so that the partial sounds inside the auditory filter are analyzed as one entity. The width of these filters can be approximated to follow the equivalent rectangular bandwidth (ERB) [11], which can be determined according to $$\mathrm{ERB}=24.7(4.37f_c+1), \tag{15}$$

where $f_c$ is the center frequency of the band (in kHz). As discussed in Section 4, the cross-over frequency between the baseband and the SBR patches is around 3 kHz. At these frequencies the ERB is about 350 Hz. The bandwidth of a QMF frequency band is actually relatively close to this, 375 Hz. Hence, the bandwidth of the QMF frequency bands can be assumed to follow ERB at the frequencies of interest.

Two properties of a sound that can go wrong due to erroneous phase spectrum were observed in Section 6: the frequency and the timing of a partial component. Concentrate on the frequency, the question is, can human hearing perceive the frequencies of individual harmonics? If it can, then the frequency offset caused by SBR should be corrected, and if not, then correction is not required.

The concept of resolved and unresolved harmonics [12] can be used to clarify this topic. If there is only one harmonic inside the ERB, the harmonic is called resolved. It is typically assumed that the human hearing processes resolved harmonics individually and, thus, is sensitive to the frequency of them. In practice, changing the frequency of resolved harmonics is perceived to cause inharmonicity.

Correspondingly, if there are multiple harmonics inside the ERB, the harmonics are called unresolved. The human hearing is assumed not to process these harmonics individually, but instead, their joint effect is seen by the auditory system. The result is a periodic signal and the length of the period is determined by the spacing of the harmonics. The pitch perception is related to the length of the period, so human hearing is assumed to be sensitive to it. Nevertheless, if all harmonics inside the frequency patch in SBR are shifted by the same amount, the spacing between the harmonics, and thus the perceived pitch, remains the same. Hence, in the case of unresolved harmonics, human hearing does not perceive frequency offsets as inharmonicity.

Timing-related errors caused by SBR are considered next. By timing the temporal position, or the phase, of a harmonic component is meant. This should not be confused with the phase of a QMF bin. The perception of timing-related errors was studied in detail in [13]. It was observed that for the most of the signals human hearing is not sensitive to the timing, or the phase, of the harmonic components. However, there are certain signals with which the human hearing is very sensitive to the timing of the partials. The signals include, for example, trombone and trumpet sounds and speech. With these signals, a certain phase angle takes place at the same time instant with all harmonics. Neural firing rate of different auditory bands were simulated in [13]. It was found out that with these phase-sensitive signals the produced neural firing rate is peaky at all auditory bands and that the peaks are aligned in time. Changing the phase of even a single harmonic can change the peakedness of the neural firing rate with these signals. According to the results of the formal listening test, human hearing is sensitive to this [13]. The produced effects are the perception of an added sinusoidal component or a narrowband noise at the frequencies where the phase was modified.

In addition, it was found out that the sensitivity to the timing-related effects depends on the fundamental frequency of the harmonic tone [13]. The lower the fundamental frequency, the larger are the perceived effects. If the fundamental frequency is above about 800 Hz, the auditory system is not sensitive at all to the timing-related effects.

Thus, if the fundamental frequency is low and if the phase of the harmonics is aligned over frequency (which means that the temporal positions of the harmonics are aligned), changes in the timing, or in other words the phase, of the harmonics can be perceived by the human hearing. If the fundamental frequency is high and/or the phase of the harmonics is not aligned over frequency, the human hearing is not sensitive to changes in the timing of the harmonics.

8 Correction Methods

In Section 7, it was noted that humans are sensitive to errors in the frequencies of resolved harmonics. In addition, humans are sensitive to errors in the temporal positions of the harmonics if the fundamental frequency is low and if the harmonics are aligned over frequency. SBR can cause both of these errors, as discussed in Section 6, so the perceived quality can be improved by correcting them. Methods for doing so are suggested in this section.

Figure 14A:
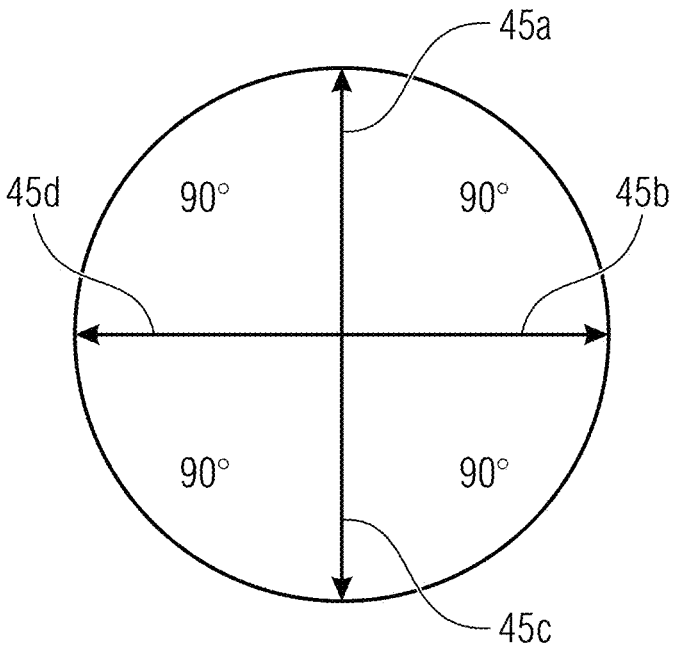
FIG. 14*a* shows schematically four phases of, e.g. subsequent time frames or frequency subbands, in a unit circle.
Figure 14B:
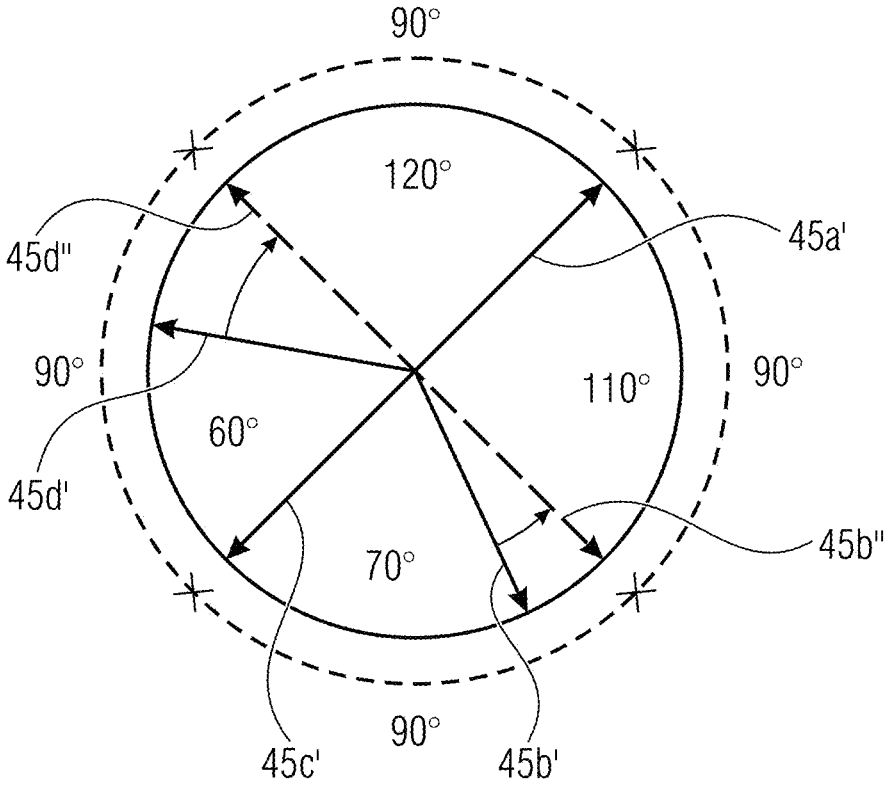
FIG. 14*b* shows the phases illustrated in FIG. 14*a* after SBR processing and, in dashed lines, the corrected phases.

FIG. 14 schematically illustrates the basic idea of the correction methods. FIG. 14*a* shows schematically four phases 45*a-d* of, e.g. subsequent time frames or frequency subbands, in a unit circle. The phases 45*a-d* are spaced equally by 90°. FIG. 14*b* shows the phases after SBR processing and, in dashed lines, the corrected phases. The phase 45*a* before processing may be shifted to the phase angle 45*a*'. The same applies to the phases 45*b* to 45*d*. It is shown that the difference between the phases after processing, i.e. the phase derivative, may be corrupted after SBR processing. For example, the difference between the phases 45*a*' and 45*b*' is 110° after SBR processing, which was 90° before processing. The correction methods will change the phase values 45*b*' to the new phase value 45*b*" to retrieve the old phase derivative of 90°. The same correction is applied to the phases of 45*d*' and 45*d*".

8.1 Correcting Frequency Errors—Horizontal Phase Derivative Correction

As discussed in Section 7, humans can perceive an error in the frequency of a harmonic mostly when there is only one harmonic inside one ERB. Furthermore, the bandwidth of a QMF frequency band can be used to estimate ERB at the first cross over. Hence, the frequency has to be corrected only when there is one harmonic inside one frequency band. This is very convenient, since Section 5 showed that, if there is one harmonic per band, the produced PDT values are stable, or slowly changing over time, and can potentially be corrected using low bit rate.

Figure 15:
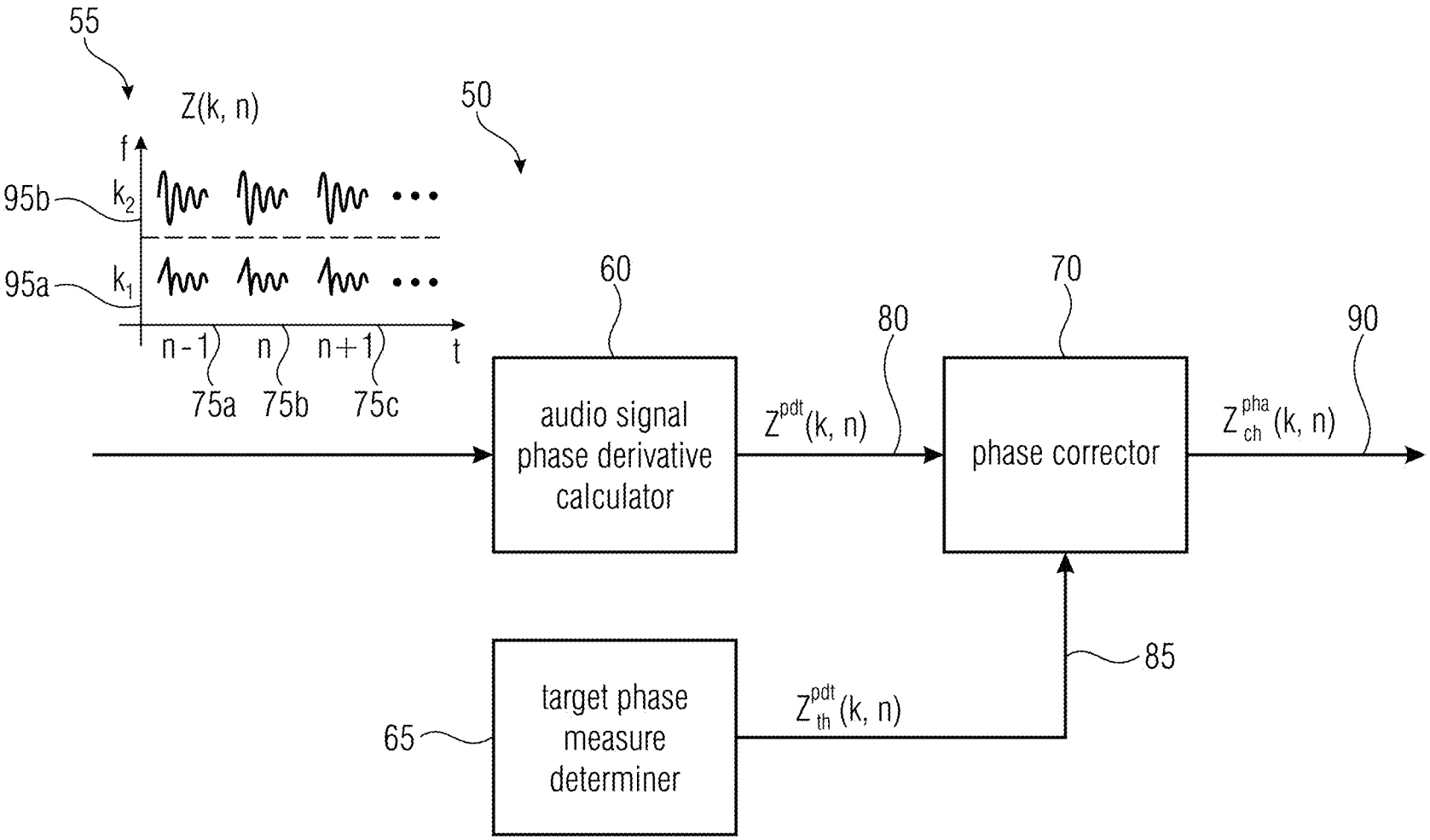
FIG. 15 shows a schematic block diagram of an audio processor 50.
Figure 16:
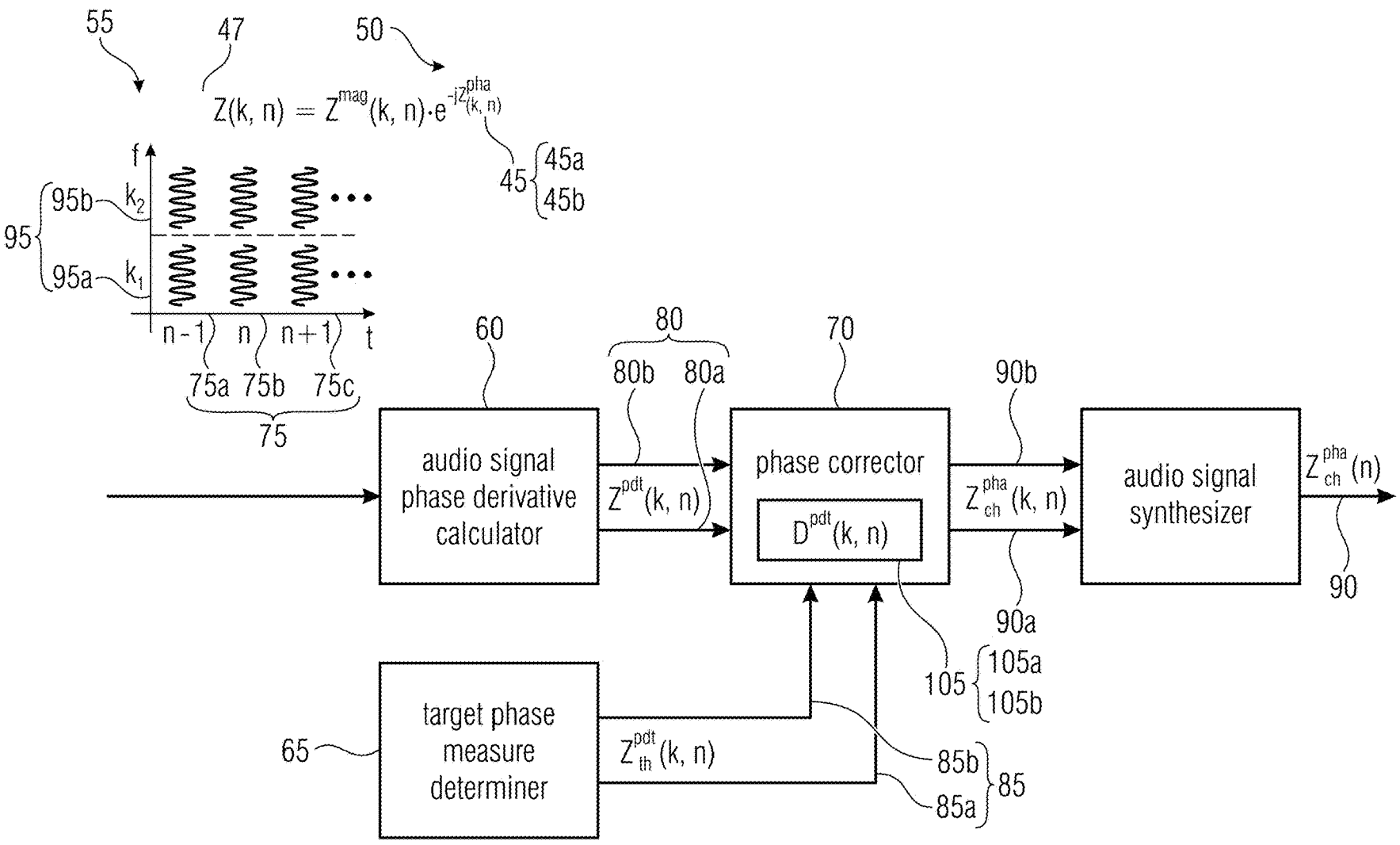
FIG. 16 shows the audio processor in a schematic block diagram according to a further embodiment.

FIG. 15 shows an audio processor 50 for processing an audio signal 55. The audio processor 50 comprises an audio signal phase measure calculator 60, a target phase measure determiner 65 and a phase corrector 70. The audio signal phase measure calculator 60 is configured for calculating a phase measure 80 of the audio signal 55 for a time frame 75. The target phase measure determiner 65 is configured for determining a target phase measure 85 for said time frame 75. Furthermore, the phase corrector is configured for correcting phases 45 of the audio signal 55 for the time frame 75 using the calculated phase measure 80 and the target phase measure 85 to obtain a processed audio signal 90. Optionally, the audio signal 55 comprises a plurality of subband signals 95 for the time frame 75. Further embodiments of the audio processor 50 are described with respect to FIG. 16. According to an embodiment, the target phase measure determiner 65 is configured for determining a first target phase measure 85*a* and a second target phase measure 85*b* for a second subband signal 95*b*. Accordingly, the audio signal phase measure calculator 60 is configured for determining a first phase measure 80*a* for the first subband signal 95*a* and a second phase measure 80*b* for the second subband signal 95*b*. The phase corrector is configured for correcting a phase 45*a* of the first subband signal 95*a* using the first phase measure 80*a* of the audio signal 55 and the first target phase measure 85*a* and to correct a second phase 45*b* of the second subband signal 95*b* using the second phase measure 80*b* of the audio signal 55 and the second target phase measure 85*b*. Furthermore, the audio processor 50 comprises an audio signal synthesizer 100 for synthesizing the processed audio signal 90 using the processed first subband signal 95*a* and the processed second subband signal 95*b*. According to further embodiments, the phase measure 80 is a phase derivative over time. Therefore, the audio signal phase measure calculator 60 may calculate, for each subband 95 of a plurality of subbands, the phase derivative of a phase value 45 of a current time frame 75*b* and a phase value of a future time frame 75*c*. Accordingly, the phase corrector 70 can calculate, for each subband 95 of the plurality of subbands of the current time frame 75*b*, a deviation between the target phase derivative 85 and the phase derivative over time 80, wherein a correction performed by the phase corrector 70 is performed using the deviation.

Embodiments show the phase corrector 70 being configured for correcting subband signals 95 of different subbands of the audio signal 55 within the time frame 75, so that frequencies of corrected subband signals 95 have frequency values being harmonically allocated to a fundamental frequency of the audio signal 55. The fundamental frequency is the lowest frequency occurring in the audio signal 55, or in other words, the first harmonics of the audio signal 55.

Furthermore, the phase corrector 70 is configured for smoothing the deviation 105 for each subband 95 of the plurality of subbands over a previous time frame, the current time frame, and a future time frame 75*a* to 75*c* and is configured for reducing rapid changes of the deviation 105 within a subband 95. According to further embodiments, the smoothing is a weighted mean, wherein the phase corrector 70 is configured for calculating the weighted mean over the previous, the current and the future time frames 75*a* to 75*c*, weighted by a magnitude of the audio signal 55 in the previous, the current and the future time frame 75*a* to 75*c*.

Embodiments show the previously described processing steps vector based. Therefore, the phase corrector 70 is configured for forming a vector of deviations 105, wherein a first element of the vector refers to a first deviation 105*a* for the first subband 95*a* of the plurality of subbands and a second element of the vector refers to a second deviation 105*b* for the second subband 95*b* of the plurality of subbands from a previous time frame 75*a* to a current time frame 75*b*. Furthermore, the phase corrector 70 can apply the vector of deviations 105 to the phases 45 of the audio signal 55, wherein the first element of the vector is applied to a phase 45*a* of the audio signal 55 in a first subband 95*a* of a plurality of subbands of the audio signal 55 and the second element of the vector is applied to a phase 45*b* of the audio signal 55 in a second subband 95*b* of the plurality of subbands of the audio signal 55.

From another point of view, it can be stated that the whole processing in the audio processor 50 is vector-based, wherein each vector represents a time frame 75, wherein each subband 95 of the plurality of subband comprises an element of the vector. Further embodiments focus on the target phase measure determiner which is configured for obtaining a fundamental frequency estimate 85*b* for a current time frame 75*b*, wherein the target phase measure determiner 65 is configured for calculating a frequency estimate 85 for each subband of the plurality of subbands for the time frame 75 using the fundamental frequency estimate 85 for the time frame 75. Furthermore, the target phase measure determiner 65 may convert the frequency estimates 85 for each subband 95 of the plurality of subbands into a phase derivative over time using a total number of subbands 95 and a sampling frequency of the audio signal 55. For clarification it has to be noted that the output 85 of the target phase measure determiner 65 may be either the frequency estimate or the phase derivative over time, depending on the embodiment. Therefore, in one embodiment the frequency estimate already comprises the right format for further processing in the phase corrector 70, wherein in another embodiment the frequency estimate has to be converted into a suitable format, which may be a phase derivative over time.

Accordingly, the target phase measure determiner 65 may be seen as vector based as well. Therefore, the target phase measure determiner 65 can form a vector of frequency estimates 85 for each subband 95 of the plurality of subbands, wherein the first element of the vector refers to a frequency estimate 85*a* for a first subband 95*a* and a second element of the vector refers to a frequency estimate 85*b* for a second subband 95*b*. Additionally, the target phase measure determiner 65 can calculate the frequency estimate 85 using multiples of the fundamental frequency, wherein the frequency estimate 85 of the current subband 95 is that multiple of the fundamental frequency which is closest to the center of the subband 95, or wherein the frequency estimate 85 of the current subband is a border frequency of the current subband 95 if none of the multiples of the fundamental frequency are within the current subband 95.

In other words, the suggested algorithm for correcting the errors in the frequencies of the harmonics using the audio processor 50 functions as follows. First, the PDT is computed and the SBR processed signal $Z^{pdt}$. $Z^{pdt}(k,n)=Z^{pha}(k,n+1)-Z^{pha}(k,n)$. The difference between it and a target PDT for the horizontal correction is computed next:

$$D^{pdt}(k,n)=Z^{pdt}(k,n)+Z_{th}^{pdt}(k,n). \tag{16a}$$

At this point the target PDT can be assumed to be equal to the PDT of the input of the input signal $$Z_{th}^{pdt}(k,n)=X^{pdt}(k,n). \tag{16b}$$

Later it will be presented how the target PDT can be obtained with a low bit rate.

Figure 17:
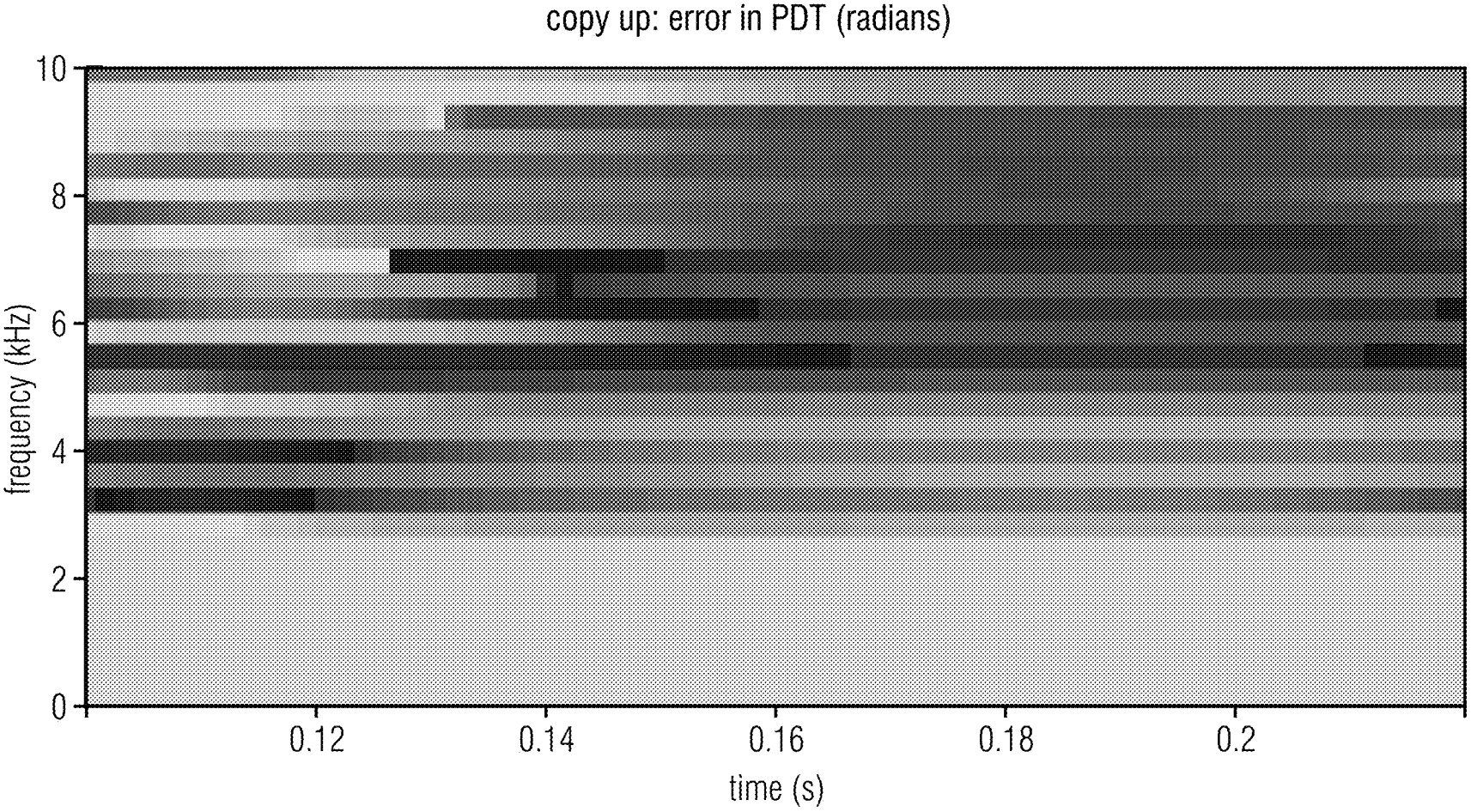
FIG. 17 shows a smoothened error in the PDT of the violin signal in the QMF domain using direct copy-up SBR in a time-frequency representation.

This value (i.e. the error value 105) is smoothened over time using a Hann window W(l). Suitable length is, for example, 41 samples in the QMF domain (corresponding to an interval of 55 ms). The smoothing is weighted by the magnitude of the corresponding time-frequency tiles $$D_{sm}^{pdt}(k,n)=\text{circmean}\{D^{pdt}(k,n+l),W(l)Z^{mag}(k,n+l)\},-20\le l\le 20, \tag{17}$$

where circmean {a, b} denotes computing the circular mean for angular values a weighted by values b. The smoothened error in the PDT $D_{sm}^{pdt}(k,n)$ is depicted in FIG. 17 for the violin signal in the QMF domain using direct copy-up SBR. The color gradient indicates phase values from red=π to blue=−π.

Next, a modulator matrix is created for modifying the phase spectrum in order to obtain the desired PDT $$Q^{pha}(k,n+1)=Q^{pha}(k,n)-D_{sm}^{pdt}(k,n). \tag{18}$$

The phase spectrum is processed using this matrix $$Z_{ch}^{pha}(k,n)=Z^{pha}(k,n)+Q^{pha}(k,n). \tag{19}$$

Figure 18A:
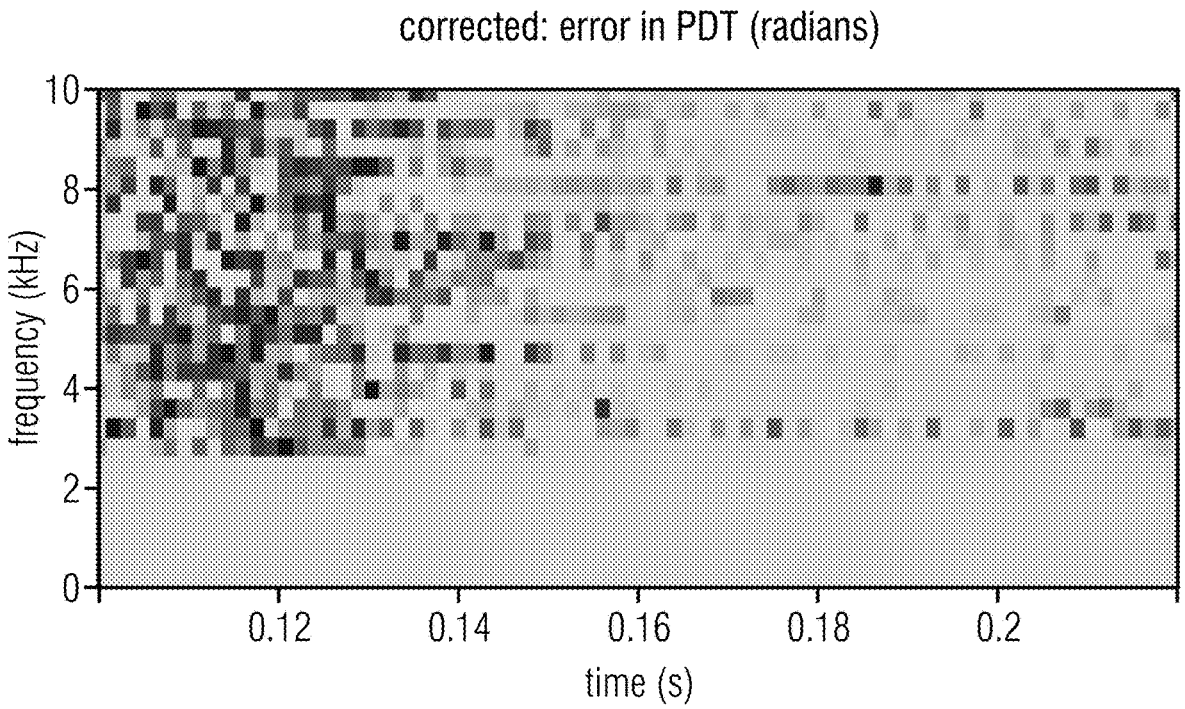
FIG. 18*a* shows an error in the PDT of the violin signal in the QMF domain for the corrected SBR in a time-frequency representation.
Figure 18B:
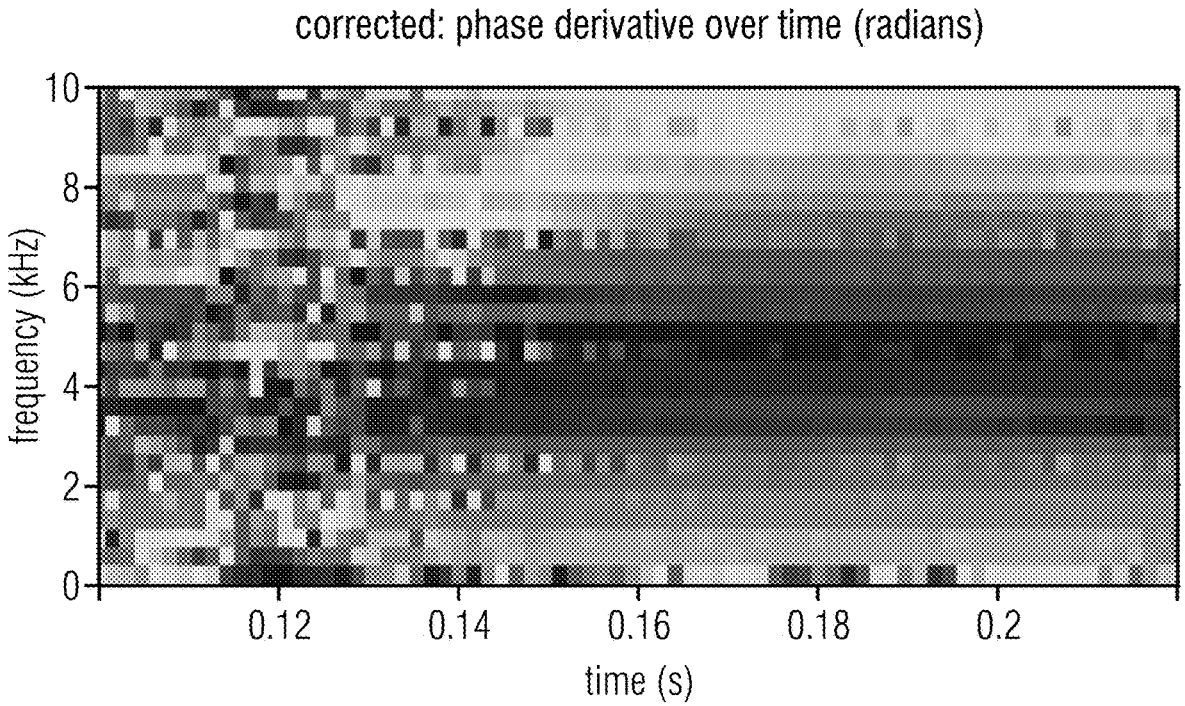
FIG. 18*b* shows the phase derivative over time corresponding to the error shown in FIG. 18*a;*

FIG. 18*a* shows the error in the phase derivative over time (PDT) $D_{sm}^{pdt}(k,n)$ of the violin signal in the QMF domain for the corrected SBR. FIG. 18*b* shows the corresponding phase derivative over time $Z_{ch}^{pdt}(k,n)$, wherein the error in the PDT shown in FIG. 18*a* was derived by comparing the results presented in FIG. 12*a* with the results presented in FIG. 18*b*. Again, the color gradient indicates phase values from red=π to blue=−π. The PDT is computed for the corrected phase spectrum $Z_{ch}^{pha}(k,n)$ (see FIG. 18*b*). It can be seen that the PDT of the corrected phase spectrum reminds the PDT of the original signal well (see FIG. 12), and the error is small for time-frequency tiles containing significant energy (see FIG. 18*a*). It can be noticed that the inharmonicity of the non-corrected SBR data is largely gone. Furthermore, the algorithm does not seem to cause significant artifacts.

Using $X^{pdt}(k,n)$ as a target PDT, it is likely to transmit the PDT-error values $D_{sm}^{pdt}(k,n)$ for each time-frequency tile. A further approach calculating the target PDT such that the bandwidth for transmission is reduced is shown in section 9.

Figure 19:
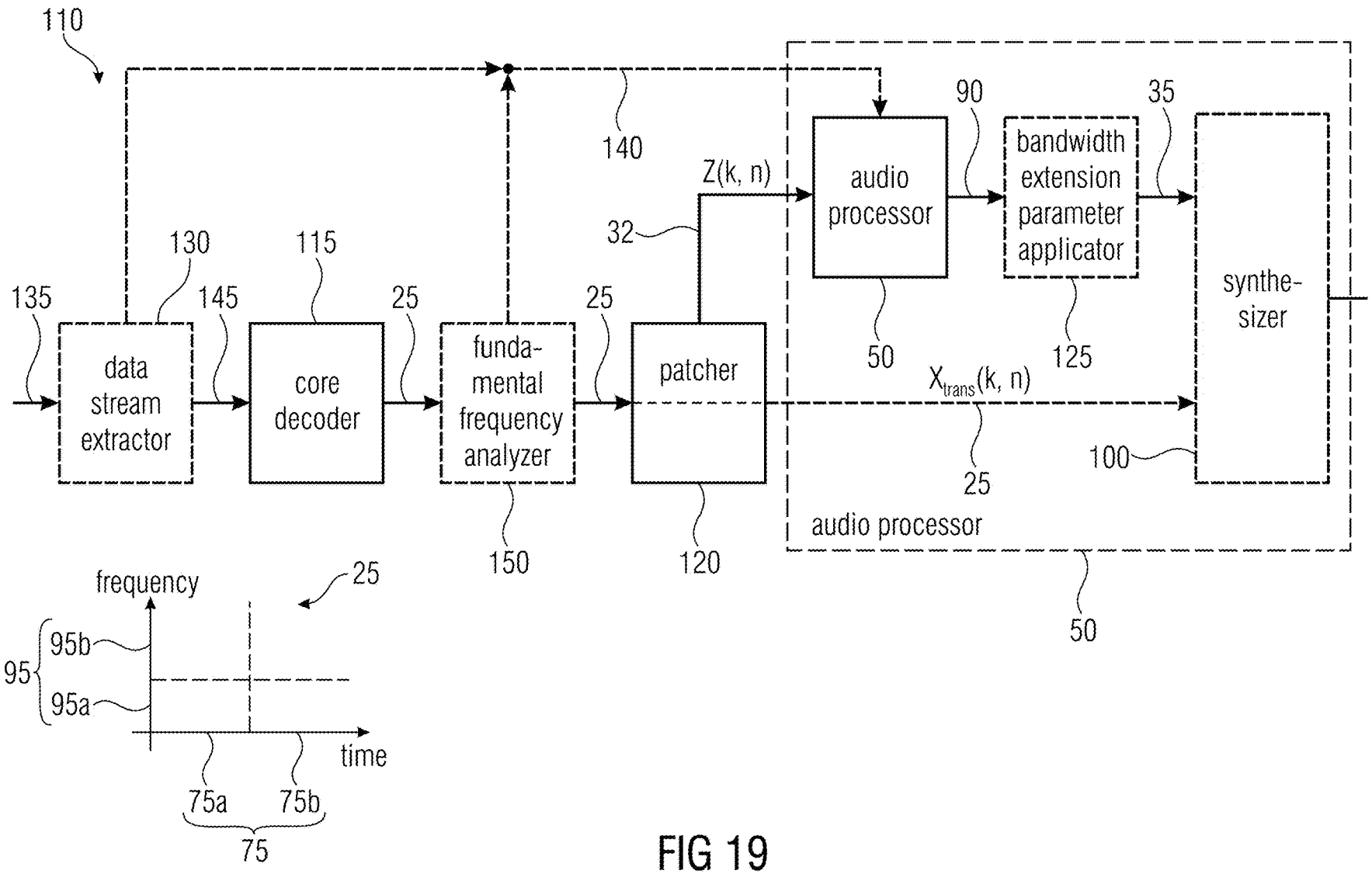
FIG. 19 shows a schematic block diagram of a decoder.

In further embodiments, the audio processor 50 may be part of a decoder 110. Therefore, the decoder 110 for decoding an audio signal 55 may comprise the audio processor 50, a core decoder 115, and a patcher 120. The core decoder 115 is configured for core decoding an audio signal 25 in a time frame 75 with a reduced number of subbands with respect to the audio signal 55. The patcher patches a set of subbands 95 of the core decoded audio signal 25 with a reduced number of subbands, wherein the set of subbands forms a first patch 30*a*, to further subbands in the time frame 75, adjacent to the reduced number of subbands, to obtain an audio signal 55 with a regular number of subbands. Additionally, the audio processor 50 is configured for correcting the phases 45 within the subbands of the first patch 30*a* according to a target function 85. The audio processor 50 and the audio signal 55 have been described with respect to FIGS. 15 and 16, where the reference signs not depicted in FIG. 19 are explained. The audio processor according to the embodiments performs the phase correction. Depending on the embodiments, the audio processor may further comprise a magnitude correction of the audio signal by a bandwidth extension parameter applicator 125 applying BWE or SBR parameters to the patches. Furthermore, the audio processor may comprise the synthesizer 100, e.g. a synthesis filter bank, for combining, i.e. synthesizing, the subbands of the audio signal to obtain a regular audio file.

According to further embodiments, the patcher 120 is configured for patching a set of subbands 95 of the audio signal 25, wherein the set of subbands forms a second patch, to further subbands of the time frame, adjacent to the first patch and wherein the audio processor 50 is configured for correcting the phase 45 within the subbands of the second patch. Alternatively, the patcher 120 is configured for patching the corrected first patch to further subbands of the time frame, adjacent to the first patch.

In other words, in the first option the patcher builds an audio signal with a regular number of subbands from the transmitted part of the audio signal and thereafter the phases of each patch of the audio signal are corrected. The second option first corrects the phases of the first patch with respect to the transmitted part of the audio signal and thereafter builds the audio signal with the regular number of subbands with the already corrected first patch.

Further embodiments show the decoder 110 comprising a data stream extractor 130 configured for extracting a fundamental frequency 114 of the current time frame 75 of the audio signal 55 from a data stream 135, wherein the data stream further comprises the encoded audio signal 145 with a reduced number of subbands. Alternatively, the decoder may comprise a fundamental frequency analyzer 150 configured for analyzing the core decoded audio signal 25 in order to calculate the fundamental frequency 140. In other words, options for deriving the fundamental frequency 140 are for example an analysis of the audio signal in the decoder or in the encoder, wherein in the latter case the fundamental frequency may be more accurate at the cost of a higher data rate, since the value has to be transmitted from the encoder to the decoder.

Figure 20:
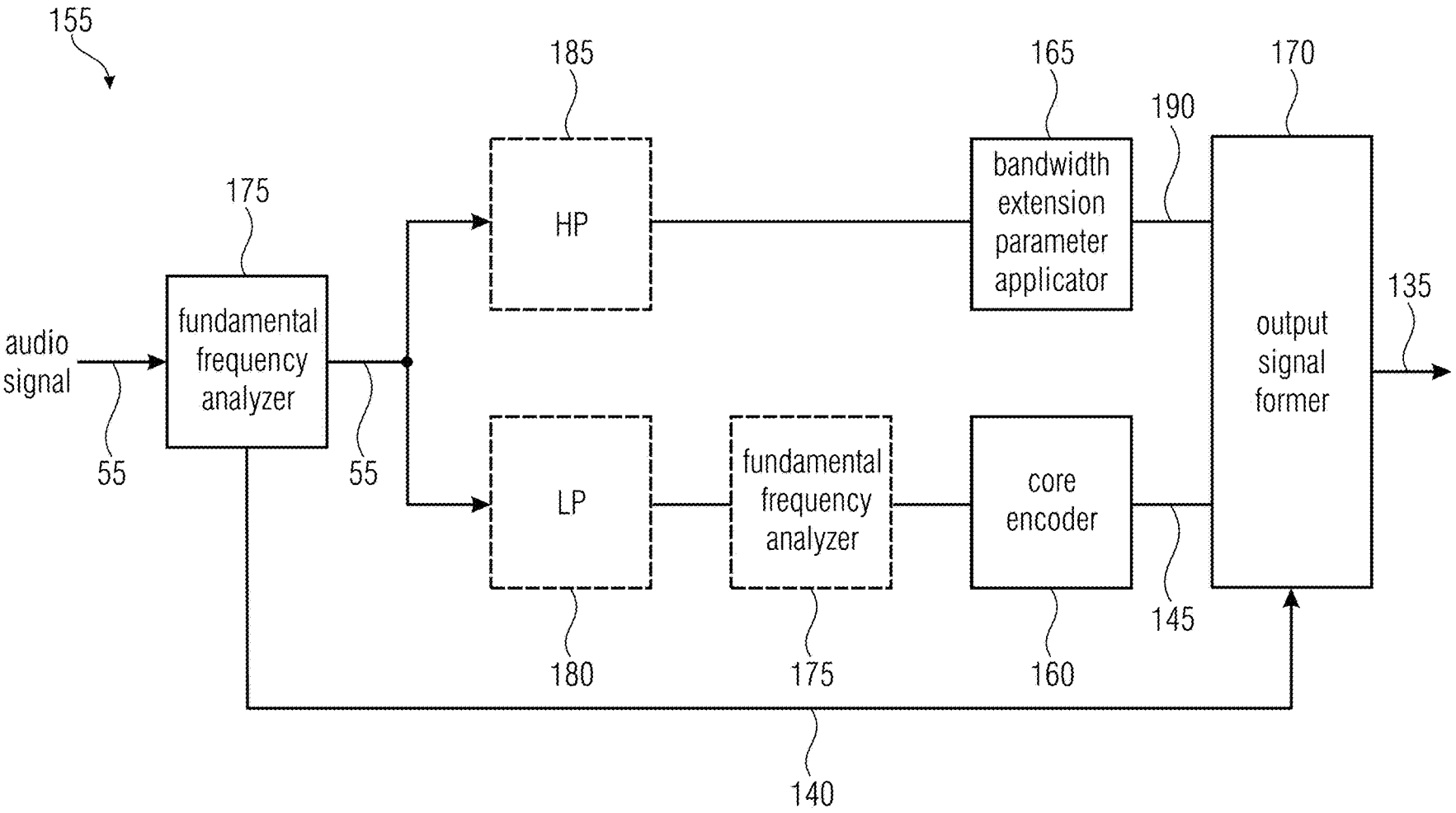
FIG. 20 shows a schematic block diagram of an encoder.

FIG. 20 shows an encoder 155 for encoding the audio signal 55. The encoder comprises a core encoder 160 for core encoding the audio signal 55 to obtain a core encoded audio signal 145 having a reduced number of subbands with respect to the audio signal and the encoder comprises a fundamental frequency analyzer 175 for analyzing the audio signal 55 or a low pass filtered version of the audio signal 55 for obtaining a fundamental frequency estimate of the audio signal. Furthermore, the encoder comprises a parameter extractor 165 for extracting parameters of subbands of the audio signal 55 not included in the core encoded audio signal 145 and the encoder comprises an output signal former 170 for forming an output signal 135 comprising the core encoded audio signal 145, the parameters and the fundamental frequency estimate. In this embodiment, the encoder 155 may comprise a low pass filter in front of the core decoder 160 and a high pass filter 185 in front of the parameter extractor 165. According to further embodiments, the output signal former 170 is configured for forming the output the signal 135 into a sequence of frames, wherein each frame comprises the core encoded signal 145, the parameters 190, and wherein only each n-th frame comprising the fundamental frequency estimate 140, wherein n 2. In embodiments, the core encoder 160 may be, for example an AAC (Advanced Audio Coding) encoder.

In an alternative embodiment an intelligent gap filling encoder may be used for encoding the audio signal 55. Therefore, the core encoder encodes a full bandwidth audio signal, wherein at least one subband of the audio signal is left out. Therefore, the parameter extractor 165 extracts parameters for reconstructing the subbands being left out from the encoding process of the core encoder 160.

Figure 21:
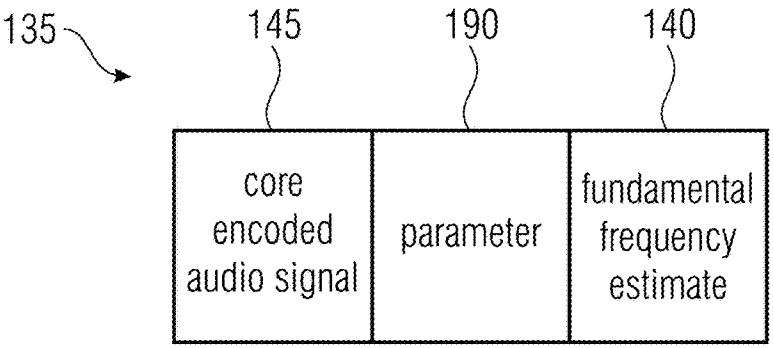
FIG. 21 shows a schematic block diagram of a data stream which may be an audio signal.

FIG. 21 shows a schematic illustration of the output signal 135. The output signal is an audio signal comprising a core encoded audio signal 145 having a reduced number of subbands with respect to the original audio signal 55, a parameter 190 representing subbands of the audio signal not included in the core encoded audio signal 145, and a fundamental frequency estimate 140 of the audio signal 135 or the original audio signal 55.

Figure 22:
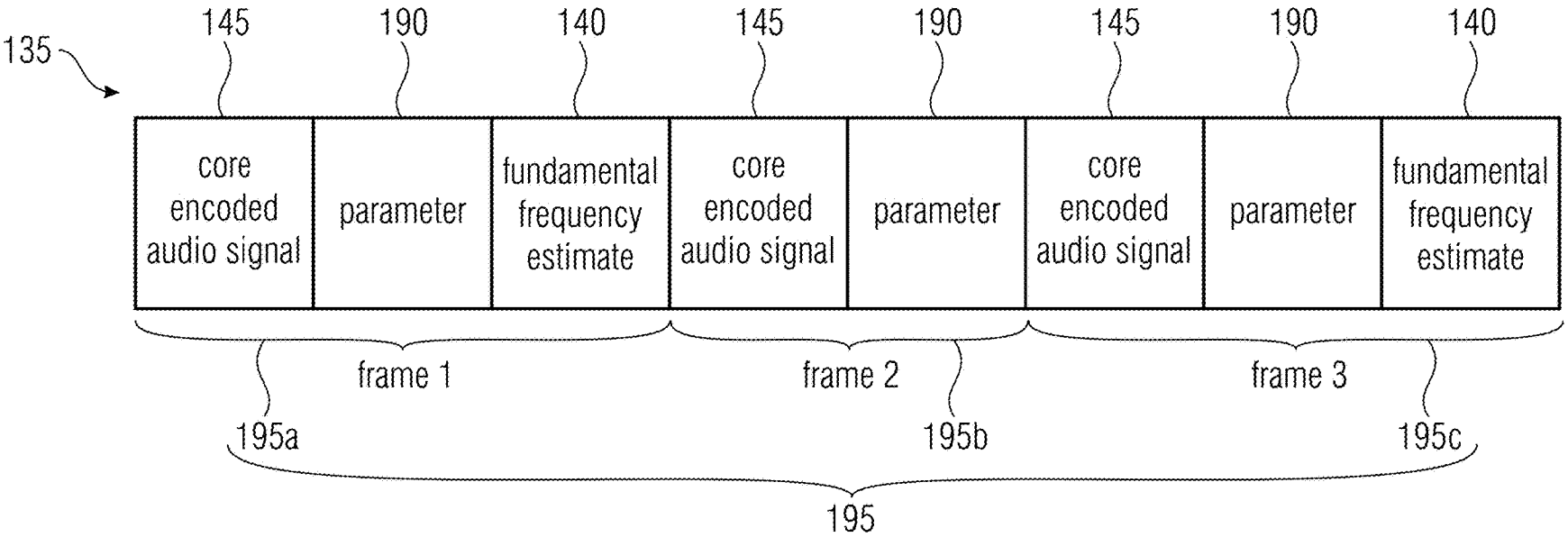
FIG. 22 shows the data stream of FIG. 21 according to a further embodiment.

FIG. 22 shows an embodiment of the audio signal 135, wherein the audio signal is formed into a sequence of frames 195, wherein each frame 195 comprises the core encoded audio signal 145, the parameters 190, and wherein only each n-th frame 195 comprises the fundamental frequency estimate 140, wherein n≥2. This may describe an equally spaced fundamental frequency estimate transmission for e.g. every $20^{th}$ frame, or wherein the fundamental frequency estimate is transmitted irregularly, e.g. on demand or on purpose.

Figure 23:
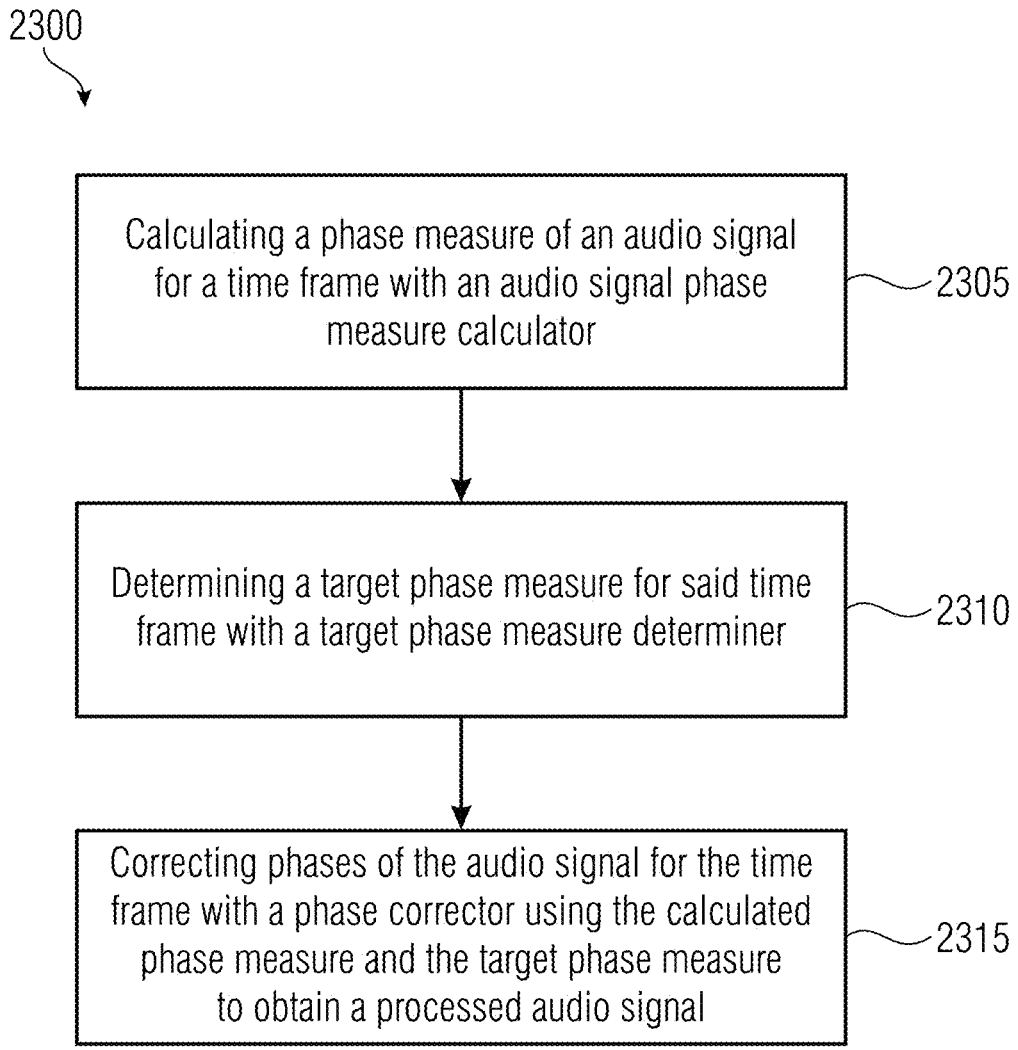
FIG. 23 shows a schematic block diagram of a method for processing an audio signal.

FIG. 23 shows a method 2300 for processing an audio signal with a step 2305 "calculating a phase measure of an audio signal for a time frame with an audio signal phase derivative calculator", a step 2310 "determining a target phase measure for said time frame with a target phase derivative determiner", and a step 2315 "correcting phases of the audio signal for the time frame with a phase corrector using the calculating phase measure and the target phase measure to obtain a processed audio signal".

Figure 24:
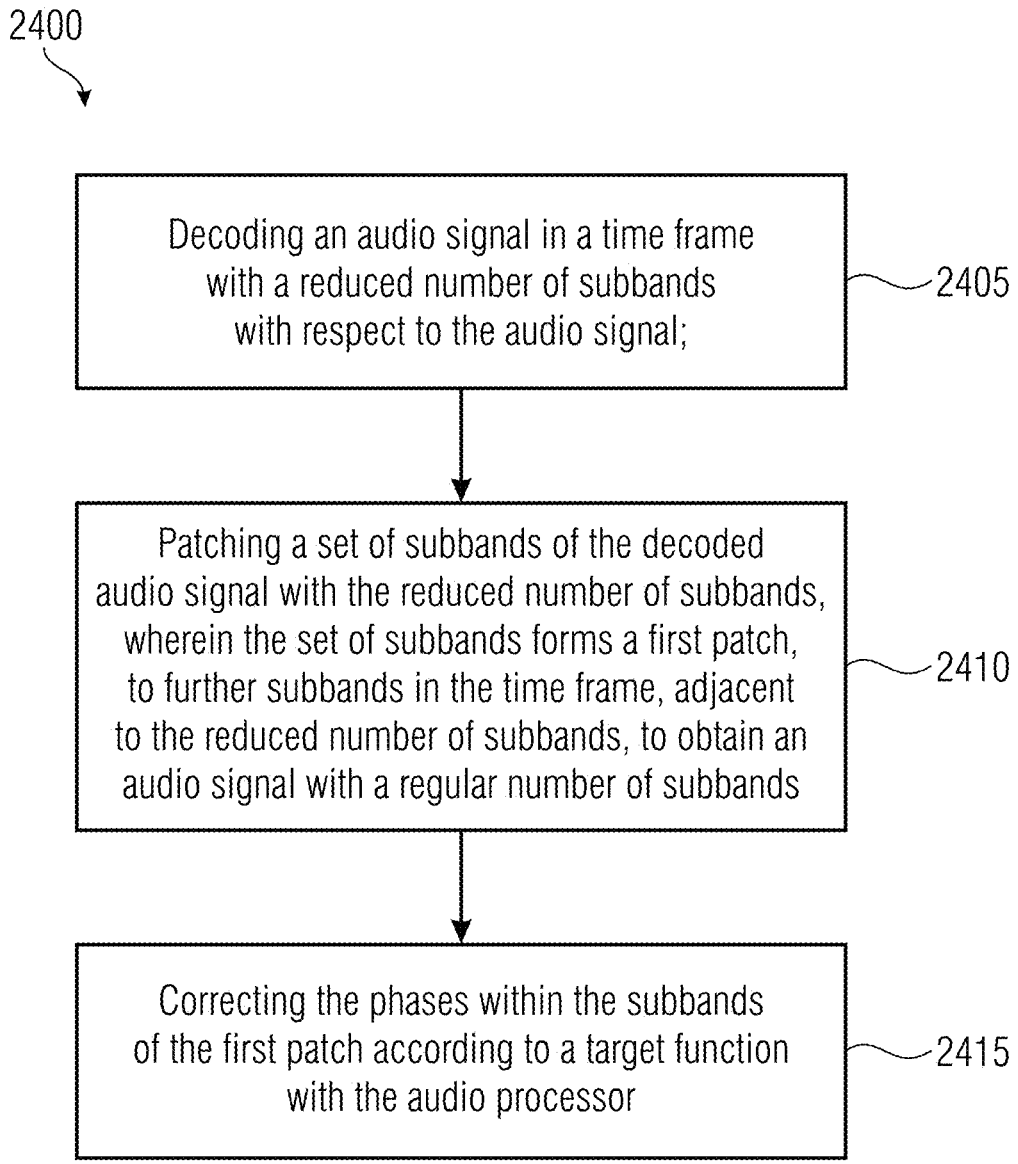
FIG. 24 shows a schematic block diagram of a method for decoding an audio signal.

FIG. 24 shows a method 2400 for decoding an audio signal with a step 2405 "decoding an audio signal in a time frame with the reduced number of subbands with respect to the audio signal", a step 2410 "patching a set of subbands of the decoded audio signal with the reduced number of subbands, wherein the set of subbands forms a first patch, to further subbands in the time frame, adjacent to the reduced number of subbands, to obtain an audio signal with a regular number of subbands", and a step 2415 "correcting the phases within the subbands of the first patch according to a target function with the audio process".

Figure 25:
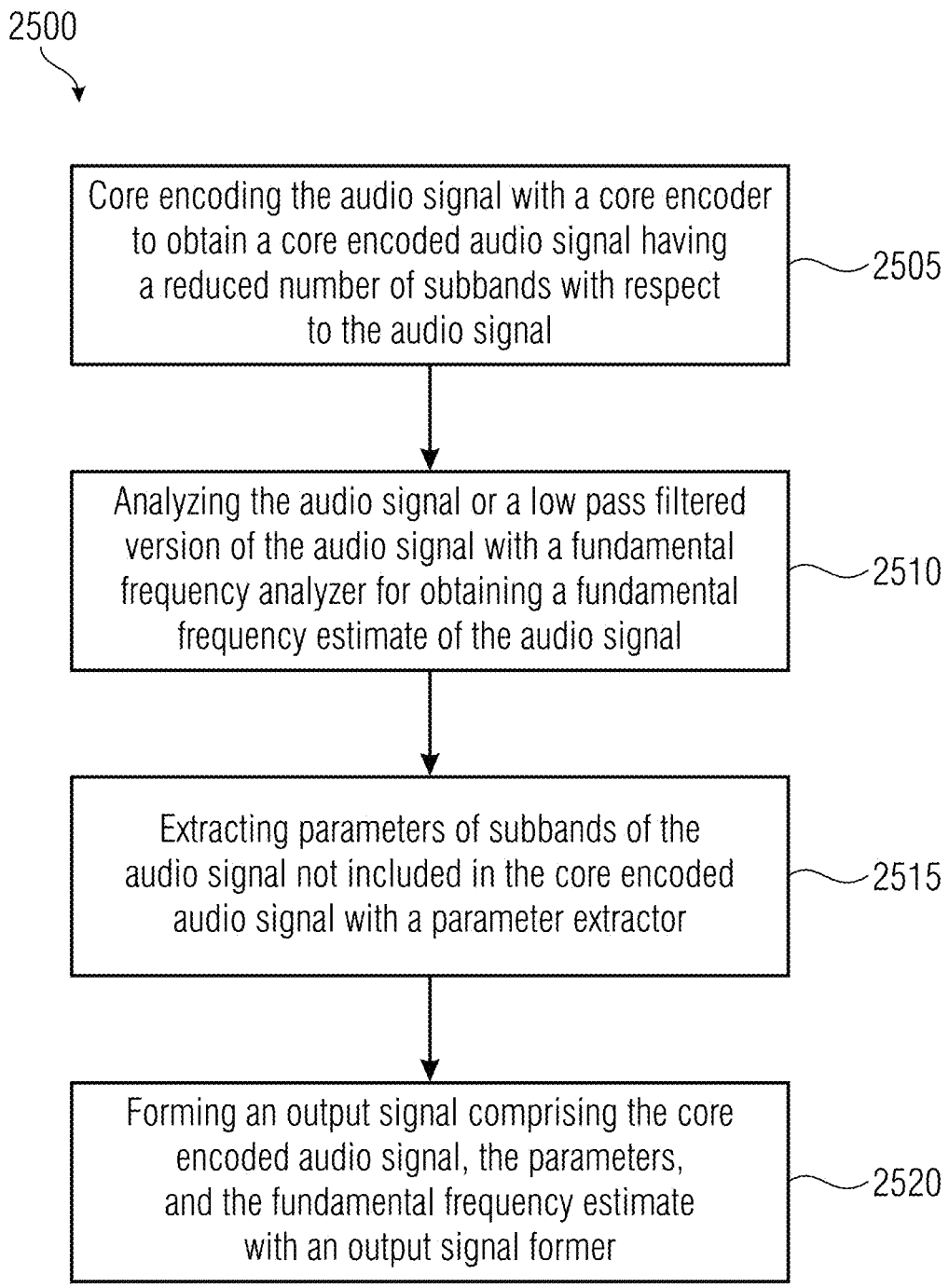
FIG. 25 shows a schematic block diagram of a method for encoding an audio signal.

FIG. 25 shows a method 2500 for encoding an audio signal with a step 2505 "core encoding the audio signal with a core encoder to obtain a core encoded audio signal having a reduced number of subbands with respect to the audio signal", a step 2510 "analyzing the audio signal or a low pass filtered version of the audio signal with a fundamental frequency analyzer for obtaining a fundamental frequency estimate for the audio signal", a step 2515 "extracting parameters of subbands of the audio signal not included in the core encoded audio signal with a parameter extractor", and a step 2520 "forming an output signal comprising the core encoded audio signal, the parameters, and the fundamental frequency estimate with an output signal former".

The described methods 2300, 2400 and 2500 may be implemented in a program code of a computer program for performing the methods when the computer program runs on a computer.

8.2 Correcting Temporal Errors—Vertical Phase Derivative Correction

As discussed previously, humans can perceive an error in the temporal position of a harmonic if the harmonics are synced over frequency and if the fundamental frequency is low. In Section 5 it was shown that the harmonics are synced if the phase derivative over frequency is constant in the QMF domain. Therefore, it is advantageous to have at least one harmonic in each frequency band. Otherwise the 'empty' frequency bands would have random phases and would disturb this measure. Luckily, humans are sensitive to the temporal location of the harmonics only when the fundamental frequency is low (see Section 7). Thus, the phase derivate over frequency can be used as a measure for determining perceptually significant effects due to temporal movements of the harmonics.

Figure 26:
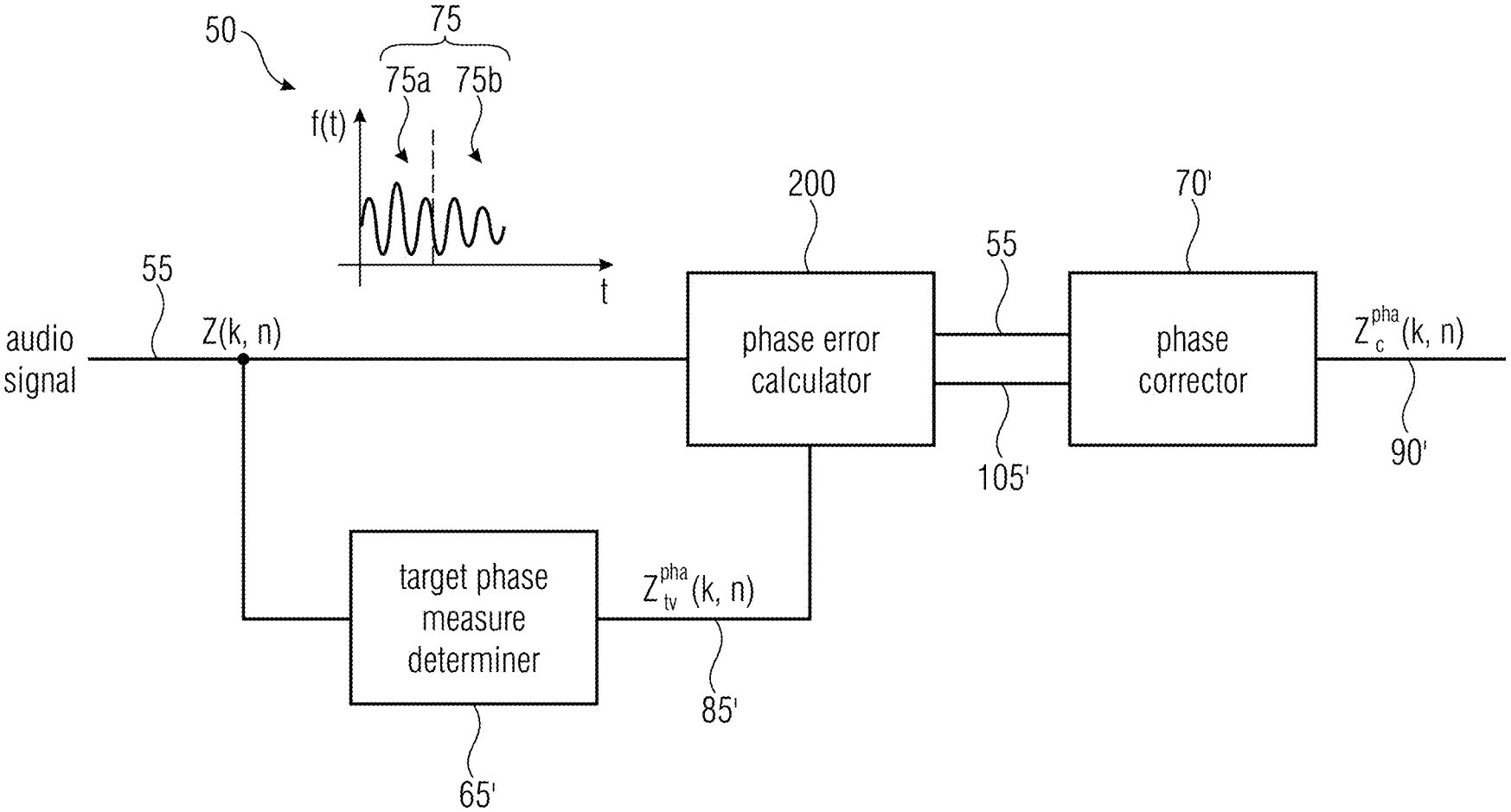
FIG. 26 shows a schematic block diagram of an audio processor according to a further embodiment.

FIG. 26 shows a schematic block diagram of an audio processor 50' for processing an audio signal 55, wherein the audio processor 50' comprises a target phase measure determiner 65', a phase error calculator 200, and a phase corrector 70'. The target phase measure determiner 65' determines a target phase measure 85' for the audio signal 55 in the time frame 75. The phase error calculator 200 calculates a phase error 105' using a phase of the audio signal 55 in the time frame 75 and the target phase measure 85'. The phase corrector 70' corrects the phase of the audio signal 55 in the time frame using the phase error 105' forming the processed audio signal 90'.

Figure 27:
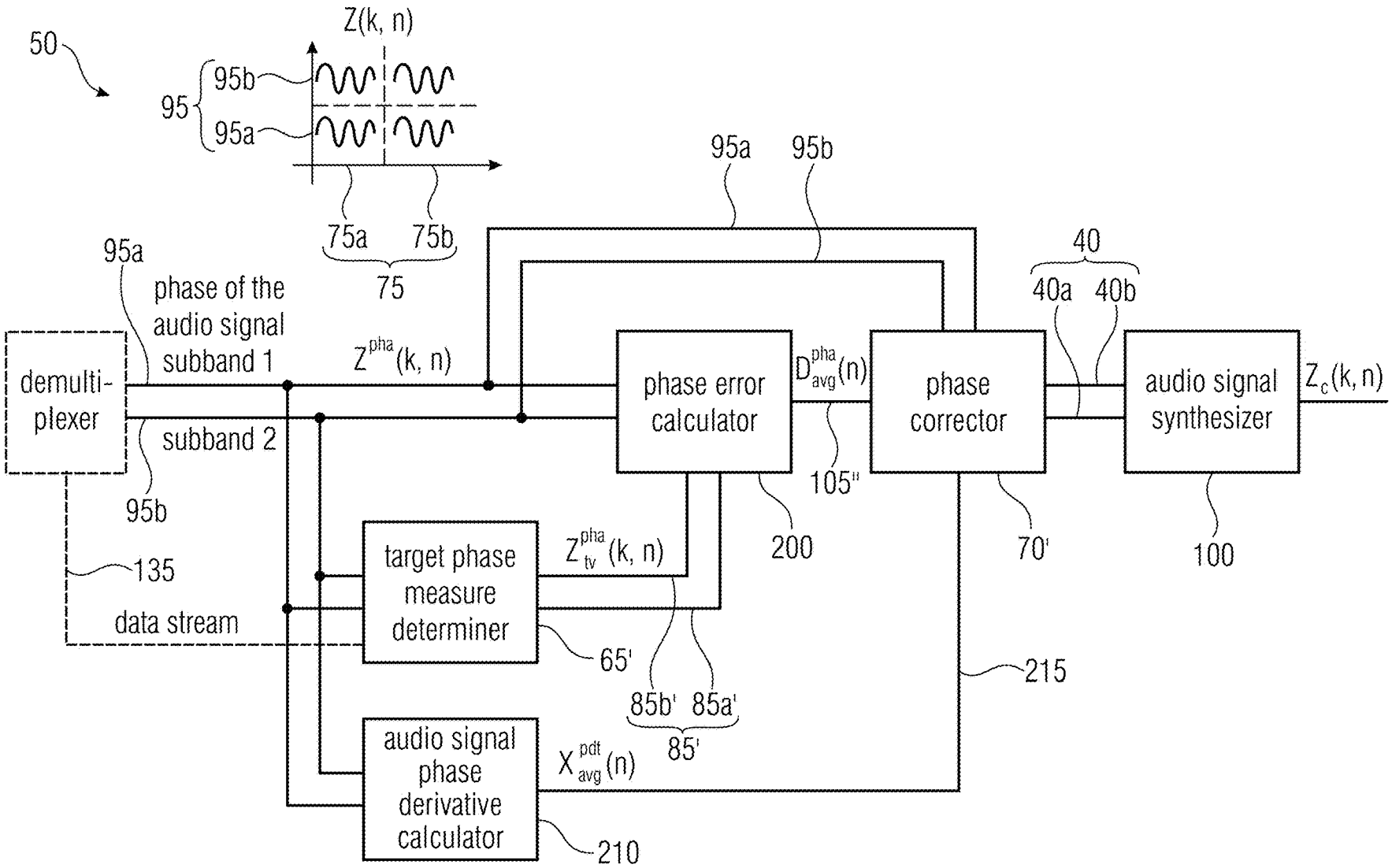
FIG. 27 shows a schematic block diagram of the audio processor according to an advantageous embodiment.

FIG. 27 shows a schematic block diagram of the audio processor 50' according to a further embodiment. Therefore, the audio signal 55 comprises a plurality of subbands 95 for the time frame 75. Accordingly, the target phase measure determiner 65' is configured for determining a first target phase measure 85*a*' for a first subband signal 95*a* and a second target phase measure 85*b*' for a second subband signal 95*b*. The phase error calculator 200 forms a vector of phase errors 105', wherein a first element of the vector refers to a first deviation 105*a*' of the phase of the first subband signal 95 and the first target phase measure 85*a*' and wherein a second element of the vector refers to a second deviation 105*b*' of the phase of the second subband signal 95*b* and the second target phase measurer 85*b*'. Furthermore, the audio processor 50' comprises an audio signal synthesizer 100 for synthesizing a corrected audio signal 90' using a corrected first subband signal 90*a*' and a corrected second subband signal 90*b'*.

Regarding further embodiments, the plurality of subbands 95 is grouped into a baseband 30 and a set of frequency patches 40, the baseband 30 comprising one subband 95 of the audio signal 55 and the set of frequency patches 40 comprises the at least one subband 95 of the baseband 30 at a frequency higher than the frequency of the at least one subband in the baseband. It has to be noted that the patching of the audio signal has already been described with respect to FIG. 3 and will therefore not be described in detail in this part of the description. It just has to be mentioned that the frequency patches 40 may be the raw baseband signal copied to higher frequencies multiplied by a gain factor wherein the phase correction can be applied. Furthermore, according to an advantageous embodiment the multiplication of the gain and the phase correction can be switched such that the phases of the raw baseband signal are copied to higher frequencies before being multiplied by the gain factor. The embodiment further shows the phase error calculator 200 calculating a mean of elements of a vector of phase errors 105' referring to a first patch 40*a* of the set of frequency patches 40 to obtain an average phase error 105". Furthermore, an audio signal phase derivative calculator 210 is shown for calculating a mean of phase derivatives over frequency 215 for the baseband 30.

Figure 28A:
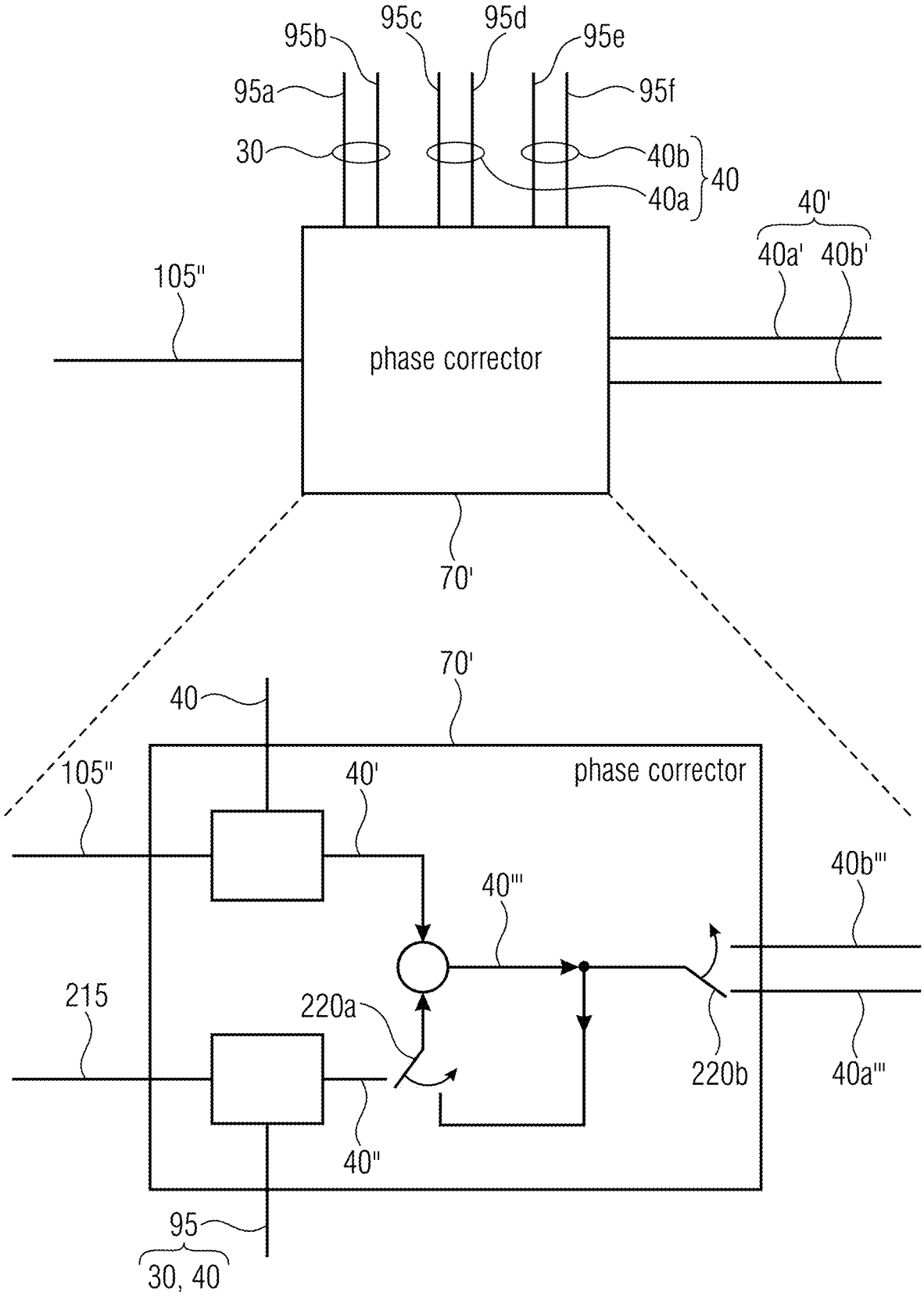
FIG. 28*a* shows a schematic block diagram of a phase corrector in the audio processor illustrating signal flow in more detail.

FIG. 28*a* shows a more detailed description of the phase corrector 70' in a block diagram. The phase corrector 70' at the top of FIG. 28*a* is configured for correcting a phase of the subband signals 95 in the first and subsequent frequency patches 40 of the set of frequency patches. In the embodiment of FIG. 28*a* it is illustrated that the subbands 95*c* and 95*d* belong to patch 40*a* and subbands 95*e* and 95*f* belong to frequency patch 40*b*. The phases are corrected using a weighted average phase error, wherein the average phase error 105 is weighting according to an index of the frequency patch 40 to obtain a modified patch signal 40'.

A further embodiment is depicted at the bottom of FIG. 28*a*. In the top left corner of the phase corrector 70' the already described embodiment is shown for obtaining the modified patch signal 40' from the patches 40 and the average phase error 105". Moreover, the phase corrector 70' calculates in an initialization step a further modified patch signal 40" with an optimized first frequency patch by adding the mean of the phase derivatives over frequency 215, weighted by a current subband index, to the phase of the subband signal with a highest subband index in the baseband 30 of the audio signal 55. For this initialization step, the switch 220*a* is in its left position. For any further processing step, the switch will be in the other position forming a vertically directed connection.

In a further embodiment, the audio signal phase derivative calculator 210 is configured for calculating a mean of phase derivatives over frequency 215 for a plurality of subband signals comprising higher frequencies than the baseband signal 30 to detect transients in the subband signal 95. It has to be noted that the transient correction is similar to the vertical phase correction of the audio processor 50' with the difference that the frequencies in the baseband 30 do not reflect the higher frequencies of a transient. Therefore, these frequencies have to be taken into consideration for the phase correction of a transient.

After the initialization step, the phase correct 70' is configured for recursively updating, based on the frequency patches 40, the further modified patch signal 40" by adding the mean of the phase derivatives over frequency 215, weighted by the subband index of the current subband 95, to the phase of the subband signal with the highest subband index in the previous frequency patch. The advantageous embodiment is a combination of the previously described embodiments, where the phase corrector 70' calculates a weighted mean of the modified patch signal 40' and the further modified patch signal 40" to obtain a combined modified patch signal 40'". Therefore, the phase corrector 70' recursively updates, based on the frequency patches 40, a combined modified patch signal 40'" by adding the mean of the phase derivatives over frequency 215, weighted by the subband index of the current subband 95 to the phase of the subband signal with the highest subband index in the previous frequency patch of the combined modified patch signal 40'''. To obtain the combined modified patches 40*a*''', 40*b*''', etc., the switch 220*b* is shifted to the next position after each recursion, starting at the combined modified 48''' for the initialization step, switching to the combined modified patch 40*b*''' after the first recursion and so on.

Furthermore, the phase corrector 70' may calculate a weighted mean of a patch signal 40' and the modified patch signal 40'' using a circular mean of the patch signal 40' in the current frequency patch weighted with a first specific weighting function and the modified patch signal 40'' in the current frequency patch weighted with a second specific weighting function.

In order to provide an interoperability between the audio processor 50 and the audio processor 50', the phase corrector 70' may form a vector of phase deviations, wherein the phase deviations are calculated using a combined modified patch signal 40''' and the audio signal 55.

Figure 28B:
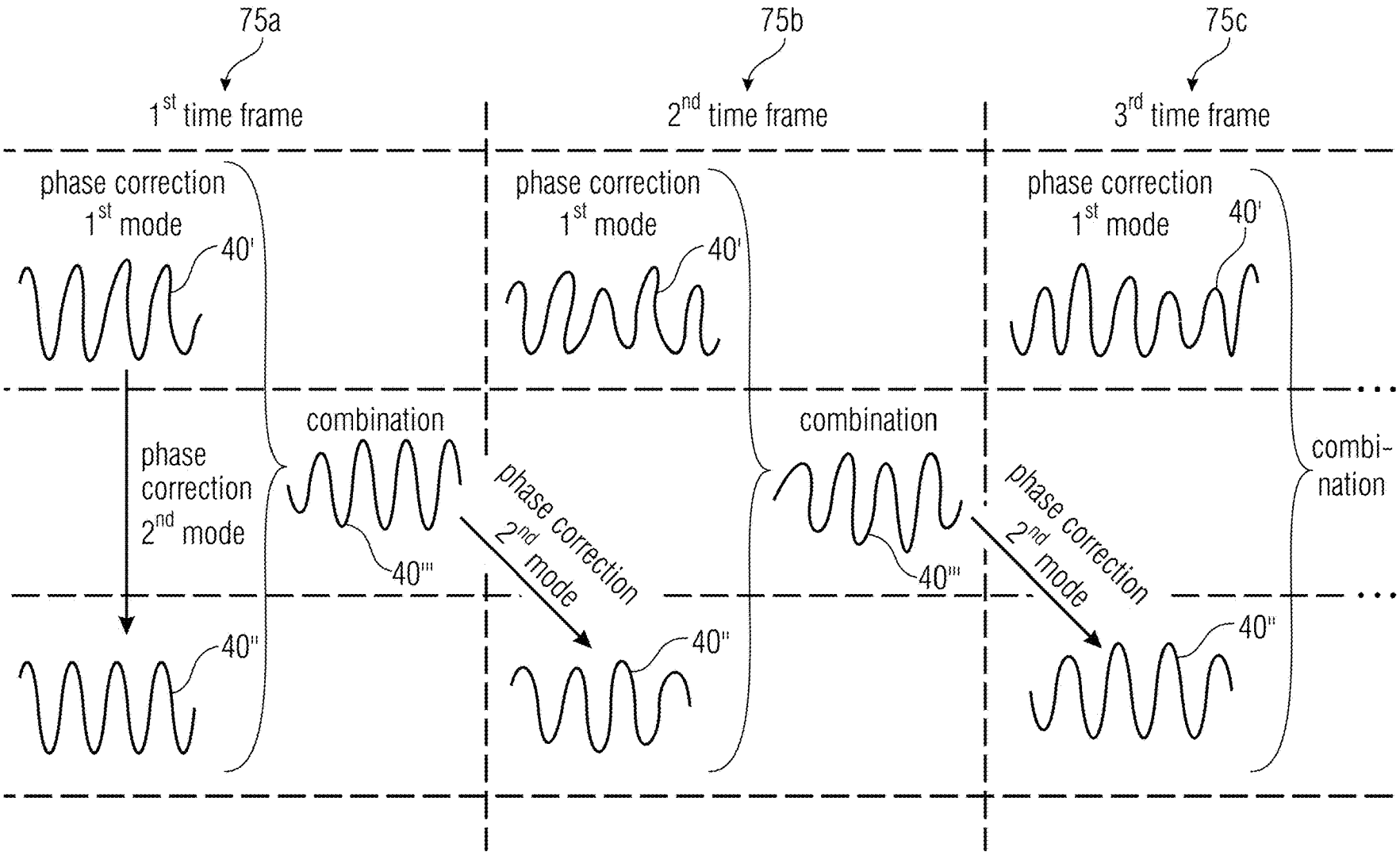
FIG. 28*b* shows the steps of the phase correction from another point of view compared to FIGS. 26-28*a;*

FIG. 28*b* illustrates the steps of the phase correction from another point of view. For a first time frame 75*a*, the patch signal 40' is derived by applying the first phase correction mode on the patches of the audio signal 55. The patch signal 40' is used in the initialization step of the second correction mode to obtain the modified patch signal 40''. A combination of the patch signal 40' and the modified patch signal 40'' results in a combined modified patch signal 40'''.

The second correction mode is therefore applied on the combined modified patch signal 40''' to obtain the modified patch signal 40'' for the second time frame 75*b*. Additionally, the first correction mode is applied on the patches of the audio signal 55 in the second time frame 75*b* to obtain the patch signal 40'. Again, a combination of the patch signal 40' and the modified patch signal 40'' results in the combined modified patch signal 40''. The processing scheme described for the second time frame is applied to the third time frame 75*c* and any further time frame of the audio signal 55 accordingly.

Figure 29:
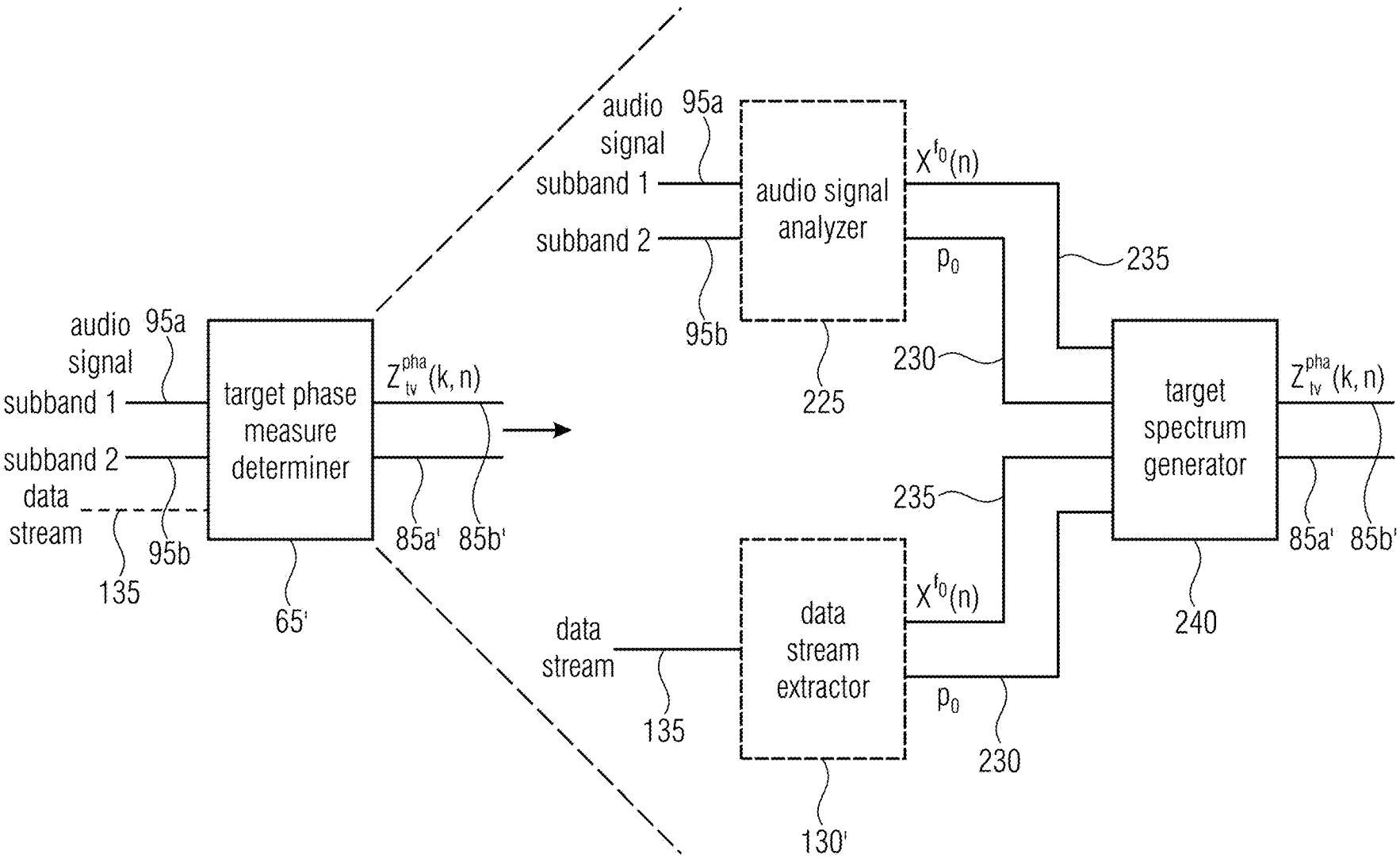
FIG. 29 shows a schematic block diagram of a target phase measure determiner in the audio processor illustrating the target phase measure determiner in more detail.

FIG. 29 shows a detailed block diagram of the target phase measure determiner 65'. According to an embodiment, the target phase measure determiner 65' comprises a data stream extractor 130' for extracting a peak position 230 and a fundamental frequency of peak positions 235 in a current time frame of the audio signal 55 from a data stream 135. Alternatively, the target phase measure determiner 65' comprises an audio signal analyzer 225 for analyzing the audio signal 55 in the current time frame to calculate a peak position 230 and a fundamental frequency of peak positions 235 in the current time frame. Additionally, the target phase measure determiner comprises a target spectrum generator 240 for estimating further peak positions in the current time frame using the peak position 230 and the fundamental frequency of peak positions 235.

Figure 30:
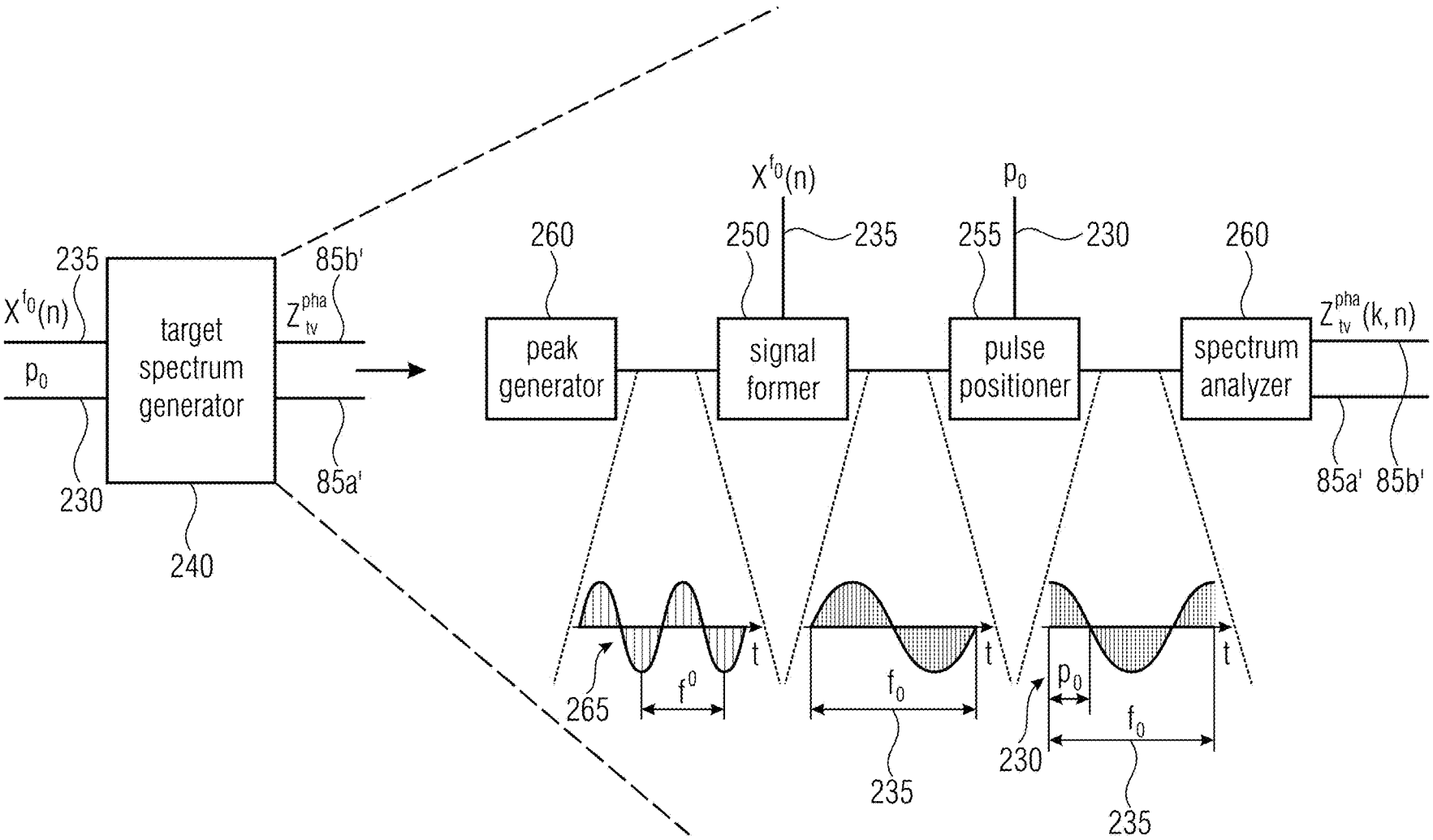
FIG. 30 shows a schematic block diagram of a target spectrum generator in the audio processor illustrating the target spectrum generator in more detail.

FIG. 30 illustrates a detailed block diagram of the target spectrum generator 240 described in FIG. 29. The target spectrum generator 240 comprises a peak generator 245 for generating a pulse train 265 over time. A signal former 250 adjusts a frequency of the pulse train according to the fundamental frequency of peak positions 235. Furthermore, a pulse positioner 255 adjusts the phase of the pulse train 265 according to the peak position 230. In other words, the signal former 250 changes the form of a random frequency of the pulse train 265 such that the frequency of the pulse train is equal to the fundamental frequency of the peak positions of the audio signal 55. Furthermore, the pulse positioner 255 shifts the phase of the pulse train such that one of the peaks of the pulse train is equal to the peak position 230. Thereafter, a spectrum analyzer 260 generates a phase spectrum of the adjusted pulse train, wherein the phase spectrum of the time domain signal is the target phase measure 85'.

Figure 31:
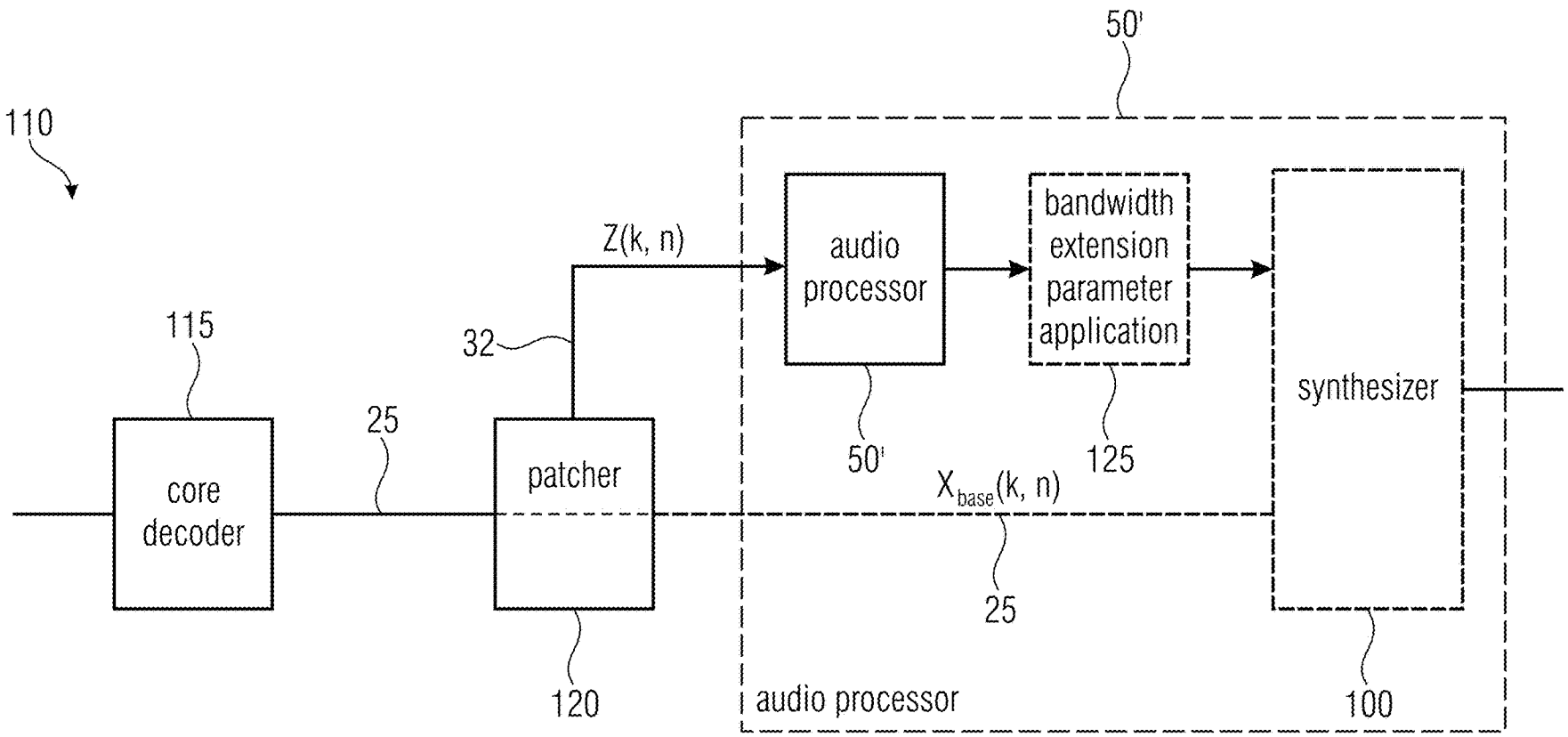
FIG. 31 shows a schematic block diagram of a decoder.

FIG. 31 shows a schematic block diagram of a decoder 110' for decoding an audio signal 55. The decoder 110 comprises a core decoding 115 configured for decoding an audio signal 25 in a time frame of the baseband, and a patcher 120 for patching a set of subbands 95 of the decoded baseband, wherein the set of subbands forms a patch, to further subbands in the time frame, adjacent to the baseband, to obtain an audio signal 32 comprising frequencies higher than the frequencies in the baseband. Furthermore, the decoder 110' comprises an audio processor 50' for correcting phases of the subbands of the patch according to a target phase measure.

According to a further embodiment, the patcher 120 is configured for patching the set of subbands 95 of the audio signal 25, wherein the set of subbands forms a further patch, to further subbands of the time frame, adjacent to the patch, and wherein the audio processor 50' is configured for correcting the phases within the subbands of the further patch. Alternatively, the patcher 120 is configured for patching the corrected patch to further subbands of the time frame adjacent to the patch.

A further embodiment is related to a decoder for decoding an audio signal comprising a transient, wherein the audio processor 50' is configured to correct the phase of the transient. The transient handling is described in other word in section 8.4. Therefore, the decoder 110 comprises a further audio processor 50' for receiving a further phase derivative of a frequency and to correct transients in the audio signal 32 using the received phase derivative or frequency. Furthermore, it has to be noted that the decoder 110' of FIG. 31 is similar to the decoder 110 of FIG. 19, such that the description concerning the main elements is mutually exchangeable in those cases not related to the difference in the audio processors 50 and 50'.

Figure 32:
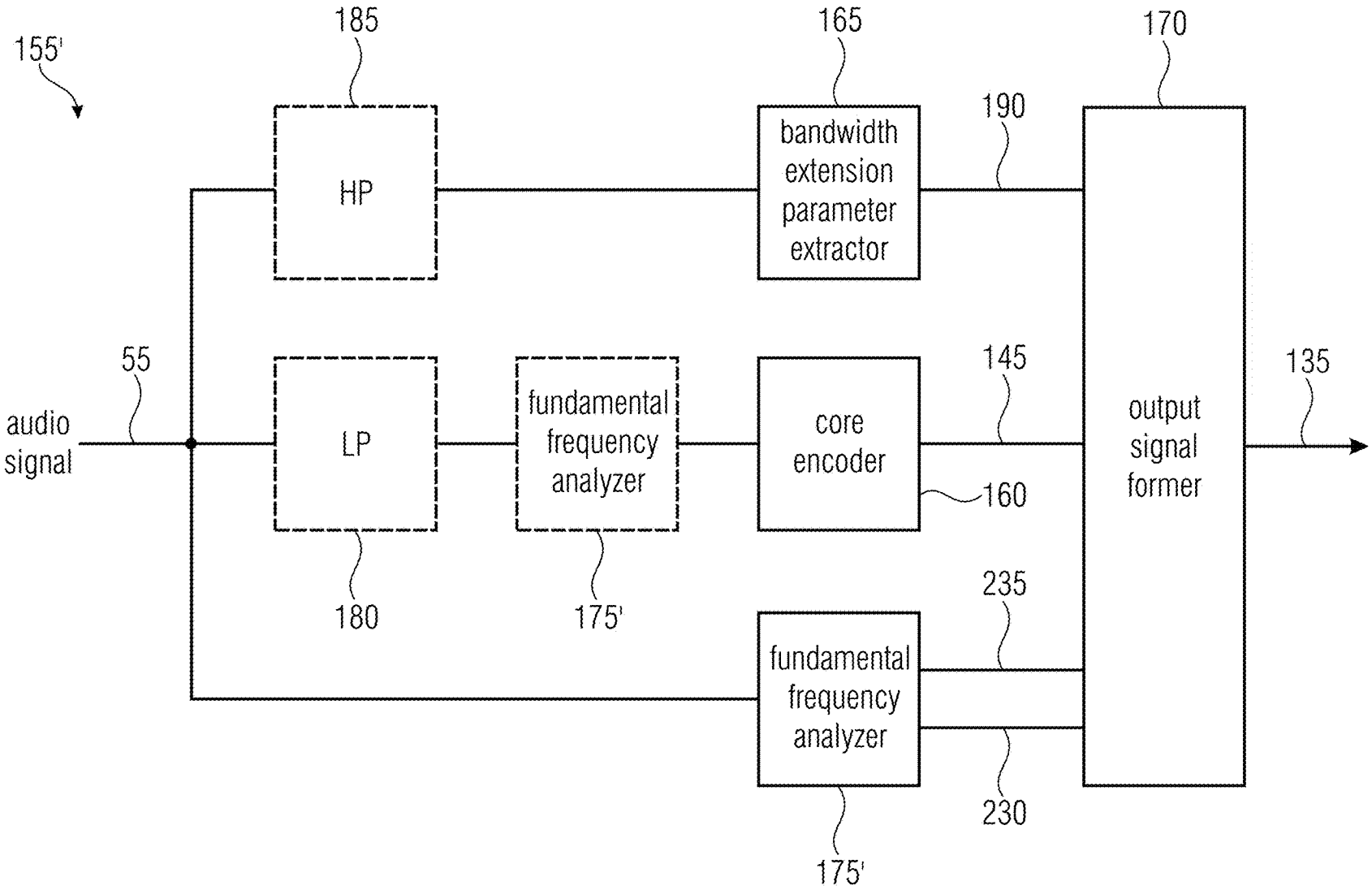
FIG. 32 shows a schematic block diagram of an encoder.

FIG. 32 shows an encoder 155' for encoding an audio signal 55. The encoder 155' comprises a core encoder 160, a fundamental frequency analyzer 175', a parameter extractor 165, and an output signal former 170. The core encoder 160 is configured for core encoding the audio signal 55 to obtain a core encoded audio signal 145 having a reduced number of subbands with respect to the audio signal 55. The fundamental frequency analyzer 175' analyzes peak positions 230 in the audio signal 55 or a low pass filtered version of the audio signal for obtaining a fundamental frequency estimate of peak positions 235 in the audio signal. Furthermore, the parameter extractor 165 extracts parameters 190 of subbands of the audio signal 55 not included in the core encoded audio signal 145 and the output signal former 170 forms an output signal 135 comprising the core encoded audio signal 145, the parameters 190, the fundamental frequency of peak positions 235, and one of the peak positions 230. According to embodiments, the output signal former 170 is configured to form the output signal 135 into a sequence of frames, wherein each frame comprises the core encoded audio signal 145, the parameters 190, and wherein only each n-th frame comprises the fundamental frequency estimate of peak positions 235 and the peak position 230, wherein n 2.

Figure 33:
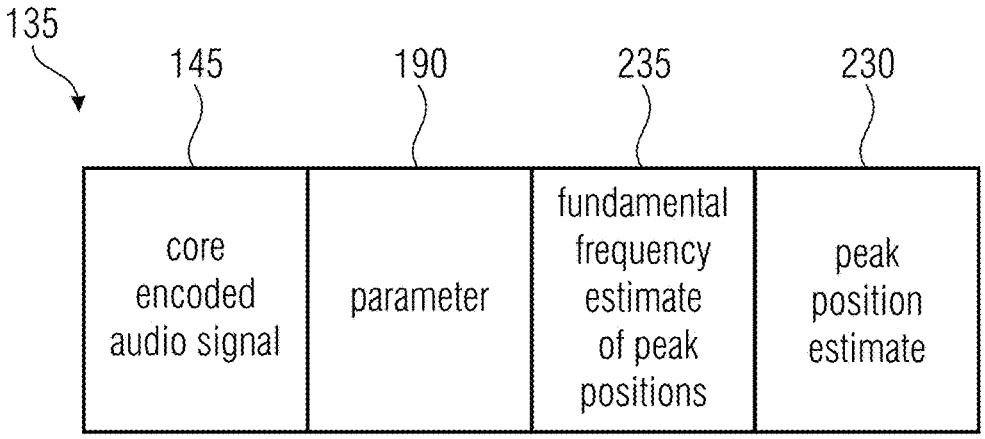
FIG. 33 shows a schematic block diagram of a data stream which may be an audio signal.

FIG. 33 shows an embodiment of the audio signal 135 comprising a core encoded audio signal 145 comprising a reduced number of subbands with respect to the original audio signal 55, the parameter 190 representing subbands of the audio signal not included in the core encoded audio signal, a fundamental frequency estimate of peak positions 235, and a peak position estimate 230 of the audio signal 55. Alternatively, the audio signal 135 is formed into a sequence of frames, wherein each frame comprises the core encoded audio signal 145, the parameters 190, and wherein only each n-th frame comprises the fundamental frequency estimate of peak positions 235 and the peak position 230, wherein n 2. The idea has already been described with respect to FIG. 22.

Figure 34:
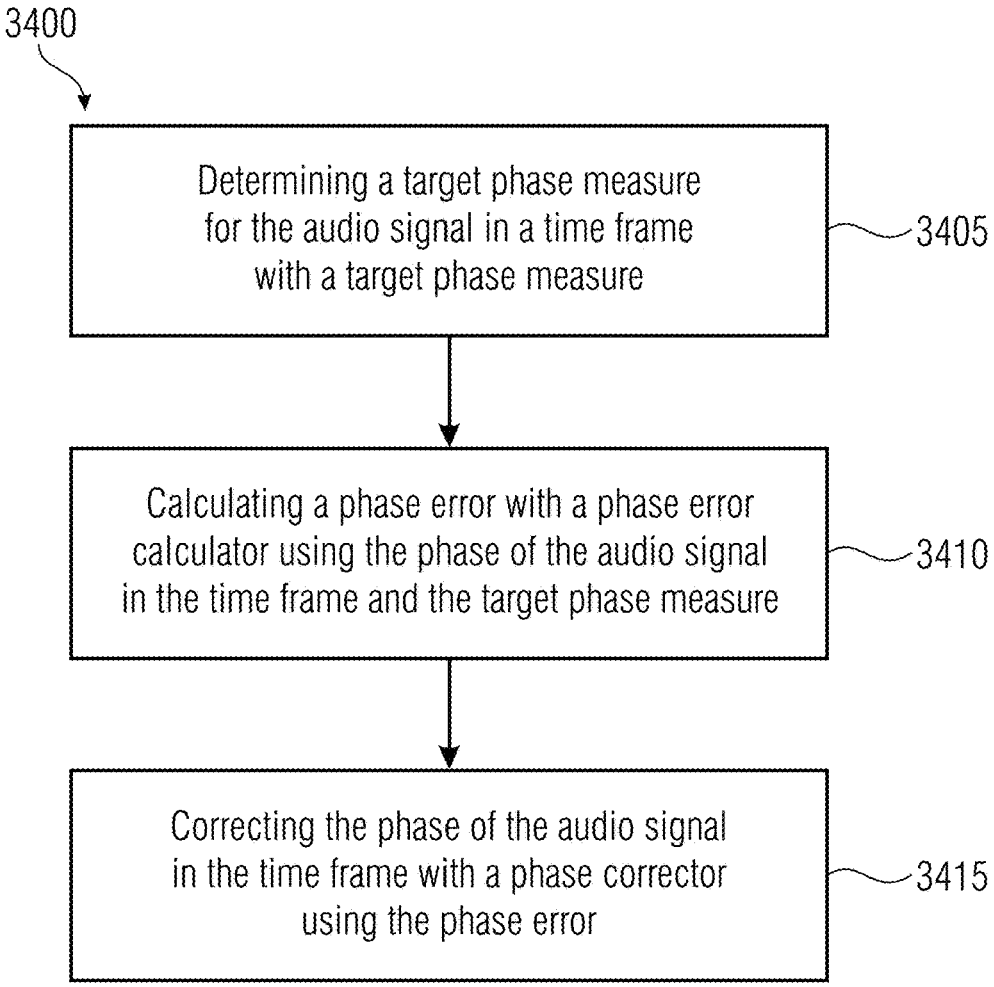
FIG. 34 shows a schematic block diagram of a method for processing an audio signal.

FIG. 34 shows a method 3400 for processing an audio signal with an audio processor. The method 3400 comprises a step 3405 "determining a target phase measure for the audio signal in a time frame with a target phase measure", a step 3410 "calculating a phase error with a phase error calculator using the phase of the audio signal in the time frame and the target phase measure", and a step 3415 "correcting the phase of the audio signal in the time frame with a phase corrected using the phase error".

Figure 35:
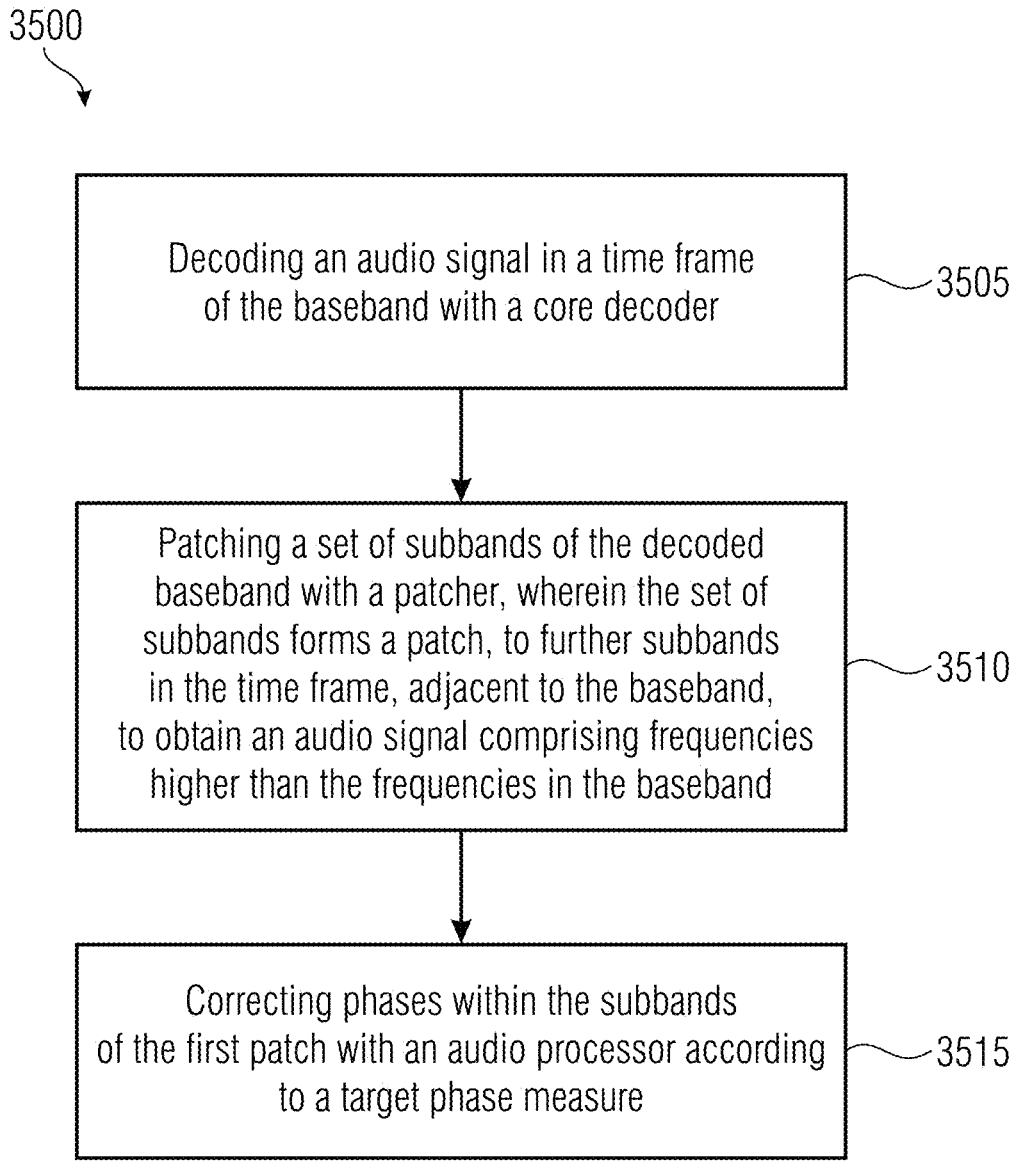
FIG. 35 shows a schematic block diagram of a method for decoding an audio signal.

FIG. 35 shows a method 3500 for decoding an audio signal with a decoder. The method 3500 comprises a step 3505 "decoding an audio signal in a time frame of the baseband with a core decoder", a step 3510 "patching a set of subbands of the decoded baseband with a patcher, wherein the set of subbands forms a patch, to further subbands in the time frame, adjacent to the baseband, to obtain an audio signal comprising frequencies higher than the frequencies in the baseband", and a step 3515 "correcting phases with the subbands of the first patch with an audio processor according to a target phase measure".

Figure 36:
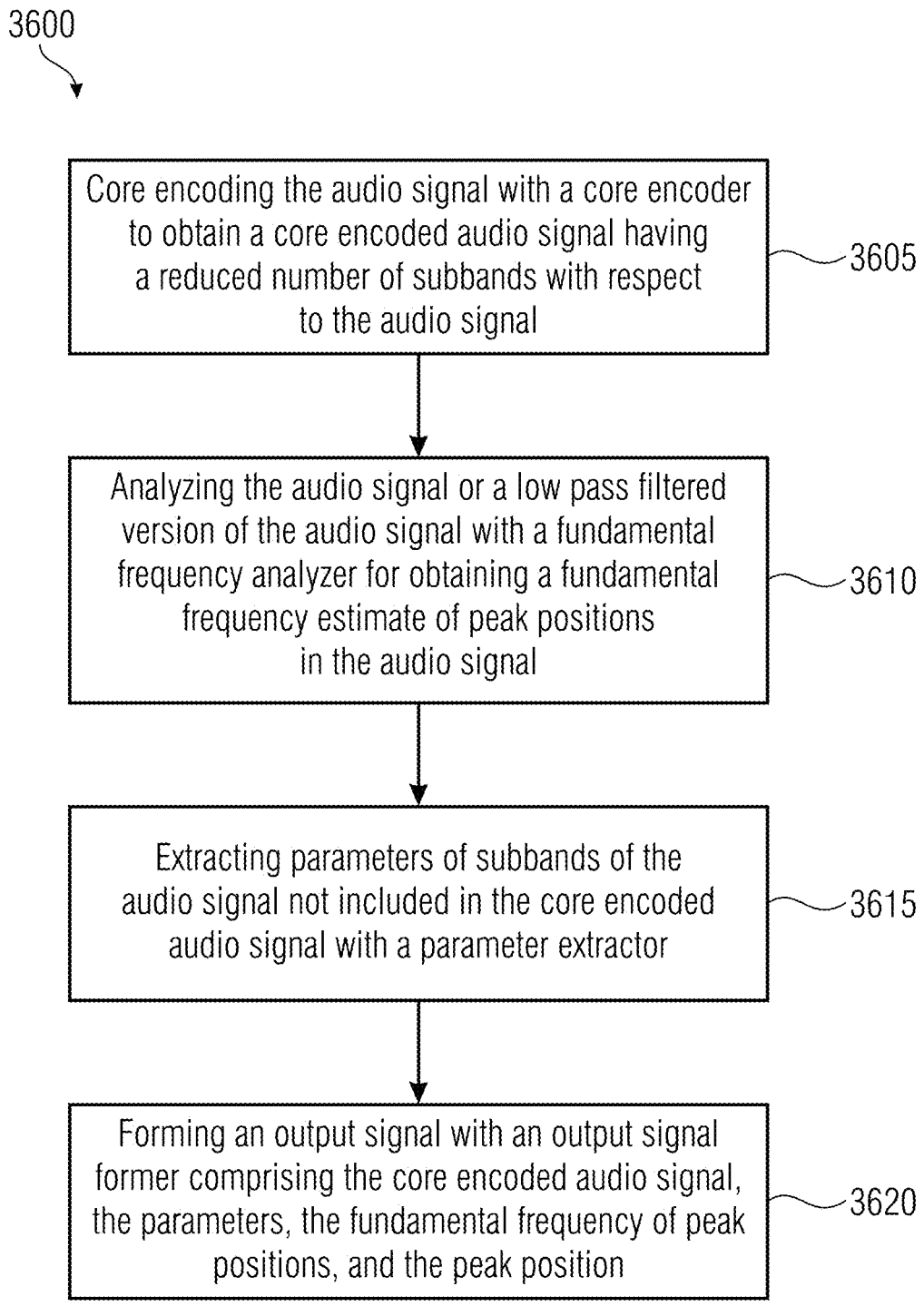
FIG. 36 shows a schematic block diagram of a method for decoding an audio signal.

FIG. 36 shows a method 3600 for encoding an audio signal with an encoder. The method 3600 comprises a step 3605 "core encoding the audio signal with a core encoder to obtain a core encoded audio signal having a reduced number of subbands with respect to the audio signal", a step 3610 "analyzing the audio signal or a low-pass filtered version of the audio signal with a fundamental frequency analyzer for obtaining a fundamental frequency estimate of peak positions in the audio signal", a step 3615 "extracting parameters of subbands of the audio signal not included in the core encoded audio signal with a parameter extractor", and a step 3620 "forming an output signal with an output signal former comprising the core encoded audio signal, the parameters, the fundamental frequency of peak positions, and the peak position".

Figure 37:
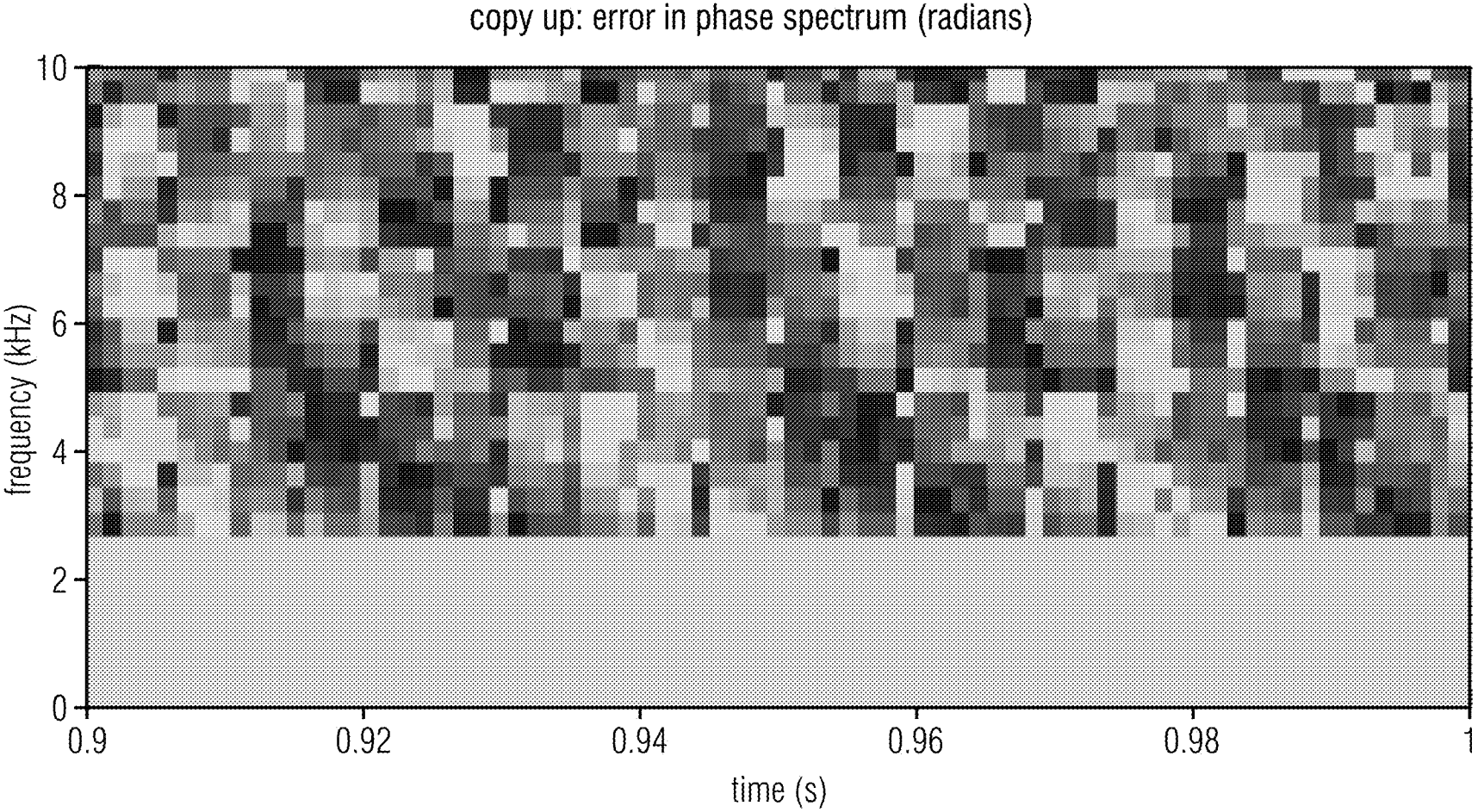
FIG. 37 shows an error in the phase spectrum of the trombone signal in the QMF domain using direct copy-up SBR in a time-frequency representation.

In other words, the suggested algorithm for correcting the errors in the temporal positions of the harmonics functions as follows. First, a difference between the phase spectra of the target signal and the SBR-processed signal ($Z_{tv}^{pha}$(k,n) and $Z^{pha}$) is computed $$D^{pha}(k,n)=Z^{pha}(k,n)-Z_{tv}^{pha}(k,n), \tag{20a}$$

which is depicted in FIG. 37. FIG. 37 shows the error in the phase spectrum $D^{pha}$(k,n) of the trombone signal in the QMF domain using direct copy-up SBR. At this point the target phase spectrum can be assumed to be equal to that of the input signal $$Z_{tv}^{pha}(k,n)=X^{pha}(k,n) \tag{20b}$$

Later it will be presented how the target phase spectrum can be obtained with a low bit rate.

The vertical phase derivative correction is performed using two methods, and the final corrected phase spectrum is obtained as a mix of them.

First, it can be seen that the error is relatively constant inside the frequency patch, and the error jumps to a new value when entering a new frequency patch. This makes sense, since the phase is changing with a constant value over frequency at all frequencies in the original signal. The error is formed at the cross-over and the error remains constant inside the patch. Thus, a single value is enough for correcting the phase error for the whole frequency patch. Furthermore, the phase error of the higher frequency patches can be corrected using this same error value after multiplication with the index number of the frequency patch.

Therefore, circular mean of the phase error is computed for the first frequency patch $$D_{avg}^{pha}(n)=\text{circmean}\{D^{pha}(k,n)\},8\le k\le 13. \tag{21}$$

The phase spectrum can be corrected using it $$Y_{cv1}^{pha}(k,n,i)=Y^{pha}(k,n,i)-i\cdot D_{avg}^{pha}(n). \tag{22}$$

This raw correction produces an accurate result if the target PDF, e.g. the phase derivative over frequency $X^{pdf}$(k, n), is exactly constant at all frequencies. However, as can be seen in FIG. 12, often there is slight fluctuation over frequency in the value. Thus, better results can be obtained by using enhanced processing at the cross-overs in order to avoid any discontinuities in the produced PDF. In other words, this correction produces correct values for the PDF on average, but there might be slight discontinuities at the cross-over frequencies of the frequency patches. In order to avoid them, the correction method is applied. The final corrected phase spectrum $Y_{cv}^{pha}$(k,n,i) is obtained as a mix of two correction methods.

The other correction method begins by computing a mean of the PDF in the baseband $$X_{avg}^{pdf}(n)=\text{circmean}\{X_{base}^{pdf}(k,n)\}. \tag{23}$$

The phase spectrum can be corrected using this measure by assuming that the phase is changing with this average value, i.e., $$Y_{cv2}^{pha}(k,n,1)=X_{base}^{pha}(6,n)+k\cdot X_{avg}^{pdf}(n),$$

$$Y_{cv2}^{pha}(k,n,i)=Y_{cv}^{pha}(6,n,i-1)+k\cdot X_{avg}^{pdf}(n), \tag{24}$$

wherein $Y_{cv}^{pha}$ is the combined patch signal of the two correction methods.

This correction provides good quality at the cross-overs, but can cause a drift in the PDF towards higher frequencies. In order to avoid this, the two correction methods are combined by computing a weighted circular mean of them $$Y_{cv}^{pha}(k,n,i)=\text{circmean}\{Y_{cv12}^{pha}(k,n,i,c),W_{fc}(k,c)\}, \tag{25}$$

where c denotes the correction method ($Y_{cv1}^{pha}$ or $Y_{cv2}^{pha}$ and $W_{fc}$(k,c) is the weighting function $$W_{fc}(k,1)=[0.2,0.45,0.7,1,1,1],$$

$$W_{fc}(k,2)=[0.8,0.55,0.3,0,0,0]. \tag{26a}$$

Figure 38A:
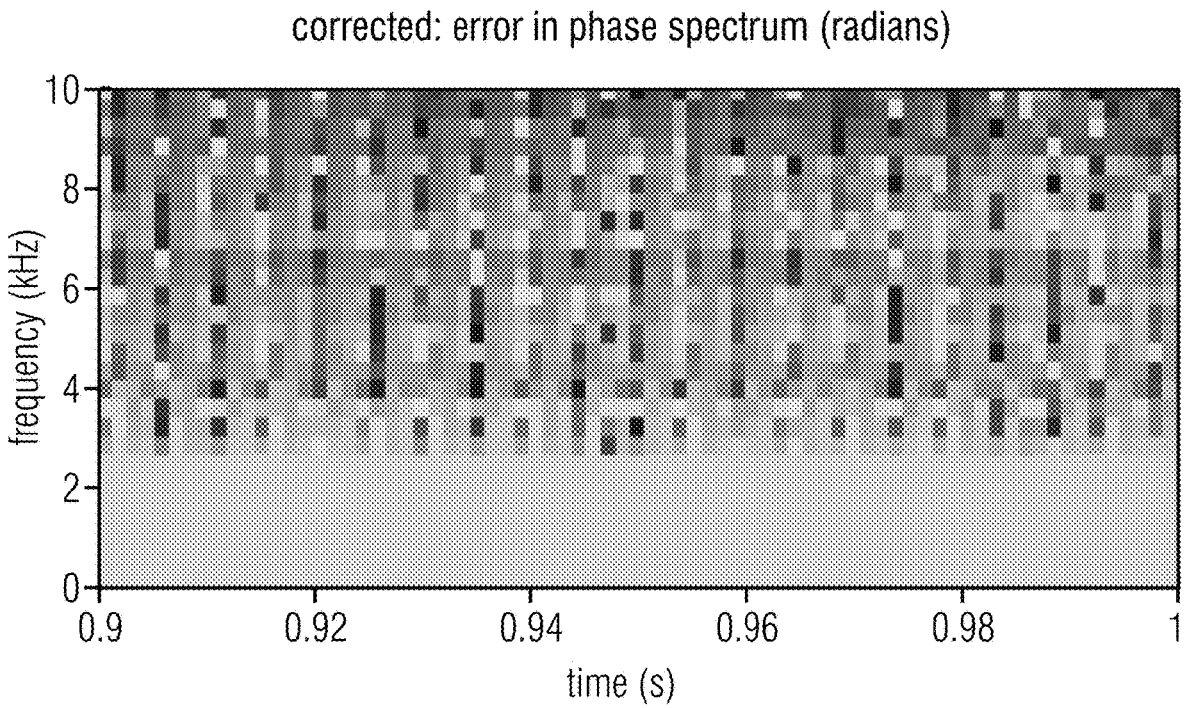
FIG. 38*a* shows the error in the phase spectrum of the trombone signal in the QMF domain using corrected SBR in a time-frequency representation.
Figure 38B:
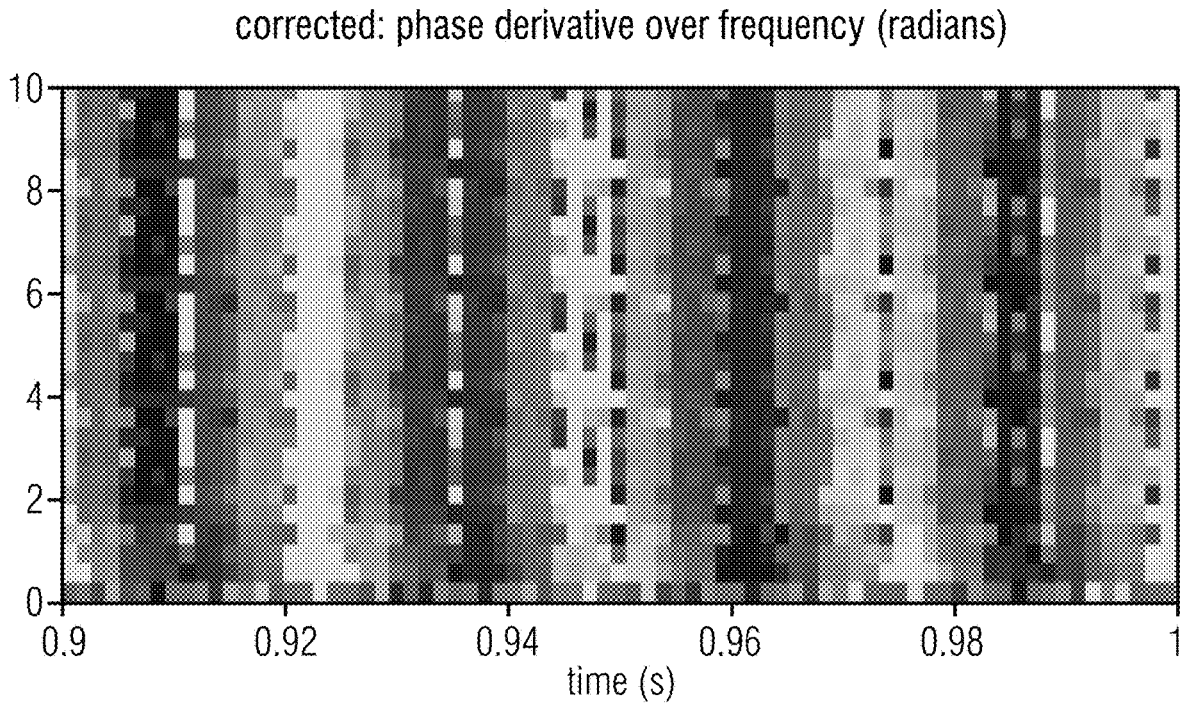
FIG. 38*b* shows the phase derivative over frequency corresponding to the error shown in FIG. 38*a;*

The resulting phase spectrum $Y_{cv}^{pha}$(k,n,i) suffers neither from discontinuities nor drifting. The error compared to the original spectrum and the PDF of the corrected phase spectrum are depicted in FIG. 38. FIG. 38*a* shows the error in the phase spectrum $D_{cv}^{pha}$(k,n) of the trombone signal in the QMF domain using the phase corrected SBR signal, wherein FIG. 38*b* shows the corresponding phase derivative over frequency $Z_{cv}^{pdf}$(k,n). It can be seen that the error is significantly smaller than without the correction, and the PDF does not suffer from major discontinuities. There are significant errors at certain temporal frames, but these frames have low energy (see FIG. 4), so they have insignificant perceptual effect. The temporal frames with significant energy are relatively well corrected. It can be noticed that the artifacts of the non-corrected SBR are significantly mitigated.

The corrected phase spectrum $Z_{cv}^{pha}(k,n)$ is obtained by concatenating the corrected frequency patches $Y_{cv}^{pha}(k,n,i)$. To be compatible with the horizontal-correction mode, the vertical phase correction can be presented also using a modulator matrix (see Eq. 18)

$$Q^{pha}(k,n)=Z_{cv}^{pha}(k,n)-Z^{pha}(k,n). \quad (26b)$$

8.3 Switching Between Different Phase-Correction Methods

Sections 8.1 and 8.2 showed that SBR-induced phase errors can be corrected by applying PDT correction to the violin and PDF correction to the trombone. However, it was not considered how to know which one of the corrections should be applied to an unknown signal, or if any of them should be applied. This section proposes a method for automatically selecting the correction direction. The correction direction (horizontal/vertical) is decided based on the variation of the phase derivatives of the input signal.

Figure 39:
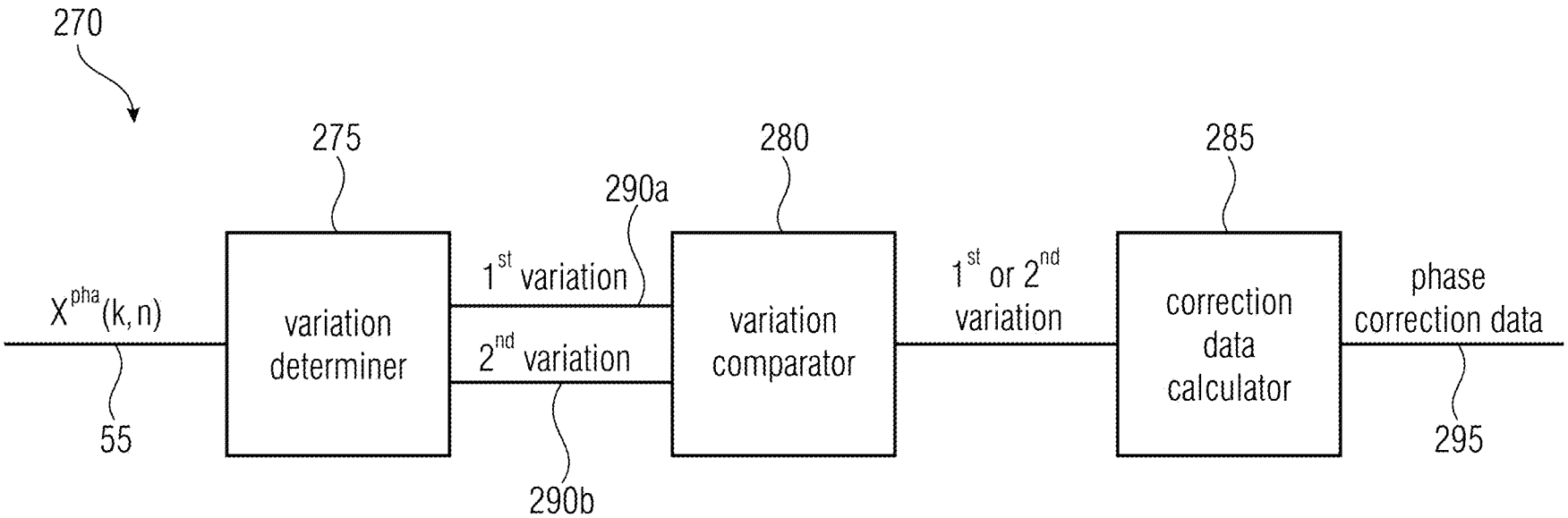
FIG. 39 shows a schematic block diagram of a calculator.

Therefore, in FIG. 39, a calculator for determining phase correction data for an audio signal 55 is shown. The variation determiner 275 determines the variation of a phase 45 of the audio signal 55 in a first and a second variation mode. The variation comparator 280 compares a first variation 290*a* determined using the first variation mode and a second variation 290*b* determined using the second variation mode and a correction data calculator calculates the phase correction data 295 in accordance with the first variation mode or the second variation mode based on a result of the comparer.

Furthermore, the variation determiner 275 may be configured for determining a standard deviation measure of a phase derivative over time (PDT) for a plurality of time frames of the audio signal 55 as the variation 290*a* of the phase in the first variation mode and for determining a standard deviation measure of a phase derivative over frequency (PDF) for a plurality of subbands of the audio signal 55 as the variation 290*b* of the phase in the second variation mode. Therefore, the variation comparator 280 compares the measure of the phase derivative over time as the first variation 290*a* and the measure of the phase derivative over frequency as a second variation 290*b* for time frames of the audio signal.

Embodiments show the variation determiner 275 for determining a circular standard deviation of a phase derivative over time of a current and a plurality of previous frames of the audio signal 55 as the standard deviation measure and for determining a circular standard deviation of a phase derivative over time of a current and a plurality of future frames of the audio signal 55 for a current time frame as the standard deviation measure. Furthermore, the variation determiner 275 calculates, when determining the first variation 290*a*, a minimum of both circular standard deviations. In a further embodiment, the variation determiner 275 calculates the variation 290*a* in the first variation mode as a combination of a standard deviation measure for a plurality of subbands 95 in a time frame 75 to form an averaged standard deviation measure of a frequency. The variation comparator 280 is configured for performing the combination of the standard deviation measures by calculating an energy-weighted mean of the standard deviation measures of the plurality of subbands using magnitude values of the subband signal 95 in the current time frame 75 as an energy measure.

In an advantageous embodiment, the variation determiner 275 smoothens the averaged standard deviation measure, when determining the first variation 290*a*, over the current, a plurality of previous and a plurality of future time frames. The smoothing as weighted according to an energy calculated using corresponding time frames and a windowing function. Furthermore, the variation determiner 275 is configured for smoothing the standard deviation measure, when determining the second variation 290*b* over the current, a plurality of previous, and a plurality of future time frames 75, wherein the smoothing is weighted according to the energy calculated using corresponding time frames 75 and a windowing function. Therefore, the variation comparator 280 compares the smoothened average standard deviation measure as the first variation 290*a* determined using the first variation mode and compares the smoothened standard deviation measure as the second variation 290*b* determined using the second variation mode.

Figure 40:
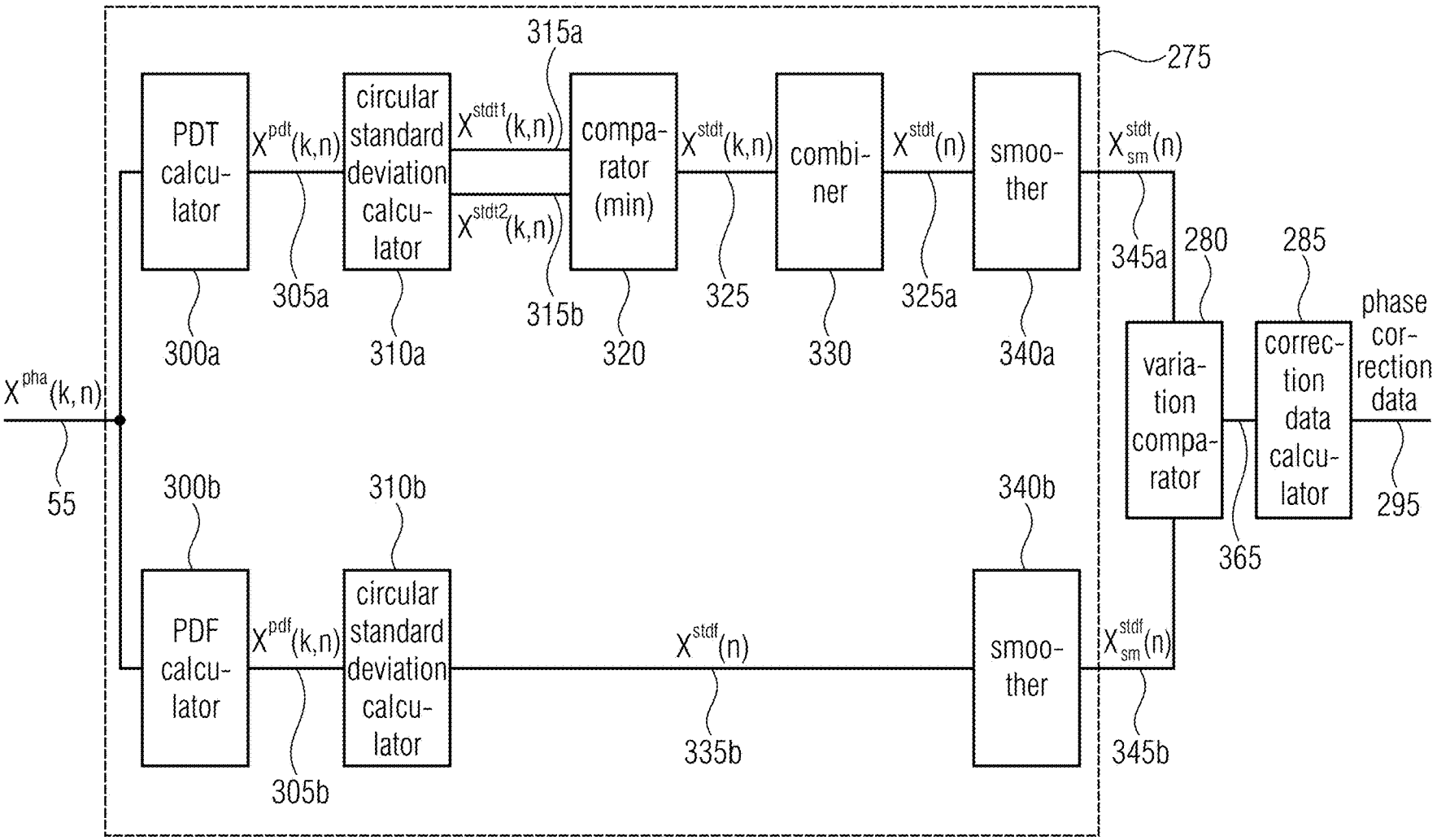
FIG. 40 shows a schematic block diagram of the calculator illustrating the signal flow in the variation determiner in more detail.

An advantageous embodiment is depicted in FIG. 40. According to this embodiment, the variation determiner 275 comprises two processing paths for calculating the first and the second variation. A first processing patch comprises a PDT calculator 300*a*, for calculating the standard deviation measure of the phase derivative over time 305*a* from the audio signal 55 or the phase of the audio signal. A circular standard deviation calculator 310*a* determines a first circular standard deviation 315*a* and a second circular standard deviation 315*b* from the standard deviation measure of a phase derivative over time 305*a*. The first and the second circular standard deviations 315*a* and 315*b* are compared by a comparator 320. The comparator 320 calculates the minimum 325 of the two circular standard deviation measures 315*a* and 315*b*. A combiner combines the minimum 325 over frequency to form an average standard deviation measure 335*a*. A smoother 340*a* smoothens the average standard deviation measurer 335*a* to form a smooth average standard deviation measure 345*a*.

The second processing path comprises a PDF calculator 300*b* for calculating a phase derivative over frequency 305*b* from the audio signal 55 or a phase of the audio signal. A circular standard deviation calculator 310*b* forms a standard deviation measures 335*b* of the phase derivative over frequency 305. The standard deviation measure 305 is smoothened by a smoother 340*b* to form a smooth standard deviation measure 345*b*. The smoothened average standard deviation measures 345*a* and the smoothened standard deviation measure 345*b* are the first and the second variation, respectively. The variation comparator 280 compares the first and the second variation and the correction data calculator 285 calculates the phase correction data 295 based on the comparing of the first and the second variation.

Figure 41:
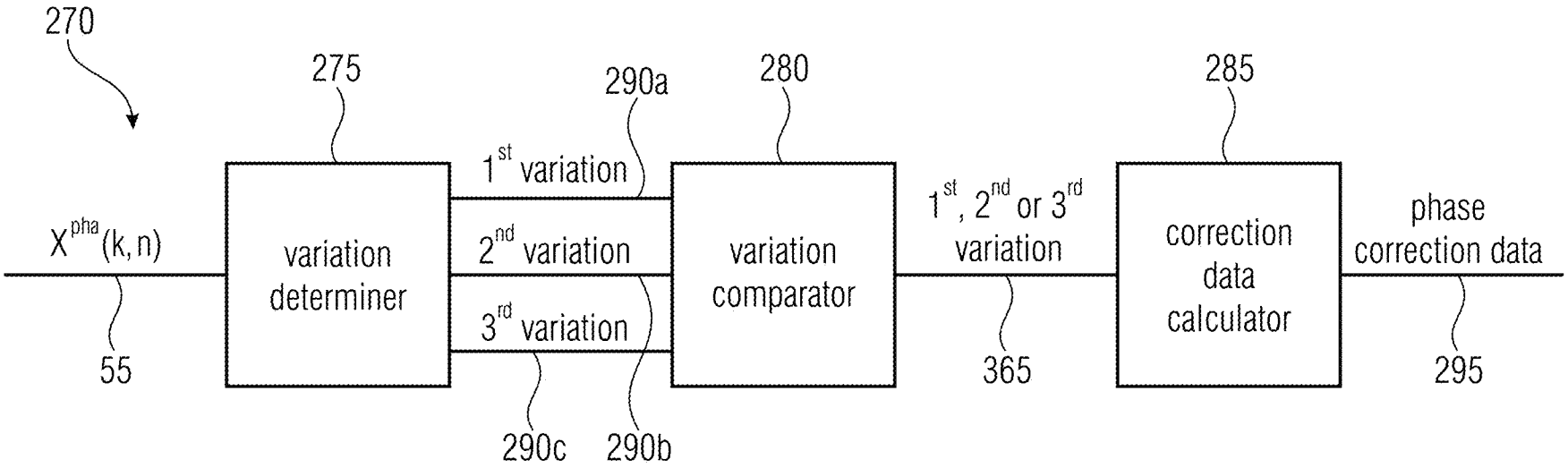
FIG. 41 shows a schematic block diagram of the calculator according to a further embodiment.

Further embodiments show the calculator 270 handling three different phase correction modes. A figurative block diagram is shown in FIG. 41. FIG. 41 shows the variation determiner 275 further determining a third variation 290*c* of the phase of the audio signal 55 in a third variation mode, wherein the third variation mode is a transient detection mode. The variation comparator 280 compares the first variation 290*a*, determined using the first variation mode, the second variation 290*b*, determined using the second variation mode, and the third variation 290*c*, determined using the third variation. Therefore, the correction data calculator 285 calculates the phase correction data 295 in accordance with the first correction mode, the second correction mode, or the third correction mode, based on a result of the comparing. For calculating the third variation 290*c* in the third variation mode, the variation comparator 280 may be configured for calculating an instant energy estimate of the current time frame and a time-averaged energy estimate of a plurality of time frames 75. Therefore, the variation comparator 280 is configured for calculating a ratio of the instant energy estimate and the time-averaged energy estimate and is configured for comparing the ratio with a defined threshold to detect transients in a time frame 75.

The variation comparator 280 has to determine a suitable correction mode based on three variations. Based on this decision, the correction data calculator 285 calculates the phase correction data 295 in accordance with a third variation mode if a transient is detected. Furthermore, the correction data calculator 85 calculates the phase correction data 295 in accordance with a first variation mode, if an absence of a transient is detected and if the first variation 290*a*, determined in the first variation mode, is smaller or equal than the second variation 290*b*, determined in the second variation mode. Accordingly, the phase correction data 295 is calculated in accordance with the second variation mode, if an absence of a transient is detected and if the second variation 290*b*, determined in the second variation mode, is smaller than the first variation 290*a*, determined in the first variation mode.

The correction data calculator is further configured for calculating the phase correction data 295 for the third variation 290*c* for a current, one or more previous and one or more future time frames. Accordingly, the correction data calculator 285 is configured for calculating the phase correction data 295 for the second variation mode 290*b* for a current, one or more previous and one or more future time frames. Furthermore, the correction data calculator 285 is configured for calculating correction data 295 for a horizontal phase correction and the first variation mode, calculating correction data 295 for a vertical phase correction in the second variation mode, and calculating correction data 295 for a transient correction in the third variation mode.

Figure 42:
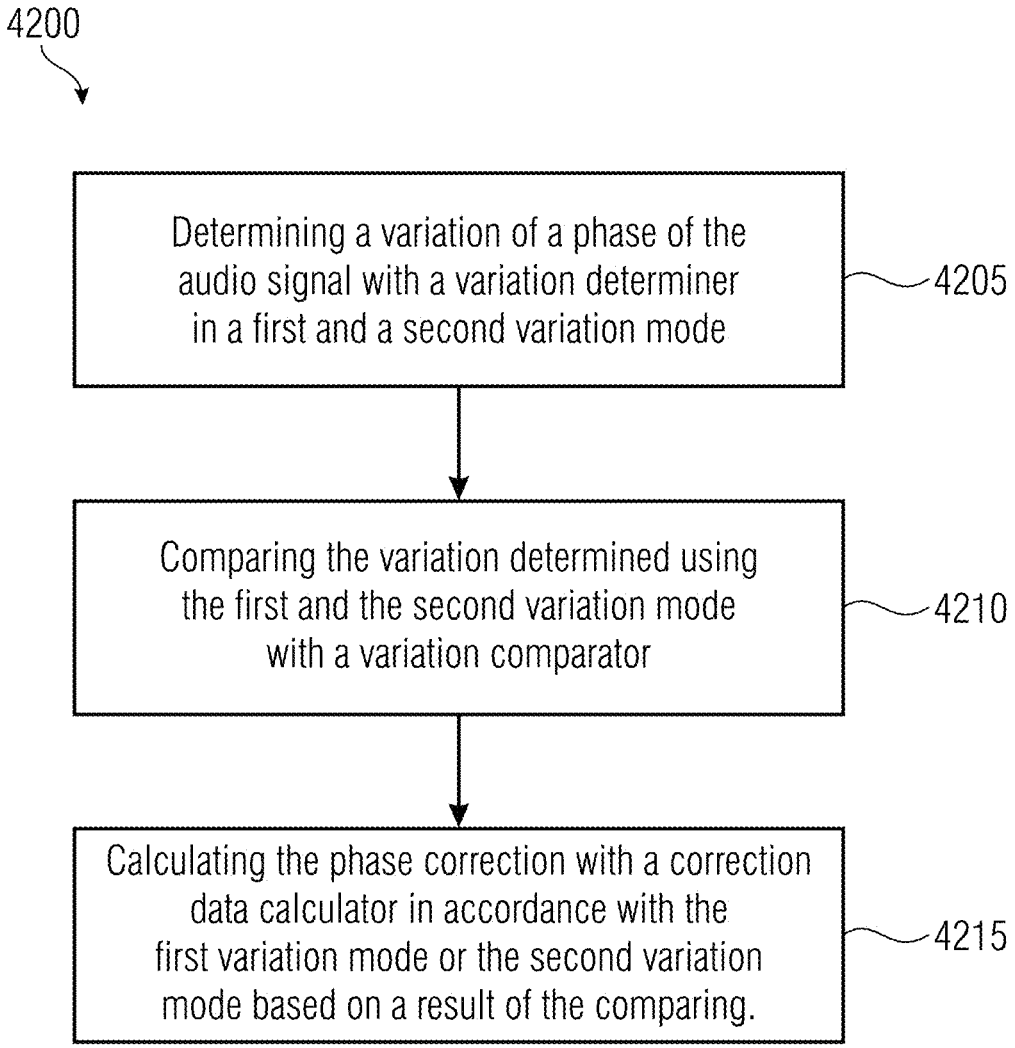
FIG. 42 shows a schematic block diagram of a method for determining phase correction data for an audio signal.

FIG. 42 shows a method 4200 for determining phase correction data from an audio signal. The method 4200 comprises a step 4205 "determining a variation of a phase of the audio signal with a variation determiner in a first and a second variation mode", a step 4210 "comparing the variation determined using the first and the second variation mode with a variation comparator", and a step 4215 "calculating the phase correction with a correction data calculator in accordance with the first variation mode or the second variation mode based on a result of the comparing".

Figure 43A:
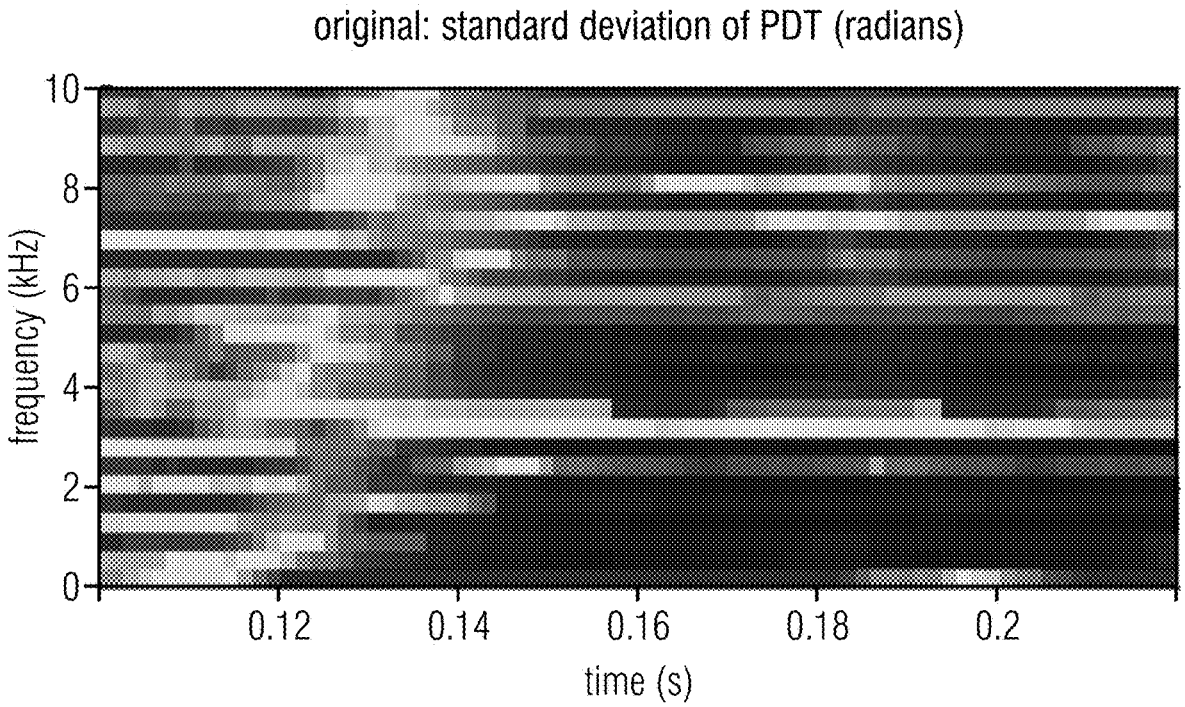
FIG. 43*a* shows a standard deviation of the phase derivative over time of the violin signal in the QMF domain in a time-frequency representation.
Figure 43B:
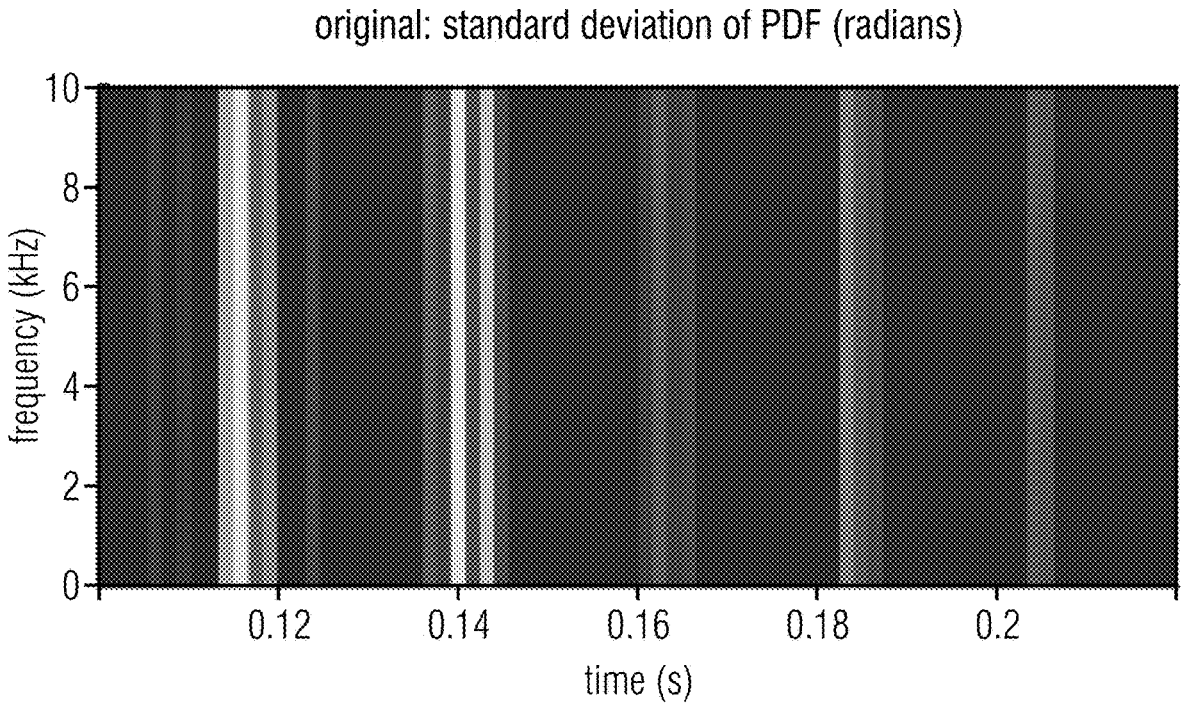
FIG. 43*b* shows the standard deviation of the phase derivative over frequency corresponding to the standard deviation of the phase derivative over time shown with respect to FIG. 43*a;*
Figure 43C:
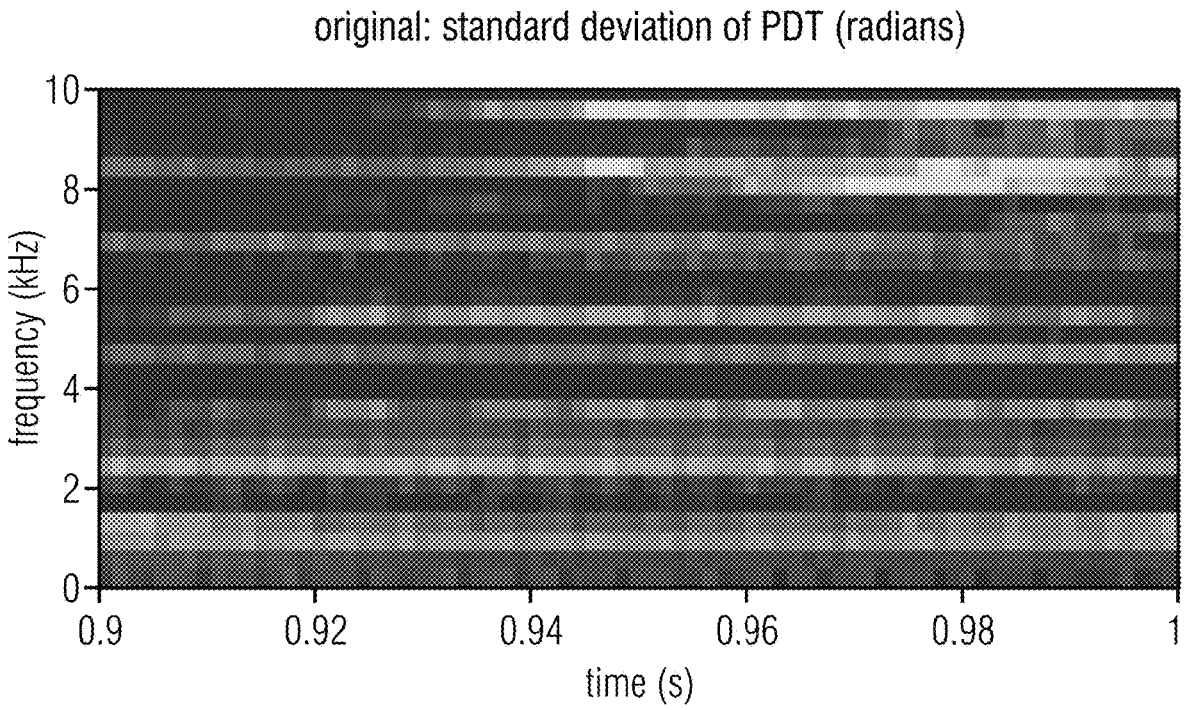
FIG. 43*c* shows the standard deviation of the phase derivative over time of the trombone signal in the QMF domain in a time-frequency representation.
Figure 43D:
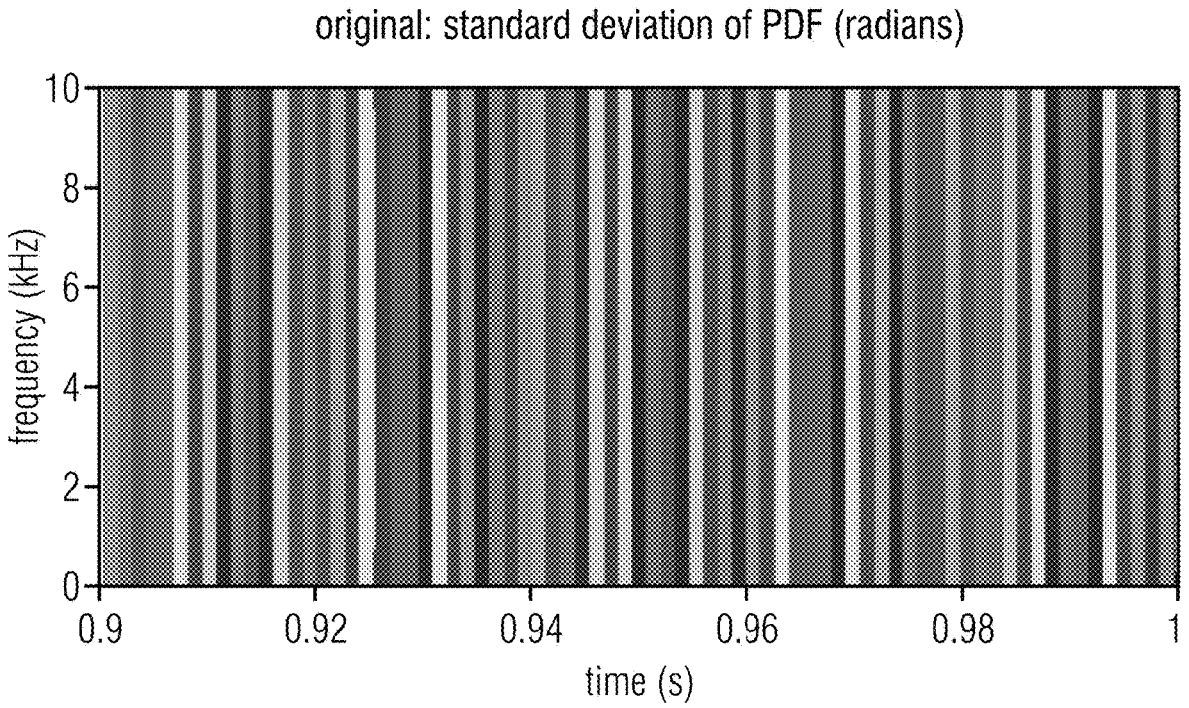
FIG. 43*d* shows the standard deviation of the phase derivative over frequency corresponding to the standard deviation of the phase derivative over time shown in FIG. 43*c;*

In other words, the PDT of the violin is smooth over time whereas the PDF of the trombone is smooth over frequency. Hence, the standard deviation (STD) of these measures as a measure of the variation can be used to select the appropriate correction method. The STD of the phase derivative over time can be computed as $$X^{stdt1}(k,n)=\text{circstd}\{X^{pdt}(k,n+l)\},-23\le l\le 0,$$

$$X^{stdt2}(k,n)=\text{circstd}\{X^{pdt}(k,n+l)\},0\le l\le 23,$$

$$X^{stdt}(k\ n)=\min\{X^{stdt1}(k,n),X^{stdt2}(k,n)\}, \tag{27}$$

and the STD of the phase derivative over frequency as $$X^{stdf}(n)=\text{circstd}\{X^{pdf}(k,n)\},2\le k\le 13, \tag{28}$$

where circstd{ } denotes computing circular STD (the angle values could potentially be weighted by energy in order to avoid high STD due to noisy low-energy bins, or the STD computation could be restricted to bins with sufficient energy). The STDs for the violin and the trombone are shown in FIGS. 43*a*, 43*b* and FIGS. 43*c*, 43*d*, respectively. FIGS. 43*a* and *c* show the standard deviation of the phase derivative over time $X^{stdt}$(k,n) in the QMF domain, wherein FIGS. 43*b* and 43*d* show the corresponding standard deviation over frequency $X_{stdf}$(n) without phase correction. The color gradient indicates values from red=1 to blue=0. It can be seen that the STD of PDT is lower for the violin whereas the STD of PDF is lower for the trombone (especially for time-frequency tiles which have high energy).

The used correction method for each temporal frame is selected based on which of the STDs is lower. For that, $X^{stdt}$(k,n) values have to be combined over frequency. The merging is performed by computing an energy-weighted mean for a predefined frequency range $$X^{stdt}(k,n)=\frac{\sum_{k=2}^{19}X^{stdt}(k,n)X^{mag}(k,n)}{\sum_{k=2}^{19}X^{mag}(k,n)}. \tag{29}$$

The deviation estimates are smoothened over time in order to have smooth switching, and thus to avoid potential artifacts. The smoothing is performed using a Hann window and it is weighted by the energy of the temporal frame $$X_{sm}^{stdt}(n)=\frac{\sum_{l=-10}^{10}X^{stdt}(n+l)X^{mag}(n+l)W(l)}{\sum_{l=-10}^{10}X^{mag}(n+l)W(l)}, \tag{30}$$

where W(l) is the window function and $$X^{mag}(n)=\sum_{k=1}^{64}X^{mag}(k,n)$$

is the sum of $X^{mag}$(k,n) over frequency. A corresponding equation is used for smoothing $X^{stdf}$(n).

The phase-correction method is determined by comparing $X_{sm}^{stdt}$(n) and $X_{sm}^{stdf}$(n). The default method is PDT (horizontal) correction, and if $X_{sm}^{stdf}(n)<X_{sm}^{stdt}(n)$, PDF (vertical) correction is applied for the interval [n−5, n+5]. If both of the deviations are large, e.g. larger than a predefined threshold value, neither of the correction methods is applied, and bit-rate savings could be made.

8.4 Transient Handling—Phase Derivative Correction for Transients

Figure 44A:
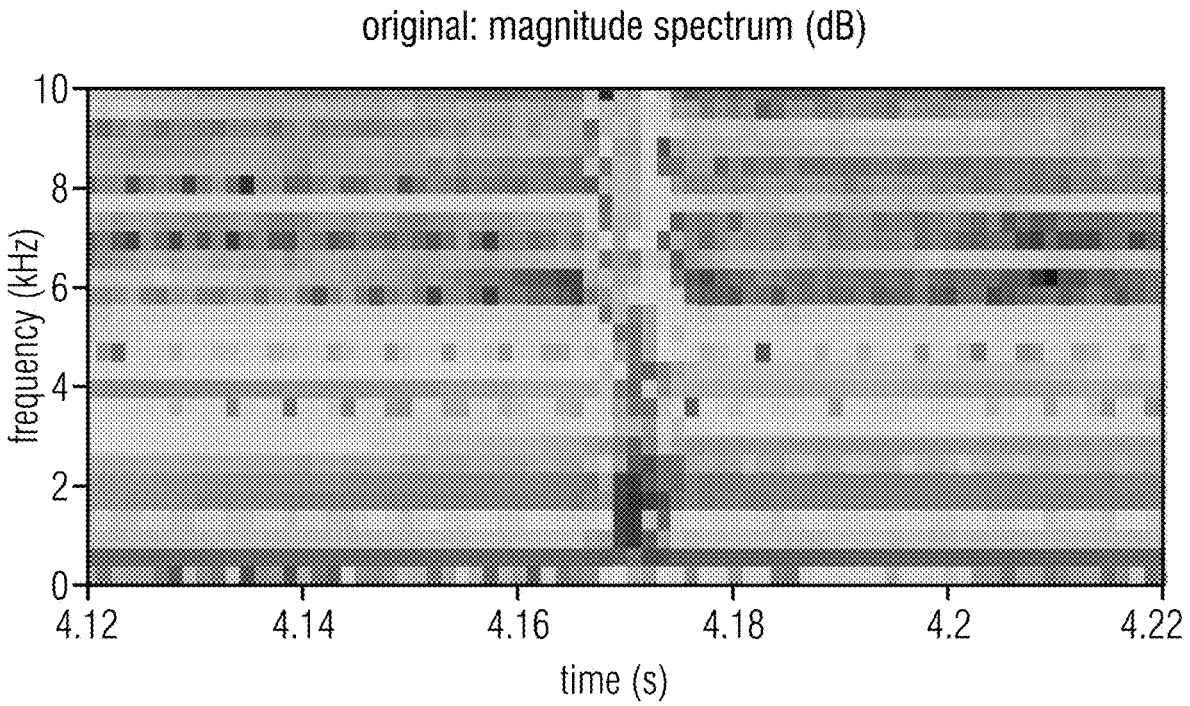
FIG. 44*a* shows the magnitude of a violin+clap signal in the QMF domain in a time-frequency representation.
Figure 44B:
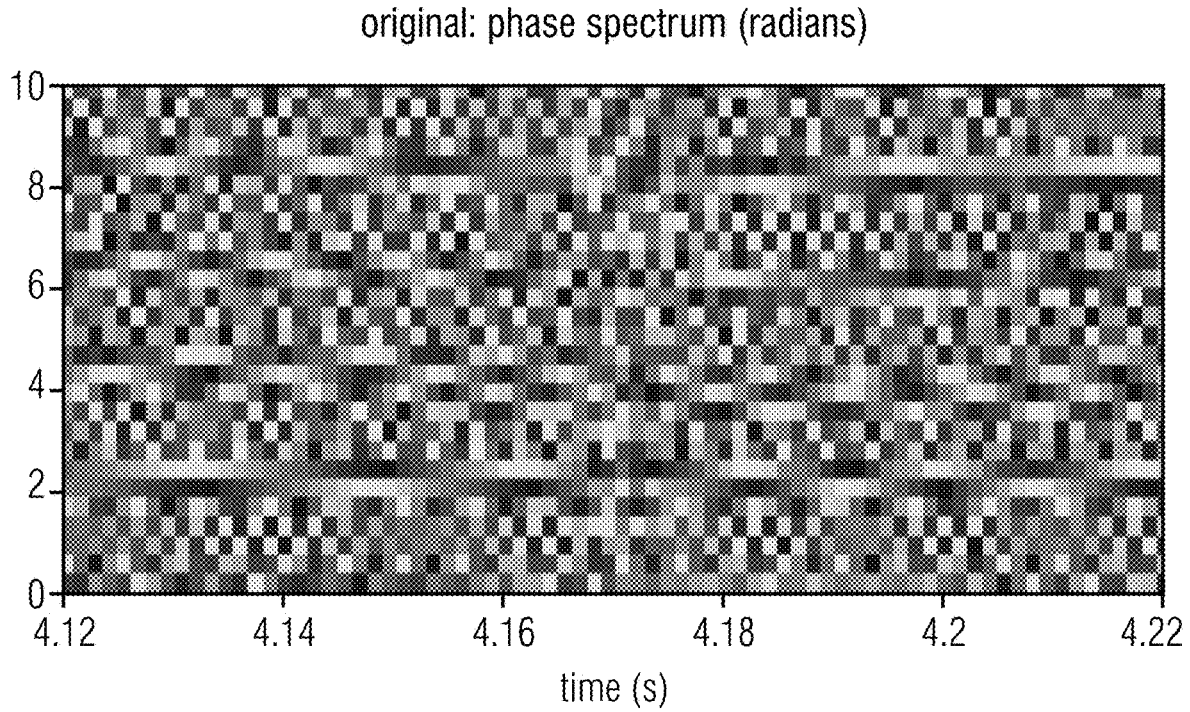
FIG. 44*b* shows the phase spectrum corresponding to the magnitude spectrum shown in FIG. 44*a;*
Figure 45A:
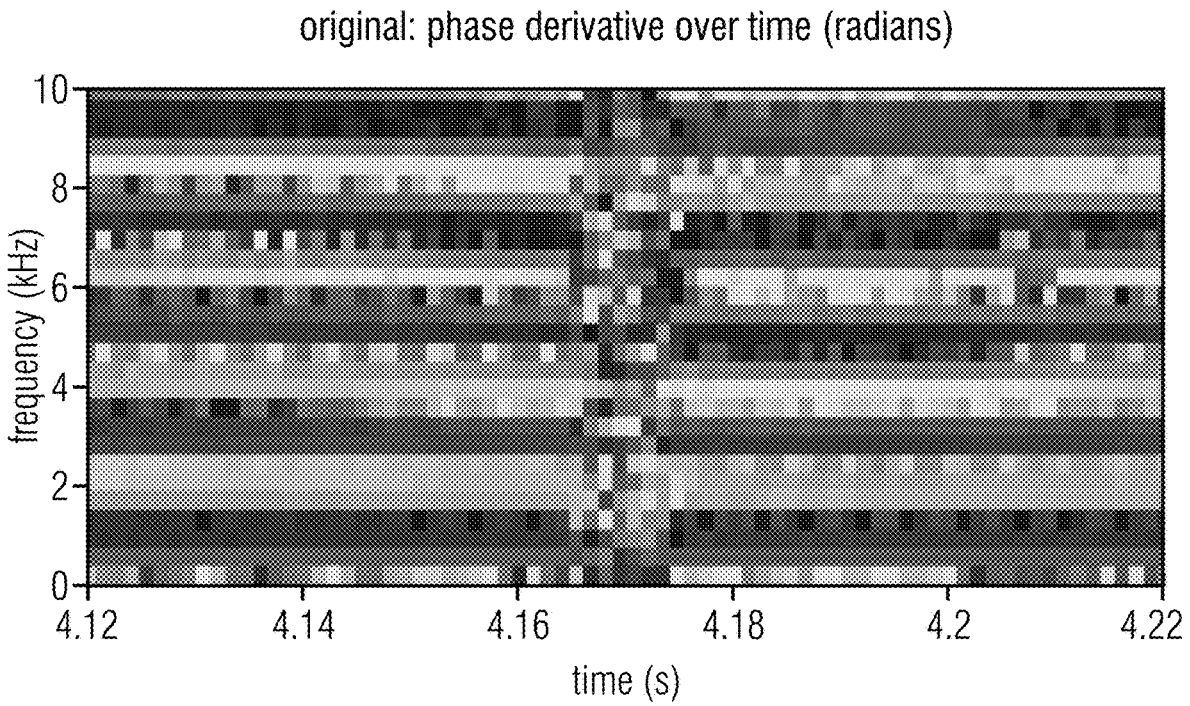
FIG. 45*a* shows a phase derivative over time of the violin+clap signal in the QMF domain in a time-frequency representation.
Figure 45B:
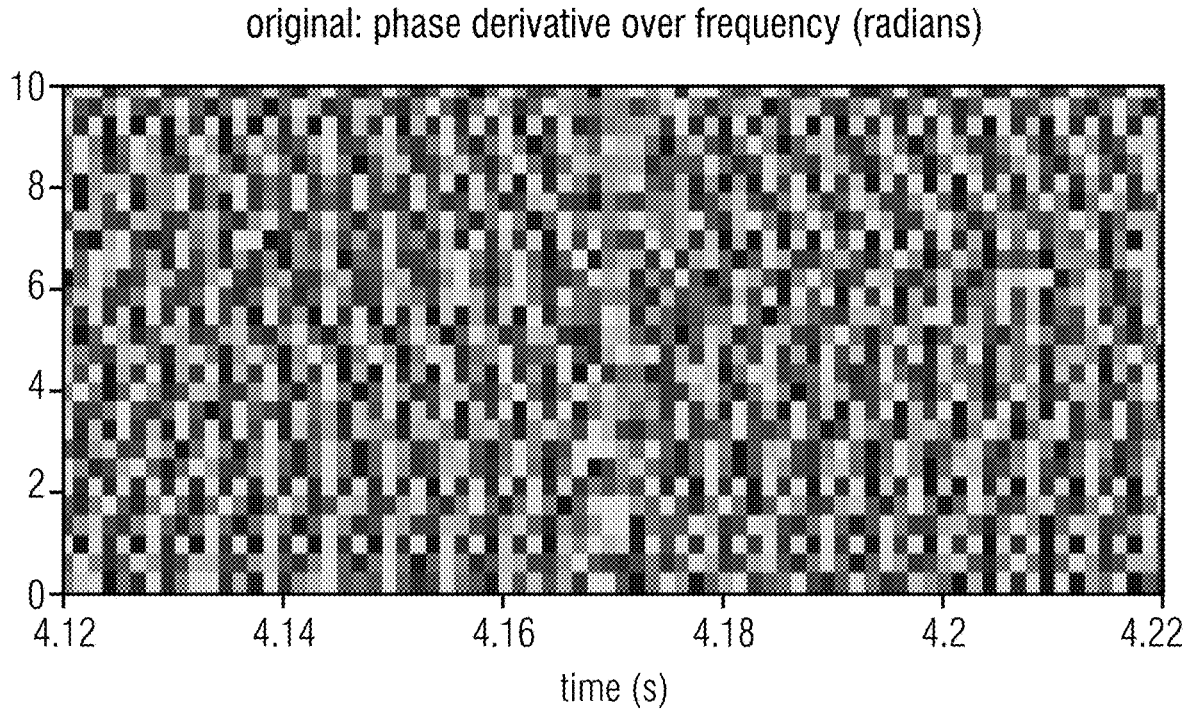
FIG. 45*b* shows the phase derivative over frequency corresponding to the phase derivative over time shown in FIG. 45*a;*

The violin signal with a hand clap added in the middle is presented FIG. 44. The magnitude $X^{mag}$(k,n) of a violin+clap signal in the QMF domain is shown in FIG. 44*a*, and the corresponding phase spectrum $X^{pha}$(k,n) in FIG. 44*b*. Regarding FIG. 44*a*, the color gradient indicates magnitude values from red=0 dB to blue=−80 dB. Accordingly, for FIG. 44*b*, the phase gradient indicates phase values from red=π to blue=−π. The phase derivatives over time and over frequency are presented in FIG. 45. The phase derivative over time $X^{pdt}$(k,n) of the violin+clap signal in the QMF domain is shown in FIG. 45*a*, and the corresponding phase derivative over frequency $X^{pdf}$(k,n) in FIG. 45*b*. The color gradient indicates phase values from red=π to blue=−π. It can be seen that the PDT is noisy for the clap, but the PDF is somewhat smooth, at least at high frequencies. Thus, PDF correction should be applied for the clap in order to maintain the sharpness of it. However, the correction method suggested in Section 8.2 might not work properly with this signal, because the violin sound is disturbing the derivatives at low frequencies. As a result, the phase spectrum of the baseband does not reflect the high frequencies, and thus the phase correction of the frequency patches using a single value may not work. Furthermore, detecting the transients based on the variation of the PDF value (see Section 8.3) would be difficult due to noisy PDF values at low frequencies.

The solution to the problem is straightforward. First, the transients are detected using a simple energy-based method. The instant energy of mid/high frequencies is compared to a smoothened energy estimate. The instant energy of mid/high frequencies is computed as $$X^{magmh}(n) = \sum_{k=6}^{64} X^{mag}(k, n). \tag{31}$$

The smoothing is performed using a first-order IIR filter $$X_{sm}^{magmh}(n)=0.1\cdot X^{magmh}(n)+0.9\cdot X_{sm}^{magmh}(n-1). \tag{32}$$

If $X^{magmh}(n)/X_{sm}^{magmh}(n)>\theta$, a transient has been detected. The threshold θ can be fine-tuned to detect the desired amount of transients. For example, θ=2 can be used. The detected frame is not directly selected to be the transient frame. Instead, the local energy maximum is searched from the surrounding of it. In the current implementation the selected interval is [n−2, n+7]. The temporal frame with the maximum energy inside this interval is selected to be the transient.

In theory, the vertical correction mode could also be applied for transients. However, in the case of transients, the phase spectrum of the baseband often does not reflect the high frequencies. This can lead to pre- and post-echoes in the processed signal. Thus, slightly modified processing is suggested for the transients.

The average PDF of the transient at high frequencies is computed $$X_{avghi}^{pdf}(n)=\text{circmean}\{X^{pdf}(k,n)\},-11\leq k\leq 36. \tag{33}$$

The phase spectrum for the transient frame is synthesized using this constant phase change as in Eq. 24, but $X_{avg}^{pdf}(n)$ is replaced by $X_{avghi}^{pdf}(n)$. The same correction is applied to the temporal frames within the interval [n−2, n+2] (π is added to the PDF of the frames n−1 and n+1 due to the properties of the QMF, see Section 6). This correction already produces a transient to a suitable position, but the shape of the transient is not necessarily as desired, and significant side lobes (i.e., additional transients) can be present due to the considerable temporal overlap of the QMF frames. Hence, the absolute phase angle has to be correct, too. The absolute angle is corrected by computing the mean error between the synthesized and the original phase spectrum. The correction is performed separately for each temporal frame of the transient.

Figure 46A:
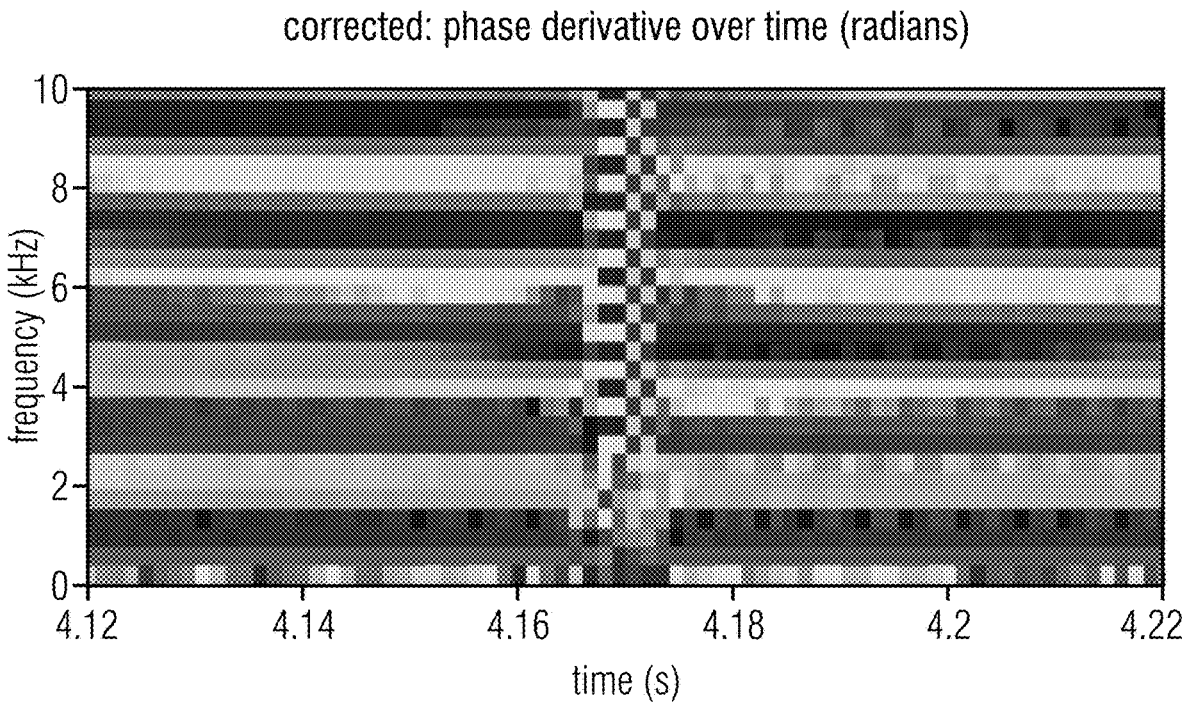
FIG. 46*a* shows a phase derivative over time of the violin+clap signal in the QMF domain using corrected SBR in a time frequency representation.
Figure 46B:
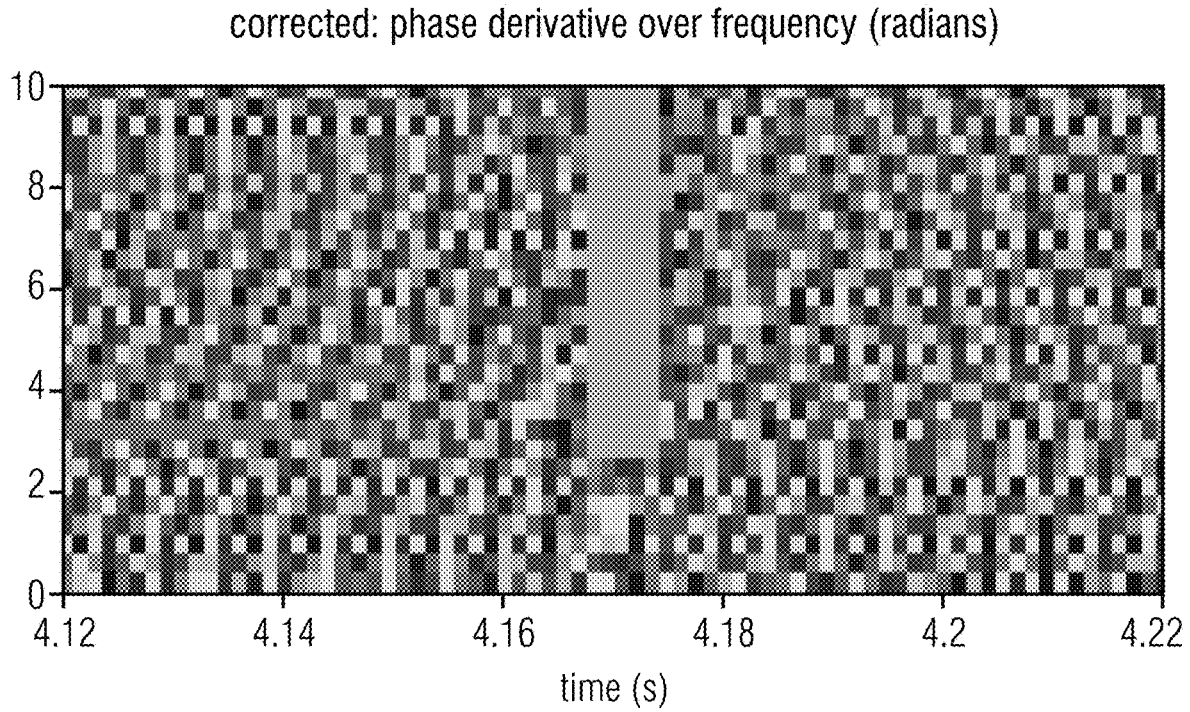
FIG. 46*b* shows the phase derivative over frequency corresponding to the phase derivative over time shown in FIG. 46*a;*

The result of the transient correction is presented in FIG. 46. A phase derivative over time $X^{pdt}(k,n)$ of the violin+clap signal in the QMF domain using the phase corrected SBR is shown. FIG. 47*b* shows the corresponding phase derivative over frequency $X^{pdf}(k,n)$. Again, the color gradient indicates phase values from red=π to blue=−π. It can be perceived that the phase-corrected clap has the same sharpness as the original signal, although the difference compared to the direct copy-up is not large. Hence, the transient correction need not necessarily be performed in all cases when only the direct copy-up is enabled. On the contrary, if the PDT correction is enabled, it is important to have transient handling, as the PDT correction would otherwise severely smear the transients.

9 Compression of the Correction Data

Section 8 showed that the phase errors can be corrected, but the adequate bit rate for the correction was not considered at all. This section suggests methods how to represent the correction data with low bit rate.

9.1 Compression of the PDT Correction Data—Creating the Target Spectrum for the Horizontal Correction There are many possible parameters that could be transmitted to enable the PDT correction. However, since $D_{sm}^{pdt}(k,n)$ is smoothened over time, it is a potential candidate for low-bit-rate transmission.

First, an adequate update rate for the parameters is discussed. The value was updated only for every N frames and linearly interpolated in between. The update interval for good quality is about 40 ms. For certain signals a bit less is advantageous and for others a bit more. Formal listening tests would be useful for assessing an optimal update rate. Nevertheless, a relatively long update interval appear to be acceptable.

An adequate angular accuracy for $D_{sm}^{pdt}(k,n)$ was also studied. 6 bits (64 possible angle values) is enough for perceptually good quality. Furthermore, transmitting only the change in the value was tested. Often the values appear to change only a little, so uneven quantization can be applied to have more accuracy for small changes. Using this approach, 4 bits (16 possible angle values) was found to provide good quality.

The last thing to consider is an adequate spectral accuracy. As can be seen in FIG. 17, many frequency bands seem to share roughly the same value. Thus, one value could probably be used to represent several frequency bands. In addition, at high frequencies there are multiple harmonics inside one frequency band, so less accuracy is probably needed. Nevertheless, another, potentially better, approach was found, so these options were not thoroughly investigated. The suggested, more effective, approach is discussed in the following.

9.1.1 Using Frequency Estimation for Compressing PDT Correction Data

As discussed in Section 5, the phase derivative over time basically means the frequency of the produced sinusoid. The PDTs of the applied 64-band complex QMF can be transformed to frequencies using the following equation $$X^{freq}(k, n) = \frac{f_s}{64}\left|\frac{(k-1.5)}{2} + \left(\left[\left(\frac{X^{pdt}(k, n)}{2\pi}\bmod 1\right) + \frac{(-1)^k}{4} + \frac{1}{2}\right]\bmod 1\right)\right|. \tag{34}$$

Figure 47:
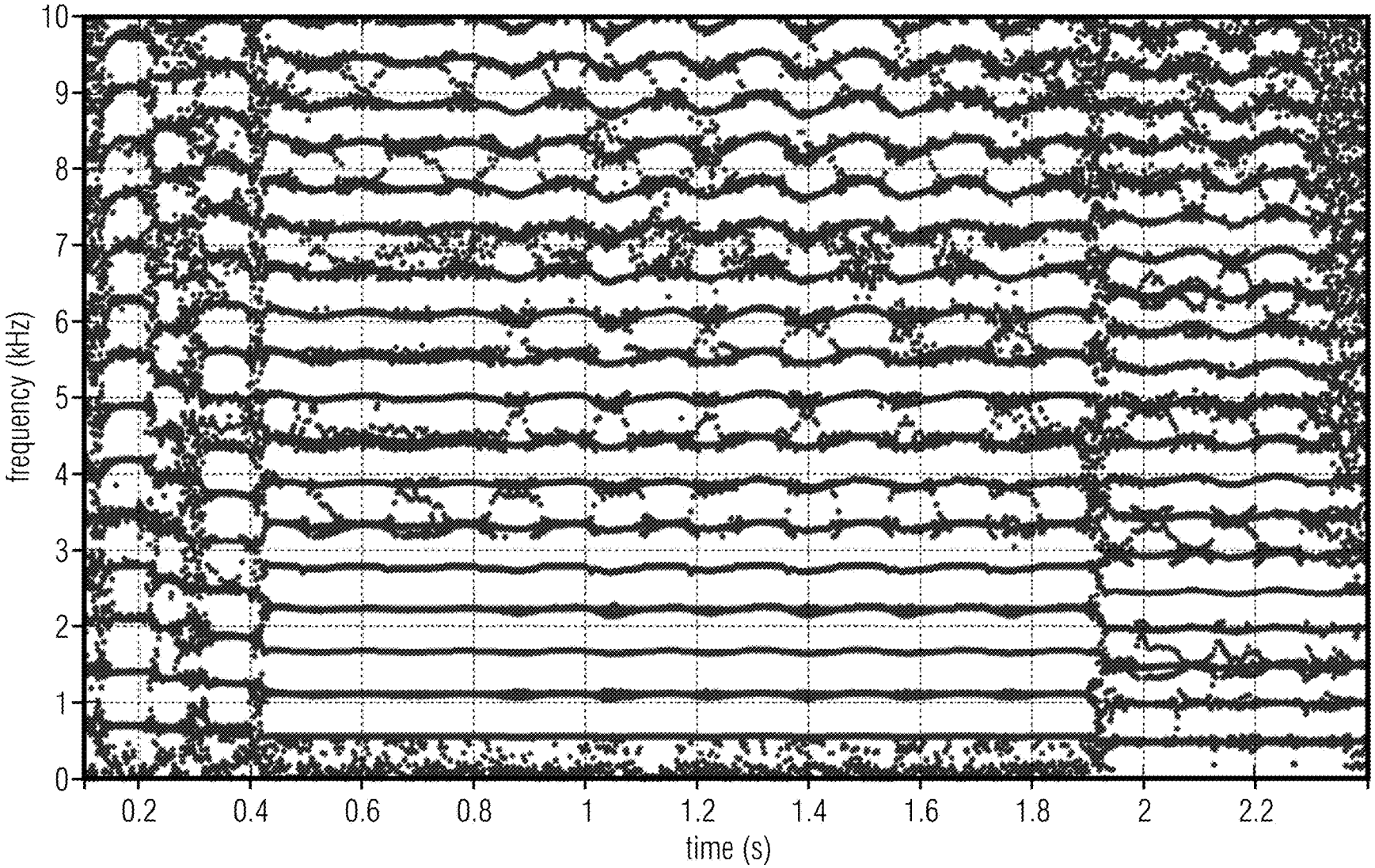
FIG. 47 shows the frequencies of the QMF bands in a time-frequency representation.

The produced frequencies are inside the interval $f_{inter}(k)=[f_c(k)-f_{BW}, f_c(k)+f_{BW}]$, where $f_c(k)$ is the center frequency of the frequency band k and $f_{BW}$ is 375 Hz. The result is shown in FIG. 47 in a time-frequency representation of the frequencies of the QMF bands $X^{freq}(k,n)$ for the violin signal. It can be seen that the frequencies seem to follow the multiples of the fundamental frequency of the tone and the harmonics are thus spaced in frequency by the fundamental frequency. In addition, vibrato seems to cause frequency modulation.

Figure 48A:
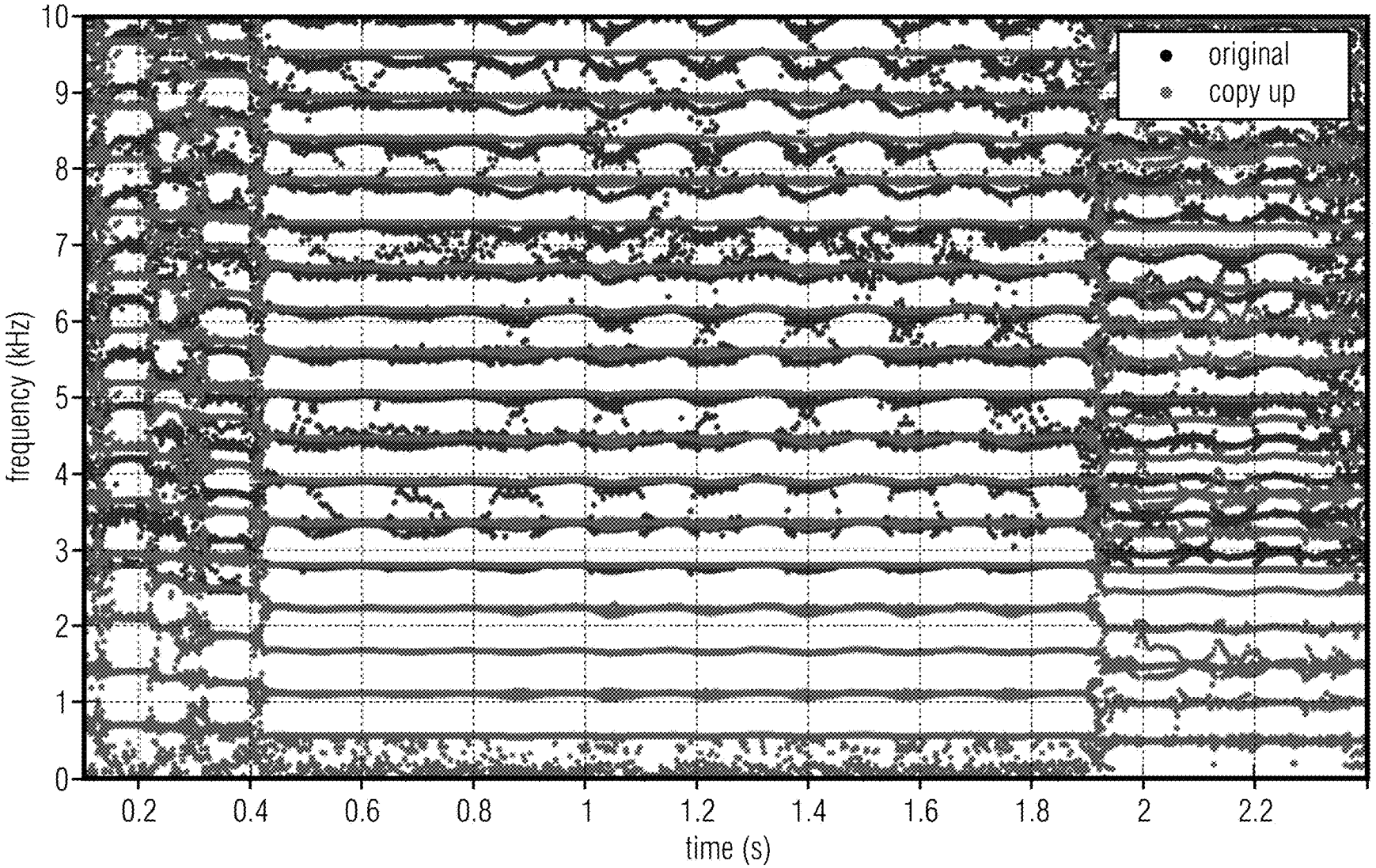
FIG. 48*a* shows the frequencies of the QMF bands direct copy-up SBR compared to the original frequencies shown in a time-frequency representation.
Figure 48B:
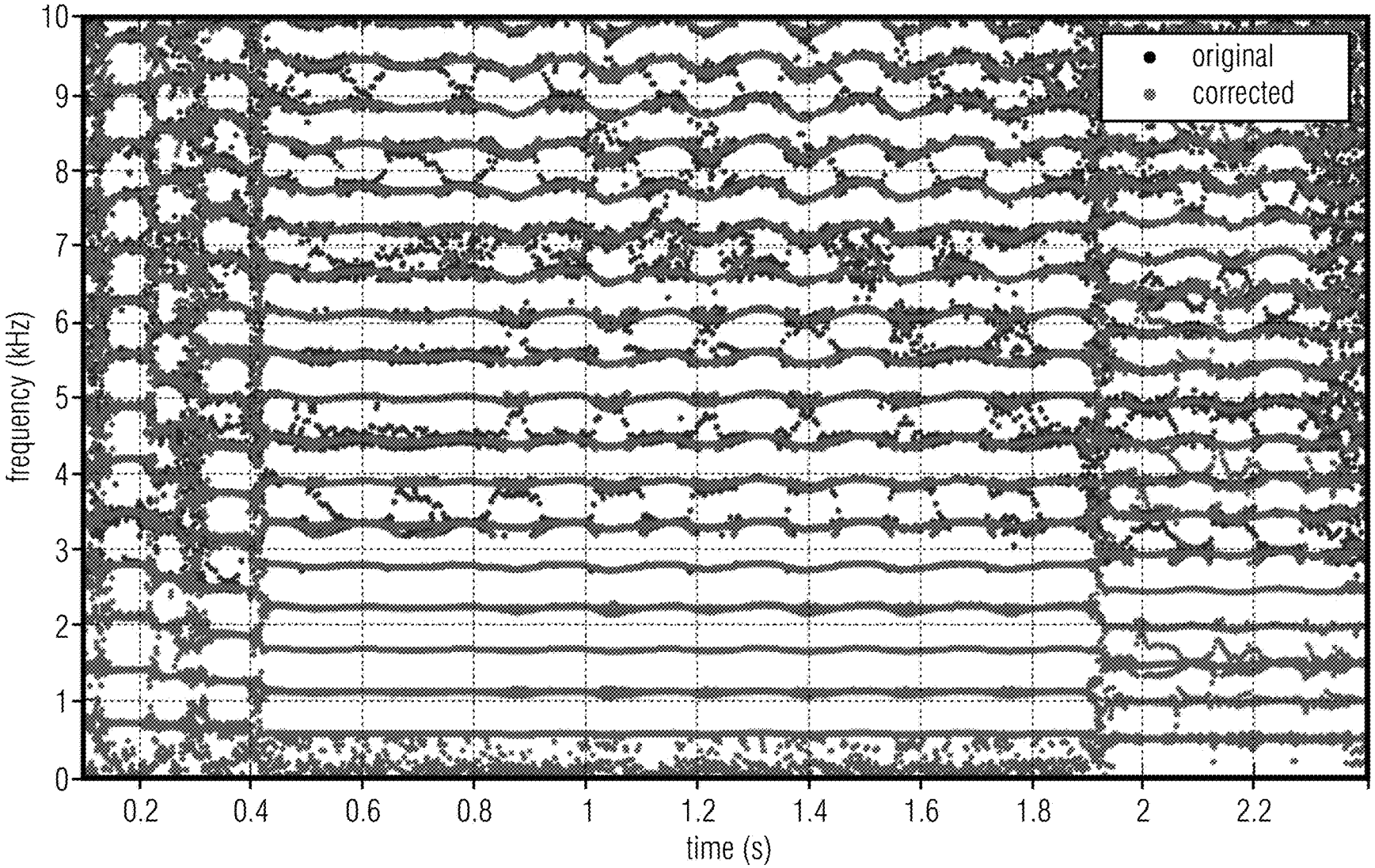
FIG. 48*b* shows the frequencies of the QMF band using corrected SBR compared to the original frequencies in a time-frequency representation.

The same plot can be applied to the direct copy-up $Z^{freq}(k,n)$ and the corrected $Z_{ch}^{freq}(k,n)$ SBR (see FIG. 48*a* and FIG. 48*b*, respectively). FIG. 48*a* shows a time-frequency representation of the frequencies of the QMF bands of the direct copy-up SBR signal $Z^{freq}(k,n)$ compared to the original signal $X^{freq}(k,n)$, shown in FIG. 47. FIG. 48*b* shows the corresponding plot for the corrected SBR signal $Z_{ch}^{freq}(k,n)$. In the plots of FIG. 48*a* and FIG. 48*b*, the original signal is drawn in a blue color, wherein the direct copy-up SBR and the corrected SBR signals are drawn in red. The inharmonicity of the direct copy-up SBR can be seen in the figure, especially in the beginning and the end of the sample. In addition, it can be seen that the frequency-modulation depth is clearly smaller than that of the original signal. On the contrary, in the case of the corrected SBR, the frequencies of the harmonics seem to follow the frequencies of the original signal. In addition, the modulation depth appears to be correct. Thus, this plot seems to confirm the validity of the suggested correction method. Therefore, it is concentrated on the actual compression of the correction data next.

Since the frequencies of $X^{freq}(k,n)$ are spaced by the same amount, the frequencies of all frequency bands can be approximated if the spacing between the frequencies is estimated and transmitted. In the case of harmonic signals, the spacing should be equal to the fundamental frequency of the tone. Thus, only a single value has to be transmitted for representing all frequency bands. In the case of more irregular signals, more values are needed for describing the harmonic behavior. For example, the spacing of the harmonics slightly increases in the case of a piano tone [14]. For simplicity, it is assumed in the following that the harmonics are spaced by the same amount. Nonetheless, this does not limit the generality of the described audio processing.

Thus, the fundamental frequency of the tone is estimated for estimating the frequencies of the harmonics. The estimation of fundamental frequency is a widely studied topic (e.g., see [14]). Therefore, a simple estimation method was implemented to generate data used for further processing steps. The method basically computes the spacings of the harmonics, and combines the result according to some heuristics (how much energy, how stable is the value over frequency and time, etc.). In any case, the result is a fundamental-frequency estimate for each temporal frame $X^{f_0}(n)$. In other words, the phase derivative over time relates to the frequency of the corresponding QMF bin. In addition, the artifacts related to errors in the PDT are perceivable mostly with harmonic signals. Thus, it is suggested that the target PDT (see Eq. 16a) can be estimated using the estimation of the fundamental frequency $f_0$. The estimation of a fundamental frequency is a widely studied topic, and there are many robust methods available for obtaining reliable estimates of the fundamental frequency.

Here, the fundamental frequency $X^{f_0}(n)$, as known to the decoder prior to performing BWE and employing the inventive phase correction within BWE, is assumed. Therefore, it is advantageous that the encoding stage transmits the estimated fundamental frequency $X^{f_0}(n)$. In addition, for improved coding efficiency, the value can be updated only for, e.g., every 20th temporal frame (corresponding to an interval of ~27 ms), and interpolated in between.

Alternatively, the fundamental frequency could be estimated in the decoding stage, and no information has to be transmitted. However, better estimates can be expected if the estimation is performed with the original signal in the encoding stage.

The decoder processing begins by obtaining a fundamental-frequency estimate $X^{f_0}(n)$ for each temporal frame.

The frequencies of the harmonics can be obtained by multiplying it with an index vector $$\forall \kappa \exists \mathbb{N} : X^{harm}(\kappa,n)=\kappa \cdot X^{f_0}(n) \tag{35}$$

Figure 49:
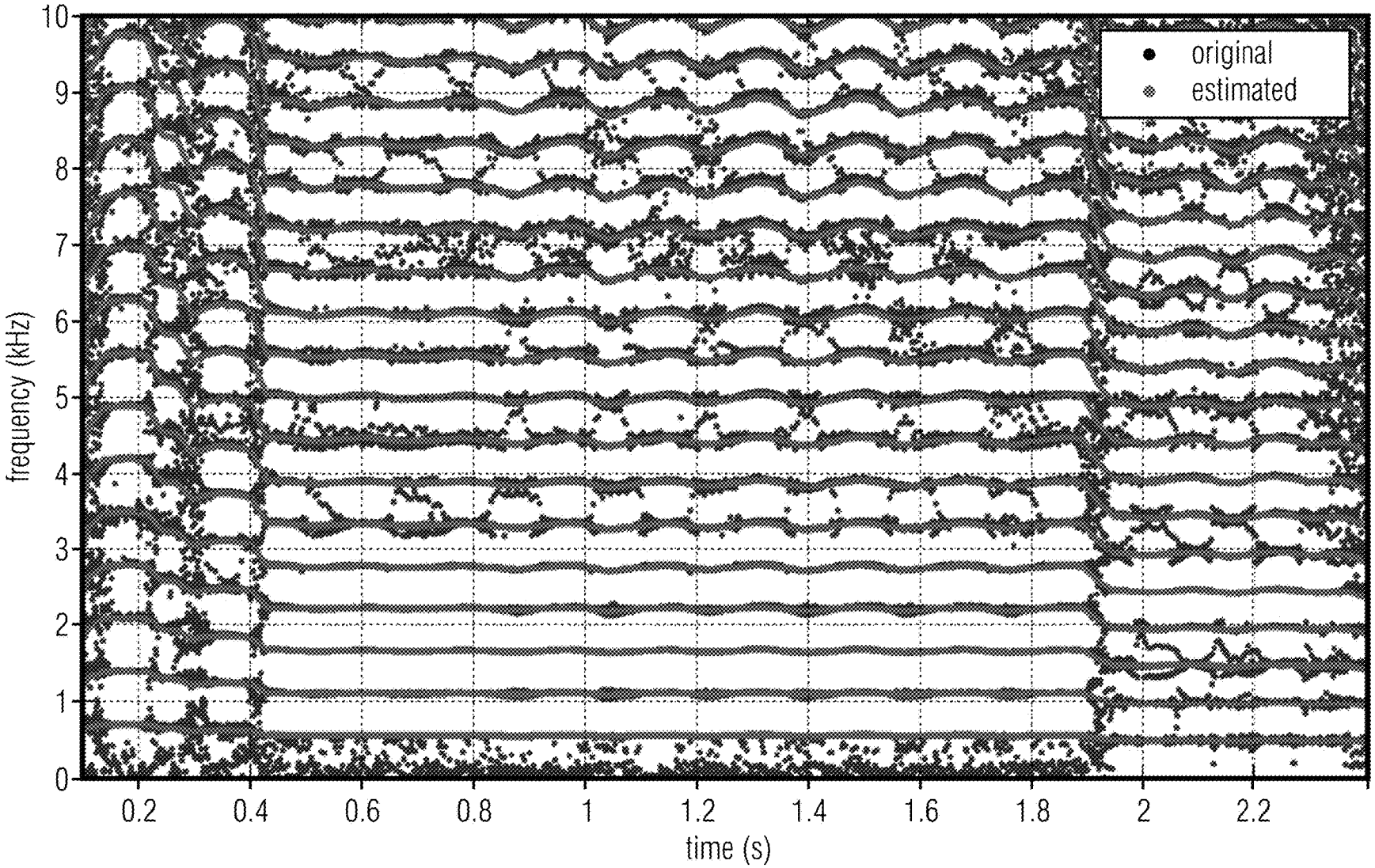
FIG. 49 shows estimated frequencies of the harmonics compared to the frequencies of the QMF bands of the original signal in a time-frequency representation.

The result is depicted in FIG. 49. FIG. 49 shows a time frequency representation of the estimated frequencies of the harmonics $X^{harm}(\kappa,n)$ compared to the frequencies of the QMF bands of the original signal $X^{freq}(k,n)$. Again, blue indicates the original signal and red the estimated signal. The frequencies of the estimated harmonics match the original signal quite well. These frequencies can be thought as the 'allowed' frequencies. If the algorithm produces these frequencies, inharmonicity related artifacts should be avoided.

The transmitted parameter of the algorithm is the fundamental frequency $X^{f_0}(n)$. For improved coding efficiency, the value is updated only for every 20th temporal frame (i.e., every 27 ms). This value appears to provide good perceptual quality based on informal listening. However, formal listening tests are useful for assessing a more optimal value for the update rate.

The next step of the algorithm is to find a suitable value for each frequency band. This is performed by selecting the value of $X^{harm}(\kappa,n)$ which is closest to the center frequency of each band $f_c(k)$ to reflect that band. If the closest value is outside the possible values of the frequency band ($f_{inter}(k)$), the border value of the band is used. The resulting matrix $X_{eh}^{freq}(k,n)$ contains a frequency for each time-frequency tile.

Figure 50A:
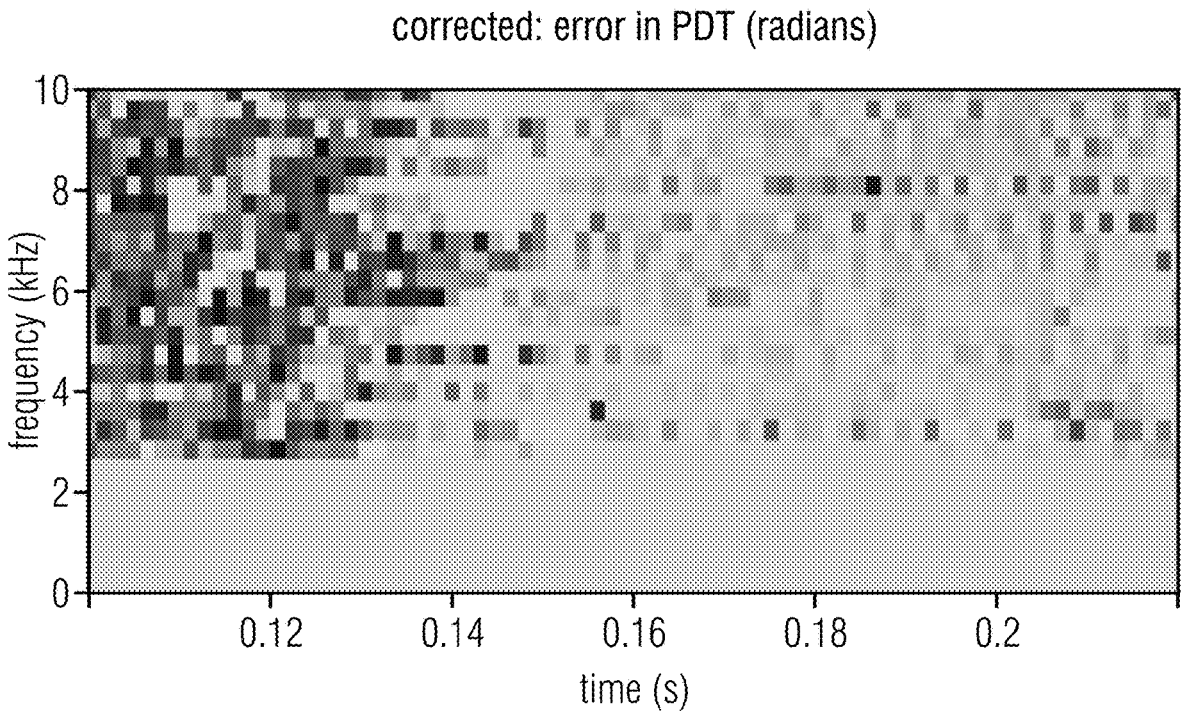
FIG. 50*a* shows the error in the phase derivative over time of the violin signal in the QMF domain using corrected SBR with compressed correction data in a time-frequency representation.
Figure 50B:
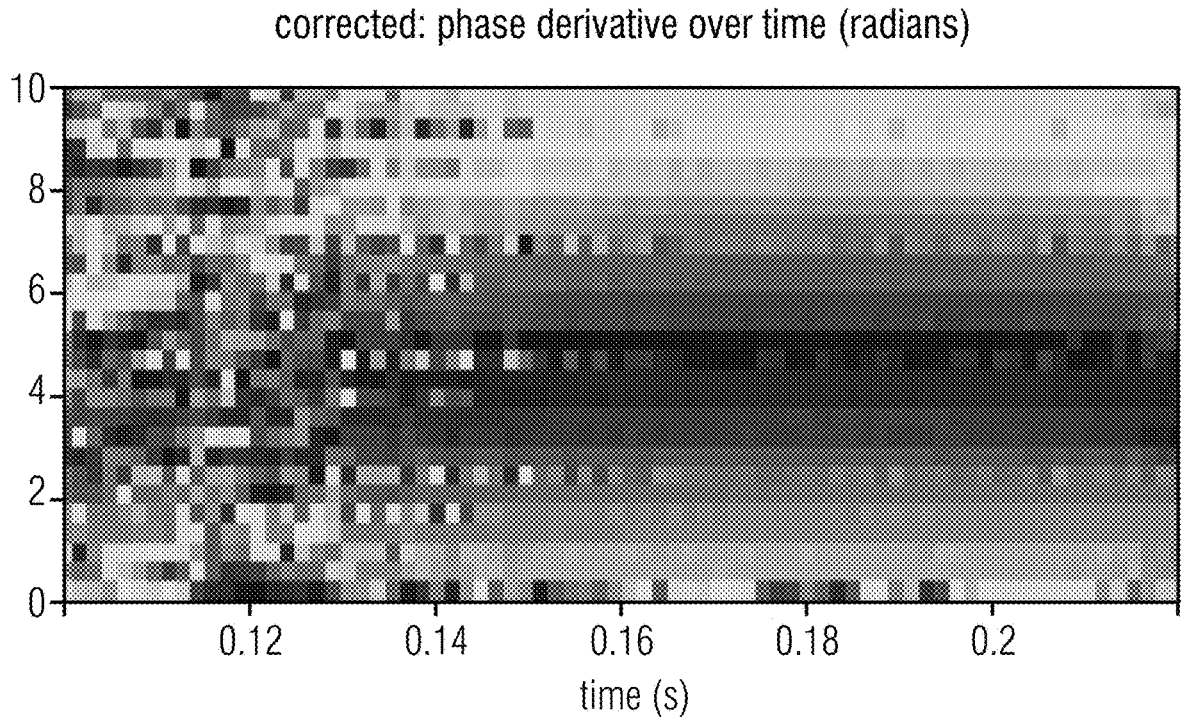
FIG. 50*b* shows the phase derivative over time corresponding to the error of the phase derivative over time shown in FIG. 50*a;*

The final step of the correction-data compression algorithm is to convert the frequency data back to the PDT data $$X_{eh}^{pdt}(k,n) = 2\pi \cdot \left( \frac{64 \cdot X_{estim}^{freq}(k,n)}{f_s} \bmod 1 \right), \tag{36}$$

where mod( ) denotes the modulo operator. The actual correction algorithm works as presented in Section 8.1. $Z_{th}^{pdt}(k,n)$ in Eq. 16a is replaced by $X_{eh}^{pdt}(k,n)$ as the target PDT, and Eqs. 17-19 are used as in Section 8.1. The result of the correction algorithm with compressed correction data is shown in FIG. 50. FIG. 50 shows the error in the PDT $D_{sm}^{pdt}(k,n)$ of the violin signal in the QMF domain of the corrected SBR with compressed correction data. FIG. 50*b* shows the corresponding phase derivative over time $Z_{ch}^{pdt}(k,n)$. The color gradients indicates values from red=$\pi$ to blue=$-\pi$. The PDT values follow the PDT values of the original signal with similar accuracy as the correction method without the data compression (see FIG. 18). Thus, the compression algorithm is valid. The perceived quality with and without the compression of the correction data is similar.

Embodiments use more accuracy for low frequencies and less for high frequencies, using the total of 12 bits for each value. The resulting bit rate is about 0.5 kbps (without any compression, such as entropy coding). This accuracy produces equal perceived quality as no quantization. However, significantly lower bit rate can probably be used in many cases producing good enough perceived quality.

One option for low-bit-rate schemes is to estimate the fundamental frequency in the decoding phase using the transmitted signal. In this case no values have to be transmitted. Another option is to estimate the fundamental frequency using the transmitted signal, compare it to the estimate obtained using the broadband signal, and to transmit only the difference. It can be assumed that this difference could be represented using very low bit rate.

9.2 Compression of the PDF Correction Data

As discussed in Section 8.2, the adequate data for the PDF correction is the average phase error of the first frequency patch $D_{avg}^{pha}(n)$. The correction can be performed for all frequency patches with the knowledge of this value, so the transmission of only one value for each temporal frame may be used. However, transmitting even a single value for each temporal frame can yield too high a bit rate.

Inspecting FIG. 12 for the trombone, it can be seen that the PDF has a relatively constant value over frequency, and the same value is present for a few temporal frames. The value is constant over time as long as the same transient is dominating the energy of the QMF analysis window. When a new transient starts to be dominant, a new value is present. The angle change between these PDF values appears to be the same from one transient to another. This makes sense, since the PDF is controlling the temporal location of the transient, and if the signal has a constant fundamental frequency, the spacing between the transients should be constant.

Hence, the PDF (or the location of a transient) can be transmitted only sparsely in time, and the PDF behavior in between these time instants could be estimated using the knowledge of the fundamental frequency. The PDF correction can be performed using this information. This idea is actually dual to the PDT correction, where the frequencies of the harmonics are assumed to be equally spaced. Here, the same idea is used, but instead, the temporal locations of the transients are assumed to be equally spaced. A method is suggested in the following that is based on detecting the positions of the peaks in the waveform, and using this information, a reference spectrum is created for phase correction.

9.2.1 Using Peak Detection for Compressing PDF Correction Data—Creating the Target Spectrum for the Vertical Correction The positions of the peaks have to be estimated for performing successful PDF correction. One solution would be to compute the positions of the peaks using the PDF value, similarly as in Eq. 34, and to estimate the positions of the peaks in between using the estimated fundamental frequency. However, this approach would involve a relatively stable fundamental-frequency estimation. Embodiments show a simple, fast to implement, alternative method, which shows that the suggested compression approach is possible.

Figure 51A:
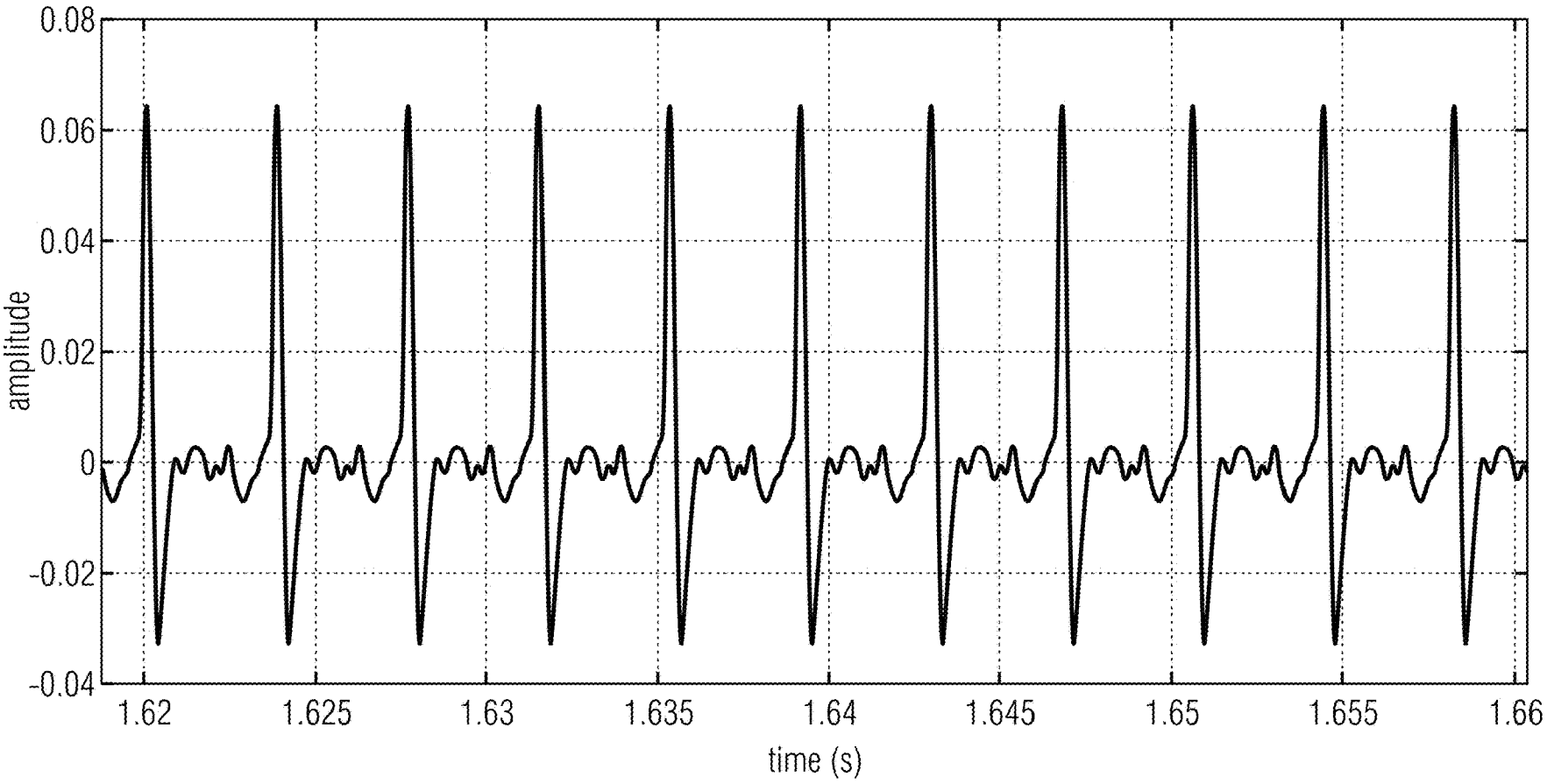
FIG. 51*a* shows the waveform of the trombone signal in a time diagram.
Figure 51B:
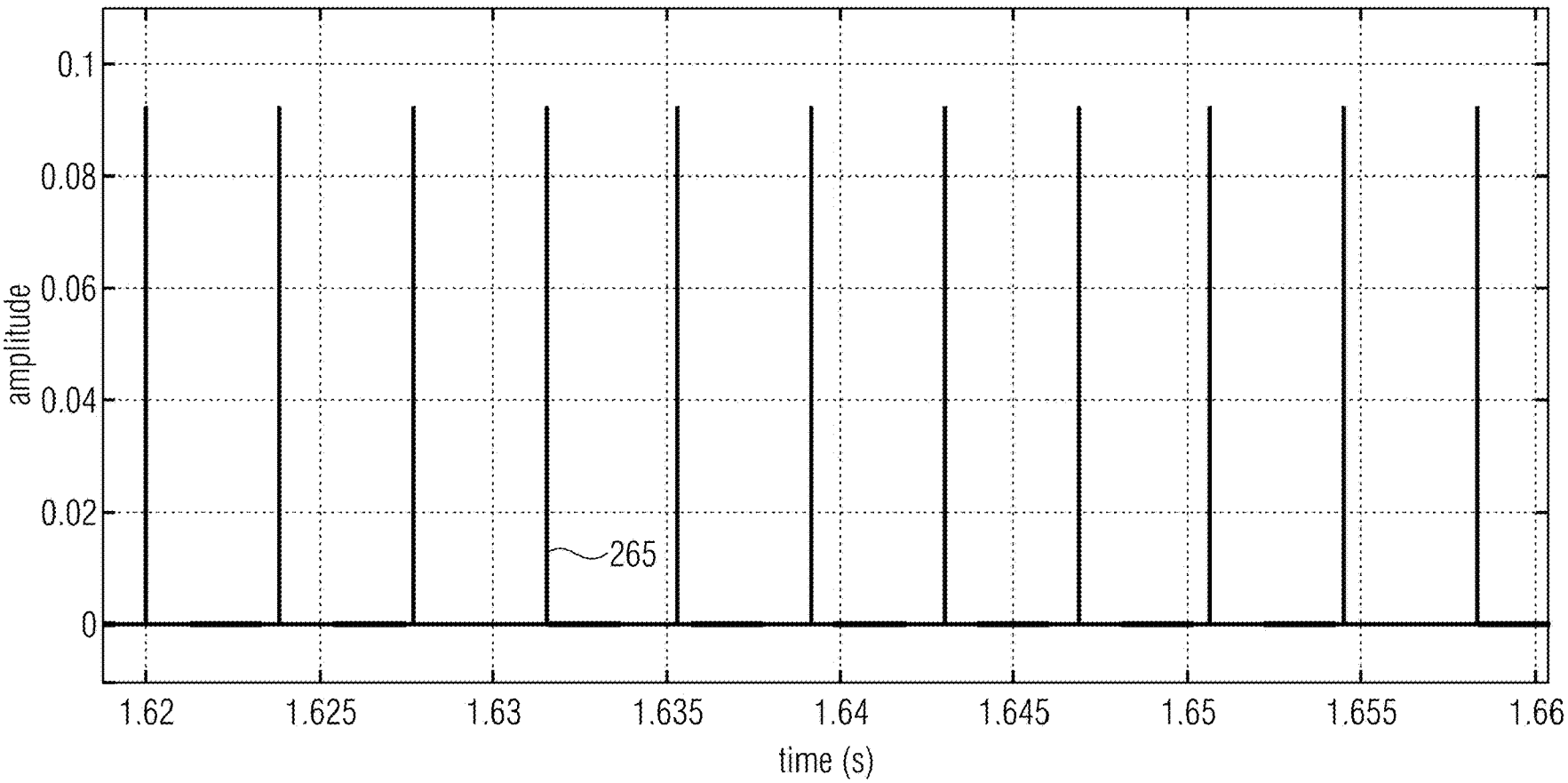
FIG. 51*b* shows the time domain signal corresponding to the trombone signal in FIG. 51*a* that contains only estimated peaks; wherein the positions of the peaks have been obtained using the transmitted metadata.

A time-domain representation of the trombone signal is shown in FIG. 51. FIG. 51*a* shows the waveform of the trombone signal in a time domain representation. FIG. 51*b* shows a corresponding time domain signal that contains only the estimated peaks, wherein the positions of the peaks have been obtained using the transmitted metadata. The signal in FIG. 51*b* is the pulse train 265 described, e.g. with respect to FIG. 30. The algorithm starts by analyzing the positions of the peaks in the waveform. This is performed by searching for local maxima. For each 27 ms (i.e., for each 20 QMF frames), the location of the peak closest to the center point of the frame is transmitted. In between the transmitted peak locations, the peaks are assumed to be evenly spaced in time. Thus, by knowing the fundamental frequency, the locations of the peaks can be estimated. In this embodiment, the number of the detected peaks is transmitted (it should be noted that this involves successful detection of all peaks; fundamental-frequency based estimation would probably yield more robust results). The resulting bit rate is about 0.5 kbps (without any compression, such as entropy coding), which consists of transmitting the location of the peak for every 27 ms using 9 bits and transmitting the number of transients in between using 4 bits. This accuracy was found to produce equal perceived quality as no quantization. However, a significantly lower bit rate can probably be used in many cases producing good enough perceived quality.

Using the transmitted metadata, a time-domain signal is created, which consists of impulses in the positions of the estimated peaks (see FIG. 51*b*). QMF analysis is performed for this signal, and the phase spectrum $X_{ev}^{pha}(k,n)$ is computed. The actual PDF correction is performed otherwise as suggested in Section 8.2, but $Z_{th}^{pha}(k,n)$ in Eq. 20a is replaced by $X_{ev}^{pha}(k,n)$.

The waveform of signals having vertical phase coherence is typically peaky and reminiscent of a pulse train. Thus, it is suggested that the target phase spectrum for the vertical correction can be estimated by modeling it as the phase spectrum of a pulse train that has peaks at corresponding positions and a corresponding fundamental frequency.

The position closest to the center of the temporal frame is transmitted for, e.g., every $20^{th}$ temporal frame (corresponding to an interval of ~27 ms). The estimated fundamental frequency, which is transmitted with equal rate, is used to interpolate the peak positions in between the transmitted positions.

Alternatively, the fundamental frequency and the peak positions could be estimated in the decoding stage, and no information has to be transmitted. However, better estimates can be expected if the estimation is performed with the original signal in the encoding stage.

The decoder processing begins by obtaining a fundamental-frequency estimate $X^{f_0}(n)$ for each temporal frame and, in addition, the peak positions in the waveform are estimated. The peak positions are used to create a time-domain signal that consists of impulses at these positions. QMF analysis is used to create the corresponding phase spectrum $X_{ev}^{pha}(k,n)$. This estimated phase spectrum can be used in Eq. 20a as the target phase spectrum $$Z_{tv}^{pha}(k,n)=X_{ev}^{pha}(k,n). \tag{37}$$

The suggested method uses the encoding stage to transmit only the estimated peak positions and the fundamental frequencies with the update rate of, e.g., 27 ms. In addition, it should be noted that errors in the vertical phase derivate are perceivable only when the fundamental frequency is relatively low. Thus, the fundamental frequency can be transmitted with a relatively low bit rate.

Figure 52A:
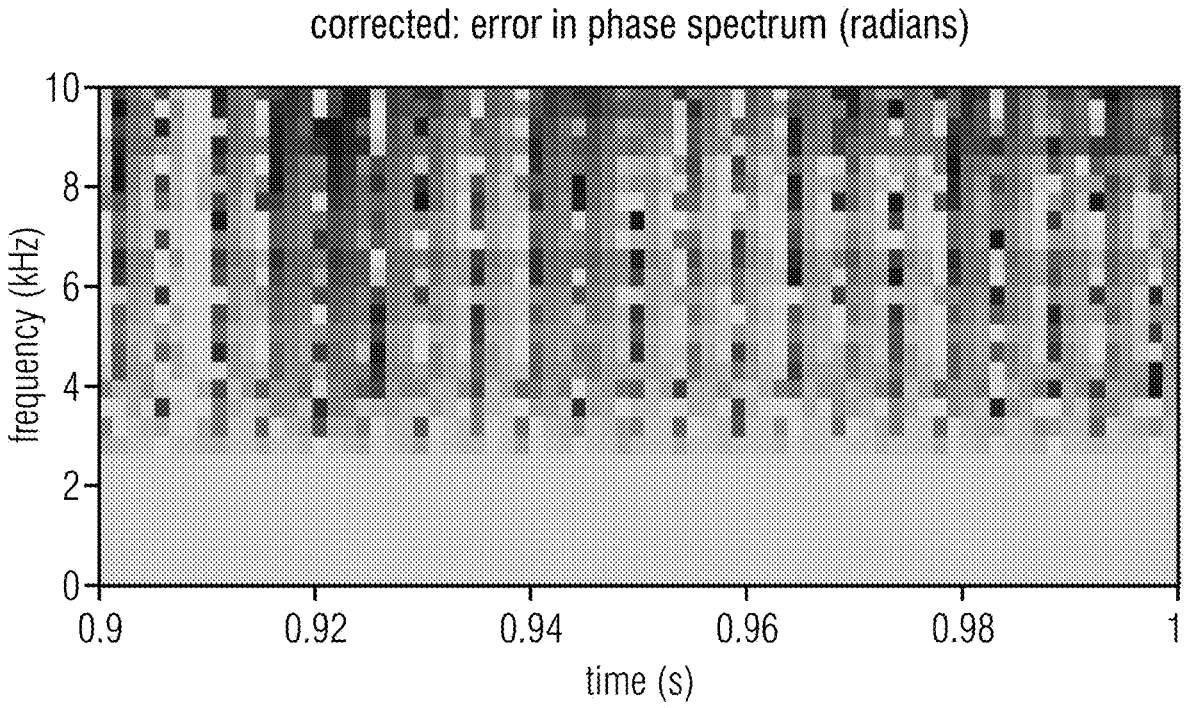
FIG. 52*a* shows the error in the phase spectrum of the trombone signal in the QMF domain using corrected SBR with compressed correction data in a time-frequency representation.
Figure 52B:
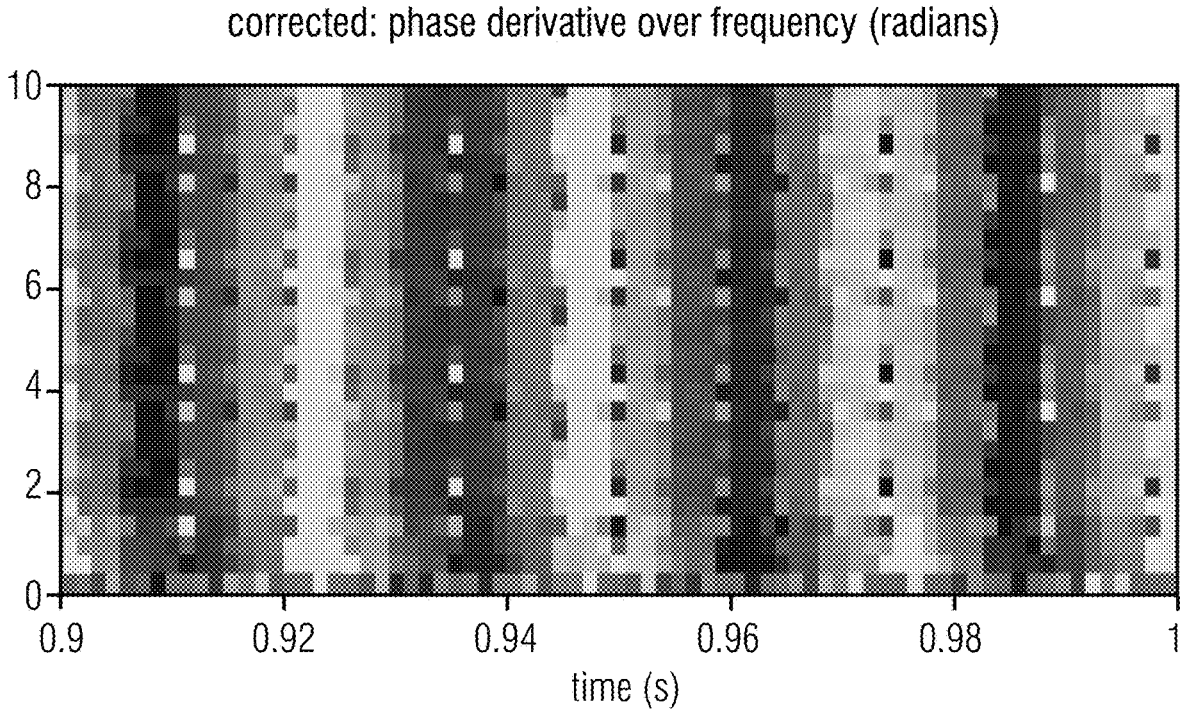
FIG. 52*b* shows the phase derivative over frequency corresponding to the error in the phase spectrum shown in FIG. 52*a;*

The result of the correction algorithm with compressed correction data is shown in FIG. 52. FIG. 52*a* shows the error in the phase spectrum $D_{cv}^{pha}(k,n)$ of the trombone signal in the QMF domain with corrected SBR and compressed correction data. Accordingly, FIG. 52*b* shows the corresponding phase derivative over frequency $Z_{cv}^{pdf}(k,n)$. The color gradient indicates values from red=π to blue=−π. The PDF values follow the PDF values of the original signal with similar accuracy as the correction method without the data compression (see FIG. 13). Thus, the compression algorithm is valid. The perceived quality with and without the compression of the correction data is similar.

9.3 Compression of the Transient Handling Data

As transients can be assumed to be relatively sparse, it can be assumed that this data could be directly transmitted. Embodiments show transmitting six values per transient: one value for the average PDF, and five values for the errors in the absolute phase angle (one value for each temporal frame inside the interval [n−2, n+2]). An alternative is to transmit the position of the transient (i.e. one value) and to estimate the target phase spectrum $X_{et}^{pha}(k,n)$ as in the case of the vertical correction.

If the bit rate needed to be compressed for the transients, similar approach could be used as for the PDF correction (see Section 9.2). Simply the position of the transient could be transmitted, i.e., a single value. The target phase spectrum and the target PDF could be obtained using this location value as in Section 9.2.

Alternatively, the transient position could be estimated in the decoding stage and no information has to be transmitted. However, better estimates can be expected if the estimation is performed with the original signal in the encoding stage.

All of the previously described embodiments may be seen separately from the other embodiments or in a combination of embodiments. Therefore, FIGS. 53 to 57 present an encoder and a decoder combining some of the earlier described embodiments.

Figure 53:
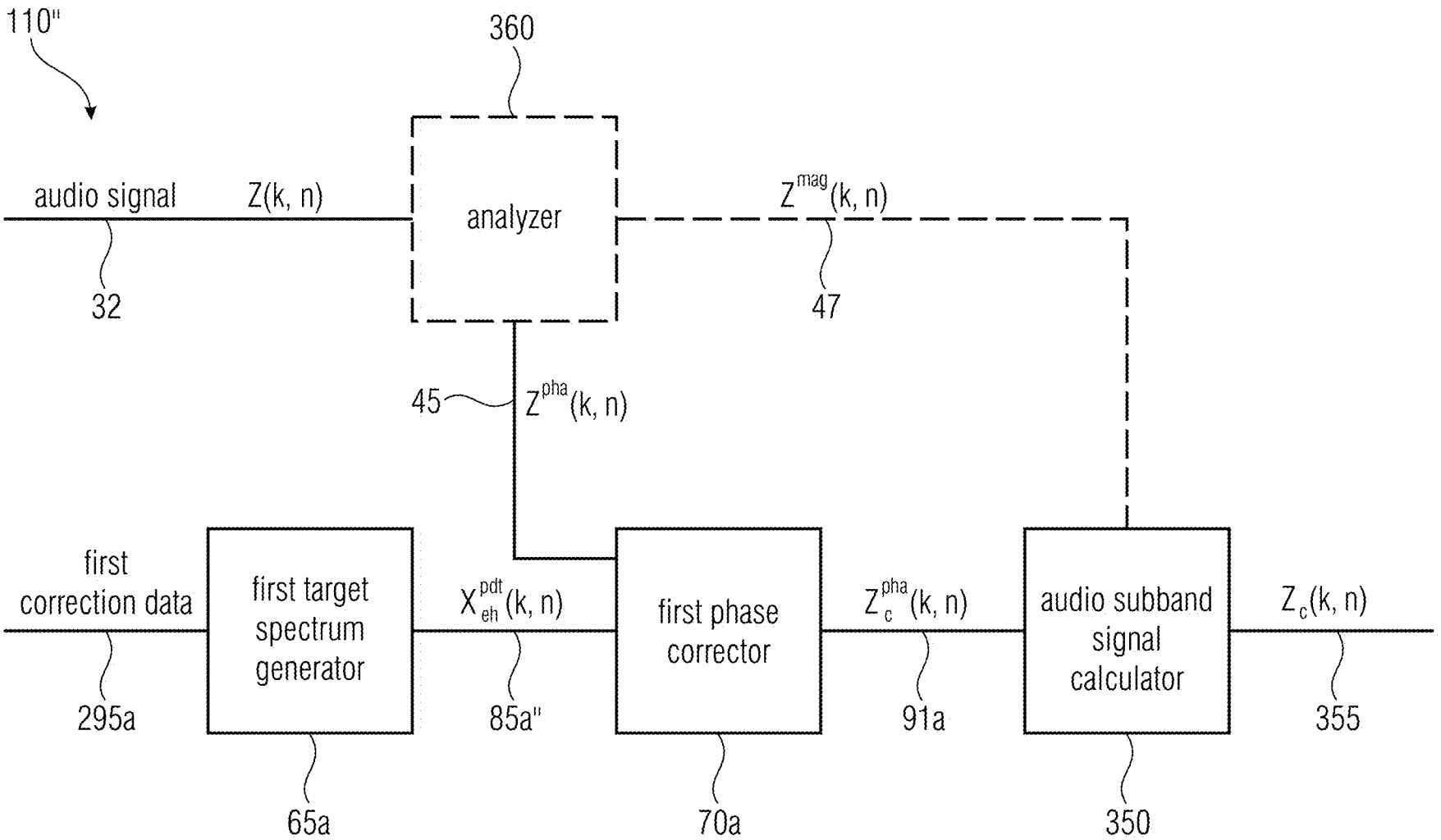
FIG. 53 shows a schematic block diagram of a decoder.

FIG. 53 shows an decoder 110" for decoding an audio signal. The decoder 110" comprises a first target spectrum generator 65*a*, a first phase corrector 70*a* and an audio subband signal calculator 350. The first target spectrum generator 65*a*, also referred to as target phase measure determiner, generates a target spectrum 85*a*" for a first time frame of a subband signal of the audio signal 32 using first correction data 295*a*. The first phase corrector 70*a* corrects a phase 45 of the subband signal in the first time frame of the audio signal 32 determined with a phase correction algorithm, wherein the correction is performed by reducing a difference between a measure of the subband signal in the first time frame of the audio signal 32 and the target spectrum 85". The audio subband signal calculator 350 calculates the audio subband signal 355 for the first time frame using a corrected phase 91*a* for the time frame. Alternatively, the audio subband signal calculator 350 calculates audio subband signal 355 for a second time frame different from the first time frame using the measure of the subband signal 85*a*" in the second time frame or using a corrected phase calculation in accordance with a further phase correction algorithm different from the phase correction algorithm. FIG. 53 further shows an analyzer 360 which optionally analyzes the audio signal 32 with respect to a magnitude 47 and a phase 45. The further phase correction algorithm may be performed in a second phase corrector 70*b* or a third phase corrector 70*c*. These further phase correctors will be illustrated with respect to FIG. 54. The audio subband signal calculator 250 calculates the audio subband signal for the first time frame using the corrected phase 91 for the first time frame and the magnitude value 47 of the audio subband signal of the first time frame, wherein the magnitude value 47 is a magnitude of the audio signal 32, in the first time frame or a processed magnitude of the audio signal 35 in the first time frame.

Figure 54:
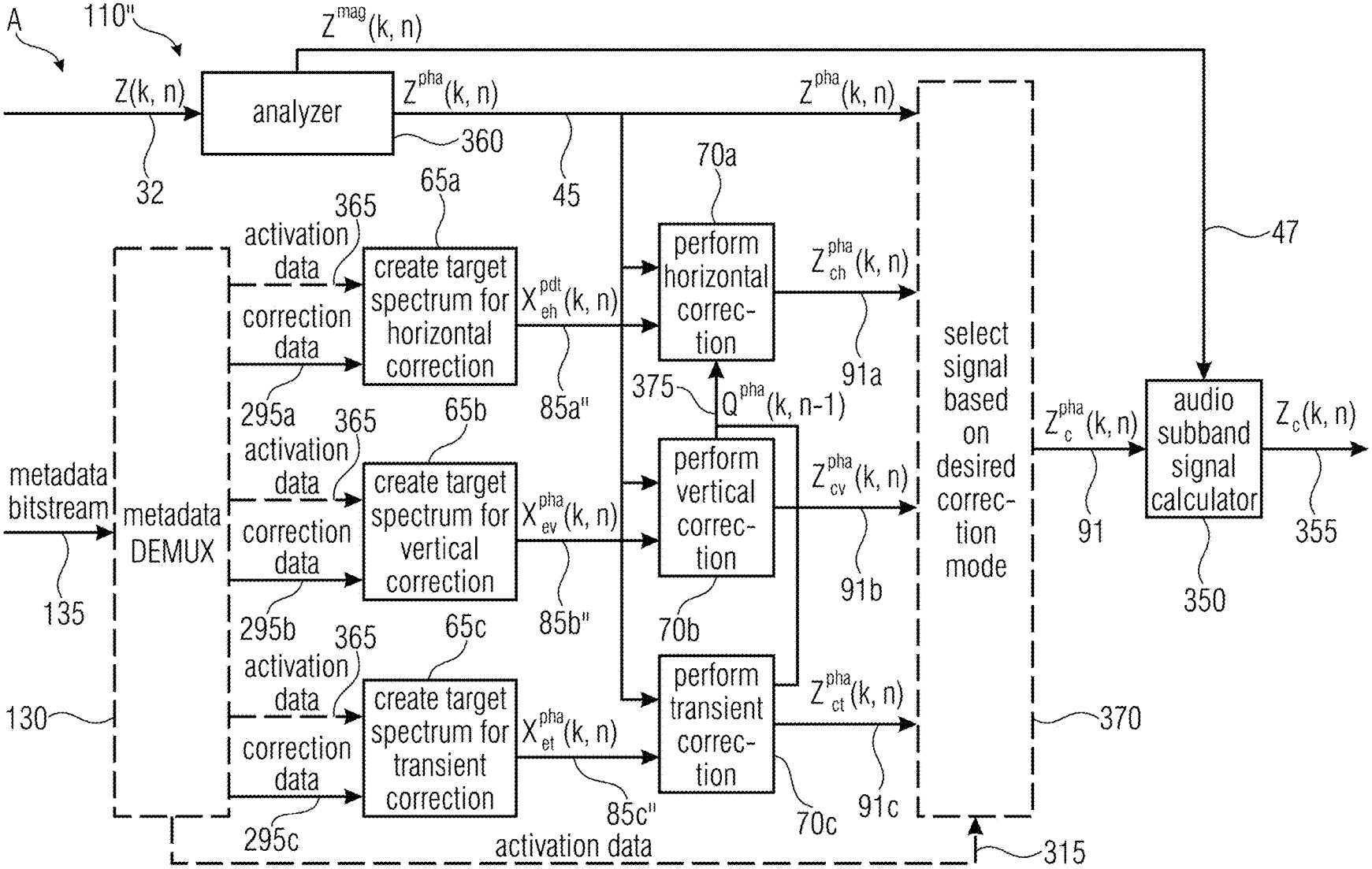
FIG. 54 shows a schematic block diagram according to an advantageous embodiment.

FIG. 54 shows a further embodiment of the decoder 110". Therefore, the decoder 110" comprises a second target spectrum generator 65*b*, wherein the second target spectrum generator 65*b* generates a target spectrum 85*b*" for the second time frame of the subband of the audio signal 32 using second correction data 295*b*. The detector 110" additionally comprises a second phase corrector 70*b* for correcting a phase 45 of the subband in the time frame of the audio signal 32 determined with a second phase correction algorithm, wherein the correction is performed by reducing a difference between a measure of the time frame of the subband of the audio signal and the target spectrum 85*b*".

Accordingly, the decoder 110" comprises a third target spectrum generator 65*c*, wherein the third target spectrum generator 65*c* generates a target spectrum for a third time frame of the subband of the audio signal 32 using third correction data 295*c*. Furthermore, the decoder 110" comprises a third phase corrector 70*c* for correcting a phase 45 of the subband signal and the time frame of the audio signal 32 determined with a third phase correction algorithm, wherein the correction is performed by reducing a difference between a measure of the time frame of the subband of the audio signal and the target spectrum 85*c*. The audio subband signal calculator 350 can calculate the audio subband signal for a third time frame different from the first and the second time frames using the phase correction of the third phase corrector.

According to an embodiment, the first phase corrector 70*a* is configured for storing a phase corrected subband signal 91*a* of a previous time frame of the audio signal or for receiving a phase corrected subband signal of the previous time frame 375 of the audio signal from a second phase corrector 70*b* of the third phase corrector 70*c*. Furthermore, the first phase corrector 70*a* corrects the phase 45 of the audio signal 32 in a current time frame of the audio subband signal based on the stored or the received phase corrected subband signal of the previous time frame 91*a*, 375.

Further embodiments show the first phase corrector 70*a* performing a horizontal phase correction, the second phase corrector 70*b* performing a vertical phase correction, and the third phase corrector 70*c* performing a phase correction for transients.

From another point of view, FIG. 54 shows a block diagram of the decoding stage in the phase correction algorithm. The input to the processing is the BWE signal in the time-frequency domain and the metadata. Again, in practical applications it is advantageous for the inventive phase-derivative correction to co-use the filter bank or transform of an existing BWE scheme. In the current example this is a QMF domain as used in SBR. A first demultiplexer (not depicted) extracts the phase-derivative correction data from the bitstream of the BWE equipped perceptual codec that is being enhanced by the inventive correction.

A second demultiplexer 130 (DEMUX) first divides the received metadata 135 into activation data 365 and correction data 295*a-c* for the different correction modes. Based on the activation data, the computation of the target spectrum is activated for the right correction mode (others can be idle). Using the target spectrum, the phase correction is performed to the received BWE signal using the desired correction mode. It should be noted that as the horizontal correction 70*a* is performed recursively (in other words: dependent on previous signal frames), it receives the previous correction matrices also from other correction modes 70*b, c*. Finally, the corrected signal, or the unprocessed one, is set to the output based on the activation data.

After having corrected the phase data, the underlying BWE synthesis further downstream is continued, in the case of the current example the SBR synthesis. Variations might exist where exactly the phase correction is inserted into the BWE synthesis signal flow. Advantageously, the phase-derivative correction is done as an initial adjustment on the raw spectral patches having phases $Z^{pha}(k,n)$ and all additional BWE processing or adjustment steps (in SBR this can be noise addition, inverse filtering, missing sinusoids, etc.) are executed further downstream on the corrected phases $Z_c^{pha}(k,n)$.

Figure 55:
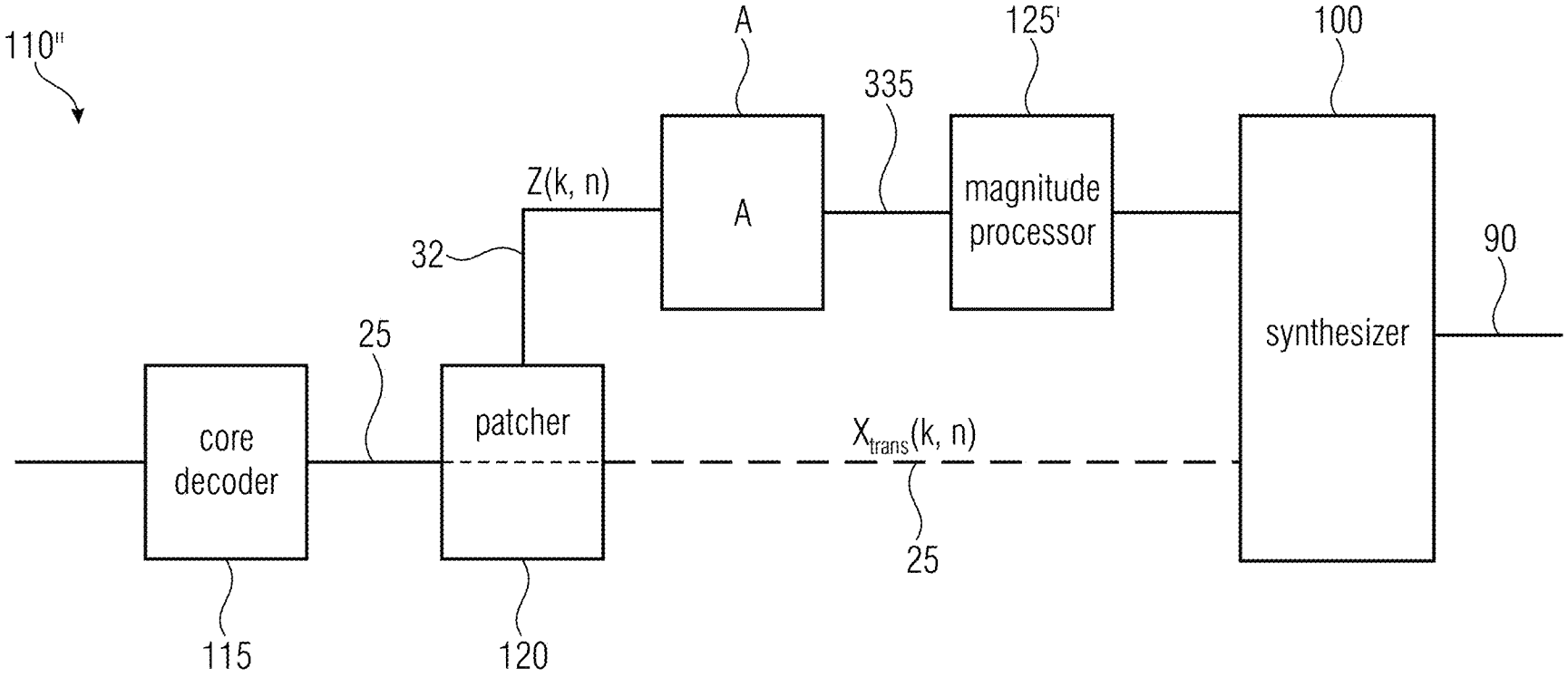
FIG. 55 shows a schematic block diagram of the decoder according to a further embodiment.

FIG. 55 shows a further embodiment of the decoder 110". According to this embodiment, the decoder 110" comprises a core decoder 115, a patcher 120, a synthesizer 100 and the block A, which is the decoder 110" according to the previous embodiments shown in FIG. 54. The core decoder 115 is configured for decoding the audio signal 25 in a time frame with a reduced number of subbands with respect to the audio signal 55. The patcher 120 patches a set of subbands of the core decoded audio signal 25 with a reduced number of subbands, wherein the set of subbands forms a first patch, to further subbands in the time frame, adjacent to the reduced number of subbands, to obtain an audio signal 32 with a regular number of subbands. The magnitude processor 125' processes magnitude values of the audio subband signal 355 in the time frame. According to the previous decoders 110 and 110', the magnitude processor may be the bandwidth extension parameter applicator 125.

Many other embodiments can be thought of where the signal processor blocks are switched. For example, the magnitude processor 125' and the block A may be swapped. Therefore, the block A works on the reconstructed audio signal 35, where the magnitude values of the patches have already been corrected. Alternatively, the audio subband signal calculator 350 may be located after the magnitude processor 125' in order to form the corrected audio signal 355 from the phase corrected and the magnitude corrected part of the audio signal.

Furthermore, the decoder 110" comprises a synthesizer 100 for synthesizing the phase and magnitude corrected audio signal to obtain the frequency combined processed audio signal 90. Optionally, since neither the magnitude nor the phase correction is applied on the core decoded audio signal 25, said audio signal may be transmitted directly to the synthesizer 100. Any optional processing block applied in one of the previously described decoders 110 or 110' may be applied in the decoder 110" as well.

Figure 56:
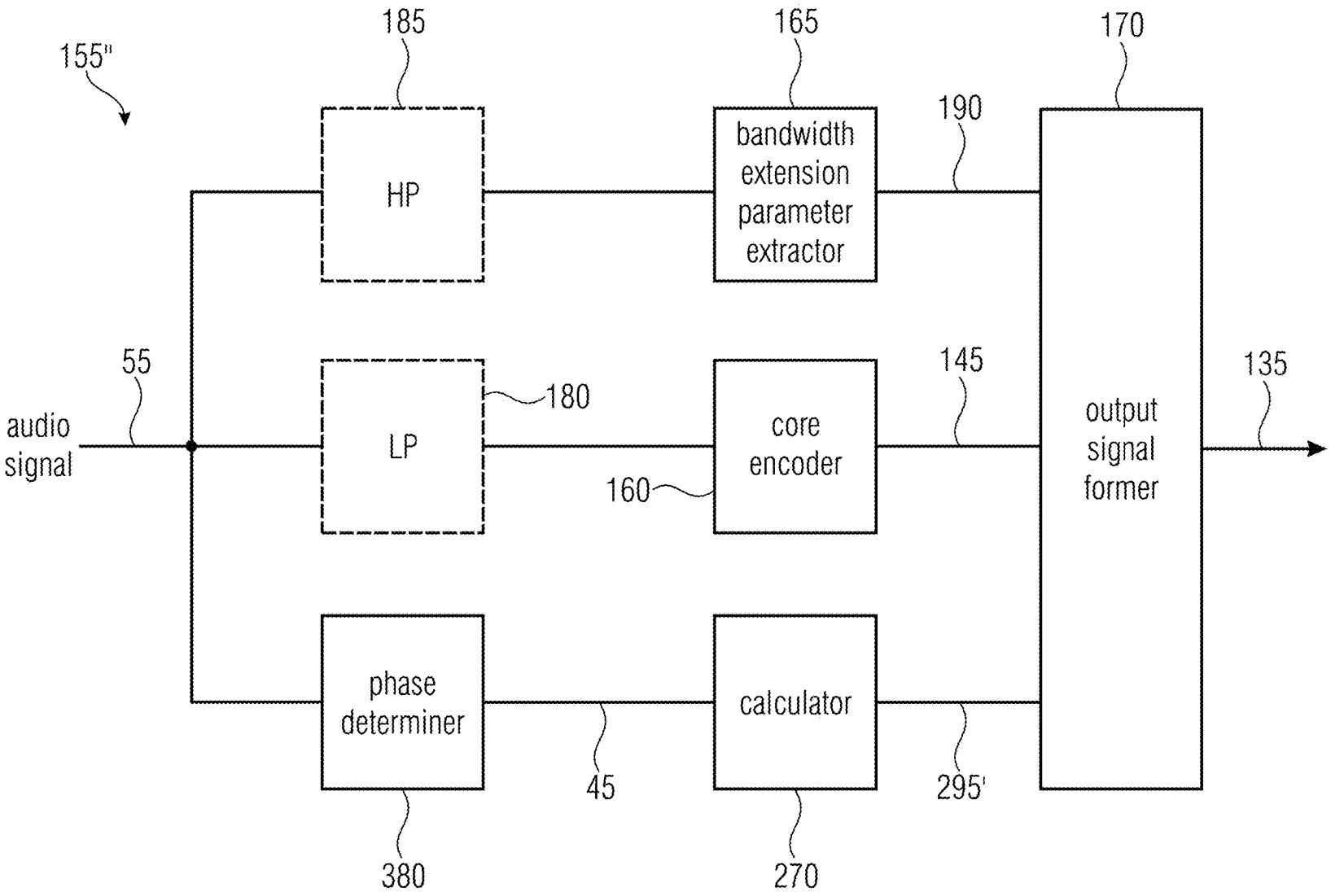
FIG. 56 shows a schematic block diagram of an encoder.

FIG. 56 shows an encoder 155" for encoding an audio signal 55. The encoder 155" comprises a phase determiner 380 connected to a calculator 270, a core encoder 160, a parameter extractor 165, and an output signal former 170. The phase determiner 380 determines a phase 45 of the audio signal 55 wherein the calculator 270 determines phase correction data 295 for the audio signal 55 based on the determined phase 45 of the audio signal 55. The core encoder 160 core encodes the audio signal 55 to obtain a core encoded audio signal 145 having a reduced number of subbands with respect to the audio signal 55. The parameter extractor 165 extracts parameters 190 from the audio signal 55 for obtaining a low resolution parameter representation for a second set of subbands not included in the core encoded audio signal. The output signal former 170 forms the output signal 135 comprising the parameters 190, the core encoded audio signal 145 and the phase correction data 295'. Optionally, the encoder 155" comprises a low pass filter 180 before core encoding the audio signal 55 and a high pass filter 185 before extracting the parameters 190 from the audio signal 55. Alternatively, instead of low or high pass filtering the audio signal 55, a gap filling algorithm may be used, wherein the core encoder 160 core encodes a reduced number of subbands, wherein at least one subband within the set of subbands is not core encoded. Furthermore, the parameter extractor extracts parameters 190 from the at least one subband not encoded with the core encoder 160.

According to embodiments, the calculator 270 comprises a set of correction data calculators 285*a-c* for correcting the phase correction in accordance with a first variation mode, a second variation mode, or a third variation mode. Furthermore, the calculator 270 determines activation data 365 for activating one correction data calculator of the set of correction data calculators 285*a-c*. The output signal former 170 forms the output signal comprising the activation data, the parameters, the core encoded audio signal, and the phase correction data.

Figure 57:
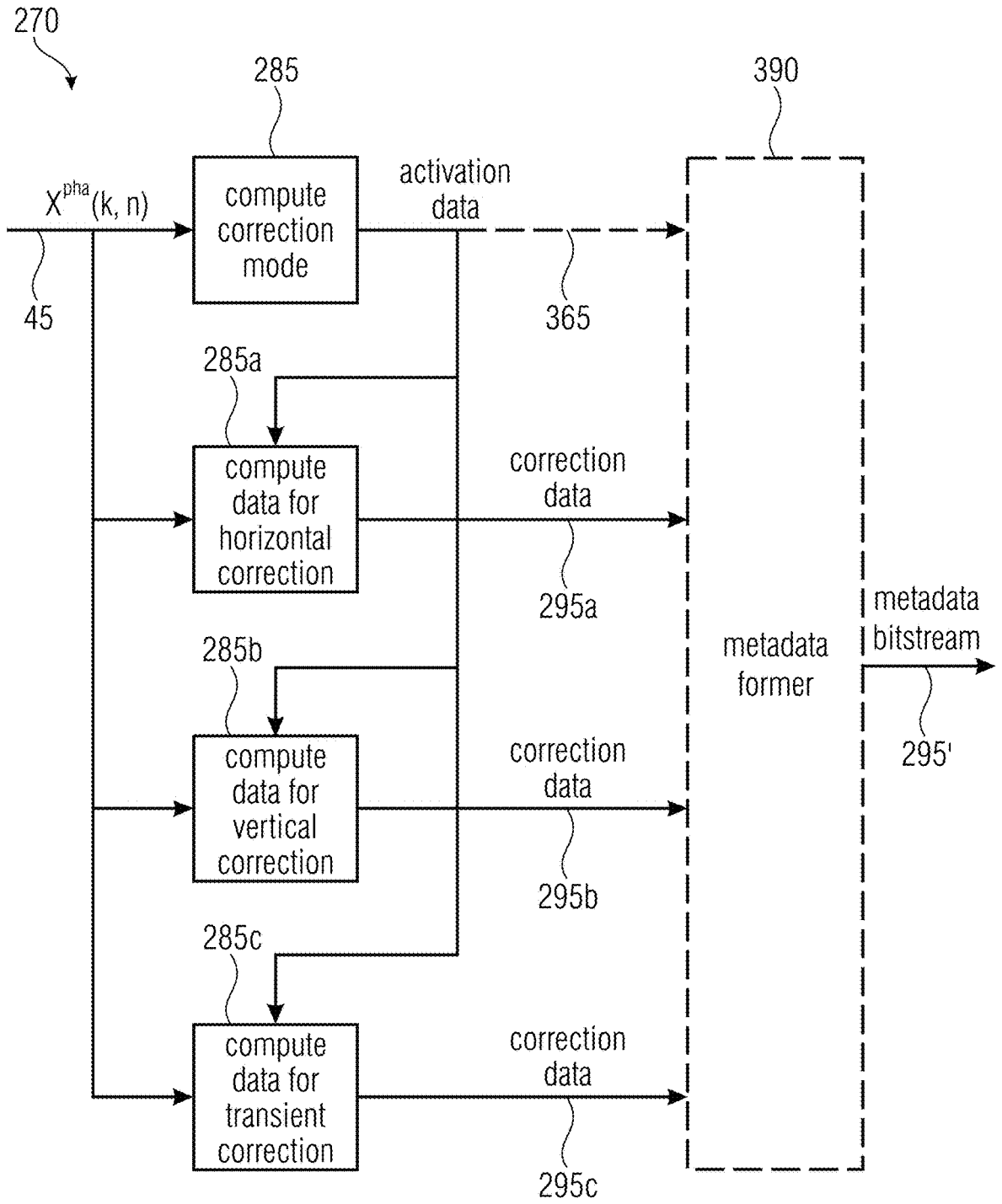
FIG. 57 shows a block diagram of a calculator which may be used in the encoder shown in FIG. 56.

FIG. 57 shows an alternative implementation of the calculator 270 which may be used in the encoder 155" shown in FIG. 56. The correction mode calculator 385 comprises the variation determiner 275 and the variation comparator 280. The activation data 365 is the result of comparing different variations. Furthermore, the activation data 365 activates one of the correction data calculators 185*a-c* according to the determined variation. The calculated correction data 295*a*, 295*b*, or 295*c* may be the input of the output signal former 170 of the encoder 155" and therefore part of the output signal 135.

Embodiments show the calculator 270 comprising a metadata former 390, which forms a metadata stream 295' comprising the calculated correction data 295*a*, 295*b*, or 295*c* and the activation data 365. The activation data 365 may be transmitted to the decoder if the correction data itself does not comprise sufficient information of the current correction mode. Sufficient information may be for example a number of bits used to represent the correction data, which is different for the correction data 295*a*, the correction data 295*b*, and the correction data 295*c*. Furthermore, the output signal former 170 may additionally use the activation data 365, such that the metadata former 390 can be neglected.

From another point of view, the block diagram of FIG. 57 shows the encoding stage in the phase correction algorithm. The input to the processing is the original audio signal 55 and the time-frequency domain. In practical applications, it is advantageous for the inventive phase-derivative correction to co-use the filter bank or transform of an existing BWE scheme. In the current example, this is a QMF domain used in SBR.

The correction-mode-computation block first computes the correction mode that is applied for each temporal frame. Based on the activation data 365, correction-data 295*a-c* computation is activated in the right correction mode (others can be idle). Finally, multiplexer (MUX) combines the activation data and the correction data from the different correction modes.

A further multiplexer (not depicted) merges the phase-derivative correction data into the bit stream of the BWE and the perceptual encoder that is being enhanced by the inventive correction.

Figure 58:
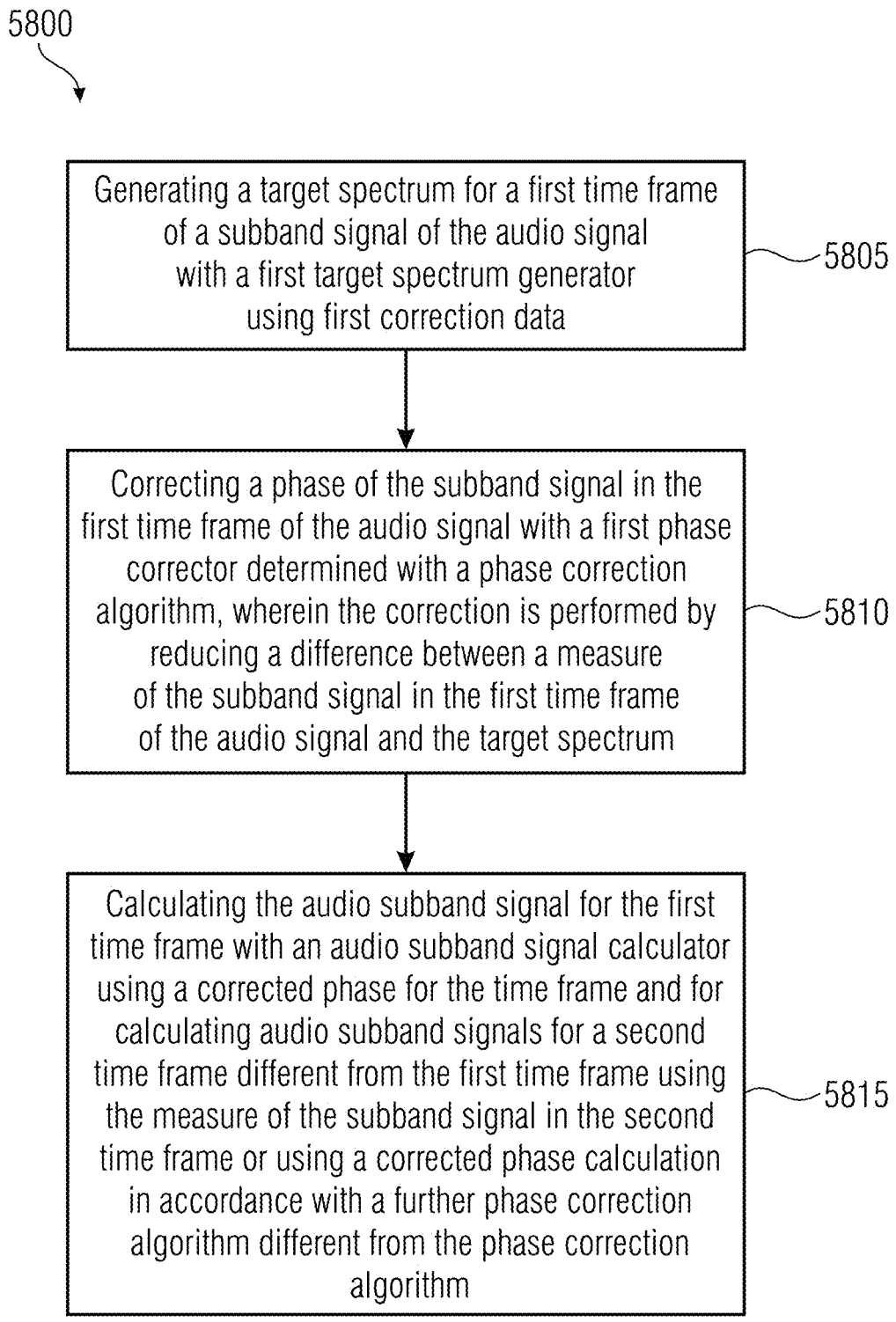
FIG. 58 shows a schematic block diagram of a method for decoding an audio signal.

FIG. 58 shows a method 5800 for decoding an audio signal. The method 5800 comprises a step S805 "generating a target spectrum for a first time frame of a subband signal of the audio signal with a first target spectrum generator using first correction data", a step S810 "correcting a phase of the subband signal in the first time frame of the audio signal with a first phase corrector determined with a phase correction algorithm, wherein the correction is performed by reducing a difference between a measure of the subband signal in the first time frame of the audio signal and the target spectrum, and a step S815 "calculating the audio subband signal for the first time frame with an audio subband signal calculator using a corrected phase of the time frame and for calculating audio subband signals for a second time frame different from the first time frame using the measure of the subband signal in the second time frame or using a corrected phase calculation in accordance with a further phase correction algorithm different from the phase correction algorithm".

Figure 59:
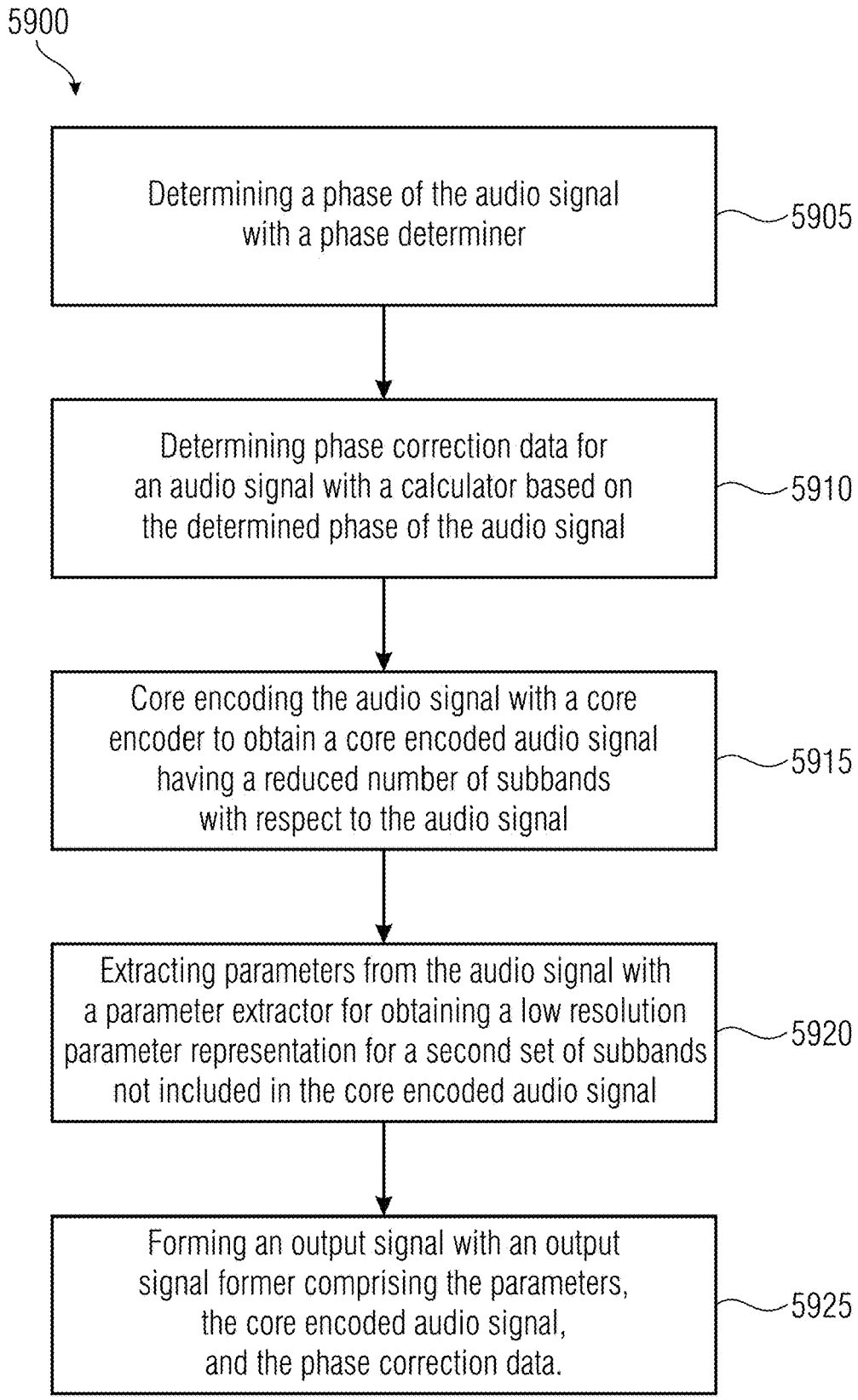
FIG. 59 shows a schematic block diagram of a method for encoding an audio signal.

FIG. 59 shows a method 5900 for encoding an audio signal. The method 5900 comprises a step S905 "determining a phase of the audio signal with a phase determiner", a step S910 "determining phase correction data for an audio signal with a calculator based on the determined phase of the audio signal", a step S915 "core encoding the audio signal with a core encoder to obtain a core encoded audio signal having a reduced number of subbands with respect to the audio signal", a step S920 "extracting parameters from the audio signal with a parameter extractor for obtaining a low resolution parameter representation for a second set of subbands not included in the core encoded audio signal", and a step S925 "forming an output signal with an output signal former comprising the parameters, the core encoded audio signal, and the phase correction data".

The methods 5800 and 5900 as well as the previously described methods 2300, 2400, 2500, 3400, 3500, 3600 and 4200, may be implemented in a computer program to be performed on a computer.

It has to be noted that the audio signal 55 is used as a general term for an audio signal, especially for the original i.e. unprocessed audio signal, the transmitted part of the audio signal $X_{trans}(k,n)$ 25, the baseband signal $X_{base}(k,n)$ 30, the processed audio signal comprising higher frequencies 32 when compared to the original audio signal, the reconstructed audio signal 35, the magnitude corrected frequency patch Y(k,n,i) 40, the phase 45 of the audio signal, or the magnitude 47 of the audio signal. Therefore, the different audio signals may be mutually exchanged due to the context of the embodiment.

Alternative embodiments relate to different filter bank or transform domains used for the inventive time-frequency processing, for example the short time Fourier transform (STFT) a Complex Modified Discrete Cosine Transform (CMDCT), or a Discrete Fourier Transform (DFT) domain. Therefore, specific phase properties related to the transform may be taken into consideration. In detail, if e.g. copy-up coefficients are copied from an even number to an odd number or vice versa, i.e. the second subband of the original audio signal is copied to the ninth subband instead of the eighth subband as described in the embodiments, the conjugate complex of the patch may be used for the processing. The same applies to a mirroring of the patches instead of using e.g. the copy-up algorithm, to overcome the reversed order of the phase angles within a patch.

Other embodiments might resign side information from the encoder and estimate some or all useful correction parameters on decoder site. Further embodiments might have other underlying BWE patching schemes that for example use different baseband portions, a different number or size of patches or different transposition techniques, for example spectral mirroring or single side band modulation (SSB). Variations might also exist where exactly the phase correction is concerted into the BWE synthesis signal flow. Furthermore, the smoothing is performed using a sliding Hann window, which may be replaced for better computational efficiency by, e.g. a first-order IIR.

The use of state of the art perceptual audio codecs often impairs the phase coherence of the spectral components of an audio signal, especially at low bit rates, where parametric coding techniques like bandwidth extension are applied. This leads to an alteration of the phase derivative of the audio signal. However, in certain signal types the preservation of the phase derivative is important. As a result, the perceptual quality of such sounds is impaired. The present invention readjusts the phase derivative either over frequency ("vertical") or over time ("horizontal") of such signals if a restoration of the phase derivative is perceptually beneficial. Further, a decision is made whether adjusting the vertical or horizontal phase derivative is perceptually advantageous. The transmission of only very compact side information is needed to control the phase derivative correction processing. Therefore, the invention improves sound quality of perceptual audio coders at moderate side information costs.

In other words, spectral band replication (SBR) can cause errors in the phase spectrum. The human perception of these errors was studied revealing two perceptually significant effects: differences in the frequencies and the temporal positions of the harmonics. The frequency errors appear to be perceivable only when the fundamental frequency is high enough that there is only one harmonic inside an ERB band. Correspondingly, the temporal-position errors appear to be perceivable only if the fundamental frequency is low and if the phases of the harmonics are aligned over frequency.

The frequency errors can be detected by computing the phase derivative over time (PDT). If the PDT values are stable over time, differences in them between the SBR-processed and the original signals should be corrected. This effectively corrects the frequencies of the harmonics, and thus, the perception of inharmonicity is avoided.

The temporal-position errors can be detected by computing the phase derivative over frequency (PDF). If the PDF values are stable over frequency, differences in them between the SBR-processed and the original signals should be corrected. This effectively corrects the temporal positions of the harmonics, and thus, the perception of modulating noises at the cross-over frequencies is avoided.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] Painter, T.: Spanias, A. Perceptual coding of digital audio, Proceedings of the IEEE, 88(4), 2000; pp. 451-513.

[2] Larsen, E.; Aarts, R. Audio Bandwidth Extension: Application of psychoacoustics, signal processing and loudspeaker design, John Wiley and Sons Ltd, 2004, Chapters 5, 6.

[3] Dietz, M.; Liljeryd, L.; Kjorling, K.; Kunz, O. Spectral Band Replication, a Novel Approach in Audio Coding, 112th AES Convention, April 2002, Preprint 5553.

[4] Nagel, F.; Disch, S.; Rettelbach, N. A Phase Vocoder Driven Bandwidth Extension Method with Novel Transient Handling for Audio Codecs, 126th AES Convention, 2009.

[5] D. Griesinger 'The Relationship between Audience Engagement and the ability to Perceive Pitch, Timbre, Azimuth and Envelopment of Multiple Sources' Tonmeister Tagung 2010.

[6] D. Dorran and R. Lawlor, "Time-scale modification of music using a synchronized subband/time domain approach," IEEE International Conference on Acoustics, Speech and Signal Processing, pp. IV 225-IV 228, Montreal, May 2004.

[7] J. Laroche, "Frequency-domain techniques for high quality voice modification," Proceedings of the International Conference on Digital Audio Effects, pp. 328-322, 2003.

[8] Laroche, J.; Dolson, M.; "Phase-vocoder: about this phasiness business," Applications of Signal Processing to Audio and Acoustics, 1997. 1997 IEEE ASSP Workshop on, vol., no., pp. 4 pp., 19-22, October 1997

[9] M. Dietz, L. Liljeryd, K. Kjörling, and O. Kunz, "Spectral band replication, a novel approach in audio coding," in AES 112th Convention, (Munich, Germany), May 2002.

[10] P. Ekstrand, "Bandwidth extension of audio signals by spectral band replication," in IEEE Benelux Workshop on Model based Processing and Coding of Audio, (Leuven, Belgium), November 2002.

[11] B. C. J. Moore and B. R. Glasberg, "Suggested formulae for calculating auditory-filter bandwidths and excitation patterns," J. Acoust. Soc. Am., vol. 74, pp. 750-753, September 1983.

[12] T. M. Shackleton and R. P. Carlyon, "The role of resolved and unresolved harmonics in pitch perception and frequency modulation discrimination," J. Acoust. Soc. Am., vol. 95, pp. 3529-3540, June 1994.

[13] M.-V. Laitinen, S. Disch, and V. Pulkki, "Sensitivity of human hearing to changes in phase spectrum," J. Audio Eng. Soc., vol. 61, pp. 860{877, November 2013.

[14] A. Klapuri, "Multiple fundamental frequency estimation based on harmonicity and spectral smoothness," IEEE Transactions on Speech and Audio Processing, vol. 11, November 2003.

The invention claimed is:

1. An audio processor for processing an audio signal comprising:

an audio signal phase measure calculator configured for calculating a phase measure of an audio signal for a time frame;

a target phase measure determiner for determining a target phase measure for said time frame; and a phase corrector configured for correcting phases of the audio signal for the time frame using the calculated phase measure and the target phase measure to achieve a processed audio signal.

2. The audio processor according to claim 1, wherein the audio signal comprises a plurality of subband signals for the time frame;

wherein the target phase measure determiner is configured for determining a first target phase measure for a first subband signal and a second target phase measure for a second subband signal;

wherein the audio signal phase measure calculator is configured for determining a first phase measure for the first subband signal and a second phase measure for the second subband signal;

wherein the phase corrector is configured for correcting a first phase of the first subband signal using the first phase measure of the audio signal and the first target phase measure to achieve a first processed subband signal and for correcting a second phase of the second subband signal using the second phase measure of the audio signal and the second target phase measure to achieve a second processed subband signal; and an audio signal synthesizer for synthesizing the processed audio signal using the processed first subband signal and the processed second subband signal.

3. The audio processor according to claim 1, wherein the phase measure is a phase derivative over time;

wherein the audio signal phase measure calculator is configured for calculating, for each subband of a plurality of subbands, the phase derivative of a phase value of a current time frame and a phase value of a future time frame;

wherein the phase corrector is configured for calculating, for each subband of the plurality of subbands of the current time frame, a deviation between the target phase derivative and the phase derivative over time;

wherein a correction performed by the phase corrector is performed using the deviation.

4. The audio processor according to claim 1, wherein the phase corrector is configured for correcting subband signals of different subbands of the audio signal within the time frame, so that frequencies of corrected subband signals comprise frequency values being harmonically allocated to a fundamental frequency of the audio signal.

5. The audio processor according to claim 1, wherein the phase corrector is configured for smoothing the deviation for each subband of the plurality of subbands over a previous, the current, and a future time frame and is configured for reducing rapid changes of the deviation within a subband.

6. The audio processor according to claim 5, wherein the smoothing is a weighted mean;

wherein the phase corrector is configured for calculating the weighted mean over the previous, the current and the future time frame, weighted by a magnitude of the audio signal in the previous, the current and the future time frame.

7. The audio processor according to claim 1, wherein the target phase measure determiner is configured for achieving a fundamental frequency estimate for a time frame;

wherein the target phase measure determiner is configured for calculating a frequency estimate for each subband of the plurality of subbands of the time frame using the fundamental frequency for the time frame.

8. The audio processor according to claim 7, wherein the target phase measure determiner is configured for converting the frequency estimates for each subband of the plurality of subbands into a phase derivative over time using a total number of subbands and a sampling frequency of the audio signal.

9. A method for processing an audio signal, the method comprising:

calculating a phase measure of an audio signal for a time frame;

determining a target phase measure for said time frame; and correcting phases of the audio signal for the time frame using the calculated phase measure and the target phase measure to achieve a processed audio signal.

10. A non-transitory digital storage medium having a computer program stored thereon to perform, when said computer program is run by a computer, the method for processing an audio signal, the method comprising:

calculating a phase measure of an audio signal for a time frame;

determining a target phase measure for said time frame; and correcting phases of the audio signal for the time frame using the calculated phase measure and the target phase measure to achieve a processed audio signal.

* * * * *